United States Patent [19]

Gubelmann, deceased et al.

[11] 4,081,070

[45] Mar. 28, 1978

[54] UNDERLINING DEVICE FOR JUSTIFYING TEXT WRITING REPRODUCING MACHINE

[75] Inventors: William S. Gubelmann, deceased, late of Oyster Bay, N.Y.; by Walter S. Gubelmann, executor, Palm Beach, Fla.; William R. Grier, New Vernon, N.J.

[73] Assignee: Realty & Industrial Corporation, Morristown, N.J.

[21] Appl. No.: 641,364

[22] Filed: Dec. 16, 1975

Related U.S. Application Data

[62] Division of Ser. No. 212,895, Dec. 28, 1971, Pat. No. 3,945,480.

[51] Int. Cl.[2] ..... B41J 29/26

[52] U.S. Cl. ..... 197/113; 197/19; 197/83

[58] Field of Search ..... 197/1 R, 19, 20, 83, 197/113

[56] References Cited

U.S. PATENT DOCUMENTS

| | | | |
|---|---|---|---|
| 1,818,078 | 8/1931 | Manly | 197/113 |
| 2,093,581 | 9/1937 | Thompson | 197/20 |
| 2,700,447 | 1/1955 | Blodgett | 197/20 |
| 2,800,213 | 7/1957 | Young | 197/113 |
| 3,019,880 | 2/1962 | Baccarelli | 197/113 |
| 3,036,686 | 5/1962 | Bacher | 197/113 |
| 3,059,751 | 10/1962 | Palmer | 197/83 |
| 3,509,982 | 5/1970 | Palmer | 197/113 |

*Primary Examiner*—Ernest T. Wright, Jr.
*Attorney, Agent, or Firm*—Burgess, Ryan and Wayne

[57] ABSTRACT

A justifying text writing reproducing machine for automatic or manual typing of text includes a keyboard enabling an operator to manually type text, and reader means responsive to coded information on a coded medium for automatically typing lines of text. The machine is responsive to separate coded function information on the coded medium for conditioning the machine to perform separate functions such as justification, print or no-print, bold or regular typing, and for printing upper or lower case characters, and the machine is responsive to other separate coded information for conditioning the machine to perform combinations of such functions. The conditioning may be overridden. The carriage of the machine is stepped incrementally in order to enable display of characters with different predetermined widths. When the coded information corresponds to determined text type, such as an underline, however, the carriage is not stepped for the imprinting of such text type, although it is stepped for other text type that may accompany the underline or other determined text type. In the automatic reproduction of text, in order to allow time for completion of operating steps, the presentation of new coded information to the machine is responsive to completion of the function of the next preceding coded information.

2 Claims, 80 Drawing Figures

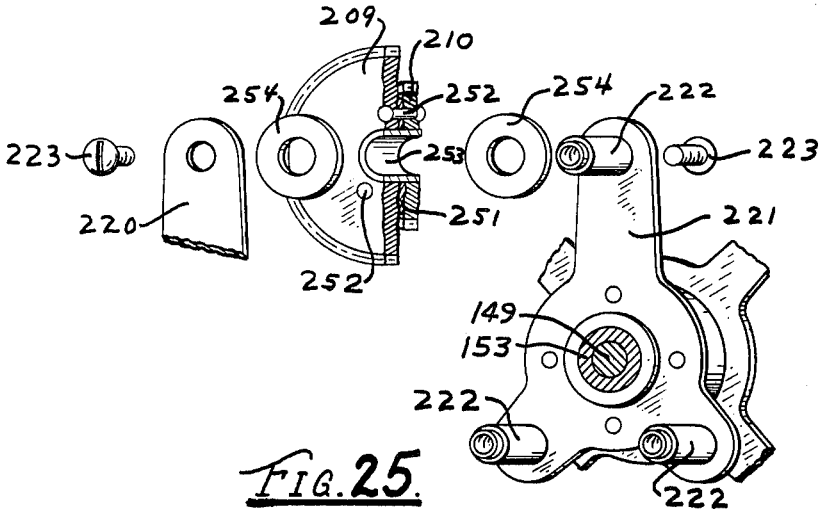
FIG. 25.
FIG. 26.
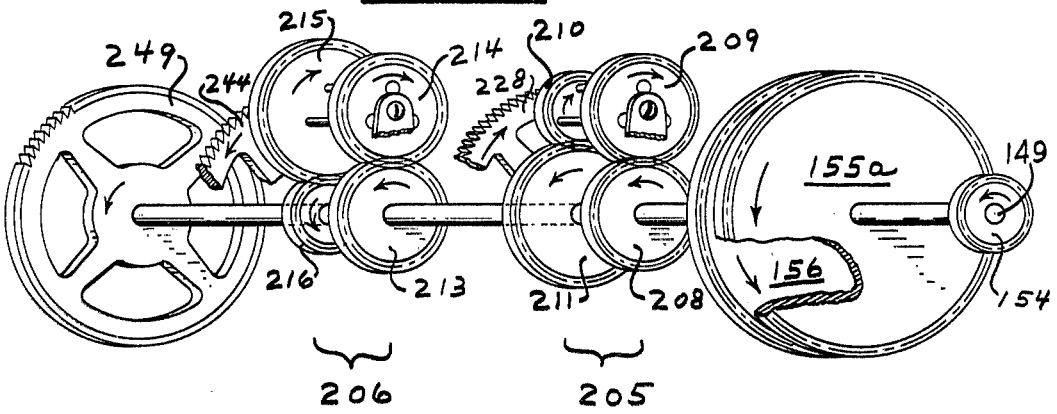

JUSTIFY
NO JUSTIFY
STOP
START
FORWARD
BACK SPACE

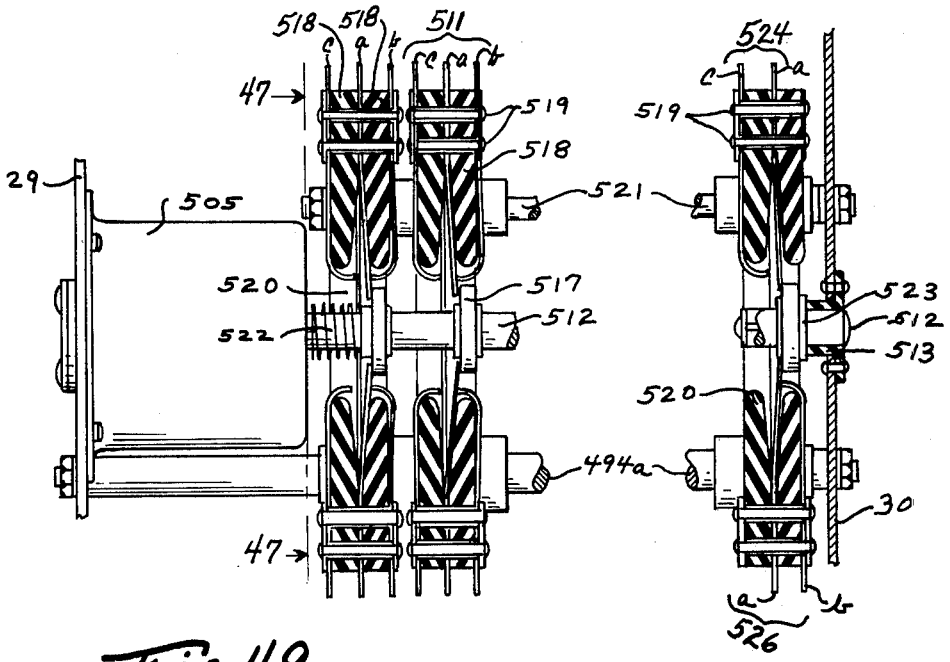
FIG. 49.
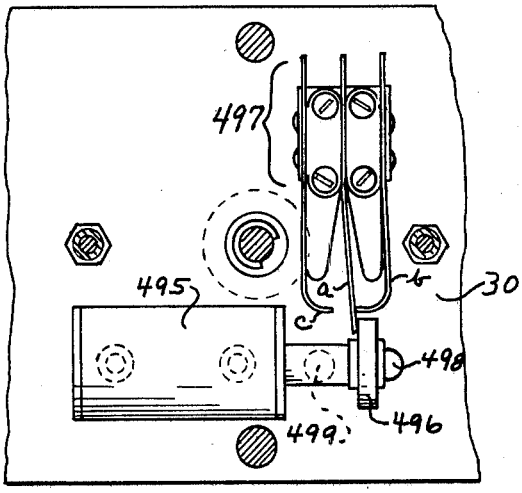
FIG. 48.
FIG. 47.
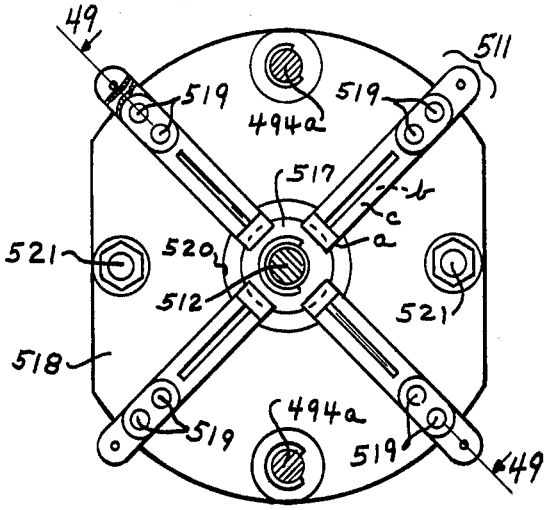

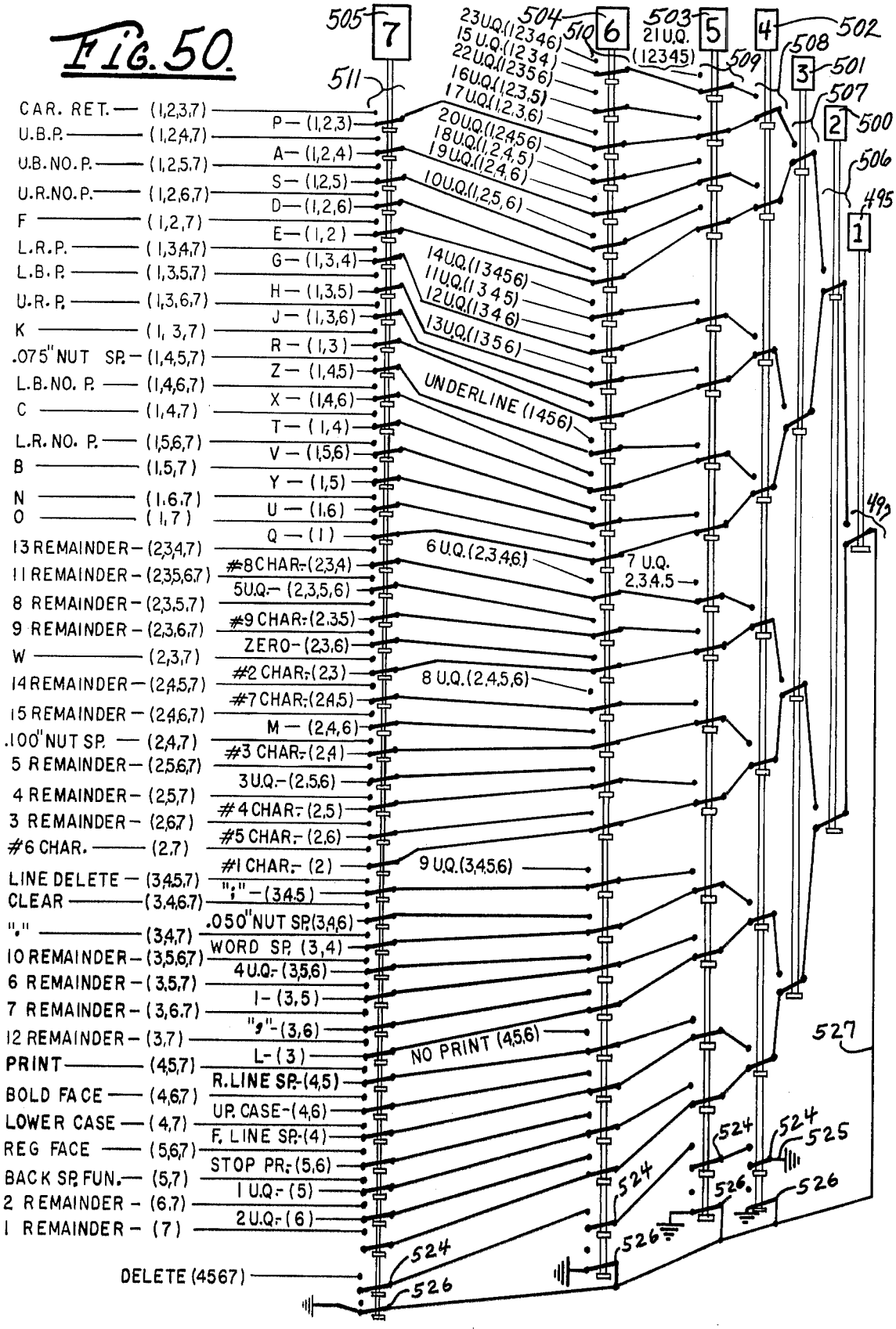
FIG. 50
CAR. RET. — (1,2,3,7)
U.B.P. — (1,2,4,7)
U.B.NO.P. — (1,2,5,7)
U.R.NO.P. — (1,2,6,7)
F — (1,2,7)
L.R.P. — (1,3,4,7)
L.B.P. — (1,3,5,7)
U.R.P. — (1,3,6,7)
K — (1,3,7)
.075" NUT SP. — (1,4,5,7)
L.B.NO.P. — (1,4,6,7)
C — (1,4,7)
L.R.NO.P. — (1,5,6,7)
B — (1,5,7)
N — (1,6,7)
O — (1,7)
13 REMAINDER — (2,3,4,7)
11 REMAINDER — (2,3,5,6,7)
8 REMAINDER — (2,3,5,7)
9 REMAINDER — (2,3,6,7)
W — (2,3,7)
14 REMAINDER — (2,4,5,7)
15 REMAINDER — (2,4,6,7)
.100" NUT SP. — (2,4,7)
5 REMAINDER — (2,5,6,7)
4 REMAINDER — (2,5,7)
3 REMAINDER — (2,6,7)
#6 CHAR. — (2,7)
LINE DELETE — (3,4,5,7)
CLEAR — (3,4,6,7)
"." — (3,4,7)
10 REMAINDER — (3,5,6,7)
6 REMAINDER — (3,5,7)
7 REMAINDER — (3,6,7)
12 REMAINDER — (3,7)
PRINT — (4,5,7)
BOLD FACE — (4,6,7)
LOWER CASE — (4,7)
REG FACE — (5,6,7)
BACK SP. FUN. — (5,7)
2 REMAINDER — (6,7)
1 REMAINDER — (7)
DELETE (4567)
P — (1,2,3)
A — (1,2,4)
S — (1,2,5)
D — (1,2,6)
E — (1,2)
G — (1,3,4)
H — (1,3,5)
J — (1,3,6)
R — (1,3)
Z — (1,4,5)
X — (1,4,6)
T — (1,4)
V — (1,5,6)
Y — (1,5)
U — (1,6)
Q — (1)
#8 CHAR. — (2,3,4)
5 U.Q. — (2,3,5,6)
#9 CHAR. — (2,3,5)
ZERO — (2,3,6)
#2 CHAR. — (2,3)
#7 CHAR. — (2,4,5)
M — (2,4,6)
#3 CHAR. — (2,4)
3 U.Q. — (2,5,6)
#4 CHAR. — (2,5)
#5 CHAR. — (2,6)
#1 CHAR. — (2)
";" — (3,4,5)
.050" NUT SP. (3,4,6)
WORD SP. (3,4)
4 U.Q. — (3,5,6)
I — (3,5)
"9" — (3,6)
L — (3)
R. LINE SP. — (4,5)
UP. CASE — (4,6)
F. LINE SP. — (4)
STOP PR. — (5,6)
1 U.Q. — (5)
2 U.Q. — (6)
23 U.Q. (12346)
15 U.Q. (1234)
22 U.Q. (12356)
16 U.Q. (12356)
17 U.Q. (1,2,3,6)
20 U.Q. (12456)
18 U.Q. (1,2,4,5)
19 U.Q. (1,2,4,6)
10 U.Q. (1,2,5,6)
14 U.Q. (13456)
11 U.Q. (1345)
12 U.Q. (1346)
13 U.Q. (1356)
UNDERLINE (1456)
6 U.Q. (2,3,4,6)
7 U.Q. 2,3,4,5
8 U.Q. (2,4,5,6)
9 U.Q. (3,4,5,6)
NO PRINT (4,5,6)
21 U.Q. (12345)
505
504
503
502
501
500
495
497
506
507
508
509
510
511
527
524
525
526

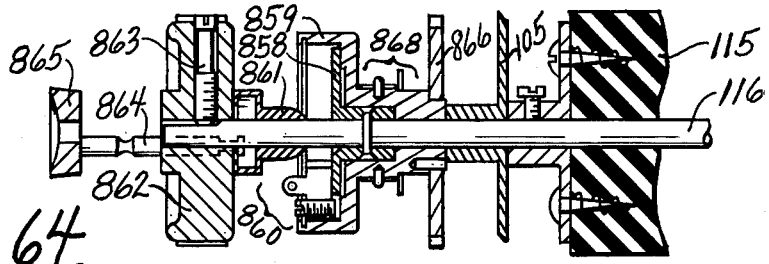
FIG. 64.
FIG. 65.
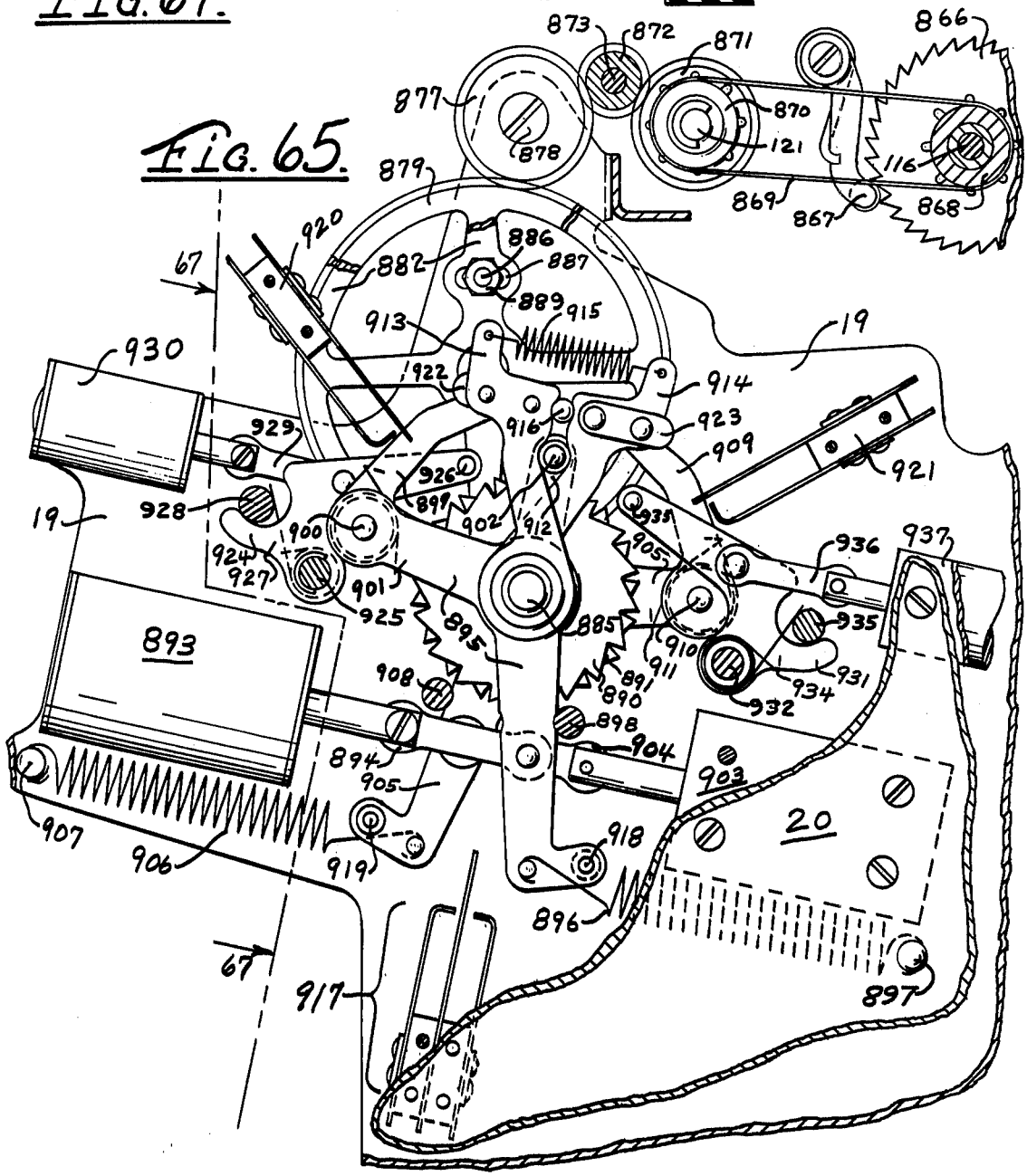

REG.
BOLD
LOCK
R
B
545
553

UNDERLINING DEVICE FOR JUSTIFYING TEXT WRITING REPRODUCING MACHINE

This application is a division of application Ser. No. 212,895, filed Dec. 28, 1971 now U.S. Pat. No. 3,945,480 issued Mar. 23, 1976.

GENERAL DESCRIPTION

Our justifying text writing system involves two illustratively interconnected machines, a justification computing and encoding composing machine that forms the greater part of our copending application for "Justifying, Text Writing Composing Machine", Ser. No. 213,045, filed Dec. 28, 1971, now U.S. Pat. No. 3,993,179, issued Nov. 23, 1976 and a justified copy reproducer that is particularly set forth in this application.

As described in our copending application, Ser. No. 213,045, filed Dec. 28, 1971, operation of the composing machine normally results in the encoding of a justifying quotient code, a justifying remainder code, then selectively a conditioning or a clearing code, the codes for the text of a line (characters, spaces and functions) and a carriage return code, in that order of space and flow on the code medium, for successive lines of written material. The carriage return code is encoded at the end of a line of the text codes, and, even though the justifying information is encoded at substantially the same time, the justifying information is encoded ahead of the text codes on the code medium. As soon as a complete line is encoded on the code medium, that part of the code medium is automatically fed into a main reading device serving area. When this occurs and when the reproducer is conditioned for automatic code controlled operations, as will be described in detail hereinafter the main reader successively reads the codes for the line.

As disclosed above, this justifying text writing reproducing machine forms a portion of a text writing machine, which includes the justifying, text writing composing machine disclosed in our copending application, Ser. No. 213,045. This reproducing machine is intended to be supplied with justifying codes from said composing machine and, in fact, is directly coupled thereto to receive the justifying codes on a tape medium. The justification codes supplied by the composing machine, generally comprise a quotient code and a remainder code that is determined by division of the number of word spaces in a line into the amount left in a fixed length justifying area, that precedes the right margin control in the composing machine. The fixed length justification area in the composing machine is limited to be no more than 23 units in length and, therfore, no more than 23 units can be added to justify any line in this reproducer.

Accordingly, the maximum that may be added to the word space in a line with only one word space is a quotient amount of 23 units, the maximum to be added to each word space in a line with two word spaces is a quotient amount of 11 units, with 1 additional remainder unit being added to the first word space, the maximum to be added in a line with three word spaces is a quotient amount of 7 units with 1 unit of the remainder being added to the first two word spaces, etc. Following this system, the quotient amount is added to each word space in that line (up to 16 word spaces) and one unit of the remainder is added to each of as many word spaces that equals the value of the remainder.

The justifying quotient code, that resulted from division of the amount left in the line by the number of word spaces in the composing machine, sets a mechanism or means in the reproducer for automatically adding the quotient number of units to each of the first sixteen word spaces (or less, depending on the number of word spaces in the line). The remainder code, that may result from the division operation in the composer, sets another means, such as a counter, for controlling the reproducer to automatically add one unit to each of the first few word spaces that correspond in number to the value of the remainder. Thus, the spacing of the reproduced words in each line is adjusted so that the last character is located precisely at the right hand margin.

The conditioning code or the clearing code places the reproducer in a particular set of operating conditions or modes (upper or lower case, bold or regular face, and print or no print conditions) that corresponds to that of the composer. A conditioning code puts the reproducer in the same condition the composer was in at the time that code was encoded. In the composer, a clearing operation places the composer in normal or cleared conditions (lower case, regular face and printing condition) and it encodes the clear code, and the clear code puts the reproducer in the same corresponding conditions. Thus, the reproducer is always conditioned appropriately before the text imprinting operations for a line are begun, and any appropriate portion of the control medium can be stored away and reused without operator concern or without any need for special manual operations to properly condition the reproducer for the ensuing text. It is also unnecessary to make condition set-up notations on any code media that may be separated from preceding code media and stored away for future reuse, since a clear code or a condition code will precede the text codes for each line and the machine will automatically be appropriately conditioned before imprinting occurs.

Of course, the text codes control the reproducer to print the line and normally to adjust the word spaces as they occur, and the carriage return code returns the carriage. While the text for a line is being automatically reproduced, a succeeding line may be encoded by the composing machine. Thus, by manual or automatic operation of the composing machine, the reproducer is code controlled to automatically produce a justified copy without an operator's attention, and the justified copy is completely normally one line behind the unjustified copy.

In the usual installation, as described in our aforesaid copending application, the composing machine with the encoding and code reading assembly, and the reproducing machine are situated near an operator's chair, where one person may conveniently insert paper into both machines and otherwise tend both machines. However, in respect to the reproducer, the operator normally only need put paper in the machine, adjust or check a normal line space button, set or check a left hand margin control and shift a reader control key to "start" position. Thereafter, the reproducer is automatically operated as explained above, and the operator does not even handle the control media.

To satisfy unusual copy requirements, certain manipulative function control keys and related mechanisms are provided in the reproducer for changing the normal character of the automatically reproduced copy. Such keys include a justifying control key, a bold-regular key and a related manipulative lock, and a print-no print key and related lock.

The justifying control key is presettable for controlling the reproducer to produce justified copy lines as explained, or to produce unjustified copy lines as explained, or to produce unjustified copies even through the control tape that is being used contains the justification codes. Thus, at any one time, the reproducer can be set to reproduce either justified or unjustified copies from any encoded media that contains the justifying information, and, by reuse of the media, both kinds of copies may be made.

A bold and regular control is provided in the reproducer, and this control is normally shiftable according to corresponding codes on the code medium for controlling the reproducer to imprint in a "bold" manner or to print in a lighter "regular" manner, respectively. A manipulative bold-regular key is also provided for shifting this control to either condition, for changing the imprinting force. A manipulative lock is provided for locking the key and therefore the control in either present condition, and, when the lock is in effective position, the control will not be changed by any bold or regular code that may occur in the text, nor will conditioning or clear codes change the control. Thus, the bold and regular key and related lock may be used as a manual override.

Print and no print control and related keys are also provided in the reproducer. This arrangement is similar to the bold and regular control that was just discussed. Accordingly, the print and no print control is normally shiftable according to corresponding codes on the code medium and it is also shiftable by a related manipulative key. This control may also be locked by a lock for overriding the print, no print, conditioning and clear codes. Normally, this control is in "print" condition and the reproducer will print all characters that appear in the text and the paper carriage will be moved appropriately for each character and space in a normal manner. However, when the control is shifted to "no-print" condition, the encoded characters will not be printed, but the carriage will be shifted for each character and space. Thus, normally the characters that are encoded between a "no-print" code and the next "print" code will not be printed and instead blank space will be left, for variables for example. However, if the related lock is rendered effective before the "no-print" code is sensed, all of the encoded text will be printed. Thus, the copy may be reproduced in either form, or in both forms if the control medium is reused at least once. When the lock is ineffective, the control may be shifted manually by use of the key to "no-print" condition appropriately to bypass any portion of the encoded text, to bypass a word, line or paragraph for examples.

The reader control key is shiftable from a normal "start" position to a "stop" position for manually terminating the code reading processes, and thereby terminating the automatic operations of the reproducer. This key is also automatically shifted to "stop" position in response to a stop-printer code. When this key is in "stop" position, the reproducer may be operated manually, for adding variables in any otherwise code controlled copy or for producing individual unjustified copies which are similar to those from an ordinary typewriter. When the machine is readied for further code controlled operations (for example, variables have been added and the carriage is back spaced to the position it was in before the variables were added, or new paper is inserted in the carriage, the normal line space button set and the left margin conrol adjusted for new copy), the operator may return the reader control key to "start" position for initiating automatic operation of the reproducer.

When the reader control key is in "stop" position and the reproducer is being operated manually, the carriage may be returned by depressing a carriage return key, and back spacing may be accomplished by shifting a back space key to "back space" position and then manipulating the character and space keys that were used in the forward operations. In this manner, the carriage is back spaced the same number of units as it was shifted forward for any given number of characters and spaces. Also, when the machine is conditioned for back spacing, a means is rendered effective for preventing the imprinting of the operated characters. When the back space key is returned to its normal position, the reproducer is conditioned for forward imprinting operations.

An interlock is provided for preventing operation of the manual carriage return key and for preventing the shift of the back space key to back space position, when the reader control key is in "start" position. This lock also prevents the reader control key from being shifted to "start" position, when manual carriage return and/or manual back spacing operations are in progress.

An object of this invention is to provide an improved justifying text writing reproducing machine requiring only a nominal amount of simple manual setup operations to prepare the machine for automatic operation.

Another object of this invention is to provide an improved justifying text writing reproducing machine that is fully automatic and normally requires no operator attention during the reproducing operations.

Yet another object of this invention is to provide an improved justifying text writing reproducing machine, controllable by a code reading means and an encoding text writing composing machine, for automatically producing justified copy lines.

Another object of this invention is to provide an improved reproducing machine, as set forth in the preceding object, wherein the justified copy is produced line-by-line, generally one line behind the line being encoded by the composing machine.

Another object of this invention is to provide an improved text writing reproducing machine, controllable by a code reading means and an encoded medium containing a conditioning code that is appropriate for successive text codes that follow in respect to the flow of the medium through the reading means, the reproducing machine including control mechanism responsive to the conditioning code for conditioning the machine appropriately for the reproduction of the text.

An object of this invention is to provide an improved justifying text writing reproducing machine, controllable by a code reading means and an encoded medium containing line justifying information and text information for each line arranged in that order in respect to a single directional flow of the medium, whereby the reproducing machine is conditioned for justifying each line before it reproduces the line according to the justifying information and the related text information.

Other objects, advantages and features will become more apparent hereinafter.

Throughout the specification and claims reference is made to "printing", "printed lines" and "imprinting" of characters. It is to be understood that such terminology is conveniently employed with the illustrated embodiment of this invention. Of course, any other conventional text reproducing processes can advantageously employ the principles of this invention, such as photoprinting, stylused writing, or any other mode of literal transcription. Therefore when considering such terms as "printing", it is to be understood that such term is merely illustrative of the principles of out invention.

FIGURE DESCRIPTIONS

FIG. 25 is an exploded fragmentary perspective view, showing primarily one of the carriage moving mechanism gear carriers and a planet gear.

FIG. 26 is a diagrammatic view of the carriage moving mechanism gear train, showing the directions of rotation of the parts.

FIG. 47 is a view of a main decoder switch block as viewed from line 47—47 (FIG. 49).

FIG. 48 is a view taken on line 48—48 (FIG. 10), showing a portion of the main decoder.

FIG. 49 is a view of a main decoder portion which typifies various sections of the decoder shown in FIG. 10, and it sectionally illustrates the switch blocks as viewed from line 49—49 (FIG. 47).

FIG. 50 is a schematic wiring diagram of the decoder shown in FIG. 10.

FIG. 64 is a fragmented sectioned view of the platen taken on its transverse centerline, and showing primarily the line space adjusting clutch.

FIG. 65 is a fragmented left side view of an extra line spacing mechanism, and showing its connection with the platen.

Figure 1:
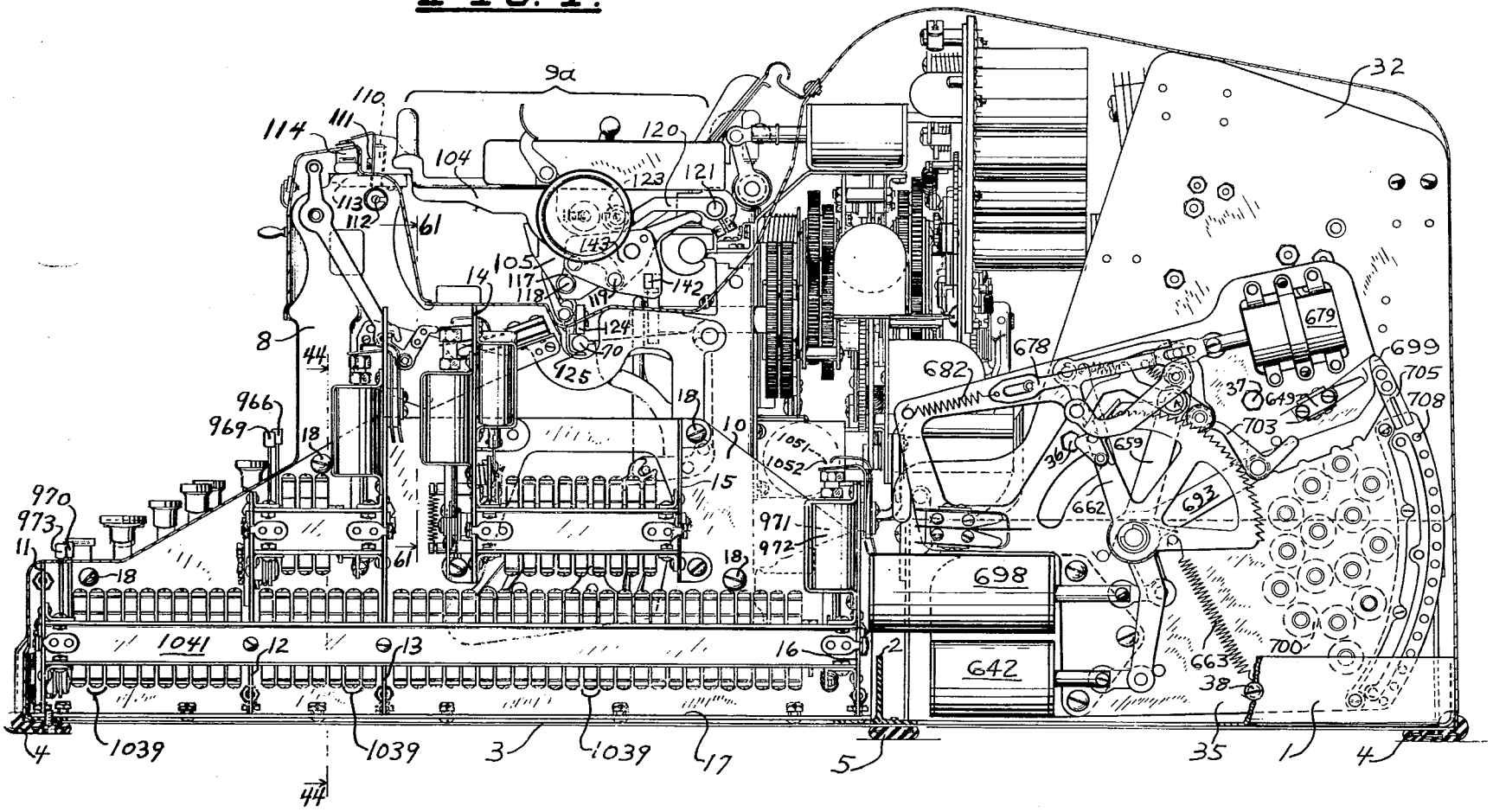
FIG. 1 is a reduced scale right side elevation of the reproducer with the cover and a portion of the base frame cut away for clarity.

The following Charts "A" - "E" are referred to occasionally in the detailed description, and they are listed here so they may be readily found.

CHART A

DIFFERENTIAL CHARACTER AND WORD SPACING

| Groups | Carriage Movement | | Different sized characters combined on related keys, and Spaces unaffected by case shift. |
|---|---|---|---|
| A. | Upper Case | .100" | " # $ % ? & (Δ) * W M and .100" nut space |
| | Lower Case | .100" | 1 2 3 4 5 6 8 9 0 w m |
| B. | UC | .050" | ' |
| | LC | .100" | 7 |
| C. | UC | .100" | Q E R T Y U O P A S D F G H J K Z X C V B N |
| | LC | .075" | q e r t y u o p a s d f g h j k z x c v b n |

CHART A-continued

| DIFFERENTIAL CHARACTER AND WORD SPACING | | | |
|---|---|---|---|
| Groups | | Carriage Movement | Different sized characters combined on related keys, and Spaces unaffected by case shift. |
| D. | UC | .075" | I |
| | LC | .050" | i |
| E. | UC | .100" | L |
| | LC | .050" | l |
| F. | UC | .050" | : - / and .050" Nut space, and Space Bar. |
| | LC | .050" | : , . |
| G. | UC | .075" | .075" nut space. |
| | LC | .075" | |

NOTE: The above includes all of the character keys, except the underline key which does not cause carriage movement.

CHART B

| CHARACTER AND SPACE KEY CODES | | | |
|---|---|---|---|
| Alphabet | Code | Numerals | Code |
| A | 124 | 1 | 2 |
| B | 157 | 2 | 23 |
| C | 147 | 3 | 24 |
| D | 126 | 4 | 25 |
| E | 12 | 5 | 26 |
| F | 127 | 6 | 27 |
| G | 134 | 7 | 245 |
| H | 135 | 8 | 234 |
| I | 35 | 9 | 235 |
| J | 136 | 0 | 236 |
| K | 137 | | |
| L | 3 | | |
| M | 246 | Punctuation | |
| N | 167 | ( , ) | 36 |
| O | 17 | ( ; ) | 345 |
| P | 123 | ( . ) | 347 |
| Q | 1 | Spaces | |
| R | 13 | .050" Nut Space, | 346 |
| S | 125 | .075" Nut Space, | 1457 |
| T | 14 | .100" Nut Space, | 247 |
| U | 16 | Word Space (Space Bar) | 34 |
| V | 156 | | |
| W | 237 | | |
| X | 146 | | |
| Y | 15 | | |
| Z | 145 | | |
| Underline | 1456 | | |

CHART C

JUSTIFICATION CODES:

| QUOTIENT | CODE THEREFOR | REMAINDER | CODE THEREFOR |
|---|---|---|---|
| 1 | 5 | 1 | 7 |
| 2 | 6 | 2 | 67 |
| 3 | 256 | 3 | 267 |
| 4 | 356 | 4 | 257 |
| 5 | 2356 | 5 | 2567 |
| 6 | 2346 | 6 | 357 |
| 7 | 2345 | 7 | 367 |
| 8 | 2456 | 8 | 2357 |
| 9 | 3456 | 9 | 2367 |
| 10 | 1256 | 10 | 3567 |
| 11 | 1345 | 11 | 23567 |
| 12 | 1346 | 12 | 37 |
| 13 | 1356 | 13 | 2347 |
| 14 | 13456 | 14 | 2457 |
| 15 | 1234 | 15 | 2467 |
| 16 | 1235 | | |
| 17 | 1236 | | |
| 18 | 1245 | | |
| 19 | 1246 | | |
| 20 | 12456 | | |
| 21 | 12345 | | |
| 22 | 12356 | | |
| 23 | 12346 | | |

CHART D

| FUNCTION CODES | |
|---|---|
| FUNCTION | CODE |
| Carriage return | 1237 |
| Line Delete | 3457 |
| Clear (Normal) | 3467 |
| Line space | 4 |
| Rev. Line space | 45 |

CHART D-continued

| FUNCTION CODES | |
|---|---|
| FUNCTION | CODE |
| Upper case | 46 |
| Lower Case | 47 |
| No Print | 456 |
| Print | 457 |
| Bold face | 467 |
| Delete, any code &, | 4567 |
| Stop printer | 56 |
| Back space func | 57 |
| Regular face | 567 |

CHART E

| CONDITION CODES | |
|---|---|
| (1) Lower case, Regular face and Print, | 1,3,4,7 |
| (2) Upper case, Regular face and Print, | 1,3,6,7 |
| (3) Lower case, Bold face and Print, | 1,3,5,7 |
| (4) Upper case, Bold face and Print, | 1,2,4,7 |
| (5) Lower case, Regular face and No-Print, | 1,5,6,7 |
| (6) Upper case, Regular face, and No-Print, | 1,2,6,7 |
| (7) Lower case, Bold Face and No-print, | 1,4,6,7 |
| (8) Upper case, Bold Face and No-Print, | 1,2,5,7 |

TOPICAL INDEX

ABSTRACT OF THE DISCLOSURE

GENERAL DESCRIPTION

Objects

FIGURE DESCRIPTIONS

Charts

TOPICAL INDEX

DETAILED DESCRIPTION

1. GENERAL FRAME MEMBERS
2. TYPEWRITER IN GENERAL
3. CARRIAGE MOVING MECHANISM
4. STRUCTURE IN THE MAIN READER CIRCUIT
   a. Main Reader
   b. Slack Tape Sensing Means
   c. Main Reader Tape Feed Mechanism
   d. Automatic Feed-Read Switch Means
   e. Main Reader Control Key
   f. Cycling Control Mechanisms
   g. Cycling Control Switches That Are Part Of Other Major Components
   h. Main Decoder
5. MAIN READER CIRCUIT
6. MAIN DECODER, CHARACTER CIRCUITS
7. CYCLING CONTROL FOR CHARACTERS
8. SPACES CONTROLLED BY CODE
9. DUPLEX COUNTER STRUCTURE
10. JUSTIFICATION CODES
   a. Justify-No Justify Key 11. CASE SHIFT, BY CODE
12. DELETE AND BACK SPACE FUNCTION CODES
13. UNDERLINE BY CODE
14. EXTRA LINE SPACING, BY CODES
15. BOLD FACE AND REGULAR, AND PRINT AND NO PRINT CONTROLS
16. CARRIAGE RETURN
17. NORMAL LINE SPACING MECHANISM
18. LINE DELETE
19. STOP PRINTER CODE
20. AUTOMATIC CONDITIONING
21. AUTOMATIC CLEARING
22. MANUAL OPERATION OF THE REPRODUCER
    a. Manipulative Carriage Return Key
    b. Back Space Key

DETAILED DESCRIPTION

1. GENERAL FRAME MEMBERS

The machine is assembled about a sturdy four-sided base 1 (FIGS. 1, 2 and 3), which is preferably made of angle stock formed of one or more pieces. A centrally located transverse T-shaped member 2, in an inverted attitude, is fitted between and it is secured at its ends to the side rails of the base 1. A solid sheet 3, fitting the dimensions of the base 1, is secured in any convenient manner to the under side of the base 1 for protecting the machine from dust or any other foreign matter upon which it may be set. Suitable resilient material 4 (FIGS. 1 and 2) is secured to the underside of the sheet 3 and the base 1 for insulating sound and vibration that originates in the machine from the table, desk or other work surface on which the machine may be placed. This material 4 is continuous and forms a barrier for preventing things such as pencils from being accidentally moved under the machine. A piece of resilient material 5 may be placed under sheet 3 and secured therethrough to the member 2 for providing more solid central machine support. Two channel members 6 and 7 (FIG. 3), in spaced positions parallel to the sides of the base 1, are secured at their forward ends to the front rail of the base 1 and at their rearward ends to the transverse member 2. A standard typewriter frame 8 is assembled on the channel members 6 and 7 and secured thereto in any well known manner. An auxiliary frame 9 (FIGS. 3, 4, 5 and 6), which supports mechanism for moving the typewriter carriage 9*a* , is mounted on and secured to the typewriter frame 8 (FIG. 3).

An assembly containing several manual and automatic circuit changing mechanisms is located to the right of the standard typewriter frame 8. The frame for this assembly consists of vertical plates 10, 11, 12, 13, 14, 15 and 16, and horizontal base plate 17 (FIGS. 1 and 3). These plates 10–17 are secured together to form a removable unit which rests on the horizontal flanges of the base 1 and is secured to the typewriter frame 8 as by screws 18.

Figure 2:
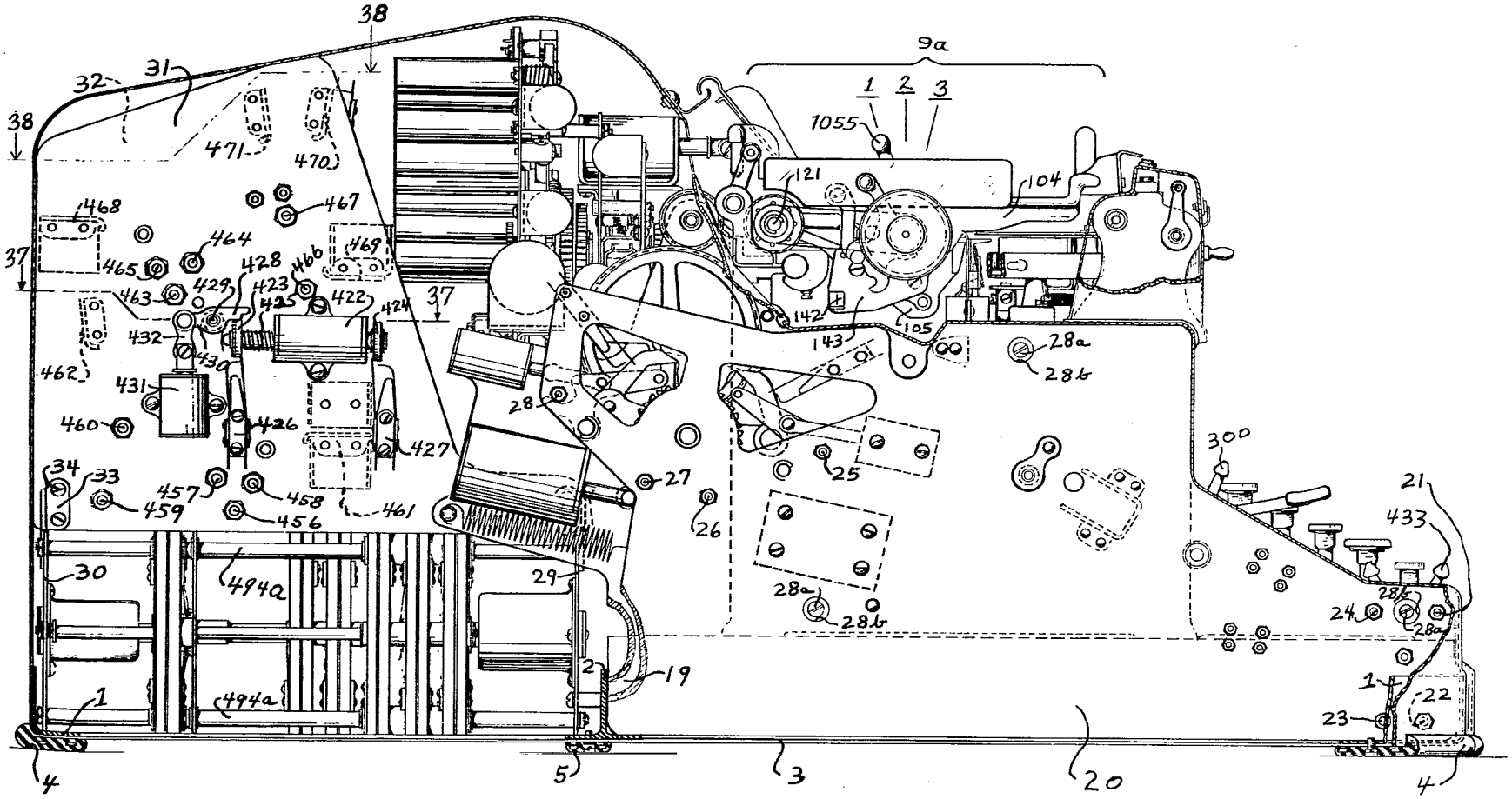
FIG. 2 is a reduced scale left side elevation of the reproducer with the cover and portions of its frame cut away.
Figure 3:
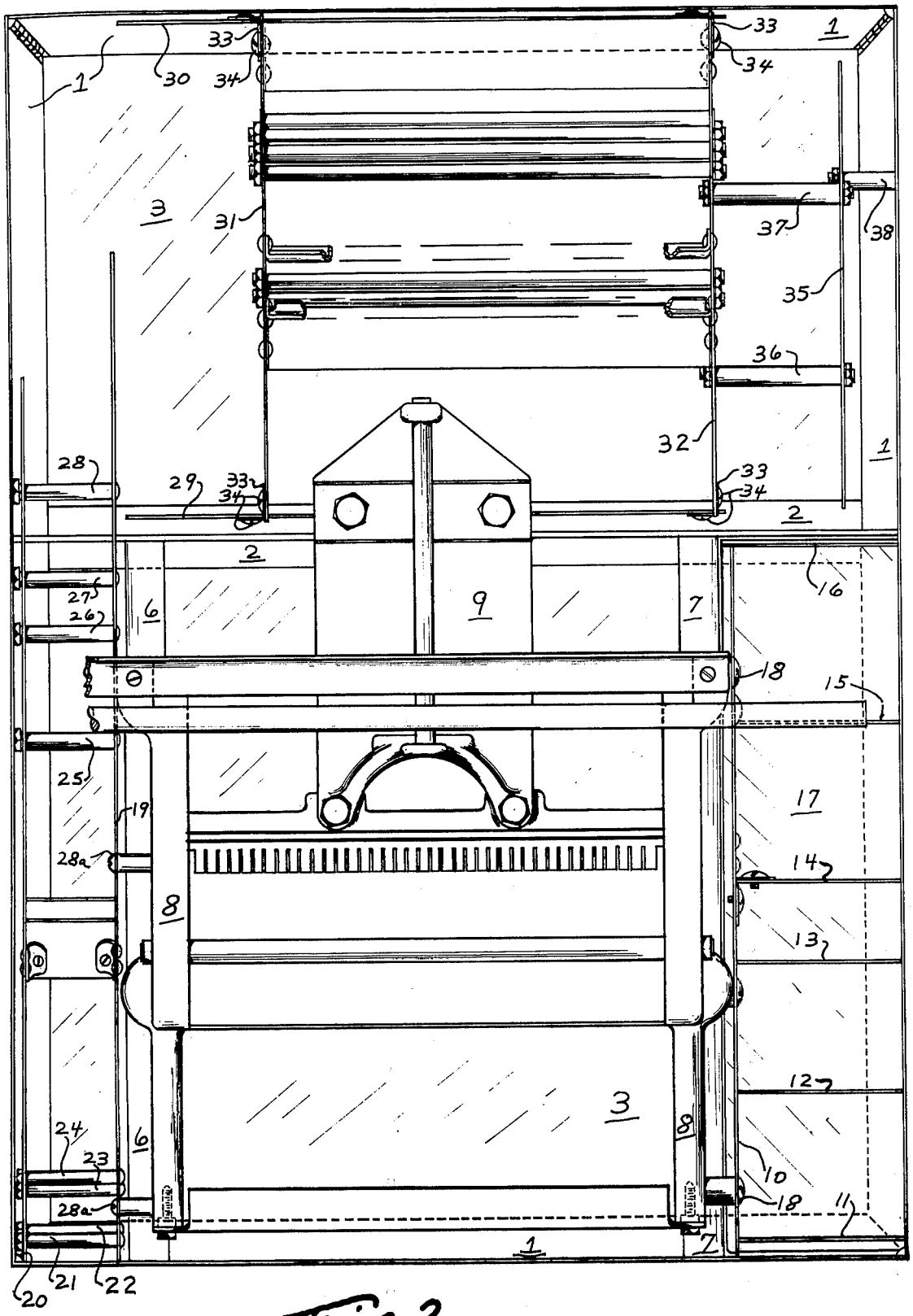
FIG. 3 is a fragmented reduced scale top plan view of the machine's frame members.
Figure 9:
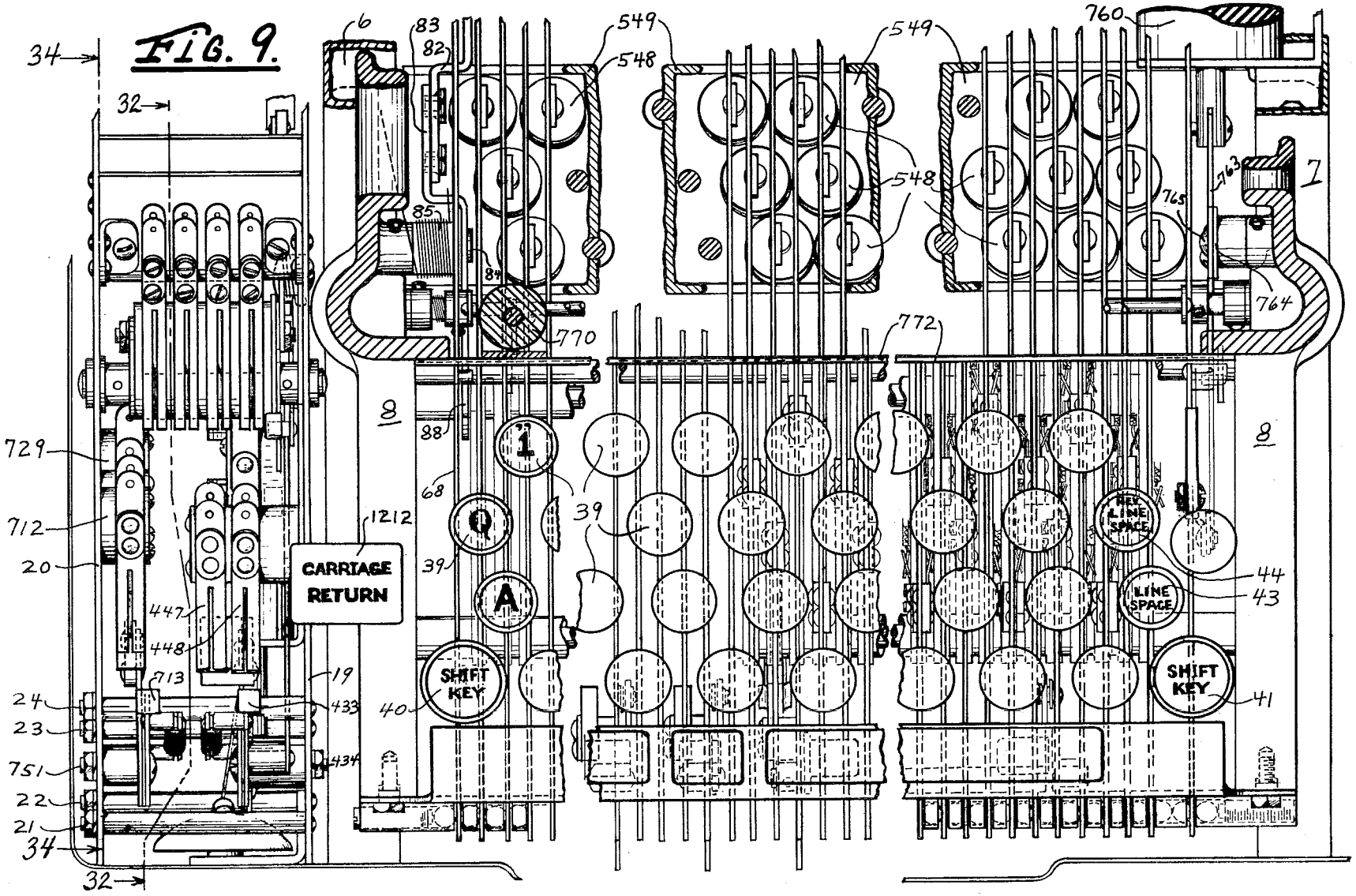
FIG. 9 is a fragmentary top view of the keyboard and mechanisn under the cover and under the paper carriage.

An assembly containing an automatic line spacing control mechanism and several manually operable controls including the carriage return key mechanism is located to the left of the standard typewriter frame 8 (FIGS. 9 and 3). The frame for this assembly consists of vertical right and left side plates 19 and 20, respectively, which are parallel and securely tied together by transverse rods 21, 22, 23, 24, 25, 26, 27 and 28, (FIGS. 2 and 3). This frame may be supported and secured to the left side of the typewriter frame 8 as by screws 28a assembled through plate 19 and secured into the frame 8. The screws 28a are accessible from the left through holes 28*b* in plate 20.

Figure 10:
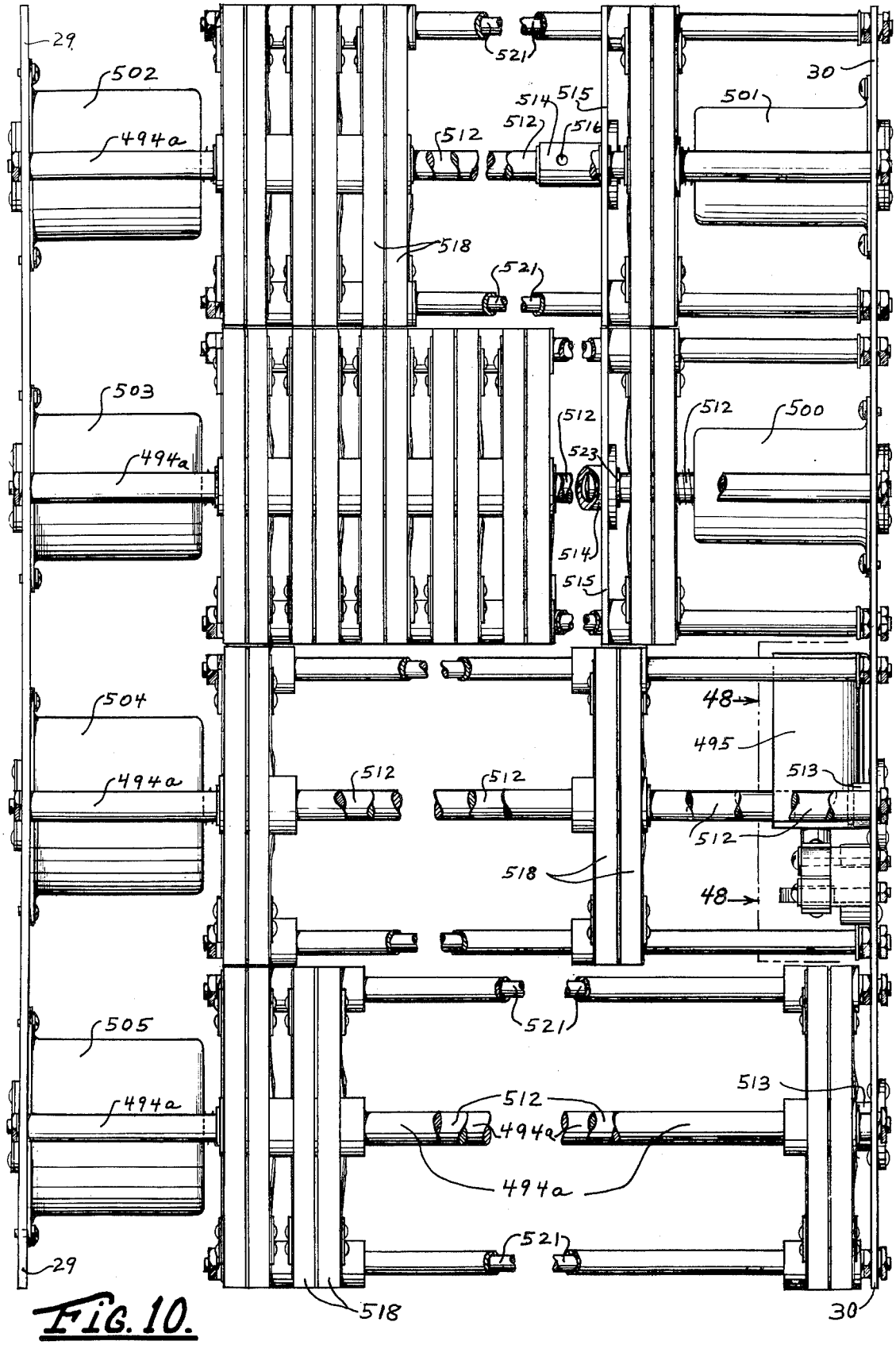
FIG. 10 is a condensed fragmentary top view of the decoder assembly.

The main decoder assembly, a top view of which is shown in FIG. 10, is located to the rear of transverse member 2, FIG. 2, and rests in the horizontal position on the rearwardly extending flange of the member 2 and on the horizontal flange of the rearmost part of the base 1. The decoder assembly's frame consists of a forward plate 29 and a rearward plate 30, and several rods 494a which solidly connect the two plates 29 and 30. The detailed construction of the decoder will be explained hereinafter.

A number of cycling control mechanisms are assembled between a leftside plate 31 and an identical rightside plate 32 (FIGS. 2 and 3). The plates 31 and 32 of this assembly rest on the top of and perpendicular to the plates 29 and 30 of the main decoder assembly (just mentioned) and they are secured thereto by four angle plates 33 and screws 34 therefor. Further structural detail is given hereinafter in the section devoted to the cycling control mechanisms.

An automatic counting mechanism which is instrumental in justification of the reproduced lines is mounted on vertical plate 35 (FIGS. 1 and 3) located at the right rear of the machine. The plate 35 is suspended on spacing studs 36, 37 and 38, which are secured on the plate 35 at one end. The other ends of studs 36 snd 37 are secured in the plate 32 of the cycling control assembly. The other end of stud 38 is secured to the frame base 1.

Further incidental frame members will be introduced herein as their significance becomes important.

2. TYPEWRITER IN GENERAL

A standard office typewriter (Underwood No. 5) is selected to illustratively indicate that any commercially developed typewriter may be adapted for use as a component in the combinations disclosed herein. Reasonably, therefore, the well known parts of the selected typewriter are explained briefly and all modifications thereof and additions thereto are described in detail.

Other commercially developed typewriters can be employed in place of the selected strictly mechanical Underwood No. 5. Motor driven typewriters having latch-control, spinning power roll and cam drive arrangements and other self powered types can be employed for performing the operations herein performed by manual or electromechanical drive means without departing from the spirit of the invention.

The keyboard (FIG. 8) in the illustrated embodiment is comprised of a nearly standard arrangement of keys. The modifications and additional control keys will be described hereinafter under appropriate headings.

Normal character keys 39 are adapted to be actuated for accordingly imprinting the appropriate character and causing the paper carriage 9*a* to be moved the appropriate letter space amount, which movement being differentially variable and corresponding to the particular character and the upper or lower case condition of the machine.

The shift keys 40 and 41 are arranged and actuatable in the well known manner for case shifting.

The underline key 42 is actuated for imprinting an underline mark, but does not cause carriage movement as do the other character keys 39. A word in a line being typed can be underlined by the alternate use of the underline key 42 and the other character keys 39 for printing the word and for accordingly moving the carriage 9a without backspacing the carriage 9a for underlining the word.

The line space key 43 in the tape controlled typewriter does not cause printing or longitudinal carriage movement but is actuated manually for causing a single step forward line space rotation of the platen 115. The reverse line space key 44 is actuated manually for causing a single step reverse line space rotation of the platen 115.

The shift lock key 45, as is customary, is actuated for holding the machine in upper-case condition until a shift key 40 is actuated for releasing the shift lock key 45.

The character keys 39 and the underline key 42 are carried by key levers 46 (FIG. 11) which, when actuated, operate bell-cranks 47 and type arms 48 through a well known type-actuating arrangement.

The rearward ends of the key levers 46 are fulcrumed on a transverse rod 49 which is rigidly held by a frame 50. The frame 50 consists of two transverse portions 51 and 52, and left and right ends which are secured to the inner sides of the typewriter frame 8. The rear transverse portion 51 carries upwardly extending comb-like furcations 53 which are drilled to receive the transverse rod 49.

The key levers 46 are assembled between furcations 53 which maintain the rearward ends of the levers 46 in their proper spaced relation. Adjusting screws 54 are threaded in portion 51. Springs 55 between each lever 46 and its adjusting screw 54 provide the desired tension for returning the keys 39, 42, etc. and the type actuating arrangements.

A headed stud 56 is fixed to the side of each of the key levers 46. The forward extensions of the bell-cranks 47 are bifurcated to receive the studs 56 of their related key lever 46 and the heads of the studs 56 guide the bell-cranks 47 in juxtaposed relationship with their respective key levers 46.

The forward transverse portion 52 of frame 50 has forwardly extending comb-like furcations 57, which maintain the bell-cranks 47 in their proper spaced relation and support a rod 58 on which the bell-cranks 47 are pivotally mounted.

The upwardly extending arms of the bell-cranks 47 support headed studs 59. The studs 59 are received by slots 60 in the type arms 48 and the heads of the studs 59 guide the upwardly extending arms of the bell-cranks 47 in proper juxtaposed relationship with their respective type arms 48.

The type arms 48 are arranged in a well known semi-circular fashion, being hung on a semi-circular bent fulcrum wire 61, and they are assembled in slots 62 (FIG. 12) formed in a type arm segment frame 63 which supports the rod 61. The frame 63 (FIG. 11) is secured to transverse support member 64, which in turn is secured to the inner left and right sides of the typewriter frame 8.

Whenever a character key 39 or the underline key 42 is depressed, its key lever 46 pivots downwardly about the rod 49, the lever 46 compresses its spring 55 slightly, and the stud 56 is swung downward. The downward movement of stud 56, acting on the bifurcation in the forward extension of the bell-crank 47, causes the bell-crank 47 to pivot counterclockwise about the rod 58. Counterclockwise movement of bell-crank 47 causes its stud 59 to move foward, and acting on the forward side of slot 60, moves the type arm 48 clockwise to perform the usual printing procedure of striking the ink ribbon and the paper against the platen 115. When the depressed key 39 is allowed to return, the reverse directions for returning the printing mechanism are assured by the spring 55 assisted by the effect of gravity on the type arm 48 and the leverages developed by the type arm 48 and bellcrank 47.

The forward line space key 43 and the reverse line space key 44 are each carried by a key lever 65 which is fulcrumed on the rod 49 and the key lever 65 is urged upward to the returned position by a spring 55, the same as the key levers 46. In a preferred form of the invention, the key levers 65 do not have corresponding bell-cranks 47 or type arms 48 but they do carry electrical contacts 556 near their forward ends for causing the line space functions when the keys 43 and 44 are depressed. These contacts 556 are identical to contact 556 carried by the character key levers 46 and they will be explained at the same time hereinafter.

Figure 11:
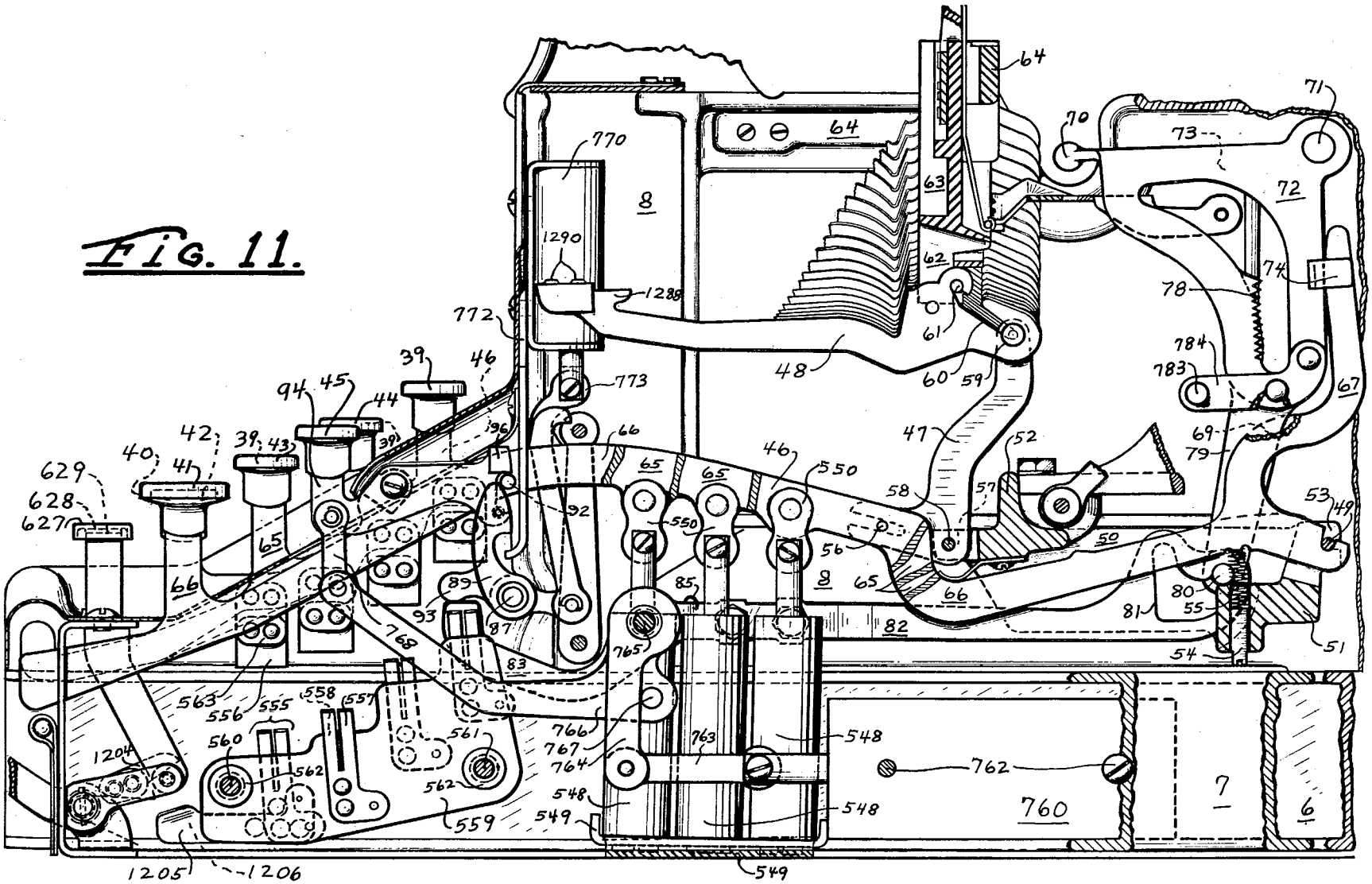
FIG. 11 is a fragmentary right side view of the basic typewriter, with the carriage cut away, and showing principally the keys, their electrical contacts, type arms and a means for automatic operation of the keys and type arms.
Figures 14, 15:
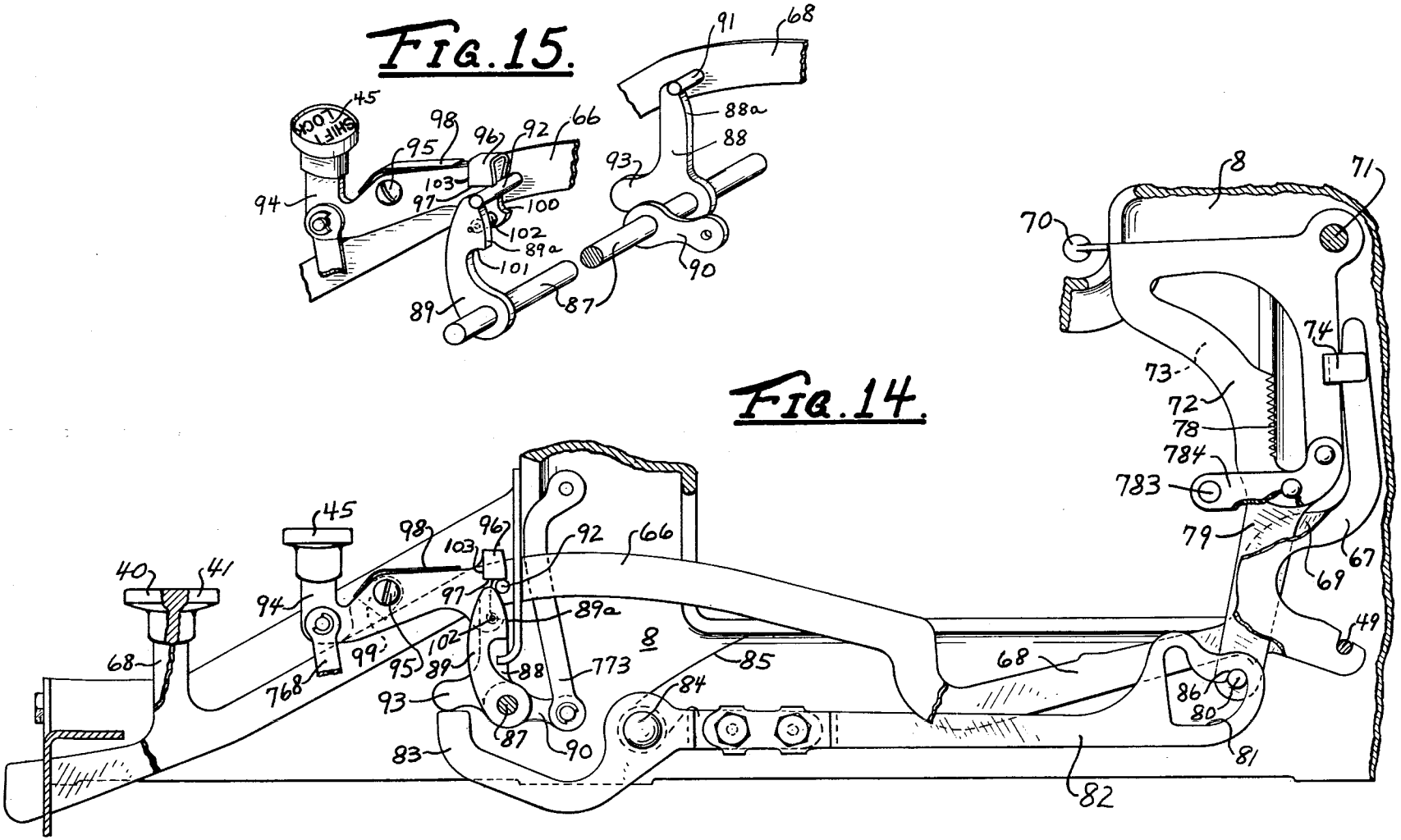
FIG. 14 is a fragmentary right side view of the case shift keys, the shift lock and case shifting bail arrangement.
FIG. 15 is a condensed fragmentary right rear perspective of a portion of the key lock mechanism shown in FIG. 14.

The typewriter chosen for illustrative purposes is a well known type wherein the platen 115 (FIGS. 5 and 8) is shiftable up or down under control of the case shift keys 40, 41 (FIGS. 11 and 14). A typewriter wherein the type arm segment assembly or other printing arrangement is moved in relation to the platen 115 (FIGS. 5 and 8) could just as well be used without departing from the spirit of the invention.

The shift key 41 (FIGS. 11 and 14) is carried by key lever 66, which is fulcrumed at its rearward end on the rod 49, and it is urged upwardly (clockwise) to normal position by one of the springs 55. The key lever 66 has a vertical arm 67 adapted for affecting a case shifting bail arrangement which wil be explained presently.

The shift key 40 (FIGS. 9 and 14), located to the left of the character key group, is carried by a key lever 68. This key lever 68 has the same general characteristics as the key lever 66 (FIGS. 11 and 14). The key lever 68 is fulcrumed on the rod 49, at its rearward end and it has a vertical arm 69 for causing case shifting and it is also spring urged to return.

The usual case shifting bail arrangement is comprised of a tranverse bail rod 70, a parallel torque rod 71 which is journalled at its ends in the sides of the typewriter frame 8, a right side member 72 which is fixed to the right end of bail rod 70 and fixed to the rod 71 near its right end, and a left side member 73 which is fixed to the left end of bail rod 70 and to the rod 71 near its left end.

The vertical arm 67 of the shift key lever 66 is arranged in engaging alignment with the rear edge of the side member 72 and it is constructed to contact the side member 72 at a point below the journalled shaft 71. Likewise, the arm 69 of the key lever 68 contacts the side member 73 at a point below the journalled shaft 71. Forward movement of either vertical arm 67 or 69, in response to depression of the respective shift key 40 or 41, causes the bail arrangement to turn clockwise for raising its rod 70 to its uppercase position.

A guide 74 is provided on the side member 72 and an identical one is provided on the left side member 73. The guides 74 are assembled through slots in their respective members 72 and 73 and are pressed firmly to the sides of the members 72 and 73 in a U shape so as to form a bifurcation within which the respective vertical arm 67 or 69 is guided in engaging alignment with the side member 72 or 73.

Depression of the shift key 40 (FIG. 14) moves the key lever 68 and its arm 69 counterclockwise about rod 49. This counterclockwise movement of arm 69 moves the bail arrangement clockwise about the axis of rod 71 and raises rod 70 to its upper case position. Depression of shift key 41 accomplishes the same result through its key lever arm 66, arm 67 and the bail arrangement for elevating the bail rod 70. Elevation of the bail rod 70 causes the platen 115 to be elevated to its upper case position through well known means to be found in the carriage 9*a* and which will be more fully explained later.

Figure 16:
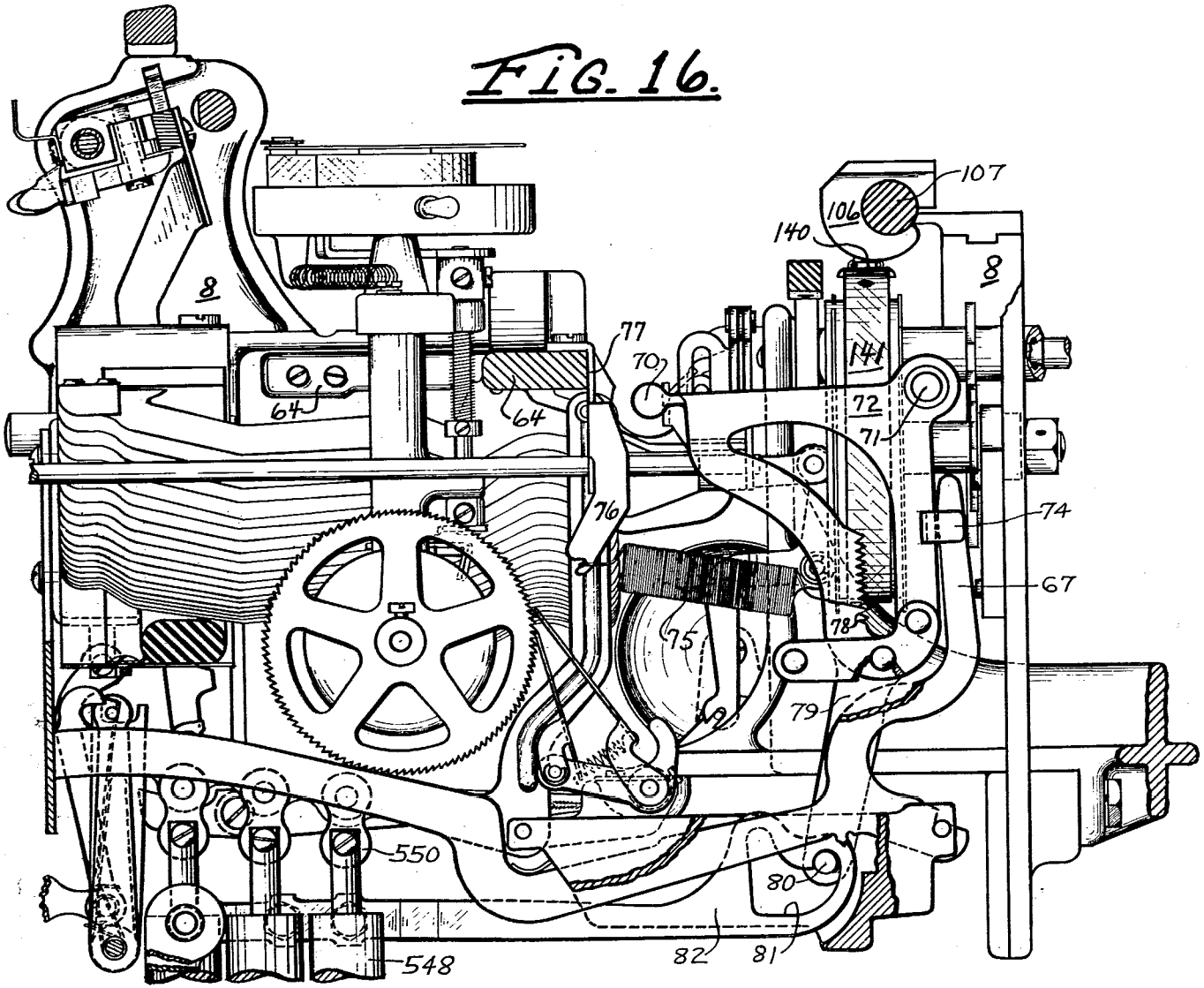
FIG. 16 is a fragmentary right side view of the basic typewriter, exclusive of its keyboard, paper carriage and the major part of the carriage moving mechanism.

The weight of the platen 115 (FIG. 8) and carriage case shift means 40,41,66–73 (FIG. 14–16) and (FIG. 1) 124 by which the paper carriage platen 115 is moved upward is, to a large extend, counterbalanced by a spring 75 (FIG. 16). The spring 75 is connected to the side member 72 at a point below rod 71 and the other end of the spring 75 is anchored to a bent over portion 76 of a member 77, which is secured to the stationary member 64 of the typewriter frame 8. The effectiveness of the spring 75 can be varied by hooking the spring 75 in any of the several notches 78, which are differentially arranged in respect to shaft 71 and in which notches 78 (FIG. 16) the spring 75 is connected to the lower portion of the side member 72. The angle of the spring force as well as the resulting leverage on the bail arrangement can thus be altered to acquire the desired shift key finger pressure assist.

A locking means is provided to prevent the bail arrangment from being pivoted out of the lower case position at times when a shift key 40 or 41 is not operated. For this provision the side member 73 (FIG. 14) extends downwardly in the form of an arm 79, which supports a rightwardly extending stud 80. The stud 80 extends through an opening 81 in the rearward end of a detent 82. The detent 82 is carried by a rearward extension of a pivotal member 83, which is fulcrumed on a stud 84 (FIGS. 9 and 14). The stud 84 is secured to the inner left side of the typewriter frame 8. A torsion spring 85 is anchored to frame 8 and assembled about the bearing hub of member 83. The free end of the spring 85 is connected to the rearward extension of member 83 and urges the member 83 and detent 82 clockwise as viewed in FIG. 14. The configuration of opening 81 provides a blocking surface 86, which lies in the path of stud 80 when the bail arrangement is in the lower case position and the detent 82 is in its clockwise position. Counterclockwise movement of the member 83 and detent 82 raises the blocking surface 86 out of effective position, and only then can the bail arrangement and, therefore, the platen 115 be moved to upper case position.

The blocking surface 86 of the detent 82 is rendered ineffective for blocking when a shift key 40 or 41 is operated. This is accomplished by an arrangement including a transverse shaft 87, which is journalled at its ends in the typewriter frame 8. A generally vertical cam member 88 (FIG. 15) is secured to the shaft 87 near the left end thereof. A vertical cam lever and hook member 89 is secured to the shaft 87 near the right end of the shaft 87. The members 88 and 89, and another member 90, which will be referred to later, are secured together with shaft 87 so when one is moved the others move also as one. The rearward edges of members 88 and 89 carry cam surfaces 88*a* and 89*a*, respectively, which extend upwardly and forwardly. Normally the upper extremes of these surfaces 88*a* and 89*a* lie against pins 91 and 92, which are secured on and extend rightwardly from the shift key levers 68 and 66, respectively. The cam member 88 has a forwardly extending arm 93, which overlies the forward part of the pivotal member 83 (FIG. 14). When the shift key lever 66 is pivoted downward, its pin 92 by cooperation with the cam surface 89*a* moves the unit comprising members 87, 88 and 89 counterclockwise about the axis of shaft 87. The same action takes place when the shift key lever 68 (FIG. 15) and its pin 91 are swung downwardly. Whenever the members 88 and 89, and the shaft 87 are turned counterclockwise, the arm 93 (FIG. 14) rocks the pivotal member 83 counterclockwise for elevating the detent 82 and raising its blocking surface 86 clear of the stud 80. The blocking surface 86 is raised to its ineffective position at or about the time the operated shift key lever 66 or 68 and its arm 67 or 69 begin to move the bail arrangement to the upper case position.

The machine may also be shifted to upper case condition by depression of the shift lock key 45. The shift lock key 45 of this exemplary machine is mounted on the forward part of a rockable member 94, which is pivotally secured to the right side of the shift key lever 66 as by bolt 95. The rearward part of member 94 has a vertical extension 96, which is bent over 180° to extend downward. A lower edge 97 of this extension 96 normally rests on top of the pin 92 for maintainin the clockwise at rest attitude of the member 94. This attitude is constantly urged by the rearward extension of a flat spring 98, which presses lightly downward on the top edge of member 94 at a point rearward of the pivot bolt 95. The forward edge of spring 98 presses against the upper edge of the shift key lever 66 at a point forward of bolt 95. A bent over tap 99 on the left side of the spring 98 is held in position against the left side of key lever 66 by a nut (not shown here) on the bolt 95. A stop surface 100 (FIG. 15) is located on the rearward part of member 94 and in engaging alignment with the stud 92. When member 94 is in its normal clockwise rest position, the surface 100 is angularly spaced from stud 92 for allowing limited counterclockwise rocking of member 94 about its pivot bolt 95. When the shift lock key 45 is pressed, it first causes the member 94 to rock counterclockwise against the tension of light spring 98, until the surface 100 contacts the stud 92, and then it causes the shift key lever 66 to be moved downward and this shifts the machine to the upper case condition as previously described.

The machine is locked in the upper case condition, when the shift key lever 66 is moved downward by the shift lock key 45. When the shift key lever 66 moves downward, the pin 92 thereon acts against surface 89*a* and causes the hook member 89 to turn counterclockwise. The pin 92 is moved beyond the extent of surface 89*a* at or about the time the shift key lever 66 reaches upper case position. A latch surface 101 on the member 89 is located at the lower extent of the cam surface 89*a* and it is adapted to latch over the pin 92, when the shift key lever 66 is lowered to its upper case position. The latching action is assured by the spring 85 (FIG. 14), which urges the members 82, 83, 88, shaft 87 and the hook member 89 clockwise to the latching position. The machine is thus held in the upper case position until the hook member 89 is again turned counterclockwise. The shift lock key 45 may be released by depression of the shift key 40, which lowers shift key lever 68 and its pin 91 (FIG. 15). The pin 91 acts on surface 88*a* for rotating member 88, shaft 87 and the member 89 counterclockwise to remove the surface 101 from the latching position, and allowing the shift key lever 66 to return upward to its lower case position. The machine is then free to return to the lower case condition as the shift key 40 is returned to normal position.

The shift lock key 45 is ineffective, when the shift key lever 66 is moved downward by depression of the shift key 41 (FIG. 14). A short stud 102 (FIG. 15) is secured in the hook member 89 at a point above the hook surface 101. The stud 102 extends leftwardly beyond the edge 97 on the extension 96 of the member 94. A vertical edge surface 103 on the extension 96 of the member 93 extends upward from the forward end of the edge 97. When the key lever 66 is turned downwardly by depression of its shift key 41 (FIG. 14), the hook member 89 is turned counterclockwise by stud 92 and surface 89*a*, and the stud 102 is swung forwardly of the downward travel of the surface 103. Upon full depression of key lever 66, the surface 103 stands in the path of clockwise movement of the stud 102 and therefore prevents the latching movement of the hook member 89.

When the shift lock key 45 is depressed and the member 94 rocked counterclockwise as previously described, the surface 103 is elevated so that the stud 102 can pass under the surface 97 and allow the hook 89 to latch onto the stud 92 as previously described.

The paper carriage 9*a* is of a well known construction having a generally rectangular shaped transversely movable base carrier 104 (FIGS. 1, 2 and 8) and a vertically shiftable platen carrier 105, which is carried by the base carrier 104.

A pair of bearings 106 (FIG. 5 and 17) are secured at spaced points to the rearward side of the base carrier 104. The bearings 106 are fitted to a transverse rail 107, along which the bearings 106 slide as the carriage 9*a* is moved from side to side. A pair of rail supporting portions 108 extend rearwardly from the rail 107 and they are secured to the typewriter frame 8 as by screws 109 (FIG. 19) for rigid support of the rail 107. The forward part of the carriage 9*a* is supported by a wheel 110 (FIGS. 1 and 20), which is mounted for turning on an axle stud 111. Stud 111 extends forward from the front of the base carrier 104 to which it is secured. The wheel 110 is supported by and rolls upon a transverse rail 112, which is fixed at its ends to the left and right sides of the typewriter frame 8. A member 113 is secured to the front of the base carrier 104 and extends forwardly under a transverse beam 114, which is secured at its ends to the left and right sides of the typewriter frame 8. The bottom side of the beam 114 is a smooth plane surface, which is situated to provide only a running clearance above the forward end of the member 113, for allowing the member 113 to move from side to side throughout such movement of the carriage 9*a* and for preventing the front of the base carrier 104 from being lifted out of the horizontal position otherwise determined by the rail 112 and the wheel 110.

The platen carrier 105 (FIGS. 8 and 17) is comprised of left and right end plates which lie in vertical planes, and transverse members (not shown) connecting the two end plates to form a rigid frame. The specific construction on the transverse members, the compression rollers and other parts, which guide the paper around the platen 115, form no part of the invention and, therefore, are not described in detail. The cylindrical platen 115 (FIG. 8) is mounted for rotation between the platen carrier end plates, which are provided with bearings for the platen axle shaft 116 extending therethrough and through the platen 115. The platen 115 is secured to its axle shaft 116 by any well known means for rotation therewith.

In the illustrated form of the invention, the platen carrier 105 is mounted for being raised and lowered in relation to the base carrier 104 of the paper carriage 9*a* for positioning the platen 115 (FIG. 8) for the printing of upper case and lower case characters, respectively. In order to maintain the platen carrier 105 parallel in both positions, two pairs of generally parallel links are used. A lower pair of links 117 (FIGS. 1 and 17), one link for each end, of the carriage 9*a* are pivotally connected at their forward ends to the platen carrier 105 as at 118 and at their rearward ends to the base carrier 104 as at 119. An upper pair of links, or arms, 120 are secured at their rearward ends to a torque shaft 121 for turning therewith. The shaft 121 is mounted for turning in two bearings 122 (FIG. 5), which are secured in the base carrier 104, at spaced points, near the ends thereof. The forward ends of the links 120 (FIGS. 1 and 17) are shaped to form saddles in which studs 123 rest. One such stud 123 is fixed to and extends outwardly from each carrier end plate. The links 120 and shaft 121 hold the ends of the platen carrier 105 and, therefore, the platen 115 in a horizontal position, and the lower links 120, hold the platen carrier 105 in a horizontal plane. A torsion spring (not shown) is connected to the shaft 121 and to the base carrier 104 for tending to turn the shaft 121 and raise the forward ends of the links 120 to maintain coupled relation of the saddles and studs 123, and for partially overcoming the weight of the platen 115 and platen carrier 105 to aid in raising the platen 115 for upper case shifting thereof.

A wheel 124 (FIG. 1) and a follower plate 125 are connected to transverse members of the platen carrier 105 for holding the platen carrier 105 in upper and lower case shifting positions as controlled by the bail rod 70 of the case shifting bail arrangement. The wheel 124 is situated to ride on the top of the transverse bail rod 70 throughout all side to side movements of the carriage 9*a*, while the follower plate 125 slides along the bottom of the bail rod 70, directly under the wheel 124, and prevents the wheel 124 from being moved upwardly away from the bail rod 70. By the just described wheel 124 and follower plate 125, and the platen carrier 105, the platen 115 is moved up or down in unison with the case shifting bail rod 70 for positioning the platen 115 in either upper or lower case position, respectively, as when a shift key 40, 41 is depressed or released, respectively.

The carriage 9*a* is caused to move leftwardly, forwardly, by power originating in a carriage moving mechanism, which will be described hereinafter, and it is returned to the left margin and it may be backspaced upon such manual control of the machine, by spring power when the carriage moving mechanism permits such rightward movement.

Figure 22:
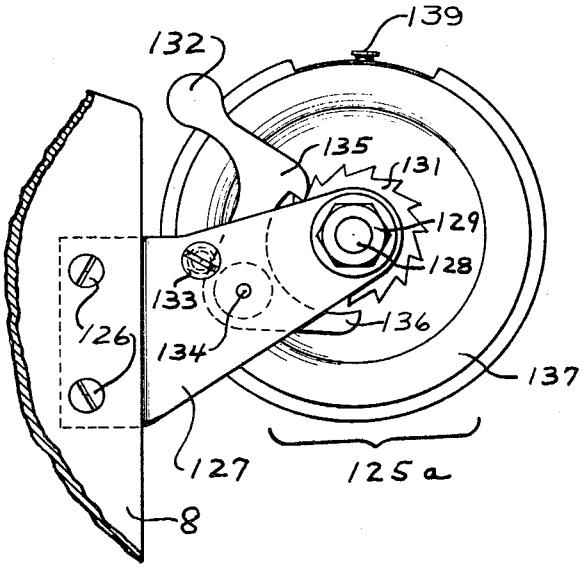
FIG. 22 is a rear view of the carriage return spring arrangement, shown also in FIG. 21.

In order to return or backspace the carriage to the right, a spring means 125*a* (FIGS. 21 and 22) which is contractile in nature, is connected between the right side of the typewriter frame 8 and the left end of the carriage 9*a*. This spring means 125*a* is connected to the frame 8 by screws 126 (FIGS. 21 and 22), which old a support bracket 127 to the frame 8. A headed axle bolt 128 extends forwardly, and is rigidly tightened into a hole in the bracket 127 by a usual shoulder (not shown) on the bolt 128 for contact with the front side of the bracket 127 and a nut 129 (FIG. 22) to the rear of the bracket 127 for tightening thereagainst. A sleeve 130

Figure 23:
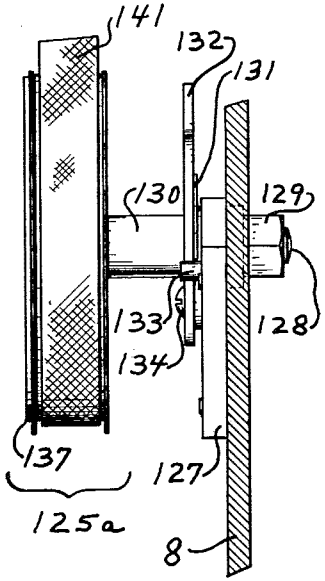
FIG. 23 is a fragmentary right side view of the spring arrangement shown in FIG. 21.

(FIG. 23) is mounted for turning on the axle bolt 128, between the bracket 127 and the head of the bolt 128. The sleeve 130 is turnable for adjusting spring tension and is lockable against rotation for maintaining the desired tension. A ratchet wheel 131 (FIG. 22), an escapement member 132 and lock bolt 133 are provided for adjusting and locking the sleeve 130. The ratchet wheel 131 is secured on the rearward end of the sleeve 130 (FIG. 23), which, therefore, may turn only when the wheel 131 is allowed to turn. The escapement member 132 is pivotally mounted on a bolt 134, which is screwed into the bracket 127 and is headed for holding the member 132 in engaging the alignment with the ratchet wheel 131. The teeth of the ratchet wheel 131 (FIG. 22) are canted for preventing clockwise turning thereof as viewed here from the rear and the member 132 is formed, above its pivot 134, with a pawl portion 135, which is normally engaged with the ratchet wheel 131 to prevent this turning. The escapement member 132 has another pawl portion 136 formed at its lower end, below the pivot 134, for engaging the teeth and allowing the ratchet wheel 131 to turn clockwise only about half of a tooth, when the lock bolt 133 is removed and the escapement member 132 is pivoted to extract the pawl 135 from a tooth of the ratchet wheel 131. Similarly, when the escapement member 132 is returned, its pawl 136 is withdrawn from contact with a tooth, and, simultaneously, the pawl 135 is inserted to allow another half of a tooth movement of the ratchet wheel 131. Thus, it may be seen that by reciprocating the escapement member 132, the ratchet wheel 131 is allowed to turn clockwise as viewed from the rear and, by turning the ratchet wheel 131 counterclockwise, the escapement member 132 will reciprocate as its pawls 135 and 136 ratchet over the teeth of the ratchet wheel 131. The lock bolt 133 is screwed into the bracket 127 from the rear and it extends through the bracket 127 beyond the edge of member 132 as shown in FIG. 23, to block withdrawal of pawl 135 (FIG. 22) from the teeth of the ratchet wheel 131, when the ratchet wheel 131 is adjusted.

Figure 21:
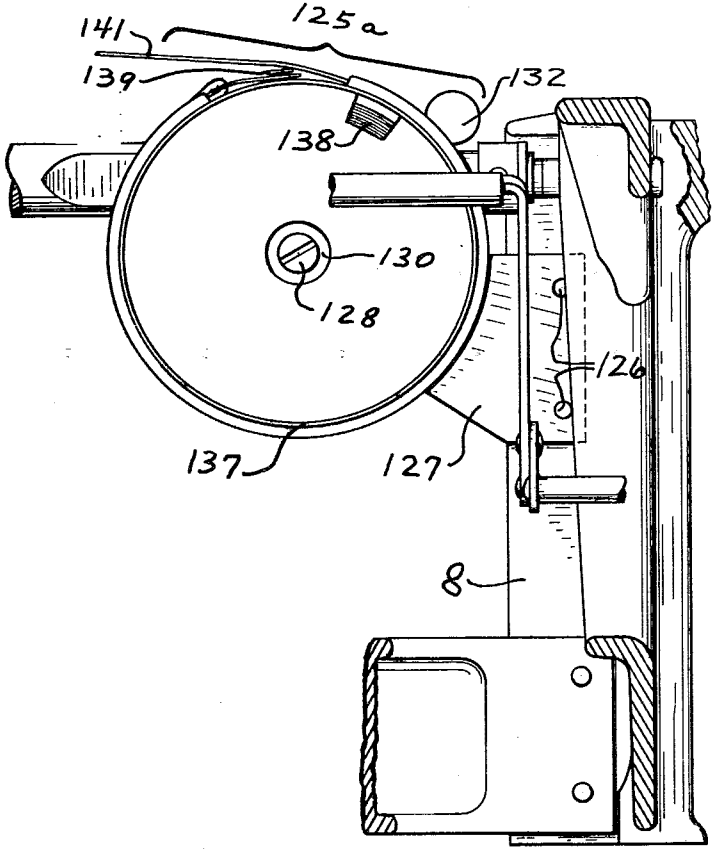
FIG. 21 is a fragmentary front view of the carriage return spring arrangement.

A spring cage 137 is mounted for turning about the sleeve 130 (FIG. 23) and encases a usual clocktype spring 138 (FIG. 21). The spring 138 is anchored, by any well known means, to the sleeve 130 and it is coiled thereabout in a counterclockwise direction as viewed here from the front. The outer end of the spring 138 is connected in a well known manner to the inner surface of the cylindrical wall of the cage 137 for urging the cage 137 clockwise.

A headed stud 139 is secured to the outer surface of the cylindrical wall of the cage 137. Another such a stud 140 (FIG. 5) is secured on the bottom of the bearing 106 on the left end of the carriage base carrier 104. One end of a flexible tape 141 (FIGS. 21 and 23) is hooked on the stud 139 (FIG. 21) and wound counterclockwise about the cylindrical external surface of the spring cage 137. The other end of the tape 141 is pulled sufficiently to turn the cage 137 counterclockwise and properly tension the spring 138 for returning the carriage **9*a* and it is connected to the stud 140 (FIG. 16) on the carriage 9*a*. From the foregoing, it may be seen that when the carriage 9*a* is moved leftward, the cage 137 (FIG. 21) is turned counterclockwise against the tension of the spring 138, and it should be noted that the carriage return spring means 125*a* is always ready to move the carriage 9*a*** rightwardly whenever such movement is permitted.

3. CARRIAGE MOVING MECHANISM

The carriage moving mechanism of the selected standard typewriter has been removed and one suited to differential movement of the carriage **9*a*** for providing proportional letter spacing, differential word spacing, line justification and a declutching arrangement for automatic carriage return has been substituted. The substitute carriage moving mechanism is part of the instant invention and will be referred to hereinafter as the carriage moving mechanism.

A transverse gear rack 142 (FIGS. 1, 2 and 5) is solidly attached to the carriage **9*a* for movement therewith and for moving the carriage 9*a* leftwardly and controlling backspace movement thereof. The rack 142 is mortised at its ends into a pair of support brackets 143, which press against shoulders at the base of the tenons to prevent axial displacement of the rack 142 in respect to the brackets 143. The brackets 143 are secured to the ends of the carriage base carrier 104 by screws 144 (FIG. 17) and by pilot pins 145, which are secured on the base carrier 104 and extend through close fitting holes in the brackets 143**.

Figure 4:
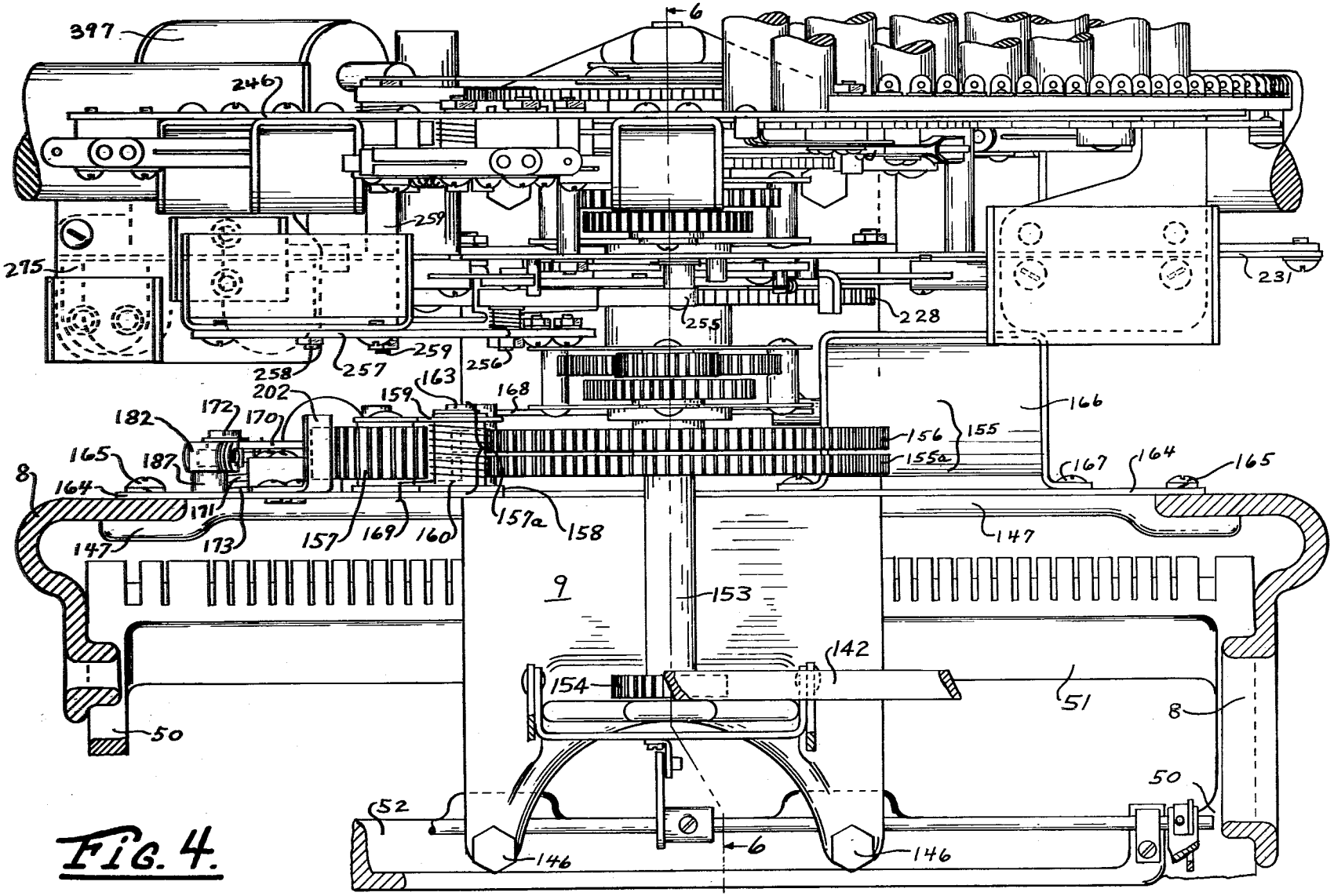
FIG. 4 is a fragmented detailed top view of the carriage moving mechanism, showing its connection with the typewriter.
Figure 5:
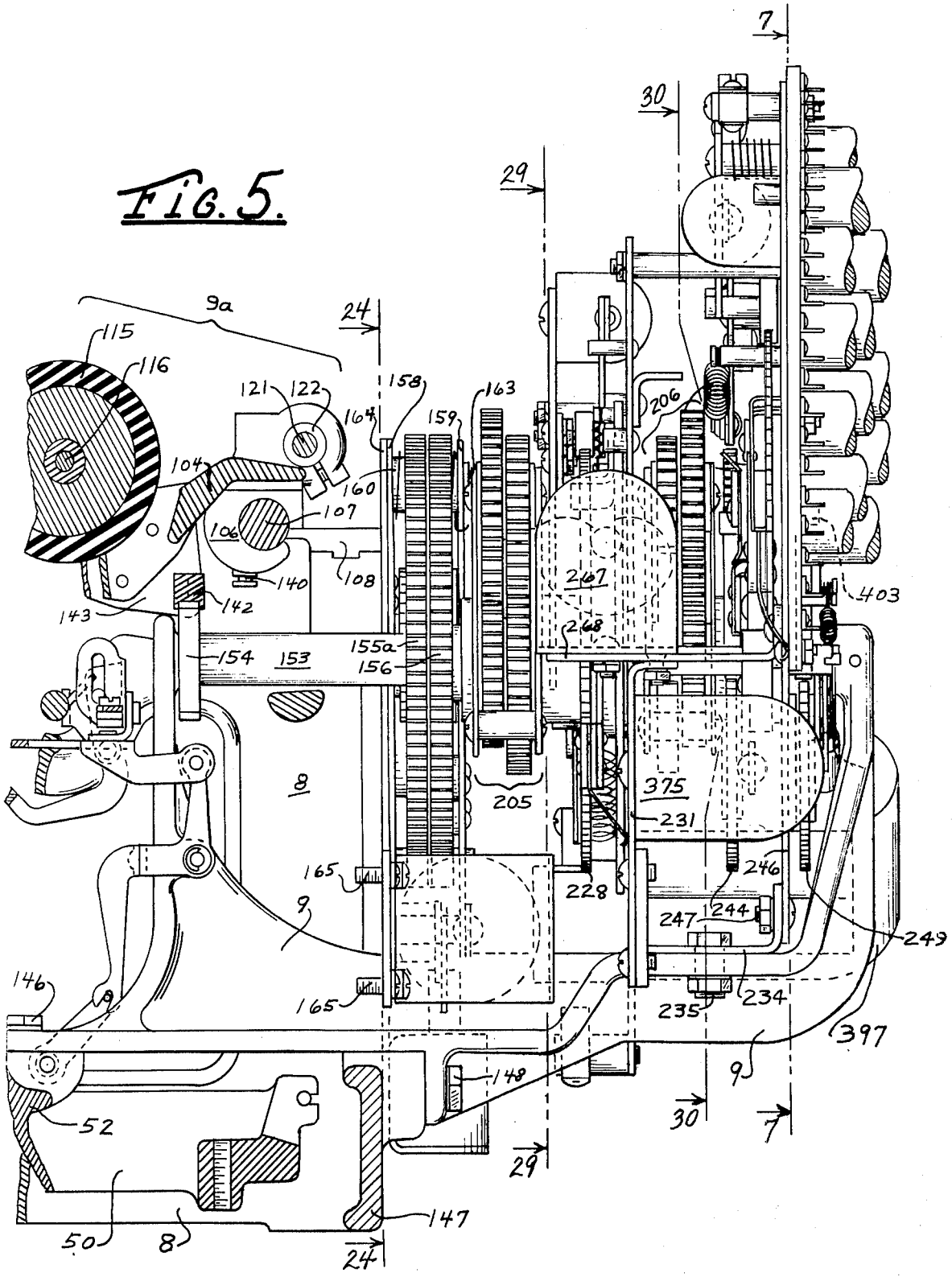
FIG. 5 is a right side elevational view of the carriage moving mechanism, and showing further fragmented portions of the typewriter frame and paper carriage.

The carriage moving mechanism is assembled on the auxiliary frame 9 (FIGS. 4 and 5), which is secured to the transverse portion 52 of the frame 50 as by cap screws 146. The frame 50 is secured to the typewriter frame 8, as previously described. The frame 9 is also secured to a transverse portion 147 of the typewriter frame 8 as by cap screws 148 (FIG. 5).

Figure 6:
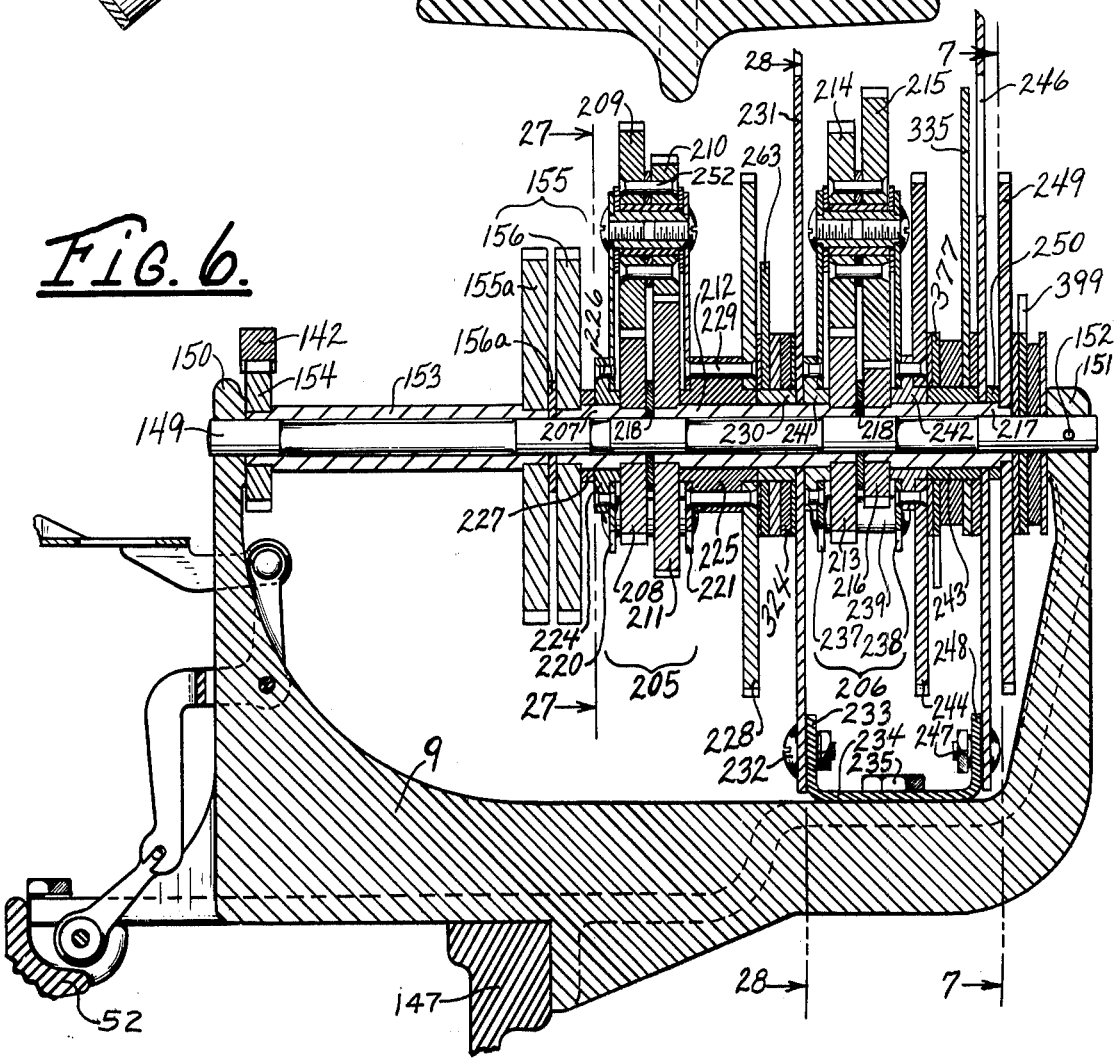
FIG. 6 is a fragmented sectional right hand view of the carriage moving mechanism's main shaft assembly and frame support therefor, taken on line 6 — 6 (FIG. 4), with other parts of the carriage moving mechanism omitted for clarity.

Cyclic and epicyclic gear means, which constitute a major part of the carriage moving mechanism, are mounted on a rod 149 (FIG. 6). The rod 149 is supported in line-bored holes in bosses 150 and 151 on upwardly extending portions of the frame 9 at the front and rear thereof, respectively. The rod 149 is held aganst rotation and axial movement by a pin 152 inserted through the shaft 149 and the rear boss 151.

The bosses 150 and 151 could just as well be split horizontally in line with the axis of the rod 149 so as to form bearing caps, which could be equipped with cap screws for easy removal of the caps to facilitate assembly, without departing from the spirit of the invention.

A sleeve 153 is mounted for rotation on the rod 149, near the forward end thereof. A carriage drive gear 154 is secured on the forward end of the sleeve 153 for rotation therewith about the axis of rod 149. The forward end of the sleeve 153 and the forward face of the carriage gear 154 lightly engage the rearward face of the boss 150, which prevents forward thrust of the gear 154 and sleeve 153 and which is situated to properly align the gear 154 with the carriage borne rack 142. The gear 154 is constantly meshed with the rack 142 so they turn and move, respectively, together.

A positive drive clutch 155 is provided for normally transmitting drive motion to the sleeve 153 for forward operations and for controlling backspace operations, and it is disengageable for carriage return. A relatively large gear **155*a* is secured on the rearward end of sleeve 153 for rotation therewith. An identical gear 156 is mounted for turning about rod 149 in axial alignment with the gear 155*a*. A thrust washer 156*a* is assembled on the rod 149, between the gears 155*a* and 156, for maintaining the gears 155 and 156 in a proper free running spaced relationship. A wide faced clutch gear 157 (FIGS. 4 and 24) is mounted for disengagement and engagement with the identical gears 155*a* and 156 for allowing these two gears 155*a* and 156** to turn freely of each other and for causing them to turn in synchronism, respectively.

Figure 24:
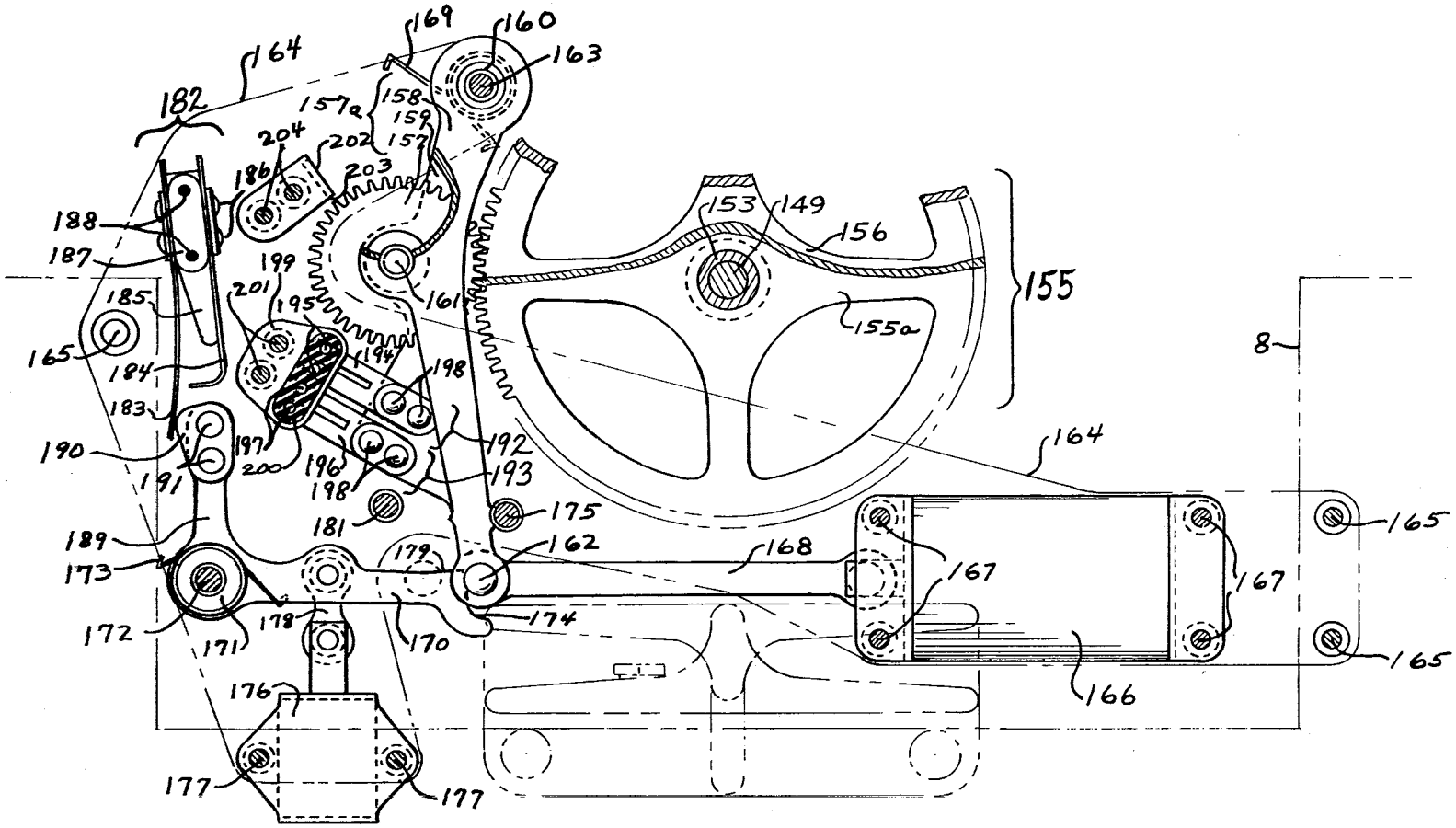
FIG. 24 is a fragmentary front sectional view of the carriage moving mechanism, taken on line 24 — 24 (FIG. 5), and showing primarily the carriage return clutch with its foreground support plate shown in phantom.

The clutch gear 157 hangs in a carrier assembly 157a comprising a forward depending lever 158, a similar rearward lever 159, and a pivot sleeve 160, a gear pivot stud 161 (FIG. 24) and a lower stud 162. The ends of the sleeve 160 and the two studs 161 and 162 are secured into the levers 158 and 159 and extend therebetween so as to form a rigid assembly. The forward and rearward levers 158 and 159 guide the respective sides of the clutch gear 157, which is rotatably mounted therebetween on the pivot stud 161. This entire assembly hangs pendently on a stud 163, which extends rearwardly from and which is secured on a support plate 164 shown in FIGS. 4 and 5. The configuration of plate 164 is shown in phantom in FIG. 24. The plate 164 is secured to the vertical back face of the standard typewriter frame 8 as by screws 165 (FIGS. 4 and 24).

Mechanisms for controlling the engagement and disengagement of the clutch gear arrangement are also mounted on the plate 164. A clutch engaging solenoid 166 is situated horizontally and is secured to the rearward side of the plate 164 by screws 167. The armature of the solenoid 166 is pivotally connected to the rightward end of a link 168 and the other end of the link 168 is pivotally connected to the lower end of the clutch gear assembly, as by the stud 162 (FIG. 24). When the carriage 9a is fully returned as will be explained, the solenoid 166 is energized for pivoting the gear assembly counterclockwise and engaging the clutch gear 157 with the gears 155a and 156 as shown.

A torsion spring 169 is assembled about sleeve 160, and its ends are connected to the stationary support plate 164 and the lever 159 of the clutch gear assembly for urging the gear assembly clockwise and for, at times, disengaging the gear 157 from the companion gears 155a and 156. A pawl 170 is provided for normally holding the clutch gear 157 in its engaged position and is operable for releasing the clutch 155 for the purpose of allowing the carriage 9a to return under tension of the carriage return spring 138 previously described.

The pawl 170 is fitted with a hub bearing 171, which is pivotally mounted on a stationary stud 172. The stud 172 is secured on the support plate 164, extends through the bearing 171 and pawl 170, and is equipped with a clip or other well known means for holding the pawl 170 on the stud 172 in position with the forward end of the bearing 171 against the plate 164. A torsion spring 173 is assembled about the bearing 171, and it is connected to the pawl 170 and to the stationary plate 164 for urging the pawl 170 counterclockwise from an ineffective position to its holding position shown here. The pawl 170 extends rightwardly and is formed with a blocking surface 174, which normally blocks leftward movement of the stud 162, and, therefore, holds the clutch gear 157 in its engaged position. The surface 174 is situated tangentially in respect to its leading edge and to the pivotal axis of the pawl 170, so as to take up all tolerance between the surface 174 and the stud 162 as the spring 173 continually presses for further counterclockwise turning of the pawl 170.

A positive stop stud 175 is fixed to plate 164 and extends rearwardly beyond the planes of the levers 158 and 159, and it is situated for stopping these levers 158 and 159 and the gear 157 carried thereby in engaged position while maintaining running clearance between the teeth of gear 157 and those of the gears 155a and 156.

The pawl 170 is operable clockwise, clear of the stud 162, for permitting disengagement of the clutch 155. A clutch disengaging solenoid 176 is provided for operating the pawl 170 and thereby allowing disengagement of the clutch gear 157 from the gears 155a and 156. Solenoid 176 is mounted on the rear face of the plate 164 by bolts 177, which pass through holes in the plate 164 and which are screwed into the back wall of the typewriter frame 8 (Shown here in phantom). The armature of the solenoid 176 is pivotally connected to a link 178. The other end of link 178 is also pivotally connected to the pawl 170. When the solenoid 176 is energized, it moves the link 178 downwardly causing the pawl 170 to turn clockwise to its ineffective position. When the surface 174 of the pawl 170 is lowered clear of the stud 162, the spring 169 operates the carrier assembly 157a and the gear 157 clockwise to their disengaged position. As the assembly 157a rotates clockwise, the stud 162 of the assembly 157a passes over an upper edge surface 179 of the pawl 170. Surface 179 is provided for contacting the bottom of stud 162, upon deenergization of solenoid 176, and preventing return of the pawl 170 until the assembly 157a is again returned to its clutch engaging position.

A stud 181, similar to stud 175, is fixed to the support plate 164 in a position for stopping clockwise turning of the assembly 157a in the disengaged position. From the foregoing, it can be seen that by alternate use of the clutch engaging solenoid 166 and the clutch disengaging solenoid 176, the clutch gear 157 is moved to its engaged and disengaged positions, respectively.

A normally open switch 182 is provided for breaking the clutch reengaging circuit, when the solenoid 166 has completed its function and the pawl 170 snaps into its effective blocking position. Illustratively, the switch 182 (FIGS. 4 and 24) is comprised of two contact blades 183 and 184, which are sprung to remain in contact with each other, an insulator 185 therebetween, and insulated rivets 186 for holding the switch assembly together. An insulator 187, between the switch 182 and the support plate 164, maintains the switch 182 properly spaced away from the back face of plate 164. The switch 182 is secured to the plate 164 by bolts 188 which pass through the insulators 185 and 187, and are screwed into the plate 164.

An upwardly extending arm 189, on the pawl 170, carries an insulator 190 which is secured to the arm 189 by rivets 191. The insulator 190 is situated for striking the blade 183 (FIG. 24) and moving it away from the blade 184 and breaking the circuit through the switch 182, when the clutch 155 is fully engaged by the solenoid 166 and the pawl 170 is snapped counterclockwise into effective position by the spring 173. The clutch reengaging circuit, which passes through switch 182 and energizes the solenoid 166, will be fully described hereinafter.

A pair of switches 192 and 193 are also operated by the carriage return clutch for proper cycling of the carriage return function. The switch 192 is in a tape reader control circuit, which is broken by this switch 192 for cycling of the control tape 412 when the carriage return code is read and the clutch 155 is disengaged, as will be explained hereinafter. The switch 193 is provided for breaking a manual carriage return circuit, which causes disengagement of the clutch 155 upon depression of a carriage return key 1212 when the reproducer is being operated manually, as will also be fully described hereinafter.

The switch 192 is comprised primarily of a spring switch blade 194 and a pair of separately spaced contacts 195.

Similarly, switch 193 is comprised of blade 196 and contacts 197. The rightward ends of blades 194 and 196 are insulated so as not to pass current therebetween or to the parts on which they are mounted. The insulated ends of the blades 194 and 196 are secured to the forward face of the lever 159 of the clutch carrier assembly 157*a* by rivets 198. The blades 194 and 196 extend leftwardly only sufficiently to make contact with their respective contacts 195 and 197, when the clutch carrier assembly 157*a* is in its rightward engaged position. The contacts 195 and 197 are formed or assembled into an insulating support block 199 which holds them rigidly to the support plate 164 in the just described position. The rearward ends of the contacts 195 and 197 are preferably headed and countersunk so that the rearward face of the block 199 and the heads of the contacts 195 and 197 present smooth surfaces to the ends of the blades 194 and 196. The shanks of the contacts 195 and 197 extend forwardly through the block 199 and a forwardly extending boss 200 thereof. The boss 200 extends forwardly, through a hole therefor in plate 164, sufficiently to thoroughly insulate the contacts 195 and 197 from the plate 164. The foremost ends of the contacts 195 and 197 are fitted with any suitable wire terminal end connections (not illustrated). The contact support block 199 is secured to the plate 164 by headed screws 201, the heads of which are preferably countersunk in the rear face of the block 199 to allow free passage of the left ends of the switch blades 194 and 196 thereover. The left ends of the blades 194 and 196 are bent forwardly so as to bear only on the rearward face of the block 199 or on the contacts 195 and 197, depending on the condition of the clutch 155 and they will not touch the contacts 195 and 197 when the ends of the blades 194 and 196 are moved leftwardly and bear on the block 199.

From the foregoing, it can be understood that the forwardly inclined and leftwardly extending contact ends of the blades 194 and 196 rest on their respective pair of contacts 195 and 197, when the clutch carrier assembly 157*a* is in its clockwise engaged position, and that the contact ends of the blades 194 and 196 are out of registry with the contacts 195 and 197, when the clutch carrier assembly 157*a* moves to its disengaged position. When engaged, current may pass through one contact 195 or 197, through its blade either 194 or 196 and the other contact 195 or 197 of the respective pair. When the clutch 155 is disengaged, the circuits through both switches 192 and 193 are broken.

A clutch gear tooth aligning device 202 is provided for preventing rotation of clutch gear 157, when it is disengaged from the other gears 155*a* and 156. This device 202 is of a thickness suitable for entry between adjacent teeth of the gear 157, and is located so that an edge 203 thereof is aligned with a dedendum between teeth of the gear 157, generally arcuately aligned with the movement of the axis 161 of the gear 157. The aligning device 202 can be bent to attain fine adjustment of its edge 203 relative the appropriate dedendum, or the device 202 may be designed to include a mechanical adjustment for this purpose without departing from the spirit of the invention.

As illustrated, the forward end of the aligning device 202 is bent over to form a support tab, which is secured to the rear face of support plate 164 by screws 204. The travel distance of the gear 157 for disengagement thereof is less than twice the length of the teeth of the gears 155*a* and 156. When the gear 157 is moved from engaged position, the edge 203 of the device 202 will be partly engaged by two teeth before the teeth on the opposite side of the gear 157 are fully disengaged from the gears 155*a* and 156. Thus, the gear 157 is never allowed to turn uncontrollably and is held for proper reengagement.

The carriage drive gear 154 (FIG. 6) has thirty teeth and a circular pitch of 0.100 of an inch. The carriage drive gear 154 moves the carriage 9*a* laterally one fourth of a tooth or 0.025 inch per unit of movement and, therefore, 120 units of movement per revolution. The clutch gears 155*a* and 156 have 120 teeth or 1 tooth per unit of carriage movement. With this arrangement, the wide face clutch gear 157 can be disengaged from its gears 155*a* and 156 in any unit position of the carriage 9*a* for return of the carriage 9*a* into any other unit position, and at which latter position the teeth of the rotated gear 155*a* and the unmoved gear 156 are again in alignment for reengagement by the wide faced gear 157. As will be explained hereinafter, the margin stops 1292 and 1067 are settable for stopping the carriage 9*a* only in positions dimensionally commensurate with 0.025 of an inch and the entire stop arrangement is laterally adjustable for causing alignment of the clutch gears 155*a* and 156 when the carriage 9*a* is in any of the margin stop positions.

The clutch gear 156 is rotatable by two interconnected differentials 205 and 206, which are operated for all movements of the carriage 9*a* except carriage return.

The gear 156 is secured on the forward end of a differential output sleeve 207, which is mounted for rotation on the rod 149. A sun gear 208 is secured on the rearward end of the output sleeve 207. The remaining gears of the differentials 205 and 206 are entrained and drive connected as follows: a planet gear 209 is meshed with the sun gear 208 and it is connected for rotation with a planet gear 210, the gear 210 is meshed with a sun gear 211, the gear 211 is secured on the forward end of a sleeve 212 which is mounted for rotation on the rod 149, a sun gear 213 is secured on the rearward end of the sleeve 212 and it is meshed with a planet gear 214, the gear 214 is connected for rotation with a planet gear 215, gear 215 is meshed with a sun gear 216, and the gear 216 is secured on the forward end of a sleeve 217 which is mounted for rotation on the rod 149.

The adjacent discoidal faces of the sun gears 208 and 211, as well as those of the sun gears 213 and 216, are separated one from the other by a thrust washer 218, which is assembled on the rod 149 between the respective pair of gears, 208, 211 and 213, 216.

The gear carrier for differential 205 is mounted for turning on the axially aligned sleeves 207 and 212 and it carries at least one pair of planet gears 209 and 210. This carrier for differential 205 is comprised of a forward plate 220 and a rearward plate 221, and at least three angularly spaced sleeves 222 (FIG. 25) with their ends secured on the plates 220 and 221 as by screws 223.

Figure 27:
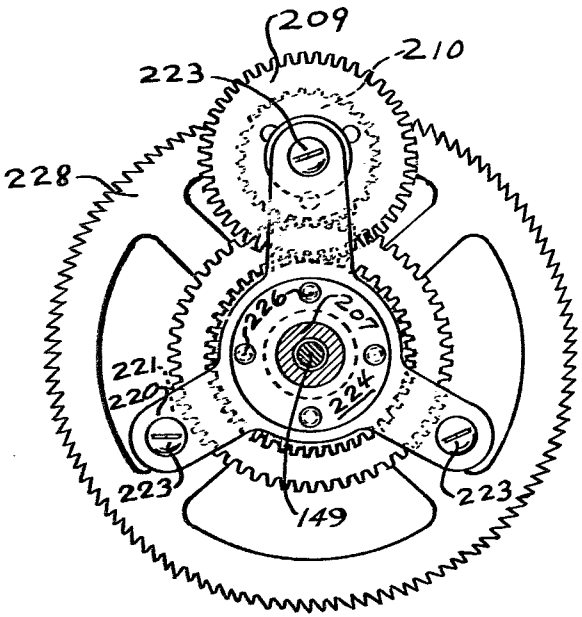
FIG. 27 is a front view, taken on line 27 — 27 (FIG. 6), showing a differential gear train of the carriage moving mechanism.

The plate 220 (FIG. 27) is equipped with a bearing 224 which is mounted for turning on the sleeve 207. The bearing 224 is secured to the plate 220 by rivets 226. A thrust washer 227 (FIG. 6) is assembled on the sleeve 207 between the bearing 224 and the clutch gear 156, and the rear face of the bearing 224 lies in running contact with the gear 208, for maintaining axial alignment of these parts. A carrier bearing 225 is rotatably mounted on sleeve 212 and the front face of the bearing 225 also acts as a thrust bearing, since it contacts the rear face of the gear 211 to maintain proper axial alignment. A drive ratchet wheel 228 (FIGS. 29 and 6) and the bearing 225 are secured together and to the plate 221 (FIG. 6) as by rivets 229 extending therethrough. A sleeve 230 is assembled on the sleeve 212 between the rear face of the bearing 225 and a stationary plate 231. The sleeve 230 serves to prevent rearward thruust of the differential assembly 205.

Figure 29:
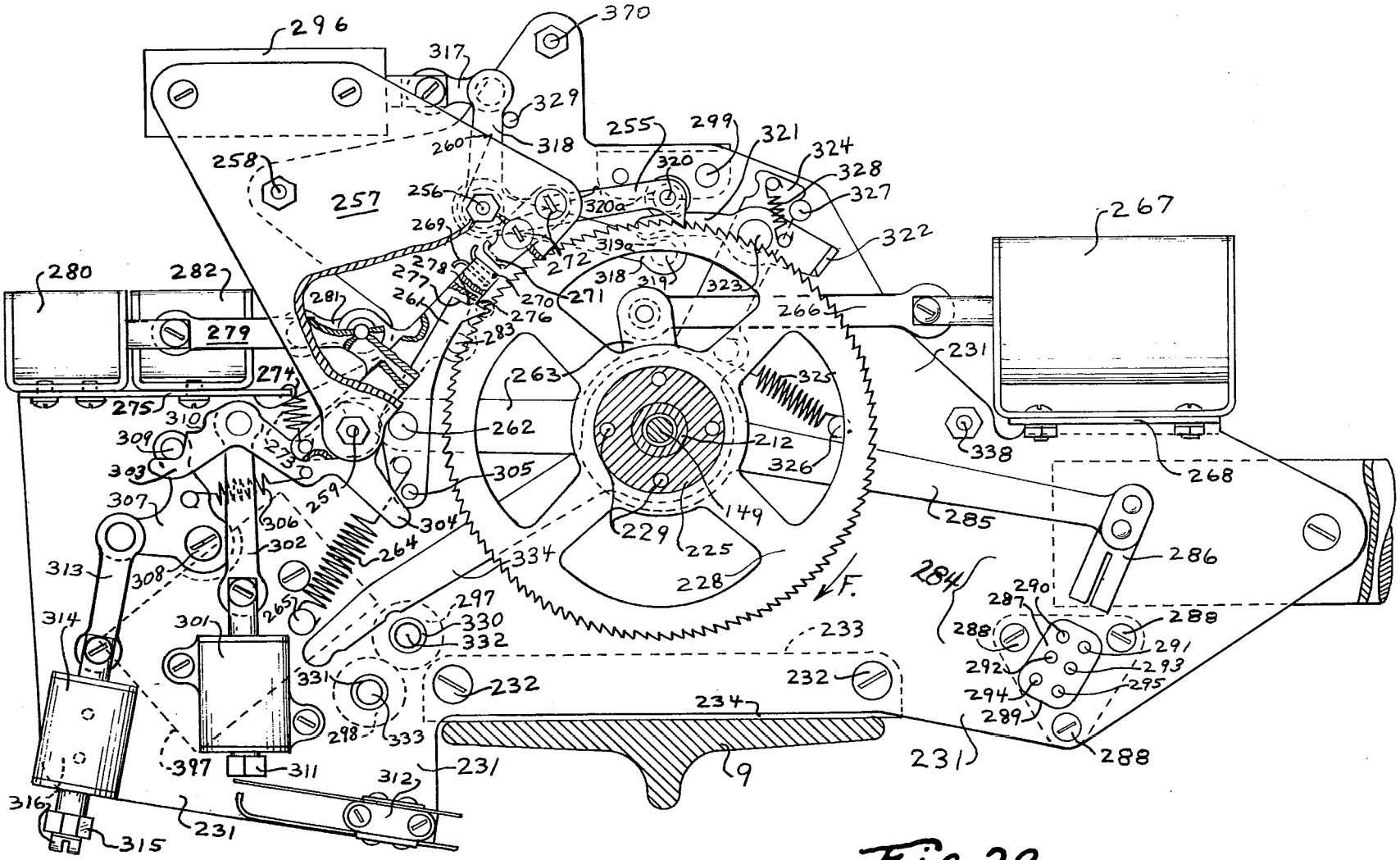
FIG. 29 is a sectional front view of the carriage moving mechanism, taken generally on line 29 — 29 (FIG. 5).
Figure 30:
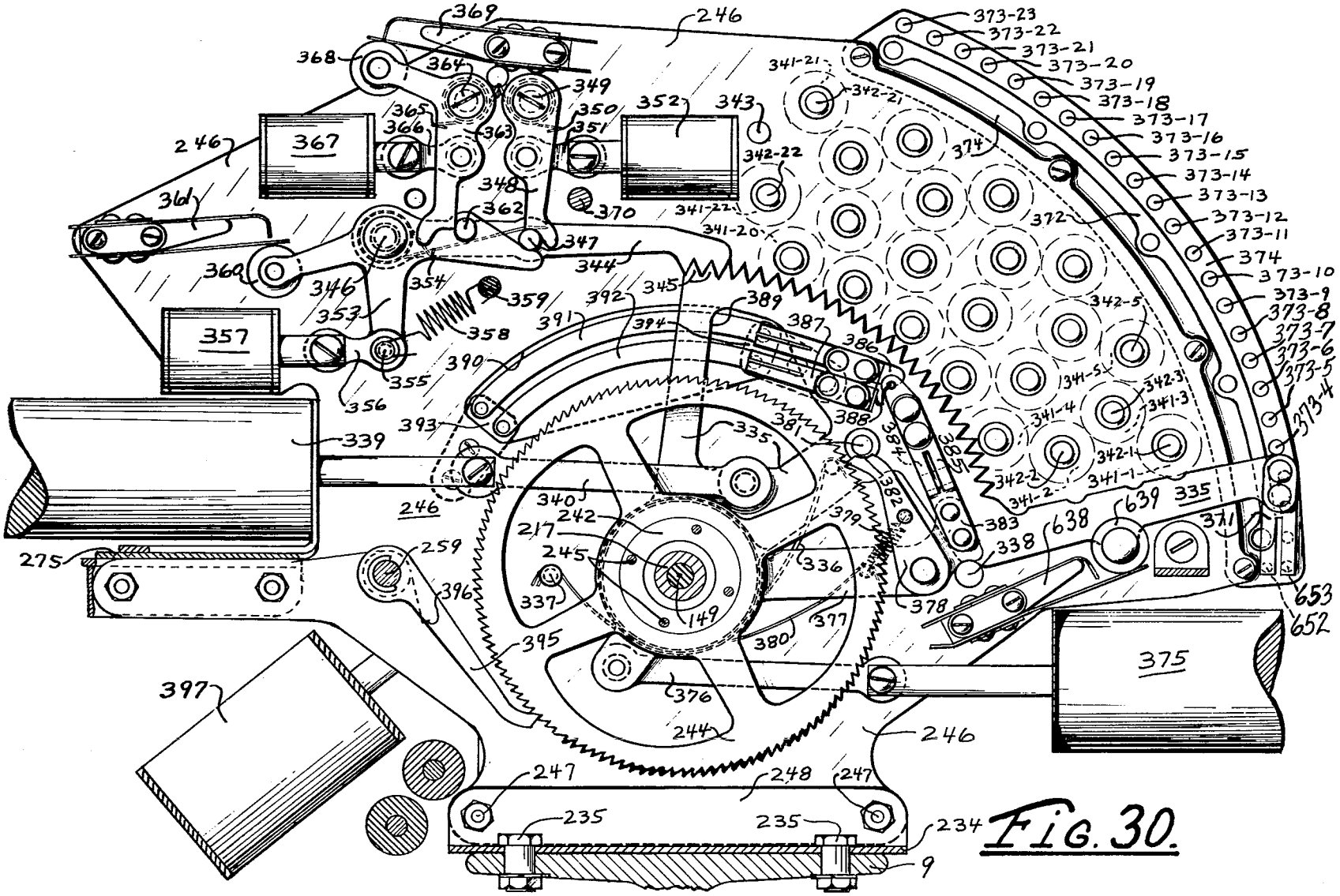
FIG. 30 is a slightly fragmented sectional front view of the carriage moving mechanism, taken generally on line 30 — 30 (FIG. 5).

The plate 231 is assembled on the sleeve 212, there being a hole therefor through which the sleeve 212 extends and may turn therein. After the mechanism is assembled on the shaft 149 and the shaft 149 is supported in the frame 9, as previously explained, the plate 231 (FIGS. 29 and 6) is secured as by bolts 232 to an upstanding transverse flange 233 of a horizontal channel member 234. The channel member 234 is bolted to the frame 9 by bolts 235. (FIG. 30)

Figure 28:
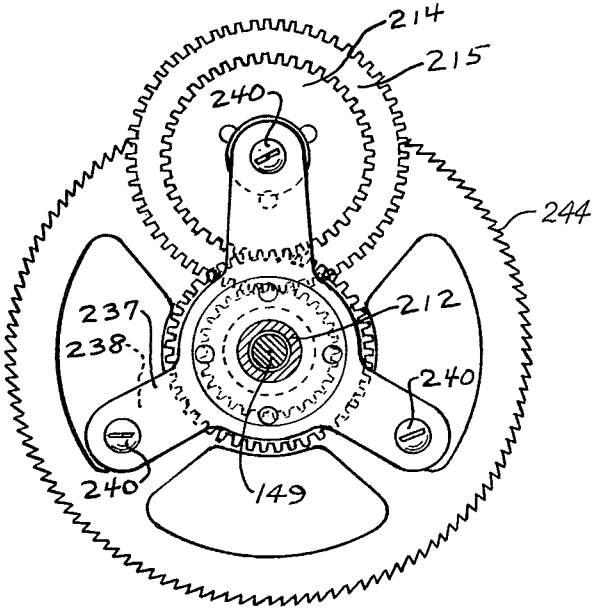
FIG. 28 is a front view, taken on line 28 — 28 (FIG. 6), showing another differential gear train of the carriage moving mechanism.

The differential 206 (FIG. 6) is mounted for turning on the sleeves 212 and 217, and it includes the planet gears 214 - 215. The carrier for differential 206 is comprised of a forward plate 237 and a rearward plate 238, and at least three angularly arranged parallel spacer sleeves 239 (like sleeves 222 in FIG. 25) with their ends fixed into the plates 237 and 238 (FIG. 28) as by screws 240.

Bearings 241 and 242 (FIG. 6) are securely riveted to the forward plate 237 and rearward plate 238, respectively, and are mounted for turning on the sleeves 212 and 217. The front face of the bearing 241 lies in running contact with the support plate 231 and the rear face of the bearing 241 lies in running contact with the gear 213. In the same manner, the forward thrust face of bearing 242 contacts gear 215 and its rearward face contacts a sleeve spacer 243 for maintaining axial alignment of differential 206 and the gears therein. A drive ratchet wheel 244, the bearing 242 and the plate 238 of the carrier are secured together by rivets 245 (FIG. 30) for rotation of the carrier by the ratchet wheel 244.

The sleeve 243 (FIG. 6) is assembled on the sleeve 217 in axial alignment with the bearing 242 and its rear face bears against a stationary plate 246. The plate 246 (FIGS. 30 and 6) is assembled on the sleeve 217, there being a hole therefor through which the sleeve 217 extends and may turn therein. When the mechanism is assembled, the plate 246 is secured, as by bolts 247, to an upstanding flange 248 of the channel member 234.

Figure 7:
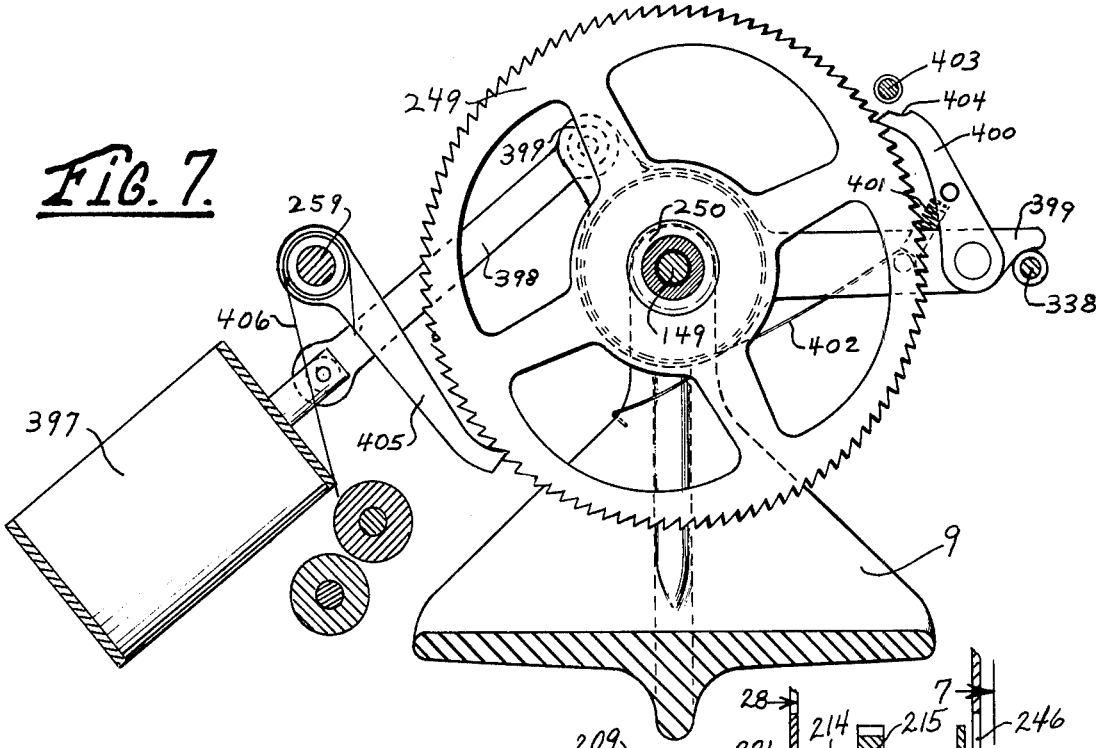
FIG. 7 is a front sectional view of a third driving section of the carriage moving mechanism, with unrelated parts omitted for clarity, as viewed from line 7 — 7 (FIGS. 5 and 6).

A ratchet wheel 249 (FIGS. 7 and 6) is secured on the rearward end of the sleeve 217 for at times driving the sleeve 217 and the gear 216.

A thrust washer 250 is assembled on the sleeve 217 between the ratchet wheel 249 and the stationary plate 246 (FIG. 6) for preventing forward movement of the ratchet wheel 249. Other washers and mechanism, to be described hereinafter, are assembled on the shaft 149 between the ratchet wheel 249 and the boss 151 of the frame 9 for preventing rearward thrust of the ratchet wheel 249 and connected parts as will be described.

From the foregoing description of the mechanisms assembled on the shaft 149, it can be seen the parts of these mechanisms are blocked against axial movement, there being only suitable tolerances thereamong for easy rotation of the parts.

The manner in which the planet gears 209 and 210, and 214 and 215 are secured together, respectively, in pairs, is identical and a description of one pair should suffice for the other. Accordingly, the gears 209 and 210 (FIG. 25), with a spacer 251 therebetween, are secured together by rivets 252 secured therethrough. A bushing 253 is then pressed into the center hole of the planet gear assembly. The assembly, with a thrust washer 254 on either side thereof, is placed on one of the sleeves 222 of the planet gear carrier. The planet carrier plates 220 and 221 are then secured to the sleeves 222 by the screws 223 as previously explained.

It can be seen in FIG. 6 that the pair of planet gears 214 and 215 are secured together in the same manner as those just described. However, the pair of gears 214 and 215 are assembled on one of the sleeves 239 that is secured on the carrier plates 237 and 238 of the differential 206.

In the instant disclosure, only one pair of planet gears 209, 210 and 214, 215 are shown in each differential 205, 206, but additional identical pairs of such gears could be used without changing the affect or without departing from the spirit of the invention.

The illustrated gear sizes and direction of rotation of the gears in the carriage moving mechanism will now be described.

As previously explained, the carriage gear 154 and the clutch gears **155*a* and 156 are rotatable 1/120th of a revolution for each unitary (0.025 inch) step of carriage movement, and all carriage movements are commensurate with 0.025 inch (2, 3 or 4**, or more units).

In the illustrated embodiment, the gears in the differentials 205 and 206 are all of standard gears and are comprised of only three different sizes. The gears 208, 209, 213 and 214 are of one size, gears 210 and 216 are another size, and gears 211, and 215 are of still another size. Also, the construction is such that like size gears can be identical, including the size of the center holes, etc., even though the manner in which they are mounted are not the same in all cases as previously described.

The ratchet wheels 228 and 244 are identical and ratchet wheel 249 is similar thereto (the center hole being the only difference), and each of the three ratchet wheels 228, 224 and 249 and 120 teeth each. As will be more fully explained later, ratchet wheel 228 is operable two, three or four teeth at a time for causing normal carriage movement of two, three or four units, which movements correspond respectively to the differential letter, work and nut spacing. Ratchet wheel 244 is operable from one to twenty-three teeth at a time, simultaneously with a two teeth operation of ratchet wheel 228 for word spacing, for adding a respective quotient number of units to the normal word spacing for justifying purposes as will be explained hereinafter. As stated above, there is never more than a total of 23 units (equal to the fixed length justifying area) added to any justified line, regardless of the number of word spaces, and as the number of word spaces increase, the quotient amount decreases accordingly. Ratchet wheel 249 is never operated more than 1 tooth at a time and is operble for adding one more unit of movement to that caused by ratchet wheels 228 and 244 for a number of word spaces corresponding to the division remainder, as previously mentioned and as will be more fully explained hereinafter.

For each one tooth operation of any one of the ratchet wheels 228, 244 or 249, the clutch gears **155*a*** and 156, and the carriage drive gear 154 are operated 1/120th of a revolution, or one tooth operation of the clutch gears 155*a* and 156 and one unit rotation of the carriage drive gear 154 for a unit (0.025 inch) movement of the carriage 9*a*.

The combined transmission and differential gearing that brings about this proportional motion is accomplished by the interconnected differentials 205 and 206, which are illustratively equipped with gear sizes as follows:

Gears 210 and 216: 32 D.P., 30 teeth, and .9375 inch P.D.

211 and 215: 32 D.P., 60 teeth, and 1.875 inch P.D.

208, 209, 213 and 214: 32 D.P. 45 teeth, and 1.40625 P.D.

From the foregoing list of gear sizes and as can best be seen in FIG. 26, the ratios of the enmeshed gears 208 and 209 are one-to-one; gears 211 and 210 are two-to-one, respectively; gears 213 and 214 are one-to-one, and gears 216 and 215 are one-to-two, respectively.

In FIG. 26, the arrows indicate the direction of rotation of the ratchet wheels 228, 244 and 249 and their connected gear carriers, and the individual gears in a forward direction for advancing the carriage 9*a* as a line progresses. Rotation in the direction of the arrows will be referred to herein as being forward and contra directional rotation will be referred to as reverse, or a reverse direction.

A study of the motion resulting from a one tooth, 1/20th revolution, rotation of ratchet wheel 249 will be discussed first. In the interest of clarity and for easier understanding, it will be considered that the ratchet wheels 228, 244 and 249 are operated only independently, in other words, when one ratchet wheel is operated the others remain stationary.

When ratchet wheel 249 is rotated 1/20th of a revolution gear 216 is also rotated 1/120th of a revolution. Since gear 215 is meshed with gear 216 and it is twice the diameter of gear 216, gear 215 and gear 214 affixed thereto are rotated half as much or 1/240th of a revolution about their common axis. Gear 213 is meshed with gear 214 of the same size and it is, therefore, also rotated 1/240th of a revolution about its own axis. Since gears 213 and 211 are connected for rotation together, gear 211 is also rotated 1/240th of a revolution. Gear 211 being twice the size of the intermeshed gear 210, rotates gear 210 twice as much or, in other words, 1/120th of a revolution. The 1/120th revolution of gear 210, through the gear 209 connected for rotation therewith, drives gear 208, which is the same size as gear 209, 1/120th revolution. Since gear 208 and clutch gear 156 are connected for rotation together, the clutch gears 155*a* and 156 are rotated counterclockwise 1/120th of a revolution, which is the amount and direction the clutch gears 155*a* and 156 are rotated to cause a single unit of carriage movement, as previously explained.

When the ratchet wheel 244 is rotated one tooth, 1/120th of a revolution, the gear carrier of differential 206 is rotated therewith. If it were not for the epicyclic rotation of gears 215 and 214, the gear 213 would be rotated 1/120th of a revolution forwardly with the carrier. However, since gear 215 is moved bodily about relatively stationary gear 216 and since gear 215 is twice the size of gear 216, the gear 215 and the connected gear 214 are rotated 1/240th of a revolution in the reverse direction about their own axis. Since the carrier is moved forwardly 1/120th of a revolution and gear 214 is rotated reversely 1/240th of a revolution, the enmeshed gear 213 is rotated forwardly only the remaining 1/240th of a revolution. Since the gear 213 is rotated forwardly 1/240th of a revolution for one tooth operation of ratchet wheel 244 and since the gear 213 is rotated forwardly 1/240th of a revolution for one tooth operation of ratchet wheel 249 as previously explained, this forward 1/240th of a revolution is transmitted through the differential 205 in the same manner as for the one unit operation of ratchet wheel 249, as previously described, for rotating the clutch gears 155*a*, 156 and carriage gear 154 forwardly for moving the carriage 9*a* forwardly one unit.

When the ratchet wheel 228 is rotated forwardly one tooth, 1/120th of a revolution clockwise in the direction of the arrow, the gear carrier of differential 205 is rotated therewith. If it were not for the epicyclic rotation of the companion gears 210 and 209, the gear 208 would be rotated 1/120th of a revolution clockwise with the gear carrier. However, since gear 210 is moved bodily about the relatively stationary gear 211 and since gear 210 is half the size of gear 211, the gear 210 and the connected gear 209 are rotated 1/60th of a revolution forwardly about their own axis. Since the gear carrier is moved 1/120th of a revolution clockwise, which is reverse in respect to the rotation of gear 208, and since gear 209 is rotated forwardly 1/60th of a revolution, the enmeshed gear 208 is rotated forwardly 1/120th of a revolution, the other 1/120th of a revolution of gear 208 being counteracted by the contradirectional rotation of the gear carrier. Thus it is seen that the gear 208 is rotated 1/120th of a revolution forwardly for each one tooth forward operation of ratchet wheel 228, the same as it is moved for each corresponding operation of ratchet wheels 244 and 249 as previously explained. Also, as previously explained, 1/120th of a revolution of gear 208 results in the same rotation of the clutch gears 155*a*, 156 and the carriage gear 154 for moving the carriage 9*a* one unit or 0.025 of an inch.

Since, as just explained, the carriage 9*a* is moved one unit for a one tooth operation of any one of the ratchet wheels 228, 224 or 249 it can be understood that a multiple tooth operation of any one ratchet wheel 244 and 249 will result in the same number of units movement of the carriage 9*a* and that the result of the operation of one ratchet wheel 228, 244 or 249 will be added to the result of simultaneous operation of another or others of the ratchet wheels 228, 244 or 249. It should also be understood that simultaneous operation of more than one ratchet wheel 228, 244 or 249 will cause a single movement of the carriage 9*a* equal in units to the number of teeth accumulated on the operated ratchet wheels 228, 244 or 249.

The ratchet wheel 228 is provided for operating the carriage moving mechanism to shift the carriage 9*a* appropriately for the various size characters and spaces. The ratchet wheel 228 is normally held from rotating, primarily for preventing the carriage 9*a* from moving in the return direction under tension of the carriage return spring 138 previously described.

The ratchet wheel 228 may be rotated clockwise, in the direction of the arrow "F" (FIG. 29), two, three or four teeth at a time for causing the corresponding two, three and four units (0.050 inch, 0.075 inch and 0.100 inch) normal forward movements of the carriage 9*a* and it is so operated appropriately for these differential letter and word spaces, whether the reproducing machine is controlled automatically by the control tape 412 or it is controlled by manipulation of the keyboard keys 39, for example, as will be described. When the machine is being operated manually, the ratchet wheel 228 may also be controlled to permit the carriage return spring 138 to shift the carriage 9a differentially reversely two, three and four units during back spacing operations as will be described later. The structure of the mechanism for holding, and for rotating the ratchet wheel 228 clockwise during forward operations, will now be described.

A detent 255 (FIG. 29) is normally engaged with the teeth on ratchet wheel 228 for positively preventing reverse operation of the ratchet wheel 228 and for yieldably preventing forward operation of the ratchet wheel 228. Detent 255 is pivoted on a rod 256 (FIG. 4 and 29) that extends between and is secured to the plate 231 and to a plate 257. The plate 257 is supported on the rod 256 and on an identical rod 258 that is also secured on plates 231 and 257. The plate 257 is further supported on a rod 259 that is secured to plate 257, that extends through a hole therefor in plate 231 and that extends through and is secured in any known manner to plate 246 (FIG. 30). A torsion spring 260 (FIG. 29) is anchored on the plate 257 and it is connected to detent 255 for urging the detent 255 clockwise to the effective position shown.

A drive pawl 261 is pivoted on a rivet 262 which is secured on a bellcrank 263. The bellcrank 263 is pivoted on the sleeve 230 (FIG. 6) that is concentric with rod 149 as described. A contractile spring 264 (FIG. 29) is anchored on a stud 265 that is secured on plate 231, and it is connected to pawl 261 for urging the pawl 261 clockwise against the teeth of the ratchet wheel 228. The effect of spring 264, acting on pawl 261, also urges bellcrank 263 counterclockwise to normally rest against the rod 259 as shown. A link 266 is pivotally connected to the bellcrank 263 and to the armature of a motivating solenoid 267. Solenoid 267 is secured on a plate 268 which is secured on plates 231 and 246 (FIG. 5). Operation of solenoid 267 (FIG. 29) pulls link 266 rightwardly, and this rotates the bellcrank 263, moves the pawl 261 and rotates the ratchet wheel 228 clockwise about the axis of rod 149. The clockwise movement of pawl 261 is limited by its engagement with a stop 269, 270 or 271 for terminating the clockwise rotation of ratchet wheel 228 at the equivalent of a two, three or four teeth extent, respectively.

The stops 269 and 270 are shiftable from their illustrated effective positions counterclockwise to ineffective positions, while stop 271 is stationary. Stop 271 is secured to plates 231 and 257, as by bolts 272, and it extends between the plates 231 and 257 in engaging alignment with the end of pawl 261. The stops 269 and 270 are generally U-shaped, their ends being pivoted on the rod 259 and their joining portions normally being situated in engaging alignment with the end of pawl 261. A pair of relatively strong springs 273 and 274 are connected to a horizontal plate 275, and they are individually connected to the stops 269 and 270, respectively, for urging the stops 269 and 270 clockwise in their illustrated normal positions against a stud 276 that is secured on plate 231. The plate 275 is secured on and extends between the vertical plates 231 and 246 (FIG. 30).

When the pawl 261 (FIG. 29) is operated, an end surface 277 of the pawl 261 engages the first effective stop 269 and a surface 278 of the pawl 261 engages under the edge of the stop 269 for preventing ratcheting of the pawl 261 and preventing overrotation of the ratchet wheel 228 when the pawl 261 is stopped. Since the axis of pawl 261, on rivet 262, is at a greater radius, from the axis of rod 149, than its surface 277 on the pawl 261, the force of the impact of the surface 277 with one of the stops 269, 270 or 271 forces the pawl 261 harder against the teeth of ratchet wheel 228 for preventing clockwise overrotation of the ratchet wheel 228 when the pawl 261 is stopped after two, three or four teeth stops of the ratchet wheel 228. In addition to the leverage developed within the pawl 261 and its mounting for preventing overrotation, the surface 278 on the pawl 261 also latches under the effective stop 269, 270 or 271 for further assisting preventing of overrotation of the ratchet wheel 228. When the solenoid 267 is operated to drive the pawl 261 and ratchet wheel 228 the equivalent of two teeth on the ratchet wheel 228, the stop 269 is effective and the surface 277 is stopped thereagainst while the surface 278 latches under the edge of the stop 269 for adding the inertia of the stop 269 and the tension of its spring 273 to the tension of the spring 264 for preventing overrotation of the ratchet wheel 228 beyond two teeth movement. When the stop 269 is rendered ineffective as will be described presently and the stop 270 is effective, the surface 277 is stopped against stop 270 and the impact force drives the pawl 261 against the ratchet wheel 228 as described, and further the surface 278 is latched under the edge of stop 270 and the inertia of stop 270 and the tension of spring 274 is added to that of spring 264 for preventing overrotation of the ratchet wheel 228 beyond three teeth movement. When both stops 269 and 270 are rendered ineffective as will be described, the surface 277 is stopped against stop 271 and the surface 278 is latched under the edge of the stationary stop 271 for preventing rotation of the ratchet wheel 228 beyond the maximum four units (four teeth) movement.

As described, the shiftable stops 269 and 270 are normally held in effective position against stud 276 by their respective springs 273 and 274 as shown. The means for selectively rendering these stop 269 and 270 ineffective will now be described. A link 279 is pivotally connected to the stop 269 and to the armature of a solenoid 280 that is secured on the plate 275. A shorter link 281 is connected to the stop 270 and to the armature of a solenoid 282 that is also secured on the plate 275. A stud 283 is secured on the rearmost side portion of the U-shaped stop 270, and it extends forwardly under the rearward side portion of the U-shaped stop 269, so that counterclockwise movement of stop 270 will cause the stop 269 to be likewise moved therewith.

At times, the solenoid 267 is operated for rotating the ratchet wheel 228 two teeth for advancing the carriage 9a two units (0.050 inch) following imprinting of two unit characters and at other times for providing a two unit word or nut space, as the case may be, and, at such times the ratchet wheel 228 and pawl 261 are stopped by stop 269 as described. When a three unit (0.075 inch) character or nut space is provided, the solenoids 267 and 280 are operated together. In this second instance, the solenoid 267 operates ratchet wheel 228 as described, and the solenoid 280 pulls link 279 and rotates the two unit stop 269 counterclockwise to its ineffective position against tension of spring 273. In this second instance, the pawl 261 drives the ratchet wheel 228 three units and it is stopped against stop 270. In a third instance, the solenoid 267 is operated to drive the ratchet wheel 228 forwardly four teeth for a four unit carriage movement, and, at the same time, the solenoid 282 is operated to render both stops 269 and 270 ineffective. In this third instance, the pawl 261 is stopped against the stationary stop 271 for limiting the rotation of the ratchet wheel 228 to four teeth (four units). When the solenoid 282 is operated, it pulls link 281 for rotating the stop 270 counterclockwise, and by the stud 283 on the stop 270 the stop 269 is moved together with the stop 270 to the counterclockwise ineffective position. In each of the above instances, the detent 255 ratchets over the teeth of the ratchet wheel 228 for holding the ratchet wheel in its final position when the solenoid 267 is deenergized. Upon deenergization of solenoid 267, the pawl 261 ratchets counterclockwise while spring 264 returns the bellcrank 263 to the illustrated normal position. Following respective operations according to the second and third instances above, the solenoid 280 is deenergized to permit the spring 273 to restore stop 269 to effective position, and the solenoid 282 is deenergized to permit springs 273 and 274 to restore the stops 269 and 270 respectively, clockwise to their effective positions against stud 276 as shown.

In order to properly continue the sequences that include the three operational instances described in the preceding paragraph, a switch means 284 is provided for signalling the instant that the solenoid 267 completes its operation of shifting the pawl 261 against the first effective stop 269, 270 or 271. An arm 285 is an integral extension of bellcrank 263, and it carries a switch blade 286 that is insulated from the arm 285 and is secured thereto in a known manner. Blade 286 is tensed rearward to normally press ineffectively against the plate 231. An insulator 287 is secured generally on the rearward side of plate 231, by screws 288, and a rectangular central portion of the insulator 287 extends through a close fitting hole 289 in plate 231 so as to present a plane surface that is flush with the front plane surface of plate 231. Three pairs of contacts 290, 291; 292, 293 and 294, 295 are carried by the insulator 287 in positions so that the pairs are selectively engaged by the blade 286 when the bellcrank 263 and arm 285 are in the two, three and four unit operated positions, respectively.

As will be explained later, the contacts 290 and 291 are the only pair that is effective when the motivating solenoid 267 is operated alone. The contacts 292 and 293 are the only pair that is effective when the solenoids 267 and 280 are operated together. Contacts 294 and 295 are the only pair that is effective when the solenoids 267 and 282 are operated together. Therefore, current will pass through the blade 286 and the effective pair of contacts 290, 291; 292, 293, or 294, 295 as soon as the ratchet wheel 228 has been shifted forward two, three or four units, respectively, in a normal forward cycle of operations to be described later.

Structural details of mechanism for performing manually controlled back spacing operations of ratchet wheel 228 and the carriage **9*a*** will now be described.

As previously described, the spring means **125*a* (FIG. 21) exerts return and back-space directional force on the carriage 9*a*, and, as also explained, reverse directional rotation of ratchet wheel 228 (FIG. 29) is normally prevented by detent 255**.

During manually controlled back spacing operations, an escapement motivating solenoid 296 and stop solenoids 297 and 298 are utilized, instead of the forward movement and control solenoids 267, 280 and 282 that were described above. Likewise, a stationary stop 299 is utilized instead of the stationary stop 271.

In order to perform manually controlled back spacing operations in the reproducer, the operator must first shift a forward and back space control key 300 (FIG. 8) to the "back space" position, and then he must operate the character and space keys to effect the actual back space operations. When the key 300 is shifted to "back space" position, a solenoid 301 (FIG. 29) is automatically operated, as will be explained later, for rendering the forward drive pawl 261 ineffective. The solenoid 301 is secured on plate 231. A link 302 is pivotally connected to the armature of solenoid 301 and to a member 303 that is pivoted on the rod 259, between the end portions of the U-shaped stop 269. A finger 304 on member 303 is situated in engaging alignment with a stud 305 on pawl 261. A contractile spring 306 is connected to member 303 and to a latch member 307, for normally urging the member 303 and its finger 304 clockwise away from stud 305, and for urging the latch member 307 clockwise. Latch member 307 is pivoted on a screw 308 that is secured on plate 231. A stud 309 on latch member 307 is normally pressed clockwise against the member 303 as shown. When the solenoid 301 is energized, it pulls the link 302 and rotates the member 303 and its finger 304 counterclockwise, for pressing finger 304 against stud 305 and rotating pawl 261 to ineffective position, clear of the teeth on ratchet wheel 228. At about the time when solenoid 301 is fully operated, the latch member 307 is snapped clockwise, by spring 306, as its stud 309 shifts over a latching surface 310 on member 303 for holding member 303 in operated position and for thus holding pawl 261 in its ineffective position during back spacing operations.

When the solenoid 301 is operated, an insulator 311 on the lower end of the armature of the solenoid 301 closes a normally open switch 312, and the switch 312 is held closed during back spacing operations, in preparation for restoring the just described back space conditioning mechanism as will be explained later. The switch 312 is secured on plate 231.

A link 313 is pivotally connected to the latch member 307 and to the armature of a solenoid 314 that is secured on plate 231. An insulator 315 is secured on the lower end of the armature of solenoid 314, and, in the illustrated normal position of the parts, the insulator 315 holds a switch 316 in closed condition. The switch 316 is secured on the rearward face of plate 231, in any well known manner, and the blades of the switch 316 are angled forwardly under the insulator 315. When the spring 306 shifts the stud 309 clockwise into latching position as described, the latch member 307 pulls the link 313, the armature of solenoid 314 and the insulator 315 upward for permitting the switch 316 to open. When the switch 316 opens, it breaks the circuit through the solenoid 301 as will be explained later. However, from the foregoing, it can be seen that operation of solenoid 301 renders the forward drive pawl 261 ineffective, it closes the switch 312 and, through the latching of member 303 in operated positions, the solenoid 301 indirectly causes the switch 316 to open. Moreover, it can be seen that the switch 316 opens appropriately for deenergizing solenoid 301, when the solenoid 301 is fully operated for conditioning the carriage moving mechanism to perform back spacing operations.

The escapement mechanism operated by solenoid 296 and controlled by stop solenoids 297 and 298 will now be described. Solenoid 296 is secured on plate 257, and a link 317 is pivotally connected to the armature of the solenoid 296 and to a bellcrank 318. The bellcrank 318 is pivoted on the rod 256, just to the rear of the detent 255 which serves as a part of the back space escapement mechanism in addition to the previously described detent function. A stud 319 is secured on and extends rearward from the bellcrank 318. A similar stud 320 is secured on and extends rearward from detent 255. The studs 319 and 320 may be equipped with antifrictional rollers 319a and 320a respectively as may be desired. The studs 319 and 320 extend respectively under and over a finger 321 that is a part of an escapement pawl 322. Pawl 322 is pivoted on a rivet 323 that is secured on a member 324. Member 324 is pivoted on the sleeve 230 (FIG. 6) which is concentric with rod 149 and which is concentric with the axis of ratchet wheel 228. A contractile spring 325 (FIG. 29) is connected to member 324 and to a stud 326, that is secured on plate 231, for urging the member 324 clockwise to normally rest against rest against a stud 327, that is also secured on plate 231. A contractile spring 328 is connected to the member 324 and to the pawl 322 for urging the pawl 322 counterclockwise, in the normal position, where its finger 321 presses down on stud 319 for yieldably holding the bellcrank 318 in clockwise position against a stud 329 secured on plate 231. The pawl 322 extends forwardly over the teeth on ratchet wheel 228, and, normally as shown, the pawl 322 is held clear of the teeth. Also, in the illustrated normal position of member 324, the pawl 322 is poised in a half step position in respect to the next clockwise tooth on ratchet wheel 228.

The stop solenoids 297 and 298 are secured on the rearward side of the plate 231. Preferably, the forward ends of the solenoids 297 and 298 are equipped with bushings 330 and 331, respectively, and the bushings 330 and 331 have male threads that are secured in threaded holes therefor in the plate 231. The solenoids 297 and 298 comprise forward end core stops 332 and 333, respectively, that are normally withdrawn rearward in any known manner sufficiently to be at least flush with the forward end of their bushings 330 and 331 as well as being generally flush with the forward face of plate 231. When a solenoid 297 or 298 is energized, it extends its stop 332 or 333, respectively, forward though its bushing 330 or 331 sufficiently to be in blocking alignment with counterclockwise movement of an arm 334. Arm 334 is an integral part of the member 324. The stop 332 is located arcuately the proportional equivalent of one unit (one tooth) step of the ratchet wheel 228 away from arm 334, and the stop 333 is located two units away from the arm 334. Also, the stationary stop 299 is located three units from member 324.

When the machine is conditioned for back spacing and a two unit character or space key is manipulated, the solenoids 296 and 297 are energized by circuitry to be described later. However, when these solenoids 296 and 297 are energized, the solenoid 297 extends its stop 332 into blocking position, and the solenoid 296 pulls link 317 and rotates the bellcrank 318 counterclockwise for moving stud 319 upward. Upward movement of stud 319 pushes the finger 321 and stud 320 generally upward for rotating the pawl 322 clockwise and the detent 255 counterclockwise. Clockwise rotation of pawl 322 lowers it against the ratchet wheel 228, and counterclockwise rotation of detent 255 disengages it from a tooth on the ratchet wheel 228. It should be noted that the pawl 322 is partially engaged between a pair of teeth on the ratchet wheel 228, before the detent 255 is fully disengaged. When the detent 255 is shifted clear of a tooth on the ratchet wheel 228, the carriage return spring 138 shifts the carriage 9a reversely and the ratchet wheel 228 reversely (counterclockwise), and the action created by solenoid 296 is limited only by full engagement of the pawl 322 at the root of the next clockwise tooth of the ratchet wheel 228. When the pawl 322 is shifted fully clockwise, the top and bottom edge surfaces of its finger 321 are arcuately concentric with the axes of the member 324 and ratchet wheel 228. As the ratchet wheel 228 rotates counterclockwise, it first moves freely one half of a tooth, then it engages the pawl 322 and moves the pawl 322 and member 324 the equivalent of one more tooth, at which point the action is interrupted by engagement of arm 334 with the now effective stop 332. Thus, the ratchet wheel 228 is rotated one and one half teeth reversely and the ratchet wheel 228 is in a half step position in respect to detent 255. When the solenoids 296 and 297 are deenergized, as will be described later, the stop 332 is held in effective position by the force of arm 334 thereagainst while the spring 260 returns the detent 255. Clockwise return of detent 255 presses its stud 320 down on finger 321 for restoring pawl 322 counterclockwise and for pressing the finger 321 down on stud 319 until the bellcrank 318 is stopped against stud 329. As the detent 255 engages between teeth on the ratchet wheel 228, the pawl 322 begins to withdraw from a tooth on the ratchet wheel 228 and, when the pawl 322 disengages, the ratchet wheel 228 rotates the remaining one half a tooth against the detent 255 for completing its two units of rotation and for thus permitting the carriage 9a to complete its two unit back space movement. Also, when the pawl 322 is thus disengaged from the ratchet wheel 228, the spring 325 restores the member 324 and arm 334 clockwise to normal position where member 324 is stopped against stud 327 as shown. As the arm 334 moves away from stop 332, the stop 332 withdraws to its ineffective position. Thus, the carriage 9a is back spaced appropriately for a two unit character or space, and the escapement mechanism is restored to the illustrated normal condition.

When the machine is conditioned for back spacing and a three unit character or space key is manipulated, the solenoids 296 and 298 are energized, as will be described later. Energization of solenoid 298 causes its stop 333 to be shifted into blocking position and solenoid 296 operates the escapement pawl 322 and detent 255 in the same manner as described above for a two unit back spacing operation. When the detent 255 releases the ratchet wheel 228, the carriage return spring 138 shifts the carriage 9a and the ratchet wheel 228 reversely, and the ratchet wheel 228 first moves freely one half of a tooth where the next tooth on the ratchet wheel 228 then moves pawl 322 and member 324 the equivalent of two teeth, where the arm 334 is stopped by the effective stop 333. Thus, the ratchet wheel 228 has moved two and a half teeth reversely, and the ratchet wheel 228 is in a half step position relative to detent 255. When solenoids 296 and 298 are deenergized, the detent 255 reengages ratchet wheel 228 and pawl 322 releases the ratchet wheel 228 and the ratchet wheel 228 rotates the remaining half a tooth against the detent 255 for completing its three units of rotation and for thus controlling the carriage 9a in a three unit back space operation. As explained in the previous example condition, return of the pawl 322 to its counterclockwise position permits the spring 325 to return member 324 and arm 334, and the stop 333 is thereby freed and it returns to its ineffective position. Thus, the carriage 9a is back spaced for a three unit character or space and the escapement mechanism is restored to normal.

When the machine is conditioned for back spacing and a four unit character or space key is manipulated, the solenoid 296 operates the escapement pawl 322 and detent 255 as described previously, and, upon disengagement of the detent 255 from the ratchet wheel 228, the carriage 9a and the ratchet wheel 228 are shifted reversely. Whereupon, the ratchet wheel 228 first moves freely a half tooth and the next tooth then moves pawl 322 and member 324 the equivalent of three teeth, and this action is terminated upon engagement of the member 324 with the stationary stop 299 that is secured on plate 231. Thus, the carriage 9a and ratchet wheel 228 have moved three and a half units and the wheel 228 is in a half step position relative to detent 255. When solenoid 296 is deenergized, the detent 255 reengages the ratchet wheel 228 and pawl 322 releases the ratchet wheel 228 which then rotates the remaining half a tooth against the detent 255 for thus controlling the carriage 9a to complete a four unit back space movement. When pawl 322 releases ratchet wheel 228, the spring 325 returns member 324 against stud 327, and the escapement mechanism is again in the illustrated normal condition.

The operator may return the forward and back space control key 300 (FIG. 8) to "forward" position, for restoring the machine to normal forward operation condition. When he does this, a circuit, that will be fully described later, passes through the then closed switch 312 (FIG. 29) and the solenoid 314. Operation of solenoid 314 causes its insulator 315 to close the switch 316 in preparation of a future back space conditioning operation as will be described, and the solenoid 314 pulls link 313 and rotates member 307 counterclockwise against tension of spring 306 for shifting the stud 309 off of surface 310. When this occurs, spring 306 rotates member 303 clockwise for pulling the link 302 upward and for permitting the spring 264 to reengage the forward drive pawl 261 to the illustrated normal position against the ratchet wheel 228. Upward movement of link 302 pulls the armature of solenoid 301 and the insulator 311 upward for permitting the switch 312 to open and for thereby breaking the circuit through solenoid 314. At this point, the mechanism is again conditioned for normal forward operations.

The ratchet wheel 244 (FIG. 26) is operable forwardly only (counterclockwise, in the direction of the arrow) and it is operated for justifying purposes only. In this particular embodiment, ratchet wheel 244 is operated simultaneously with ratchet wheel 228, only when the ratchet wheel 228 is operated for forward word spaces and only when the reproducer is operated automatically according to precoded information on the control tape 412. In this embodiment, the justifying amounts are added to word spaces only, but the invention can be adapted to add the justifying amounts to letter spaces only or to both letter spaces and word spaces without department from the spirit of the invention.

As will be fully explained later, the first code for a line may be a quotient code and such a quotient code will cause control mechanism to be set for controlling the ratchet wheel 244 (FIG. 30) to add the quotient amount (number of units) to word spaces in that line. When the control mechanism is set to a position representing one or more units and the reproducer is operated according to a word space code, the ratchet wheel 244 is operated for adding the number of units that correspond to the quotient of the amount left over in the unjustified line on the composer divided by the number of word spaces in that line, to the word space for justifying purposes in the reproducer.

The control mechanism for limiting the number of teeth (number of units) extent of the operations of the ratchet wheel 244 will now be described. An adjustable stop member 335 is pivoted on the sleeve spacer 243 (FIG. 6) concentrically with the axis of rod 149 and ratchet wheel 244 (FIG. 30). A torsion spring 336 is connected to member 335 and to a stud 337, that is secured on plate 246, for rotating the member 335 clockwise to the illustrated normal position against a rod 338. The rod 338 is secured on plate 246 and on plate 231 (FIG. 29).

A solenoid 339 (FIG. 30) is provided for setting the stop member 335 in an operated position. Solenoid 339 is secured on the plate 275, and a link 340 is pivotally connected to the armature of the solenoid 339 and to the member 335.

When the solenoid 339 is energized, it pulls link 340 and rotates the stop member 335 counterclockwise to one of twenty-three operated positions. As stated above, there is never more than a total of 23 units (equal to the fixed length justifying area) added to any justified line, regardless of the number of word spaces, and as the number of word spaces increase, the quotient amount decreases accordingly. Twenty two stop solenoids 341, with respective suffix numbers 1–22, are arranged in positions corresponding to the first twenty two operated positions of the stop member 335. The solenoids 341 are secured on the rearward face of the plate 246, and their normally ineffective stops 342 extend forwardly generally no more than flush with the forward face of the plate 246, in a manner similar to that described for solenoids 297 and 298 (FIG. 29). The arrangement is such that, upon operation of a solenoid 341 (FIG. 30), its respective stop 342 is extended forwardly into blocking alignment with counterclockwise movement of member 335 for stopping the member 335 in the respective operated position. Upon deenergization of a solenoid 341, its stop 342 is withdrawn to ineffective position, in a known manner. A stud 343 is secured on plate 246 and it extends forwardly in blocking position for stopping member 335 in the twenty third (last) operated position.

A locking pawl 344 is normally engaged with a segment of mating teeth 345 on the stop member 335 for preventing rotation of the member 335 and for thus holding the member 335 in one of its 24 positions (normal position or an operated position 1-23). Pawl 344 is pivoted on a stud 346 that is secured on the plate 246. In the illustrated position of pawl 344, a stud 347 on the pawl 344 is latched by a pawl 348 for preventing disengagement of pawl 344. Pawl 348 is pivoted on a screw 349 that is secured on plate 246. A spring 350 is connected to pawl 348 and to the plate 246 for urging the pawl 348 into latching position as shown. A link 351 is pivotally connected to pawl 348 and to the armature of a solenoid 352, which is provided for disengaging the latch pawl 348 as will be explained. A member 353 with a customary spacing hub is pivoted on the stud 346 forward of the pawl 344. A relatively heavy torsion spring 354 is assembled on the hub of member 353, and it is connected to the member 353 and to the stud 347 for normally urging the member 353 counterclockwise against the stud 347. A stud 355 is secured on the depending arm of member 353. A link 356 is pivoted on stud 355, and it is also pivotally connected to the armature of a solenoid 357 that is secured on plate 246. A contractile spring 358 is connected to stud 355 and to a stud 359 that is secured on plate 246. An insulator 360 is secured on member 353 in engaging alignment with a normally open switch 361 that is secured on plate 246. A stud 362 is secured on member 353 and a pawl 363 is normally urged against the stud 362 as shown. Pawl 363 is pivoted on a screw 364 that is secured on plate 246, and a torsion spring 365 is connected to the pawl 363 and to plate 246 for urging the pawl 363 counterclockwise. A link 366 is pivotally connected to pawl 363 and to the armature of a solenoid 367 that is secured on plate 246. In the illustrated normal position of pawl 363, an insulator 368, secured on the pawl 363 holds a switch 369 closed as shown. The normally closed switch 369 is secured on plate 246, and it is connected in a reader control circuit that will be described later.

The arrangement is such that, upon completion of a line and return of the carriage 9*a* the solenoid 352 is energized, by circuitry to be described later. However, upon operation of solenoid 352, the solenoid 352 pulls link 351 and rotates pawl 348 counterclockwise against a rod 370. Rod 370 is secured on and extends between the plate 231 (FIG. 29) and the plate 246 (FIG. 30). Counterclockwise rotation of pawl 348 releases stud 347, and permits the spring 358 to rotate member 353, stud 347 and locking pawl 344 to ineffective position against rod 370. Disengagement of pawl 344 from teeth 345 permits the spring 336 to restore the stop member 335 clockwise to the illustrated normal position against rod 338. Thus, the stop member 335 is restored to normal position, and the locking pawl 344 is disengaged so that the member 335 may again be set counterclockwise for an ensuing line. As ill be explained hereinafter, return of the carriage 9*a* may cause the control tape 412 and the codes for an ensuing line to be fed into the main reader 407, and the first code for the new line may be a quotient code. When a quotient code is read and the main decoder 494 is operated accordingly, the solenoid 339 is operated together with a stop 342 (1–22) or it may be operated alone, for rotating the member 335 a number of increments from one to twenty two, or to twenty three, respectively, as described, for setting the member 335 in a particular quotient representing position. As stated above, there is never more than a total of 23 units (equal to the fixed length justifying area) added to any justified line, regardless of the number of word spaces, and as the number of word spaces increase, the quotient amount decreases accordingly. When the member 335 is thus positioned, a switching means is effective for completing the setting sequences as will now be described.

A blade 371 is secured on and it is insulated from the end of member 335, in a known manner. Blade 371 is flexed rearward and it is arranged to engage a conductor strip 372 and successive contacts 373 when member 335 is moved to operated positions 1 to 23, as described. The strip 372 and individual contacts 373 (1–23) are mounted on an arcuately shaped insulator 374 that is secured on the plate 246. Suffix numbers 1 – 23 are associated with the individual contacts 373, and the respective contacts 373, 1–23 are situated to be individually engaged by the lower end of the blade 371, when the member 335 is stopped by a respective stop 342 - 1 to 342 - 22 or 343, in the operated positions 1 - 23 of the stop member 335. As will be described later in connection with circuit diagrams, each contact 373 - 1 to 373 - 23 is effective only when the member 335 is moved to and stopped in the corresponding operated position. Also, as will be explained later, the solenoid 357 is connected in circuit with the conductor strip 372 and, thus, the solenoid 357 is operated as soon as the blade 371 is engaged with an effective contact 373 and the member 335 is stopped in an operated position corresponding to the quotient code.

When the solenoid 357 is operated, it pulls link 356, rotates member 353 clockwise and by tension of strong spring 354 the locking pawl 344 is engaged with teeth 345 for locking the member 335 in operated position. As soon as pawl 344 is shifted to locking position, the pawl 348 is shifted to the illustrated latching position. When the pawl 344 is stopped by teeth 345, the member 353 is rotated a bit further by solenoid 357 against tension of spring 354 for closing the switch 361. When the member 353 is rotated clockwise sufficiently to assure full engagement of switch 361, the pawl 363 latches counterclockwise over stud 362, under tension of spring 365, for permitting the switch 369 to open, and for latching member 353 in operated position and thereby holding switch 361 closed.

The opening of reader control circuit switch 369 breaks the main reading circuit and thereby deenergizes the main decoder 494 which then deenergizes the solenoid 339, any operated stop solenoid 341 and the solenoid 357, as will be described later. Breaking of the main reading circuit causes the quotient code to be fed out of the main reader 407 and completion of this tape feeding operation causes a circuit that runs through the now closed switch 361 and the solenoid 367 to be completed, as will be explained later. Thus, the solenoid 367 is operated to pull link 366 and rotate pawl 363 clockwise for closing switch 369 and for releasing stud 362. Closure of switch 369 remakes the main reading circuit for reading the next code in the line, as will be explained. The release of stud 362 permits springs 354 and 358 to return the member 353 counterclockwise against the stud 347 for permitting the switch 361 to open and to thereby deenergize the solenoid 367.

In the just described manner the stop member 335 may be rotated and locked in an operated position corresponding to a quotient code, and tape handling and main reading circuitry is controlled by completion of the stop setting operations as will be described more fully hereinafter. As stated above, there is never more than a total of 23 units (equal to the fixed length justifying area) added to any justified line, regardless of the number of word spaces, and as the number of word spaces increase, the quotient amount decreases accordingly.

The manner in which the ratchet wheel 244 may be rotated for adding a predetermined justifying quotient amount to each normal word space will now be described. A motivating solenoid 375 (FIG. 5) is secured on the plate 231. A link 376 (FIG. 30) is pivotally connected to the armature of solenoid 375 and to a member 377 that is pivoted on the sleeve spacer 243 (FIG. 6) concentric with the rod 149 (FIG. 30). A drive pawl 378 is pivotally mounted on the member 377 and it is urged against ratchet wheel 244 by a contractile spring 379 that is connected to the pawl 378 and to the member 377. A torsion spring 380 is connected to the stud 337 and to the member 377 for urging the member 377 clockwise to normal position against rod 338 as shown.

A stop stud 381 is secured on the adjustable stop member 335, and it is thus shiftable to quotient representing positions with the member 335. A curved surface 382 on the upper end of pawl 378 is formed to abut the stud 381 and to shift slightly under the stud 381 (between stud 381 and the ratchet wheel 244), when the pawl 378 is moved against the stud 381.

The arrangement is such that, when the member 335 is set in a counterclockwise quotient representing position (1 - 23) as described, operation of solenoid 375 pulls link 376, rotates member 377 and the pawl 378 rotates the ratchet wheel 244 counterclockwise (forwardly as described) a number of teeth corresponding to the quotient amount. At the end of this motion, the pawl 378 engages the stud 381, and the surface 382 in cooperation with the stud 381 prevents overrotation of the ratchet wheel 244 beyond the quotient representing amount.

When the ratchet wheel 244 is rotated the quotient amount, as just described, a switch means is closed to signal the completion of that operation. A conductor 383 is insulated from and it is secured on the member 377. A pair of identical blades 384 and 385 are insulated from each other and from the member 335 on which the blades 384 and 385 are secured. Another pair of blades 386 and 387 are secured on member 335, and they are also insulated from each other and from the member 335. The blade 384 and blade 386 are conductively connected directly with each other, and the blades 385 and 387 are connected as by a small bit of wire 388. The leftward ends of blades 386 and 387 are flexed rearward, through a → hole 389 in the member 335 and through a hole 390 in the plate 246, and they respectively engage arcuate conductors 391 and 392 in all positions of the member 335 on which the blades 386 and 387 are mounted as described. The conductors 391 and 392 are secured on insulators 393 and 394 that are secured on the rearward side of plate 246. When the stop member 335 is rotated and locked in a counterclockwise quotient representing position as described, the blades 384 and 385 are shifted with the stop member 335 the same amount away from the conductor 383. Thereafter, during reproduction of the line, when the solenoid 375 is operated to add the quotient amount to the normal word space as described, the conductor 383 will engage the blades 384 and 385 at about the time the ratchet wheel 244 is operated the quotient amount and the drive pawl 378 is stopped against the stud 381. Thus, as soon as ratchet wheel 244 is operated the quotient amount, the conductor 383 is engaged with the blades 384 and 385. When this occurs, a circuit to be described fully hereinafter is complete through the conductor 391, blade 386, blade 384, conductor 383, blade 385, wire 388, blade 387 and conductor 392 for signalling the completion of the operation and for continuing the sequences of the operation as will be explained later. It can also be seen that deenergization of solenoid 375 permits spring 380 to restore member 377 and conductor 383 clockwise for breaking the circuit between blades 384 and 385.

A detent 395 is pivoted on the rod 259 and it is urged against ratchet wheel 244 by a spring 396 connected to the detent 395 and anchored in a known manner. When the ratchet wheel 244 is operated counterclockwise to add the quotient amount, the detent 395 ratchets over the teeth on the ratchet wheel 244 and, at other times, the detent 395 prevents reverse rotation of the ratchet wheel 244. For example, when the solenoid 375 is deenergized and spring 380 returns member 377 against rod 338, the pawl 378 ratchets clockwise over the teeth on ratchet wheel 244, while the detent 395 holds the ratchet wheel 244 in its operated position.

The ratchet wheel 249 (FIGS. 7 and 26) is operable forwardly (counterclockwise) only, and it is operable only one tooth at a time for adding one unit to each word space for as many word spaces as correspond to the remainder in a justifying computation, as will be described later. As stated above, there is never more than a total of 23 units (equal to the fixed length justifying area) added to any justified line, regardless of the number of word spaces, and as the number of word spaces increase, the quotient amount decreases accordingly.

A motivating solenoid 397 (FIGS. 30 and 7) is secured on the rearward side of plate 231 (FIGS. 4, 5 and 29). A link 398 (FIG. 7) is pivotally connected to the armature of solenoid 397 and to a member 399 that is pivoted on the rod 149 (FIG. 6). A drive pawl 400 (FIG. 7) is pivotally mounted on the member 399, and a contractile spring 401 is connected to pawl 400 and to member 399 for urging the pawl 400 against ratchet wheel 249. A torsion spring 402 is anchored on the frame 9 and it is connected to member 399 for urging the member 399 clockwise in normal position against the rearward extension of stationary rod 338. A stationary stud 403 is secured on plate 246 (FIG. 5) in a position for stopping pawl 400 (FIG. 7) when the pawl 400 has shifted ratchet wheel 249 one tooth (one unit) counterclockwise. A curved surface 404 on the end of pawl 400 is arranged to abut stud 403 and to engage under the stud 403 for preventing overrotation of the ratchet wheel 249 at the end of the one step movement. A detent 405 is pivoted on the rod 259, and a torsion spring 406 is connected to detent 405 and anchored in any manner for urging the detent 405 counterclockwise and for holding ratchet wheel 249 in its last operated position.

Operation of solenoid 397 pulls link 398, rotates member 399, moves drive pawl 400 and rotates ratchet wheel 249 counterclockwise, while the detent 405 ratchets one tooth. At the end of one tooth rotation of ratchet wheel 249, the stud 403 stops the pawl 400 and the ratchet wheel 249 in operated position. When the solenoid 397 is deenergized as will be described, the spring 402 restores the drive mechanism generally clockwise to the illustrated normal position where the member 399 is stopped against the rod 338. The solenoid 397 is operated simultaneously with the solenoid 267 (FIG. 29) for adding one unit to the normal two unit word space, respectively, as will be described later.

4. STRUCTURE IN THE MAIN READER CIRCUIT

As described in our copending application in THE UNITED STATES PATENT OFFICE, for "Justifying, Text Writing Composing Machine", Ser. No. 213,045, filed Dec. 28, 1971, our combined arrangement of the "Composing Machine" of the copending application Ser. No. 213,045, filed Dec. 28, 1971, and the "Reproducing Machine" of the instant application includes a text and general function encoding means, a back space and deleting reading device for correction purposes, justifying encoding means and a main reading device for controlling reproducing operations, arranged in that order in respect to the flow of code media therethrough, together with slack code media sensing means and automatic media handling means, are assembled into a single unit for performance of automatic encoding, automatic deleting, and automatic justifying reproducing operations without any manual handling of the code media. The "single unit" encoding and reading assembly is preferably secured as a sub-assembly on the composing machine, of the application, Ser. No. 213,045, filed Dec. 28, 1971, and the main reader of the "single unit" is connected to the reproducing machine, of the instant application, by wires, or by wires and communication means such as teletype, radio, or any other means capable of transmitting codified information, all as discussed thoroughly in the application. Ser. No. 213,045, filed Dec. 28, 1971. It should also be understood that a reproducing machine of the instant application may have an attached main reading device for controlling the reproducing machine according to previously encoded media. However, to avoid repetitious description, the "single unit" encoding and reading assembly will be herein considered as being on the composing machine of the copending application, Ser. No. 213,045, filed Dec. 28, 1971, and the main reader thereof as being simply connected to the reproducing machine by wires.

This and the next several sub-topics are devoted to the structures that are included in a code media reading circuit to be described later.

Punched tape is the type of code media chosen as exemplary. Since the main reader 407 (FIG. 31), the related type feed mechanism 408 and the slack tape sensing means 409 were described thoroughly in the above mentioned application, Ser. No. 213,045, filed Dec. 28, 1971, they will be described briefly herein.

a. Main Reader

The main reader 407 is comprised primarily of seven channel related sensing springs 410 that are arranged to individually sense a common conductor plate 411 through any aligned channel related code punch holes on a control tape 412 that is shiftable therethrough. When no code punch holes are aligned with the sensing springs 410, the tape 412 insulates the sensing springs from the plate 411.

b. Slack Tape Sensing Means

In the composing maching of our application, Ser. No. 213,045, filed Dec. 28, 1971, encoded tape 412 is accumulated in a line storage buffer or loop 413, ready for reproducing purposes. When a buffer loop 413 is formed, the slack tape sensing means 409 closes a switch 414, whereupon the reproducing machine may operate according to the codes in the loop 413, as will be explained. When the loop 423 is eliminated, by completion of the work in the reproducing machine, the tape 412 is drawn down and the slack tape sensing means 409 opens the switch 414 for delaying further operation of the reproducing machine, until further material is encoded by the composing machine and the new material is fed into the loop buffer 413 as described in the application, Ser. No. 213,045, filed Dec. 28, 1971.

c. Main Reader Tape Feed Mechanism

The main reader'tape feed mechanism 408 is comprised primarily of a rotatable ratchet wheel and sprocket means 415 that is operable for advancing the tape 412 one code space increment per operation in the direction of the arrow, and this tape feed mechanism 408 also includes a drive pawl 416, a cocking solenoid 417, and a pair of normally closed switches 418 and 419. The arrangement is such that, upon operation of solenoid 417, the pawl 416 is ratcheted one tooth on the ratchet wheel of the ratchet wheel and sprocket means 415, and the switches 418 and 419 are snapped open at the end of the stroke. Upon deenergization of solenoid 417, a return spring 420 returns the drive pawl 416 for rotating the ratchet wheel and sprocket means 415 one tooth clockwise and thereby feeding the control tape 412 one step forward, and the spring 420 also returns the mechanism 408 for closing the switches 418 and 419 at the end of the return stroke. From the foregoing, it can be understood that, upon energization of solenoid 417, the switches 418 and 419 are opened, and that, upon deenergization of solenoid 417, the pawl 416 and ratchet wheel and sprocket means 415 advance the tape 412 one step forward and the switches 418 and 419 are again closed.

d. Automatic Feed-Read Switch Means

A feed-read switch means 421 will now be described. As described in our application, Ser. No. 213,045, filed Dec. 28, 1971, blank (uncoded) space is provided on the control tape 412 between the justifying codes at the beginning of a line of encoded information and the first text code of the line, and also blank space is provided on the control tape 412 between a carriage return code at the end of the line and the first code for an ensuing line. Thus, the word "feed", of the feed-read switch means 421 refers to the condition where the tape feed mechanism 408 must be controlled to feed consecutive steps of blank tape 412. Similarly, the word "read" refers to the condition where the main reader 407 reads a code and the operations of the tape feed mechanism 408 must be coordinated with the performance of the reproducing machine as controlled by consecutive codes on the tape 412 as will be fully described later herein.

A "READ" solenoid 422 is secured on the plate 31 (FIG. 2). An insulator 423 is secured on one end of the solenoid's armature and an insulator 424 is secured on an extension of the other end of the armature. A spring 425 is mounted on the armature between the solenoid body and the insulator 423 for normally holding the armature and its insulators 423 and 424 in the illustrated leftward position. A normally closed switch 426 is secured on plate 31 in alignment with insulator 423 for being opened thereby upon operation of the solenoid 422. A switch 427 is secured on plate 31 in position to be normally held open by insulator 424 as shown. A latch means 428 is pivoted on a stud 429 that is secured on plate 31. A torsion spring 430 is connected to latch means 428 for normally urging the latch means 428 clockwise against insulator 423. A "feed" solenoid 431 is secured on plate 31 and a link 432 is pivotally connected to the armature of the solenoid 431 and to the latch means 428 for rotating the latch means 428 counterclockwise against tension of spring 430 upon operation of the solenoid 431.

The arrangement is such that operation of the "read" solenoid 422 shifts the insulators 423 and 424 rightward, for opening switch 426 and permitting switch 427 to close, respectively. When switches 426 and 427 are fully shifted, as just described, the spring 430 shifts the latch means 428 into effective position for holding the insulators 423 and 424 and switches 426 and 427 in shifted position. As will be explained later, the latch means 428 may hold the mechanism in operated position throughout a number of consecutive reading cycles. However, following reading of a justifying code or a carriage return code and the resulting operation of the composing machine, the "feed" solenoid 431 is energized by a circuit to be described later. Operation of solenoid 431 pulls link 432 and rotates the latch means 428 against tension of spring 430 to release the insulator 423. Whereupon, the spring 425 restores the armature of solenoid 422 and the insulators 423 and 424 leftward for opening the switch 427 and permitting the switch 426 to close, as shown.

e. Main Reader Control Key

A reader control key 433 (FIG. 8 and 31) is shiftable from the illustrated normal rearward "start" position to a forward "stop" position for manually terminating the main reading processes, and thereby stopping code controlled operations of the reproducing machine. Provision is also made for automatically shifting the key 433 to the "stop" position in response to a stop-printer code on the control tape 412, as will be explained later. Paper may be changed in the paper carriage 9*a* of the reproducing machine, and also the reproducing machine may be operated manually for adding personalized names, addresses etc., in a code controlled form letter or for operating the reproducing machine as an ordinary typewriter, when the reader control key 433 is in the "stop" position. When the machine is ready for further code controlled operations (for example, new paper is properly inserted in the carriage 9*a* and the left margin stop 1067 is set to locate the column), the operator may return the reader control key 433 to the "start" position for initiating reader controlled operations, as will be described later herein.

The reader control key 433 (FIGS. 9 and 32) is pivoted on a bolt 434 that is secured on the frame plate 19. A bellcrank 435 (FIG. 32) is also pivoted on the bolt 434. A contractile spring 436 is connected to leftwardly extending studs 437 and 438 that are respectively secured on the key 433 and the bellcrank 435. When the key 433 is shifted counterclockwise to the illustrated "start" position, the spring 436 holds the key 433 counterclockwise against the transverse rod 24, and, since the centerline of spring 436 is then to the left of pivot bolt 434, the bellcrank 435 is snapped clockwise against the rod 23 by the spring 436. When the key 433 is shifted clockwise to the "stop" position, the centerline of spring 436 is shifted to the right of bolt 434 for holding the key 433 against the rod 21 and for snapping the bellcrank 435 counterclockwise against the rod 22. The rods 21 - 24 are secured on and they extend between the frame plates 19 and 20 (FIG. 9) as previously described.

A bell 439 (FIG. 32) is sounded whenever the key 433 is shifted to "stop" position. This audible signal indicates that the machine has stopped reproducing operations as will be explained, and the signal is particularly helpful to alert an operator who may be involved in other work at a time when the reader control key 433 is shifted to "stop" position as a result of a stop printer code on the control tape 412. When a stop printer code is read by the main reader 407, a solenoid 440 is energized, as will be described later. Solenoid 440 is secured on the plate 19, and a link 441 is pivotally connected to the armature of the solenoid 440 and to a downward extension of the key 433. Operation of solenoid 440 pulls link 441 and rotates the key 433 clockwise against rod 21, and this causes the spring 436 to snap the bellcrank 435 counterclockwise against rod 22 as described. The upper end of a clapper support wire 442 is secured on bellcrank 435 and a clapper 443 is secured on the lower free end of the wire 442. The arrangement is such that the rapid counterclockwise rotation of bellcrank 435 moves the wire 442 and clapper 443 therewith, and when the bellcrank 435 is abruptly stopped against rod 22, the weight and momentum of the clapper 443 springs the wire 442 to permit the clapper 443 to strike and ring the bell 439. The bell 439 is secured on an angle bracket 444 as by a rivet 445, and the bracket 444 is secured on plate 19, in any well known manner.

When the reader control key 433 is in "start" position and bellcrank 435 is in its illustrated clockwise position as described, an insulator 446 that is secured on the bellcrank 435 holds two identical switches 447 and 448 closed as shown. Switches 447 and 448 are secured side by side, as shown best in FIG. 9 on the frame plate 19 in any known manner. A single-pole double-throw switch 449 (FIG. 32) is also secured on plate 19 and its center blade 450 is situated in engaging alignment with the insulator 446. With the mechanism conditioned as shown, the blade 450 is engaged with blade 451 of the switch 449. When the key 433 is shifted to "stop" position and the bellcrank 435 is snapped counterclockwise as described, the insulator 446 permits the switches 447 and 448 to open and it shifts the blade 450 to disengage from blade 451 and to then engage a blade 452 of the switch 449. From the above, it can be seen that the switched 447 and 448 are closed and that the switches 449 is conditioned with blade 450 engaged with blade 451 as shown, when the key 433 is in "start" position. Also, when the key 433 is in "stop" position, the switches 447 and 448 are open, and the switch 449 is shifted so that blade 450 is disengaged from blade 451 and it is engaged with blade 452.

f. Cycling Control Mechanisms

Figure 38:
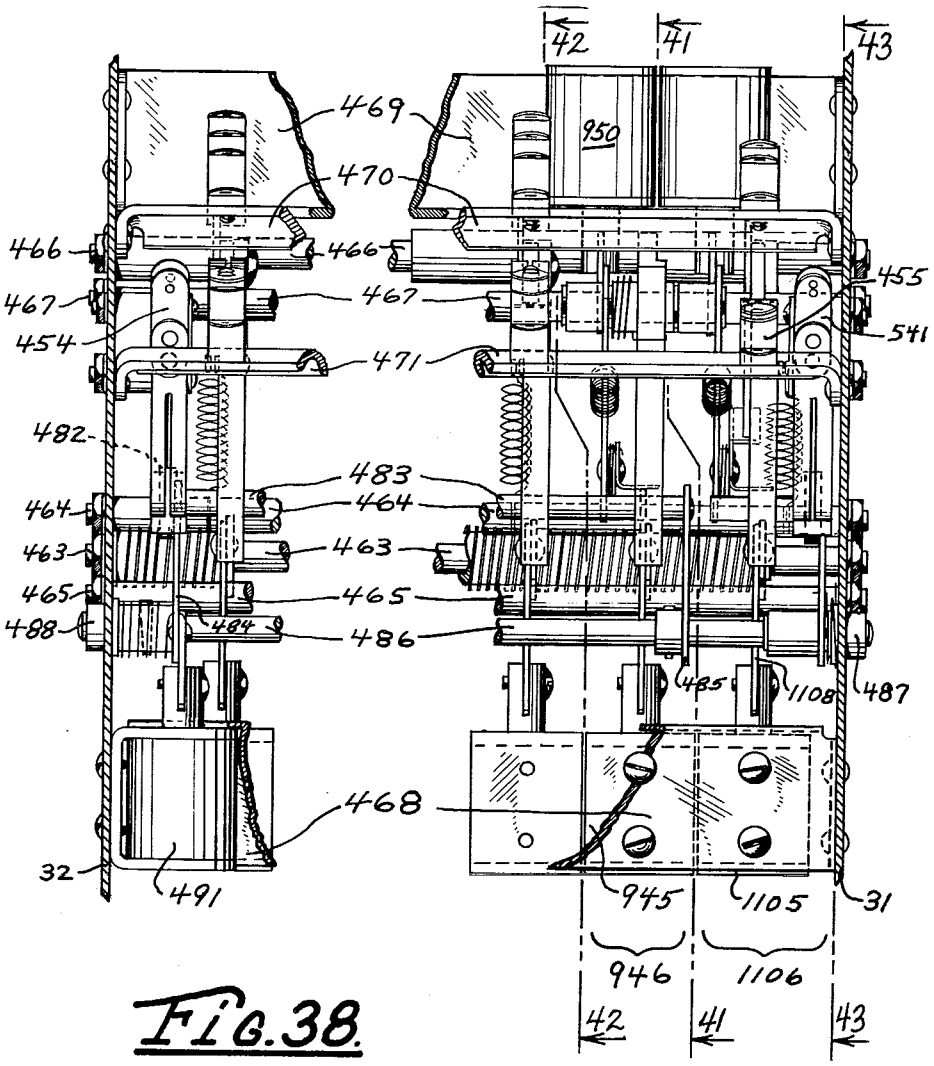
FIG. 38 is a condensed fragmentary top sectional view of a cycling control assembly taken on line 38 — 38 (FIG. 2).
Figure 37:
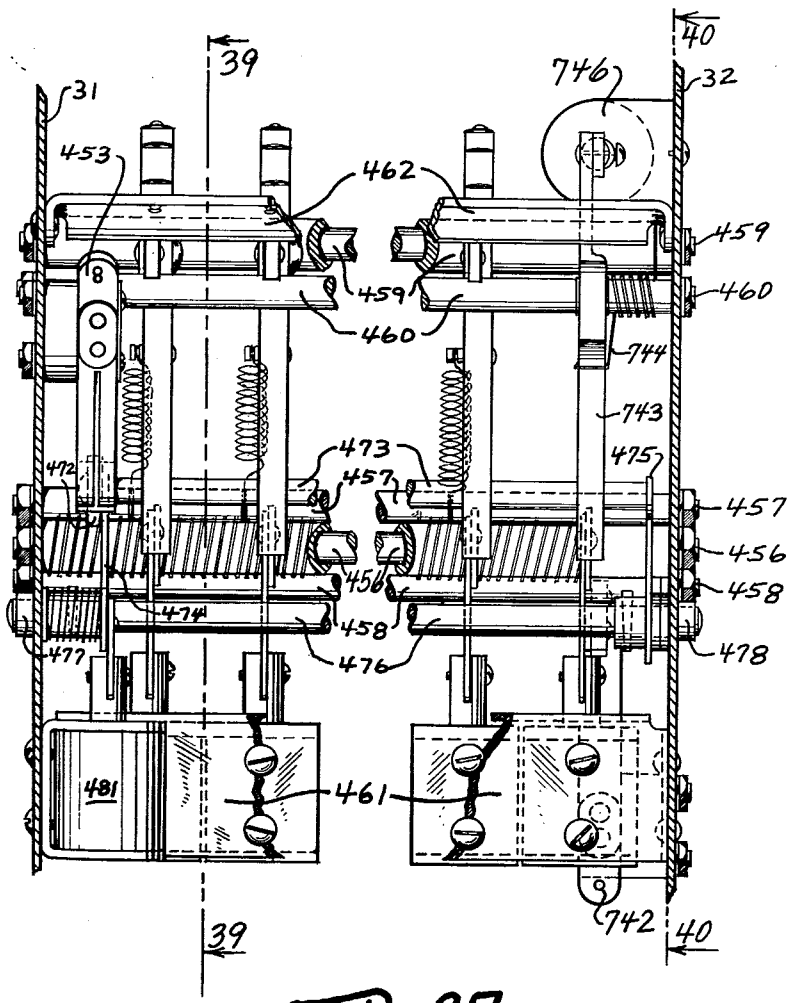
FIG. 37 is a condensed fragmentary top sectional view of a cycling control assembly taken on line 37 — 37 (FIG. 2).

Three reader control circuit switches 453, 454 and 455 (FIG. 31) are included in a cycling control assembly that is supported between the parallel left and right side plates 31 and 32 (FIG. 2). A first bank of cycling control mechanisms are arranged side by side as indicated in FIG. 37 and as viewed from line 37 — 37 (FIG. 2). A second bank of cycling control mechanisms are similarly arranged as indicated in FIG. 38 and as viewed from line 38 — 38 (FIG. 2), but the mechanism in FIG. 38, as it is situated in the machine, is turned around in FIG. 38 so that the left side plate 31 is on the right of the view and the right side plate 32 is on the left. The FIG. 38 is situated in this manner so that parts in this view are parallel to and identifiable with similar parts in the bank of cycling control mechanisms in FIG. 37.

Each cycling control mechanism is provided for controlling the sequences of operations that are necessary to perform a distinct type of function in the reproducer. The structure of each cycling mechansim will be described in connection with the type of function that it controls. However, the structure of the assembly and the parts that are common to a number of the mechanisms within the assembly will be described now.

Figure 41:
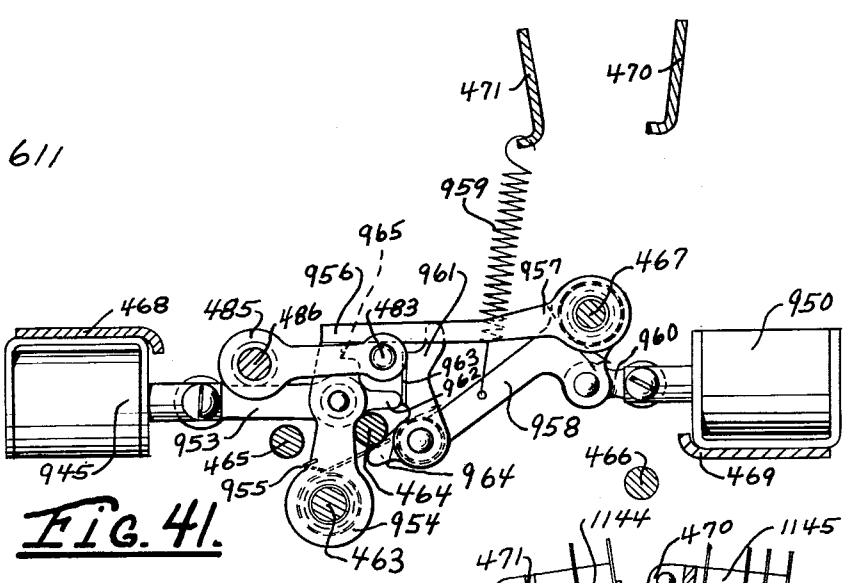
FIG. 41 is a sectional view taken on line 41 — 41 (FIG. 38), showing a different type of cycling unit.
Figure 42:
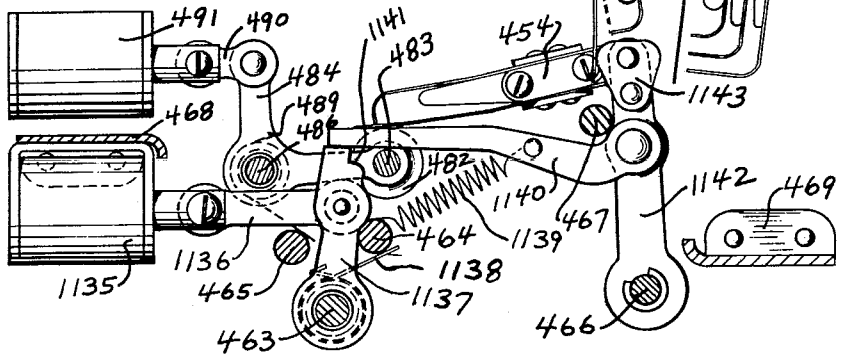
FIG. 42 is a sectional view taken on line 41 — 42 (FIG. 38), showing a cycling unit which is illustrative of a number of such units in the assembly shown in FIG. 38.
Figure 39:
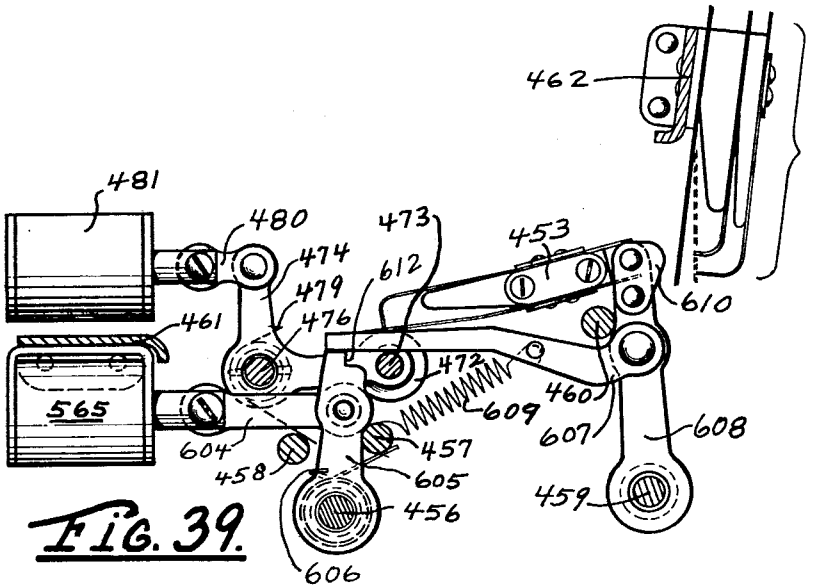
FIG. 39 is a sectional view taken on line 39 — 39 (FIG. 37), showing a cycling unit which is illustrative of a number of such units that form a substantial part of the assembly shown in FIG. 37.
Figure 40:
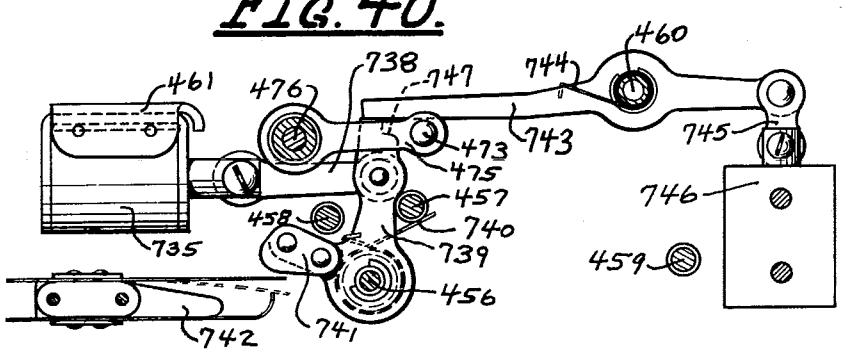
FIG. 40 is a sectional view taken on line 40 — 40 (FIG. 37).
Figure 43:
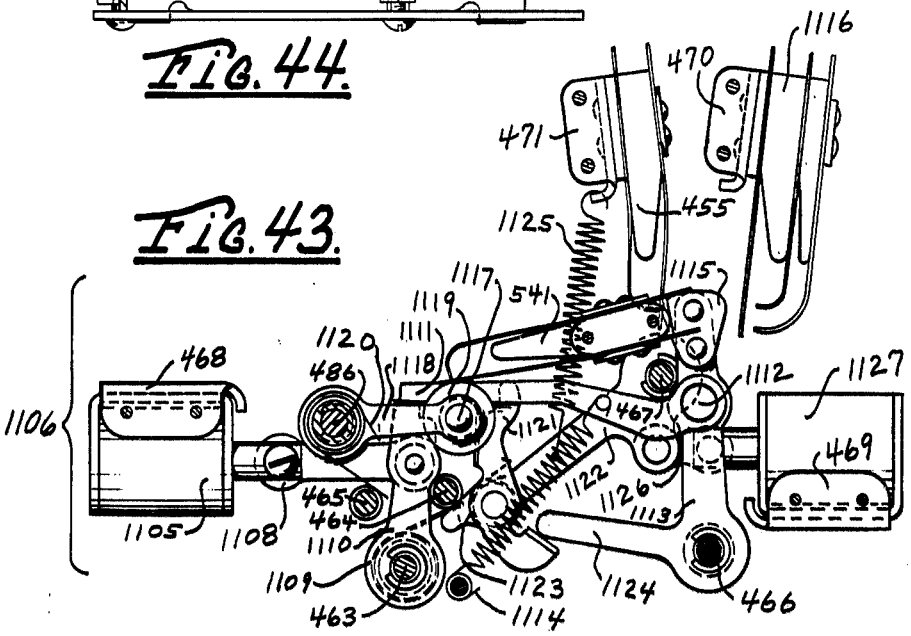
FIG. 43 is a sectional view taken on line 43 — 43 (FIG. 38), showing a line delete program cycling mechanism.

The first bank of cycling control mechanisms are mounted on or about stationary rods 456 (FIG. 2), 457, 458, 459 and 460 that are secured on and extend between the plates 31 and 32 (FIG. 37). Two types of cycling control mechanisms are included in the first bank of such mechanisms and they are shown in FIGS. 39 and 40, but their parts will be described later. However, a transverse solenoid support member 461 is secured on the plates 31 and 32 (FIG. 37). A transverse switch support member 462 (FIG. 39) is also secured on the plates 31 and 32 (FIG. 37). Similarly, parts of the second bank of cycling control mechanisms are mounted on or about rods 463 (FIGS. 41, 42 and 43), 464, 465, 466 and 467, on two transverse solenoid support members 468 and 469, and on two switch support members 470 and 471, and the ends of these rods and members are secured on the plates 31 and 32 (FIGS. 2 and 38). Three types of cycling control mechanisms are included in the second bank and they are shown in FIGS. 41, 42, and 43, but they will be described particularly later herein. From the above, it can be seen that the left and right side plates 31 and 32 (FIG. 2), and transverse rods and members 456 - 471 are secured together to form a rigid cycling control mechanism frame.

The reader control circuit switch 453 (FIGS. 39 and 31) is normally closed as indicated, and it is secured on plate 31 (FIG. 37) in engaging alignment with an insulator 472. Insulator 472 is secured on the leftward end of a tranverse bail 473 that is common to the first bank of cycling control mechanisms. The left end of bail 473 (FIG. 39) is secured on a support member 474, and the rightward end of the bail 473 (FIG. 37) is secured on a support member 475. The support members 474 and 475 are secured on a shaft 476 that is pivoted in bushings 477 and 478 secured on plates 31 and 32, respectively. A torsion spring 479 (FIG. 39) is anchored on rod 458 and it is connected to member 474 for urging the unit formed of member 474, shaft 476, member 475 (FI. 37), bail 473 (FIG. 39) and the insulator 472 counterclockwise, about the axis of shaft 476, where the insulator 472 holds switch 453 closed as shown. A link 480 is pivotally connected to an upward extension of member 474 and to the armature of a solenoid 481 that is secured on plate 31 (FIG. 37). When one of the cycling control mechanisms in the first bank is operated, the bail 473 (FIG. 39) is pushed downward against the tension of spring 479, as will be described, for lowering insulator 472 and permitting switch 453 to open. When the sequence of operations initiated by operation of the cycling control mechanism and the opening of switch 453 is completed, the solenoid 481 is energized as will be described later. When solenoid 481 is operated, it pulls link 480, and rotates the unit including member 474, shaft 476, bail 473 and insulator 472 counterclockwise for raising bail 473 and insulator 472 to restore the operated cycling control mechanism as will be described and to close the reader control circuit switch 453, respectively.

The reader control circuit switch 454 (FIGS. 42 and 31) is normally closed as shown, and it is secured on plate 32 (FIG. 38) in engaging alignment with an insulator 482. Insulator 482 is secured on the leftward end of a transverse bail 483 that is common to all but one of the cycling control mechanisms in the second bank. The only mechanism in this bank that is not associated with the bail 483 is the mechanism situated between the section lines 43 — 43 and 41 — 41, and shown in FIG. 43, as will be described later. Bail 483 (FIG. 42) is secured on a support member 484, and the other end of the bail 483 is secured on a support member 485 (FIG. 38). Support members 484 and 485 are secured on a shaft 486 that is pivoted in bushings 487 and 488 secured on plates 31 and 32, respectively. A torsion spring 489 (FIG. 42) is anchored on rod 465 and it is connected to member 484 for urging the unit formed of member 484, shaft 486, member 485 (FIG. 38), bail 483 (FIG. 42) and the insulator 482 counterclockwise, about the axis of shaft 486, where the insulator 482 normally holds switch 454 closed as shown. A link 490 is pivotally connected to member 484 and to the armature of a solenoid 491 that is secured on plate 32 (FIG. 38). When one of the cycling control mechanisms that is associated with the bail 483 is operated, the bail 483 (FIG. 42) is pushed downward, as will be described, for lowering insulator 482 and permitting switch 454 to open. When the sequence of operations initiated by operation of a cycling control mechanism and opening of the switch 454 if completed, the solenoid 491 is energized as will be described later. Operation of solenoid 491 pulls link 490, and restores the unit including member 484, shaft 486, bail 483 and insulator 482 counterclockwise for raising bail 483 and insulator 482 to restore the operated cycling control mechanism as will be described and to close the reader control circuit switch 454, respectively.

The reader control circuit switch 455 (FIG. 31) is secured on the switch support member 471 (FIG. 38), and it is part of a line delete cycling control mechanism that will be described later in connection with FIG. 43. For the moment, it is sufficient to know that the switch 455 is normally closed, that it is opened only in a sequence of line deleting operations and that it is automatically closed when a deleted portion of the control tape 412 is completely fed through the main reader 407, as will be described later.

g. Cycling Control Switches That Are Part Of Other Major Components

The reader control circuit switch 369 (FIG. 31) is instrumental in cycling the control tape following reading of a quotient code for justifying purposes, as described in topic "3. Carriage Moving Mechanism", as described in connection with FIG. 30, and as will be described further hereinafter. At the moment, it may be instructive to recall that the switch 369 is normally closed, that it is opened only when the member 335 is set according to a quotient code, and that it is again closed as soon as the quotient code is fed out of the main reader 407.

The reader control circuit switch 192 (FIG. 31) is provided for cycling the control tape 412 following reading of the carriage return code as described in topic "3" and as described in connection with FIG. 24. It may be recalled that the switch 192 is normally closed as shown, that it is opened upon reading of a carriage return code and disengagement of clutch 155 (FIG. 31), and that it is again closed when the carriage **9*a* is fully returned and the clutch 155** is again engaged.

A normally closed reader control circuit switch 492 is part of a upper-lower case switch means 493 that will be described later in connection with case shifting operations and control of character spaces by the upper-lower case switch means 493. For the present, it is sufficient to know that the switch 492 is momentarily opened each time there is a case shift sequence of operations.

h. Main Decoder

The main decoder 494 is provided for initiating automatic operational sequences of the reproducer as controlled by the codes on the tape 412 that are sensed by the main reader 407.

The main decoder 494 is shown particularly in FIGS. 47, 48, 49 and 10, and it is shown schematically in FIG. 50. The decoder's forward frame plate 29 (FIGS. 2 and 3) rests on the rearward flange of the transverse frame member 2 and the rearward plate 30 rests on the forward flange of the rearmost portion of the main base of frame 1, as previously mentioned, and the plates 29 and 30 may be respectively secured to the member 2 and frame 1 in any known manner. The decoder 494 is housed generally between the plates 29 and 30, which are spaced and held rigidly parallel to each other by eight similar rods 494*a* (FIGS. 2 and 10) the ends of which are secured to the plates 29 and 30.

A motivating solenoid 495 (FIG. 50) is relative to the number "1" code channel, as indicated here. Solenoid 495 (FIGS. 48 and 10) is secured on the rearward plate 30. An insulator 496 (FIG. 48) is secured on the remote end of the armature of solenoid 495. A single-pole double-throw switch 497 is secured on the plate 30, and its center blade "*a*" normally holds the insulator 496 and the armature in extended position where the insulator 496 is stopped against a stud 498 that is secured on plate 30. The blade "*a*" is also normally engaged with a blade "*b*" of the switch 497. Upon the reading of a number "1" code channel and consequent energization of the solenoid 495, its armature and the insulator 496 are retracted for disengaging the blade "*a*" from blade "*b*" and engaging it with a blade "*c*" of the switch 497. Thereafter, the insulator 496 is stopped in operated position against a stud 499 that is secured on plate 30. Upon deenergization of the solenoid 495, the blade "*a*" returns the armature and insulator 496 to normal position, and it disengages from blade "*c*" and reengages with blade "*b*".

Motivating solenoids 500 - 505 (FIG. 50), which are relative to code channels "2"0 - "7", respectively, are provided for operating respective groups of switches 506 - 511. As indicated schematically, the arrangement of these solenoids 500 - 505 and switches 506 - 511 is the same in principle as that provided for channel "1" described above. However, in order to include the indicated larger number of switches 506 - 511 in a relatively small space, while providing adequate clearance between electrical components, the structure of these mechanisms is quite different from that described for channel "1".

The solenoids 500 and 501 (FIG. 10) are secured to plate 30, in respective axial alignment with solenoids 503 and 502 which are secured to plate 29, as shown. Solenoids 504 and 505 are secured on plate 29, and they are not axially aligned with any other solenoids in the decoder 494.

Each of the solenoids 500 - 505 has an armature extension 512 that is slidably supported in a stationary bearing 513, 514. The extensions 512 for the solenoids 504 and 505 are independently mounted in identical bearings 513 that are secured on plate 30. The remote ends of extensions 512 for the axially aligned solenoids 500 and 503 are mounted in a bearing 514, and the extensions for solenoids 501 and 502 are mounted in an identical bearing 514. The bearings 514 are mounted on identical stationary plates 515, and the bearings 514 may each be provided with an air vent hole 516 for preventing vacuum and pressure within the bearings 514 when the extensions 512 are slid axially therein, upon operation of their respective solenoids 500 - 503.

A further description of one of the solenoids 500 - 505 and its respective switches 506 - 511 should serve to describe the others. The structure of solenoid 505 and its switches 511 is here selected as exemplary.

The armature extension 512 (FIG. 49) of solenoid 505 as shown here extends rightward and the rightward end of the extension 512 is slidably supported in the stationary bearing 513. A suitable plurality of insulators 517 (FIGS. 47 and 49) are secured on the extension 512, in a known manner, so as to shift unitarily with the armature. The insulators 517 are appropriately spaced along the armature extension 512 for operating the blades "*a*" of all of the switches 511 (FIG. 50). The switches 511 (FIGS. 47 and 49) are each comprised of blades "*a*", "*b*" and "*c*", which may be identical with the blades in the decoder switch 497 (FIG. 48) described above. However, to save space, where a large number of such switches are required, four of these single-pole double-throw switches 511 (for example) (FIGS. 47 and 49) are supported on one insulating assembly. The blades "*a*" are sandwiched between two insulating disks 518, which are identical except that they are reversed back to back. The blades "*b*" and "*c*" are assembled on the outer discoidal faces of the disks 518, and a unit formed of as many as four of each of the blades "*a*", "*b*" and "*c*" and the two disks 518 are secured together by four pair of rivets 519 as shown. The rivets 519 are insulated in a known manner from the blades through which they extend, thus the blades are insulated one from the others. A clearance hole 520, in each of the disks 518, permits the blades "*b*" and "*c*" to turn toward the blade "*a*" as shown and it permits travel of the respective insulator 517 therein.

Each pair of disks 518 is located about the axis of armature extension 512 and in a position, longitudinally in respect to the normal position of the armature, so that the blades "*a*" each normally effectively engage their related blade "*b*" and they also contact, or substantially contact, the respective insulator 517.

The disks 518 are provided with holes for a pair of rods 494*a*, on which the disks 518 are mounted, and the disks 518 are held in position longitudinally on these rods 494*a*, in a known manner, as by clips and spacers as shown. The disk assemblies are also further held rigidly in their respective planes by two rods 521 (FIGS. 47 and 10) which extend through holes therefor in the disks 518 and in the frame plate 30 (FIG. 10). The rods 521 are secured to the plate 30 and the disks 518 are held in their positions therealong, in a known manner as by suitable nuts and spacers as shown.

The bearings 514 are rigidly secured, in a known manner, in holes therefor in plates 515, and the plates 515 are supported on the rods 494*a* and 521 as are the disks 518 described above.

An expansive spring 522 (FIG. 49) is assemblied on the armature extension 512, between the solenoid 505 and the leftmost insulator 517, for urging the armature assembly rightward, as shown here in the example, where a clip 523 in an annular groove on the extension 512 abuts the end of bearing 513 for stopping the armature extension 512 in the illustrated normal rightward position.

The arrangement is such that, upon operation of solenoid 505 for example, the armature extension 512 and its insulators 517 are shifted leftward for shifting the free ends of all blades "*a*" of switches 511 out of engagement with the blades "*b*" and into engagement with blades "*C*" of these switches 511. Upon deenergization of the solenoid 505, the spring 522 returns the armature extension 512 and the insulators 517 thereon to normal position, and by the predisposed tension of blades "*a*" they disengage from blades "*c*" and reengage the blades "*b*" as shown.

The action and the parts associated with solenoids 502 - 504 (FIG. 10) are exactly like that described for the solenoid 505. The arrangements for solenoids 500 and 501 are the same, but the parts are reversed and the action is opposite. For example, the armature extension 512 of solenoid 500 extends leftward and the end thereof is slidably mounted in the rightward portion of the bearing 514. Also, a clip 523 in an annular groove on the armature extension 512 abuts the rightward end of the bearing 514 for stopping the armature extension 512 in its normal leftward position.

From the above, it can be seen that the main decoder 494 assembly is comprised of seven sections and it should be understood that these sections correspond to the seven channels of the control tape 412. When a punch hole or a plurality of punch holes that form one code is read by the main reader 407 (FIG. 31), the corresponding section or sections of the decoder 494, respectively, are operated to complete a circuit for accomplishing a particular function, as will be explained presently.

The main decoder system is based on the well known binary system of decoding where the different sections all act to select one circuit. With seven sections we could provide for 127 different functions controlled by the punch holes. In the illustrated machine, there are only 103 functions that may be performed in the reproducer through the main system of switches 497, 506 – 511 in the decoder 494, plus one delete function that merely causes cycling of delete codes through the main reader 407. Because we need only these 104 functions controlled by the tape 412 and the main decoder 494, our decoder 494 is reduced in size.

As shown in FIG. 50, there is one switch 497 in the "1" code channel section, there are two switches 506 for the "2" code channel, four switches 507 for the "3" code channel, eight switches 508 for the "4" channel, sixteen switches 509 for the "5" channel, thirty switches 510 for the "6" channel, and there are forty two of the previously descriibed switches 511 for the "7" channel section of the main decoder 494 system of switches. In addition to the single-pole double-throw switches 497, 506 – 511 described above, the decoder 494 includes four switches 524, one in each of the code channel sections "4", "5", "6" and "7", for the "DELETE (4, 5, 6, 7)" circuit shown near the bottom of FIG. 50. These switches 524 (FIG. 49) each comprise only a blade "*a*" and a blade "*c*", instead of the three blades described for the switches 511, and the switches 524 are normally open as shown. Otherwise, the switches 524 are constructed the same and function the same as the switches 511 described above. The switches 524 are wired in the delete circuit as indicated in FIG. 50, and the switch 524 in the "4" code channel section is grounded at 525 as indicated. There are four more switches 526 at the bottom of FIG. 50, and there is one of these switches 526 in each of the code channel sections "4", "5", "6" and "7". The switches 526 each comprise a blade "*a*" and a blade "*b*" (FIG. 49) that are normally engaged as shown, and the switches 526 are grounded as indicated (FIG. 50). A wire 527 is connected between the "1" code channel switch 497 and each of the switches 526 and normally any circuit that is made effective through the main portion of the decoder 494 will find a ground through the wire 527 and one or more of the switches 526. However, when the delete code "4", "5", "6" and "7" is read and the decoder 494 is operated accordingly, there will be no circuit that is effective through wire 527 and the now open switches 526, but the "DELETE (4567)" circuit will be led to ground 525 through the then closed switches 524, as will be discussed further hereinafter.

5. MAIN READER CIRCUIT

When the reader control key 433 (FIG. 31) is in the "start" position and the control tape 412 is advanced to a point where one or more of the sensing springs 410, of the main reader 407, make contact with the conductor plate 411 through code punch holes in the tape 412 the main decoder 494 is operated by the main reader circuit as will now be described.

A source of power (S) is connected by a wire 528 to the switch 414 that is closed as long as slack tape 412 is stored in the buffer loop 413 as described. A wire 529 is connected between the switch 414 and the cocking solenoid 417, a wire 530, which may include a communication means as previously described, is connected between solenoid 417 and the "READ" solenoid 422 in the feed-read switch means 421. A wire 531 is connected to solenoid 422 and to the switch 448 that is closed as long as the reader control key 433 is in "START" position as described. A wire 532 is connected between switch 448 and switch 453. A wire 533 is connected between switches 453 and 454, and another wire 534 is connected between switches 454 and 455. As previously mentioned and as will be explained in detail later, the switches 453, 454 and 455 are normally closed and one will be opened by operation of a related cycling mechanism when such a mechanism is operated as a result of a reading operation. A wire 535 is connected to the switch 455 and to the normally closed switch 369, which is opened only when the code that is read is a quotient code and the carriage moving mechanism is set according to the respective quotient as will be explained fully hereinafter. A wire 536 is connected to switch 369 and to the switch 192 that is normally closed and that is opened when the code that is read is for carriage return as explained and as will be explained further hereinafter. A wire 537 is connected between the switch 192 and the switch 492 that is opened momentarily each time an instant code is for a case shift and the switch means 493 is shifted accordingly for an upper or lower case shift. A wire 538 is connected to the switch 492 and to each one of the seven motivating solenoids 495, 500 – 505 in the main decoder 494. Seven wires 539 are connected between the individual motivating solenoids 495, 500 – 505 in the decoder 494 and the respective sensing spring 410 in the main reader 407. As discussed previously, the wires 539 may include communication means intermediate their ends. The conductor plate 411 is grounded in any suitable manner, as at 540.

Thus, when the reader control key 433 is shifted to "start" position and the main reader 407 senses a code the just described main reader circuit is effective for operating the solenoid 417 to cock the tape feed mechanism 408 is preparation for an ensuing step of the control tape 412 as explained, for operating the "read" solenoid 422 to condition the feedread switch means 421 for consecutive reading operations as described, and for operating the main decoder 494 according to the code on the tape 412. The reproducer is thus conditioned for reading operations and control of the tape 412 and the decoder 494 is operated for initiating a sequence of operations according to a particular code.

During a decoder initiated sequence of operations, one of the switches 453, 454, 455, 369, 192 or 492 will be opened, as will be described, for breaking the main reader circuit. When this occurs, the solenoid 417 is deenergized and the tape feed mechanism 408 shifts the control tape 412 forwardly one step to remove the just read code and to normally shift an ensuing code into the main reader 407, as described. At the same time, the "read" solenoid 422 is deenergized, but the switch means 421 is held in read condition by the latch means 428, unless the previous code was for a justifying or for a carriage return code as described. When the reader circuit is broken, the operated motivating solenoids 495, 500 – 505 in the decoder 494 are deenergized and the decoder 494 is restored as described. Upon completion of the decoder initiated sequence of operations, the switch 453, 454, 455, 369, 192 or 492 that was opened to break the main reader circuit is again closed automatically, as will be described, for making the main reader circuit again effective for reading the ensuing code.

6. MAIN DECODER, CHARACTER CIRCUITS

The circuits for automatically operating character keys 39, as controlled by the decoder 494, will now be described.

Figure 51:
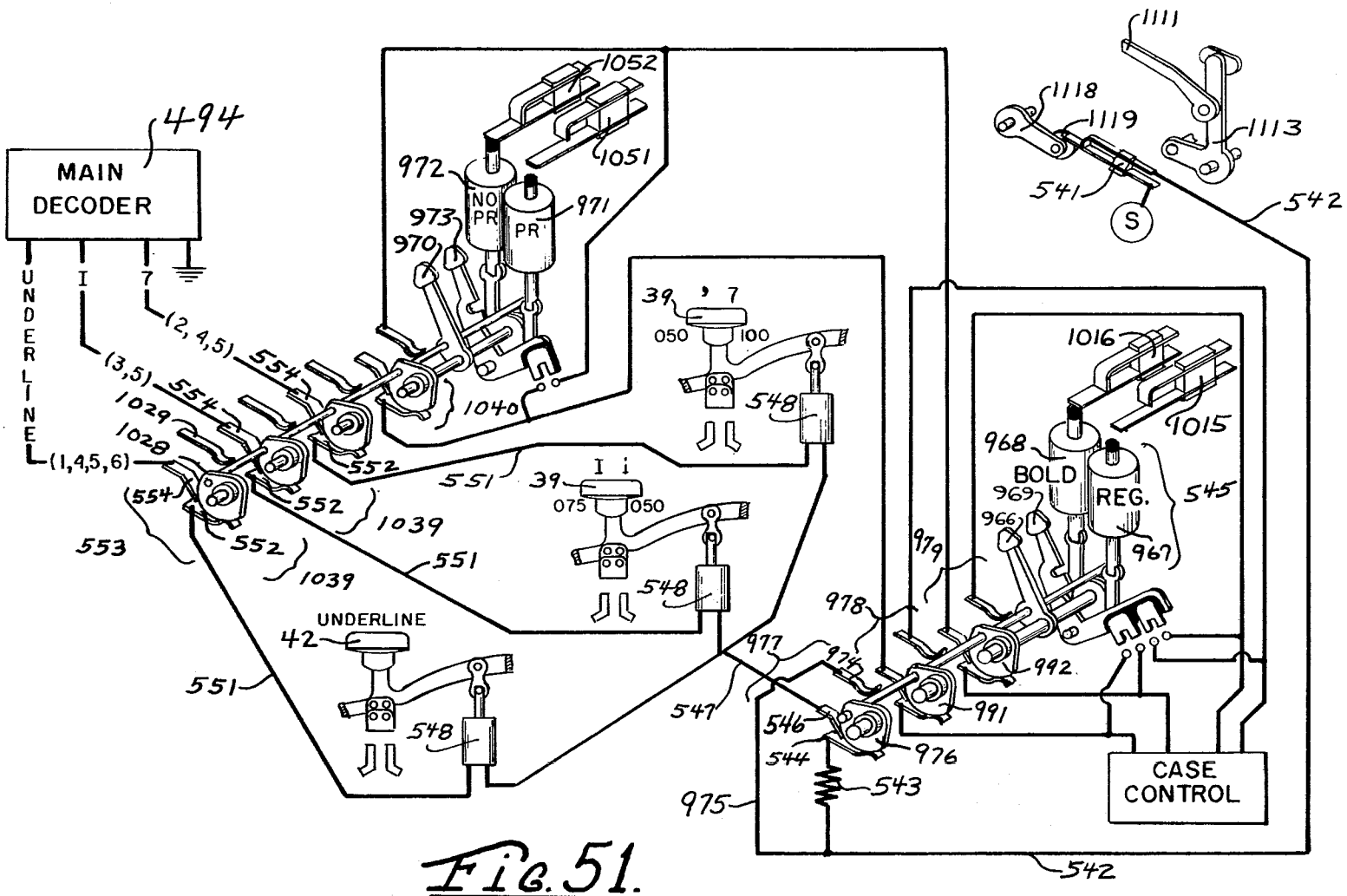
FIG. 51 is a schematic wiring diagram of the circuits for automatically imprinting characters.

A source of power (S) is connected to a switch 541 (FIG. 51). The switch 541 is normally closed, and it is opened for preventing normal decoder controlled operations only during line delete operations that will be described later.

A wire 542 is connected to the switch 541 and to a resistor 543. The resistor 543 is provided for normally reducing the flow of current to provide a normal imprinting force, and this resistance is avoided at times to provide a greater ("bold") imprinting force, as may be better understood later. The resistor 543 is also connected to a normally effective brush 544 in a bold-regular control mechanism 545 to be described later. A constantly effective brush 546, in the mechanism 545, is connected by a wire 547 to a solenoid 548 for each character key 39.

There is one solenoid 548 for each of the character imprinting keys 39 and the underline key 42. There is also, for convenience, a solenoid 548 for the line space keys 43 and 44 (FIG. 8) for operating these keys 43, 44 even though these keys 43, 44 do not cause printing.

The solenoids 548 (FIGS. 9 and 11) are secured at their lower ends to a transverse frame plate 549 that is secured in any known manner to the bottom of the main frame channel members 6 and 7. The solenoids 548 are arranged in three rows that are angled slightly, as shown in FIG. 9, so as to provide spacing for a solenoid 548 for each of the keys 39, 42, 43 and 44.

A link 550 (FIG. 11) is pivotally connected to the armature of each of the solenoids 548 and to a respective character key lever 46 or to a line space key lever 65 as the case may be. The arrangement is such that operation of a solenoid 548 pulls its link 550 and operates the respective key 39, 42 – 44, and the key 39, 42-44 and key lever 46, 65 are returned, in a previously described manner, when the operated solenoid 548 is deenergized.

A wire 551 (FIG. 51) is connected between each character key related solenoid 548 and a respective brush 552 that is normally effective in a print-no print control mechanism 553 to be described later. There is a constantly effective brush 554, in the print-no print control mechanism 553, for each character key motivating circuit, and each one of these brushes 554 is controlled by a wire that will be distinguished hereinafter by the related character and the code for the respectve key 39, 42 – 44. In the event the key 39 is for different characters in upper and lower case, the lower case character and the code for the key 39 will generally be used to identify the circuit. In other words, for example, the brush 554 that corresponds to the "7" character key 39 is connected by a wire "7 (2, 4, 5)38 to the main decoder 494 and this wire is connected particularly to the terminal "#7 Char. (2, 4, 5)" (FIG. 50) of the main decoder 494.

Thus, normally when the decoder 494 is operated according to the code "2,4,5" and the decoder motivating solenoids 500, 502 and 503 are operated for shiting the decoder switches 506, 508 and 509, respectively, the "7" character key circuit is effective. When this circuit is effective, current travels from source (S) and switch 541 (FIG. 51), through wire 542, resistor 543, normally effective brushes 544 and 546, wire 547, the solenoid 548 for operating the "7" key 39, its wire 551, its normaly effective brushes 552 and 554, the wire "7(2,4,5)", the decoder terminal "No. 7 Char. (2,4,5)" (FIG. 50) the related switch 511 in normally position, a switch 510 in normally position, a switch 509 in operated position, an operated switch 508, a switch 507 in normally condition, an operated switch 506, the switch 497 in normal condition, wire 527, and the circuit goes to ground through the switches 526 that are in normal condition (in this instance, through the switches 526 that remain closed in the "6" and "7" code sections).

For a further example, assume now that the code for "*i*" ("3,5") is read and the decoder 494 (FIG. 51) is operated accordingly. The circuit for operating the "*i*" character is the same as the example above, except that this time the solenoid 548 under the key "*i*" is operated and the circuit continues through the respective wire 551, brushes 552 and 554, the wire "I (3,5) "the terminal "I (3,5)" (FIG. 50) in the decoder 494 the respective switch 511 in normal condition, a switch 510 in normal condition, an operated switch 509, a switch 508 in normal condition, an operated switch 507, a swtich 506 in normal condition, the switch 497 in normal condition, wire 527, and the circuit goes to ground through the switches 526 in the "4", "6" and "7" code sections of the decoder 494.

With the above examples in mind and by referring to FIG. 51, it can be seen that the underline key 42 is operated in the same manner, when the "UNDERLINE (1,4,5,6)" wire is effective. The underline circuit through the decoder 494 travels via the "UNDERLINE (1,4,5,6)" terminal (FIG. 50) in the "6" code section, through the related and operated switches 510, 509 and 508, switches 507 and 506 in normal condition, the operated switch 497, wire 527, and the switch 526 that remains closed in the "7" code section.

The codes for all character keys 39, 42, including "Alphabet", "Underline", "Numeral" and "Punctuation" keys, may be found in a "CHART B" that is listed amount charts "A" – "E" located immediately after the Figure Descriptions hereinbefore. With the above examples as a guide, and by referring to the FIGS. 50 and 51, and the code "CHART B" the code and decoder initiated operation of any character key 39,42 may be understood.

7. CYCLING CONTROL FOR CHARACTERS

When a character key representing code is read and the decoder 494 is operated accordingly, the corresponding character key 39 is operated, as described. When such a key 39 is operated sufficiently to cause printing of either the upper case character or the key related lower case character on the paper carriage 9a as described, a switch 555 (FIG. 11) under the key 39 is closed by a conductor 556, that is carried by the key lever 46, to cause a sequence of operations that includes proper carriage movement for the width of the character, depending on the upper or lower case condition of the machine at that moment.

Since the machine involves differential carriage movement and since the upper case character width may be different from that of the lower case character width for a given character key 39, the sequence of operation controlled by closure of a switch 555 must also include an upper-lower case condition control of the carriage movement for the particular character, as will be explained presently. The precise carriage movement for each character is shown in "CHART A" that may be found immediately following the Figure Descriptions hereinbefore.

By referring to "CHART A", it can be seen that the keys 39 that must cause carriage movement are arranged in "Groups", "A" - "G". It may be noted that the characters in "Group A" are provided 0.100 inch carriage movement in both upper and lower case. The key 39 in group "B" is used for imprinting either an upper-case apostrophe (') that is given a 0.050 inch carriage movement, or the lower case number "7" that is provided with 0.100 inch character space. In group "C", the upper case capital letters have 0.100 inch carriage movement, and the key related lower case letters have 0.075 inch carriage movement. In group "D", the "I" key 39 is 0.075 inch in upper case and 0.050 inch in lower case. In group "E", the "L" is 0.100 inch and 0.050 inch in upper and lower case, respectively. The punctuation marks in group "F" are provided with 0.050 inch carriage movement in both upper and lower case. The space keys 627,628,629 listed in groups "A", "F" and "G" do not cause imprinting, of course, and they will be discussed later. The upper case character for each key 39 in each of the groups "A", "C" and "F" is designated as having the same carriage movement as the other upper case characters in that group, and the lower case characters in each group all have the same carriage movement as the other lower cse characters in its group. The grouping of the keys 39 that have the same carriage movement requirements aids in simplifying the circuitry that controls carriage movement.

Each switch 555 (FIG. 11) is comprised of two similar blades 557 and 558 that are assembled back to back and they are secured on an insulator 559. Insulators 559 are carried by transverse rods 560 and 561, the ends of which are secured on the main frame channel members 6 and 7. As shown, the switches 555 are arranged in four rows that correspond generally with the rows of keys 39 on the keyboard, seen best in FIG. 8. The insulators 559 (FIG. 11) are held in place by spacers 562 on the rods 560 and 561, and each switch 555 is situated on its insulator 559 in a position to be properly engageable by the conductor 556 of its respective key 39, for example. Each conductor 556 is secured on an insulator 563 that in turn is secured on its respective key lever 46. The arrangement is such that upon operation of a key 39, an extent sufficient to cause printing of the character, its conductor 556 is pressed between the blades 557 and 558 to complete a circuit therebetween. Thus, when a character is imprinted on the paper carriage 9a, a sequence of operations for the key 39 and imprinted character is initiated by closure of its switch 555.

Figure 52:
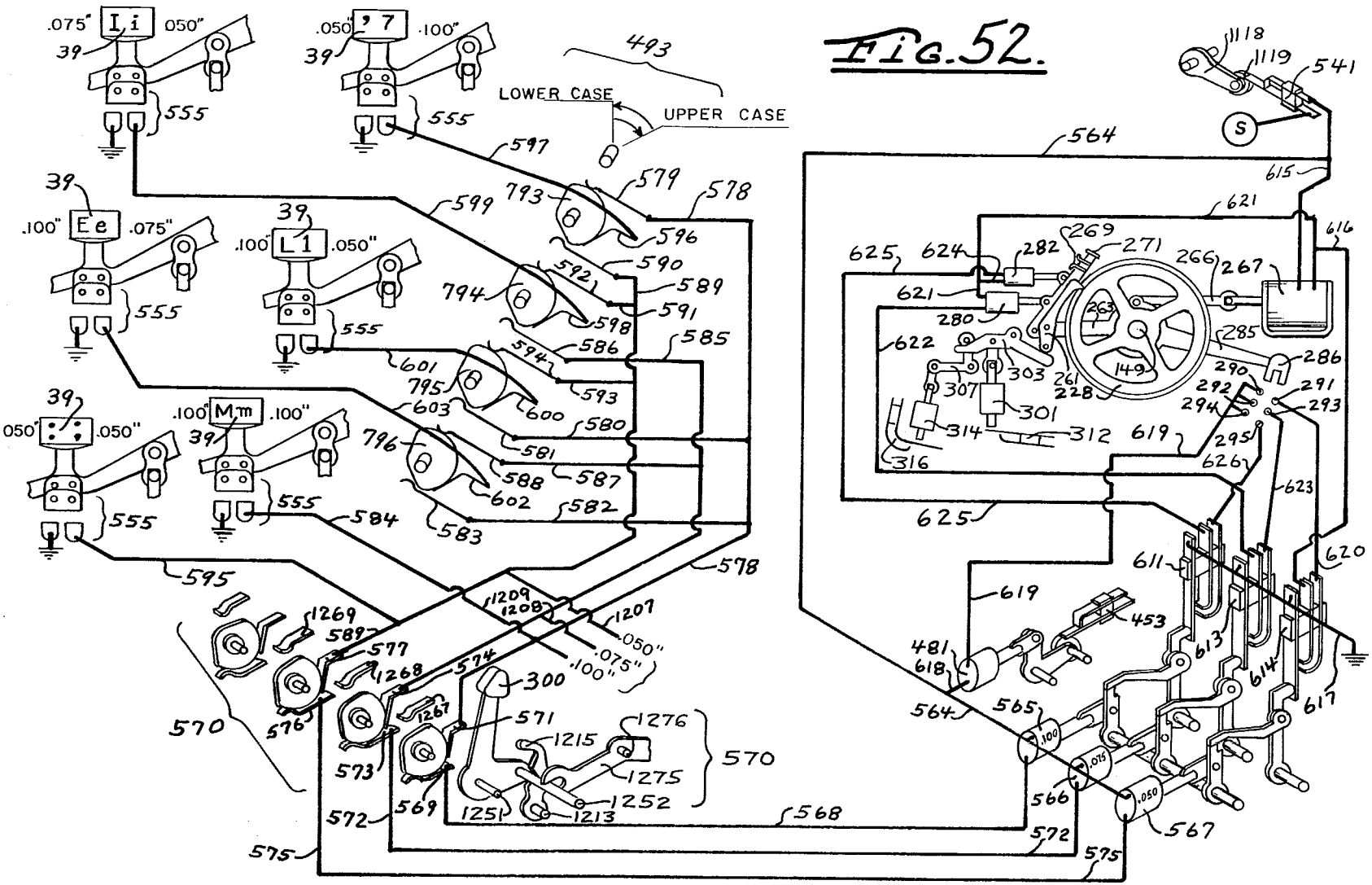
FIG. 52 is a schematic wiring diagram of the circuits that are primarily related to cycling control and carriage movement for upper and lower case characters.

Closure of a switch 555, under any character key 39, normally completes a circuit that originates in a source of power (S) and the normally closed switch 541 (FIG. 52). As previously mentioned, the switch 541 is opened only for preventing normal functions of the machine during line delete operations, that will be described later. A wire 564 is connected to switch 541 and to three solenoids 565, 566 and 567.

The solenoids 565, 566 and 567 are provided for operating respective 0.100, 0.075 and 0.050 inch cycling mechanisms that are provided for breaking the main reading circuit and for controlling the carriage moving mechanism to move the carriage 9a a corresponding amount suitable for the imprinted character, as will be explained presently.

A wire 568 is connected to the 0.100 inch cycling mechanisms solenoid 565 and to a blade 569 in a forward and back space control mechanism 570 that will be described later. At the present, it is sufficient to know that the control key 300 (FIG. 8) is normally in "forward" operating position as previously mentioned and the mechanism 570 (FIG. 52) is normally conditioned accordingly so that the blade 569 (FIG. 35) is effective with a blade 571 in the mechanism 570. A wire 572 (FIG. 52) is connected to the 0.075 inch cycling mechanisms solenoid 566 and to a blade 573 that is normally effective with a blade 574 in the mechanism 570. A wire 575 is connected between the 0.050 inch cycling mechanisms solenoid 567 and a blade 576, and the blade 576 is normally effective with a blade 577.

For 0.100 inch characters, a wire 578 is connected to blade 571 and to a blade 579 that is effective only when the upper-lower case switch means 493 is in lower case condition, as will be described. A wire 580 is connected to the wire 578 and to a blade 581 that is effective only when the upper-lower case switch means 493 is in upper case condition. The structural details of the upper-lower case switch means 493 will be described later. At the moment, it is sufficient to know that all lower case blades, such as blade 579, are effective when the machine and upper-lower case switch means 493 are in lower case condition, and that all upper case blades, such as blade 581, are effective when the machine and upper-lower case switch means 493 are in upper case condition. A wire 582 is connected to wire 578 and to an upper case blade 583. A wire 584 is connected to the wire 578 and directly to a switch 555, under each of the character keys 39 that are listed in group "A" (Chart A). The wire 584 avoids the upper-lower case switch means 493, since the keys in group "A" (Chart A) have 0.100 inch characters in both upper and lower case, and no control by the upper-lower case switch means 493 is required for these keys 39.

For 0.075 inch characters, a wire 585 is connected to the blade 574 and to an upper case blade 586. A wire 587 is connected between the wire 585 and a lower case blade 588.

For 0.050 inch characters, a wire 589 is connected to blade 577 and to an upper case blade 590. A wire 591 is connected between wire 589 and a lower case blade 592. A wire 593 is connected between the wire 589 and a lower case blade 594. A wire 595 is connected to the wire 589 and directly to a switch 555 under each of the several character keys 39 that are listed in group "F" (Chart A). The keys 39 in Group "F" are for punctuation characters that require 0.050 inch carriage movement in both upper and lower case conditions, and, thus, the wire 595 (FIG. 52) bypasses the upper-lower case switch means 493.

A blade 596 in the upper-lower case switch means 493 is constantly effective; that is, it is selectively effectively coupled with the blases 579 or 590 when the upper-lower case switch means 493 is in lower case and upper case conditions, respectively. A wire 597 is connected to the blade 596 and to the switch 555, as indicated, under the key 39 that is operated to imprint the upper case apostrophe (') or the lower case "7".

A constantly effective blade 598 is selectively coupled with the blades 592 or 586 when the upper-lower case switch means 493 is in lower case and upper case conditions, respectively. A wire 599 is connected to blade 598 and to the switch 555, as indicated, under the key 39 that is operated to imprint a lower case "*i*" or an upper case "I".

A blade 600 is selectively coupled with blades 594 or 581 when the upper-lower case switch means 493 is in lower case and upper case, respectively. A wire 601 is connected between blade 600 and the switch 555 under the "L" key 39.

A blade 602 is selectively coupled with blades 588 or 583, when the upper-lower case switch means 493 is in lower case and upper case, respectively. A wire 603 is connected to blade 602 and to a switch 555 under each of the character keys 39 that are listed in group "O" (Chart A), and that are represented by the key "E" (FIG. 52) of this group.

The arrangement is such that upon operation of a key 39 in group "A" (Chart A), the switch 555 (FIG. 52) (here represented by the switch 555 under the "M", "*m*" key) under the key 39 is closed for operating the solenoid 565 in the 0.100 inch mechanism. In this particular instance, the circuit originates in a source (S) and switch 541, travels through wire 564, solenoid 565, wiere 568, blades 569 and 571, wires 578 and 584, and goes to ground through the switch 555 under the operated key 39, here exemplified by the "M" key. Thus, the solenoid 565 is operated each time a character in group "A" (Chart A) is imprinted.

When a character in group "B" is imprinted, 0.050 inch carriage movement is required for the upper case apostrophe and 0.100 inch carriage movement is required for the lower case "7", and the upper-lower case switch means 493 (FIG. 52), together with the operated key 39, determines whether the 0.050 inch or 0.100 inch cycling mechanism is operated. Assume now that the machine and the upper-lower case switch means 493 is in the lower case condition indicated, and the "7" key 39 is operated. The circuit travels from source and switch 541, wire 564, the solenoid 565 in the 0.100 inch cycling mechanism, wire 568, blades 569 and 571, wire 578, effective blades 579 and 596 in the upper-lower case switch means 493, wire 597 and goes to ground through the switch 555 under the operated key 39. Thus, the 0.100 inch cycling mechanism's solenoid 565 is operated when the number "7" is imprinted. When the same key 39 is operated but the machine and the upper-lower case switch means 493 is shifted into upper case condition for imprinting the apostrophe and for controlling for 0.050 inch carriage movement, respectively, the circuit completed by operation of the key 39 originates in the same manner, but this time the 0.050 inch cycling mechanism solenoid 567 is operated and the circuit continues through wire 575, blades 576 and 577, wire 589, now effective blades 590 and 596 in the shifted upper-lower case switch means 493, wire 597 and it goes to ground through the switch 555 under the operated key 39. Thus, the 0.050 inch cycling mechanism solenoid 567 is operated when the apostrophe is imprinted.

The circuits for the characters in group "C" (Chart A), as exemplified by the character "E", "*e*" (FIG. 52), will now be discussed. When the machine is in lower case condition and a key 39 in this group ("*e*" for example) is operated, the circuit originates as discussed previously, but this time the circuit goes through the 0.075 inch cycling mechanism solenoid 566, wire 572, blades 573 and 574, wires 585 and 587, effective blades 588 and 602 in upper-lower case switch means 493 in lower case condition, wire 603, and to ground through the switch 555 under the key "*e*" for example. Thus, the 0.075 inch cycling mechanism solenoid 566 is operated whenever an "*e*", or any other lower case character in group "C" (Chart A) is imprinted. When the machine is in upper case condition and any key 39 in group "C" (the capital letter "E" for example) is operated, the circuit goes through the 0.100 inch cycling mechanism solenoid 565 (FIG. 52) and so on, but this time the circuit goes through wire 582, now effective blades 583 and 602, wire 603 and the switch 555 under the operated key 39 ("E" for example). In this way, the 0.100 inch mechanism solenoid 565 is energized whenever an upper case character in group "C" (Chart A) is imprinted.

The circuits for the characters in group "D" will now be described. When the lower case "*i*" is imprinted, its circuit energizes the 0.050 inch mechanism solenoid 567 (FIG. 52), it continues as described, goes through the wires 589 and 591, the now effective blades 592 and 598, wire 599 and to ground under the operated key "*i*". When the upper case "I" is imprinted, the key's upper case circuit energizes the 0.075 inch mechanism solenoid 566, it continues as described, goes through wire 585, now effective blades 586 and 598, wire 599 and to ground under the operated key "I".

The circuits for the characters in group "E" (Chart A) will now be described. When a lower case "1" is imprinted, the 0.050 inch mechanism solenoid 567 (FIG. 52) is energized, the circuit continues as described, goes through wires 589 and 593, blades 594 and 600, wire 601 and to ground under the operated key "1". When the upper case "L" is imprinted, the key's circuit energizes the 0.100 inch mechanism solenoid 565 and continues as described, goes through wires 578 and 580, blades 581 and 600, wire 601 and to ground under the operated key "L".

The circuit for characters in group "F" (Chart A), which are provided 0.050 inch of carriage movement in both upper and lower case, energizes the 0.050 inch mechanism solenoid 567 (FIG. 52), proceeds as described, then goes through wires 589 and 595, and goes to ground under the operated punctuation key 39, here exemplified by the colon and semicolon key 39.

From the above, it can be understood that operation of a character key 39 and the upper-lower case condition of the machine will determine the character that is imprinted, and generally the operation of the key 39 and the upper-lower case condition of the upper-lower case switch means 493 will control operation of the one of the cycling control solenoids 565, 566 or 567 that corresponds with the size of the imprinted character.

The structures of the cycling control mechanisms that are operated by the solenoids 565, 566 and 567 are idential, so a description of one should suffice to described the others. The cycling mechanism that is employed in the 0.100 inch character circuits, and operated by the solenoid 565, is chosen as exemplary.

The solenoid 565 (FIG. 39) is secured on the support member 461, and a link 604 is pivotally connected to the armature of the solenoid 565 and to a cocking member 605. Member 605 is pivoted on the rod 456, and a relatively strong torsion spring 606 is connected to the member 605 and to rod 457 for urging the member 605 clockwise against rod 457 as shown. A pawl 607 overlies the bail 473 and normally rests on the upper end of member 605 as shown. Pawl 607 is pivoted on a member 608 that is pivoted on the rod 459. A contractile spring 609 is anchored on rod 457 and it is connected to pawl 607 for urging the pawl 607 counterclockwise and for urging the member 608 counterclockwise against the rod 460 as shown. An insulator 610 is secured on the upper end of member 608 in alignment with a switch 611 that is secured on the support member 462.

The arrangement is such that energization of the solenoid 565, upon the imprinting of 0.100 inch character as described, pulls the link 604 and rotates the cocking member 605 counterclockwise against the rod 458. Near the end of the counterclockwise operation of member 605, the end of pawl 607 is urged down into a notch 612 in the end of member 605 by spring 609. At this point, the mechanism, is said to be cocked.

Upon cocking of the mechanism and as the pawl 607 pivots down into the notch 612, the pawl 607 pushes the bail 473 and insulator 472 downward against tension of spring 479 for opening the reader control circuit switch 453 as described. The opening of reader control circuit switch 453 (FIG. 31) breaks the reader circuit and thus deenergizes the code controlled motivating solenoids 495, 500 – 505 in the main decoder 494 for normalizing as described. When the decoder 494 (FIG. 51) is normalized, the circuit through the operated character key solenoid 548 is broken for permitting return of the operated key 39 as described. When the operated normal 0.100, inch 0.075 inch, or 0.050 inch character key 39 begins to return, its respective switch 555 (FIG. 52) is opened, as described, for deenergizing the respective (operated) 0.100 inch, 0.075 inch or 0.050 inch cycling mechanism solenoid 565, 566 or 567 as the case may be.

Upon deenergization of a cycling mechanism solenoid (565, FIG. 39, for example), the relatively strong spring 606 returns the cocked member 605 clockwise and thereby pushes the engaged pawl 607 rightward against the tension of lighter spring 609 for rotating the member 608 clockwise and thereby pushing its insulator 610 against the switch 611 to close the switch 611. Thus, the example 0.100 inch cycling mechanism is operated to close its switch 611 (FIG. 52).

In the same manner, following imprinting of a 0.075 inch character, deenergization of the operated solenoid 566 permits the cocked 0.075 inch cycling mechanism to operate for closing a respective switch 613. Likewise, for 0.050 inch character, deenergization of solenoid 567 permits its 0.050 inch cycling mechanism to close its respective switch 614.

From the above, it can be seen that a switch 614, 613 or 611 is closed as a key 39 that caused imprinting of a 0.050 inch, 0.075 inch or 0.100 inch character, respectively, begins to return from operated position. Closure of one of these switches 614, 613 or 611 causes the carriage moving mechanism to move the carriage **9*a*** forwardly appropriately for the imprinted character as will now be described.

Upon closure of switch 614, the carriage **9*a* is moved 0.050 inch by a circuit that runs from source (S) and switch 541, through a wire 615 connected between switch 541 and the motivating solenoid 267, it operates the solenoid 267, goes through a wire 616 connected between solenoid 267 and the now closed switch 614, and it goes to ground through switch 614 and a wire 617 as indicated. Operation of the solenoid 267 (FIG. 29) moves the drive pawl 261 against the first effective stop 269 and thereby moves the ratchet wheel 228 clockwise the equivalent of two teeth for shifting the paper carriage 9*a* forwardly two units (0.050inch), as described previously. At the end of this two unit (0.050inch) operation, the switch blade 286 is shifted onto the contacts 290 and 291, as previously described, and current now also travels from source (S) and switch 541 (FIG. 52), through wire 564, a wire 618 connected between wire 564 and the restoring solenoid 481, it operates solenoid 481 for restoring the operating cycling mechanism as will be described presently, it ccontinues through a wire 619 connected to solenoid 481 and to the contacts 290, 292 and 294, it now goes through the effective contact 290, blade 286 and contact 291, a wire 620 between contact 291 and switch 614, and it goes to ground through switch 614 and wire 617. Thus, the solenoid 481** is operated as soon as the carriage movement is accomplished.

Operation of solenoid 481 (FIG. 39) elevates the bail 473 for lifting the end of the operated pawl 607 out of the notch 612 and for reclosing the reader control circuit switch 453. When the pawl 607 is disengaged from notch 612, the spring 609 slides the pawl 607 leftward on the bail 473 and rotates the member 608 against rod 460 for, in this instance, permitting the switch 614 (FIG. 52) to open. When switch 614 opens, the motivating solenoid 267 is deenergized for permitting restoration of the carriage moving mechanism and thereupon shifting the blade 286 away from contacts 290 and 291 as described, and, at the same time, the solenoid 481 is deenergized. Deenergization of solenoid 481 permits the spring 609 (FIG. 39) to lower the end of pawl 607 slightly down on top of the member 605, while the lighter spring 479 holds the insulator 472 up in normal position where the insulator 472 holds the reader control circuit switch 453 closed, all as shown. Thus, a 0.050 inch character carriage moving cycle of operations is complete, and the reader control circuit is effective for reading an ensuing code.

Upon deenergization of solenoid 566 (FIG. 52) and closure of switch 613 as described, the carriage **9*a* is moved 0.075 inch by a circuit that runs from source (s) and switch 541, through wire 615, the motivating solenoid 267, a wire 621 connected between solenoid 267 and the solenoid 280, solenoid 280, a wire 622 that is connected between solenoid 280 and the now closed switch 613, and it goes to ground through the wire 617. As previously described, simultaneous operation of the solenoids 280 and 267 causes ratchet wheel 228 to be operated three teeth, since the solenoid 280 (FIG. 29) removes the two unit stop 269 and the solenoid 267 moves the ratchet wheel 228 until the drive pawl 261 abuts the three unit stop 270 as described. Whereupon, as described, the carriage 9*a* is moved 0.075 inch (three units) and the blade 286 is shifted onto the contacts 292, 293, that are rendered effective by closure of the switch 613 (FIG. 52) as will now be described. The engagement of blade 286 with contacts 292, 293 completes the cycling mechanism restoring circuit that goes through switch 541, wires 564 and 618, solenoid 491, wire 619, contact 292, blade 286, contact 293, a wire 623 connected between contact 293 and switch 613, and goes to ground through wire 618. Operation of the solenoid 481 restores the operated cycling mechanism for opening the switch 613, and it recloses the reader control switch 453 so that an ensuring code may be immediately read, all as described previously. The opening of switch 613 deenergizes the solenoids 267 and 280 for permitting restoration of the carriage moving mechanism as described. Opening of switch 613 and restoration of blade 286 deenergizes the restoring solenoid 481** as described.

Upon the imprinting of a 0.100 inch character, the operating of solenoid 565, the resulting opening of the reader control circuit switch 453, the opening of the character key switch 555 and the resulting deenergization of the solenoid 565, all as described, the switch 611 is closed, as described, for causing 0.100 inch carriage movement and concluding the sequence of operations. Closure of switch 611 completes a circuit that runs from the source (S) of power, through switch 541, wire 615, solenoid 267, wire 621, a wire 624, the solenoid 282, a wire 625, the switch 611, and goes to ground through wire 617. As previously described, simultaneous operation of the solenoids 282 and 267 (FIG. 29) moves the carriage 0.100 inch as controlled by the four unit stop 271. In this instance, as the blase 286 is engaged with the contacts 294 and 295, the cycling mechanism restoring circuit is complete from source (S) and switch 541 (FIG. 52), through wires 564 and 618, solenoid 481, wire 619, contacts 294, 295 and blade 286, a wire 626, switch 611, wire 617 and to ground, operation of solenoid 481 restores reader control circuit switch 453 for the reading of an ensuing code, and it restores the operated cycling mechanism for opening switch 611 and deenergizing the solenoids 282, 267 and 481.

In each of the above instances, the opening of the reader control circuit switch 453 deenergizes the solenoid 417 (FIG. 31) for permitting the cocked main reader tape feed mechanism 408 to feed the control tape 412 forwardly one step and for thereby shifting the just read code out of the main reader 407 and for shifting the succeeding code into the main reader 407, to initate the next sequence of operations, as described previously.

8. SPACES CONTROLLED BY CODE

The space keys 627, 628 and 629 (FIG. 8) in the reproducer are utilized only when the machine is being operated manually, and they are not operated when the reproducer is being operated automatically. Therefore, the structure and functions of these keys 627, 628, 629 will not be discussed further in this topic, but they will be described hereinafter in connection with manual operation of the machine.

Figure 31:
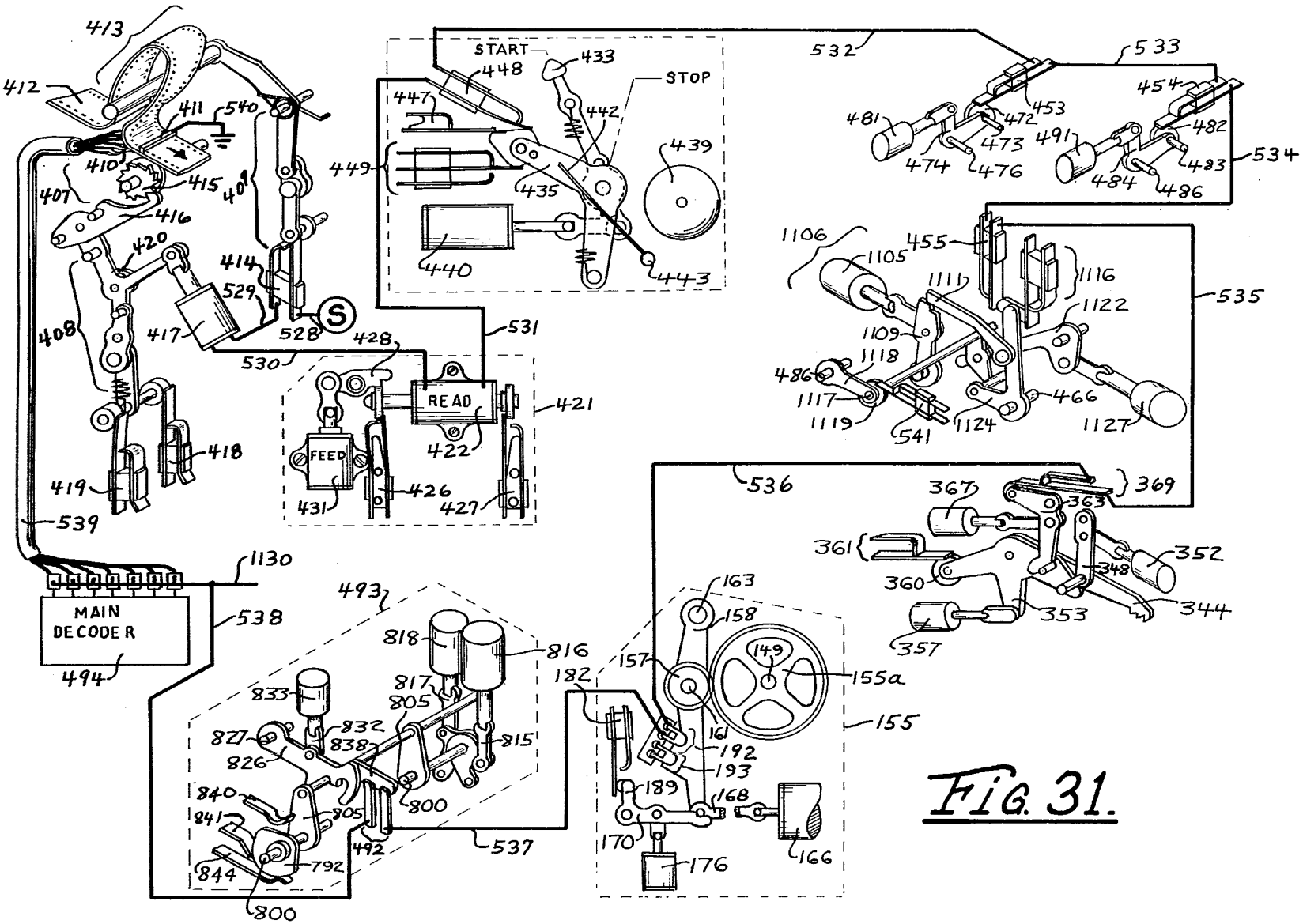
FIG. 31 is a schematic wiring diagram of the main code reading circuit.

As described in our copending applicaton, Ser. No. 213,045, for "JUSTIFYING TEXT WRITING COMPOSING MACHINE", filed Dec. 28, 1971, nut spaces that are given definite 0.050 inch, 0.075 inch and 0.100 inch carriage movements and that are not altered for justifying purposes, and a word space that is provided a normal 0.050 inch carriage movement and may be increased for justifying purposes may be encoded on the control tape 412 (FIG. 31). By referring to "Chart B", among the charts that are located herein immediately following the Figure Descriptions, it can be seen that the code for a 0.050 inch nut space is 3, 4, 6, that the code for a 0.075 inch nut space is 1, 4, 5, 7, and that the code for a 0.100 inch nut space is 2, 4, 7. It is also shown here that the "word space" code is 3, 4.

The code controlled 0.050 inch nut space operations will be discussed first. A wire 630 (FIG. 53) is connected between the wire 575 and the main decoder 494; particularly it is connected to the "0.050" NUT SP. (3, 4, 6) inch (FIG. 50) terminal that is rendered effective when the decoder motivating solenoids 501, 502, 504 for the code channels 3, 4, 6 are operated, in a manner previously described. Thus, when the main reader 407 (FIG. 31) senses the 0.050 inch Nut Space code 3, 4, 6 and the main decoder 494 (FIG. 53 ) is operated accordingly, in a previously described manner, a circuit is completed from source (S) and switch 541, wire 564, the solenoid 567 for cocking the 0.050 inch cycling mechanism, the wire 575, wire 630 and the circuit goes to ground through the operated decoder 494. The same as for 0.050 inch characters described previously, operation of the solenoid 567 cocks its respective cycling mechanism and thereby opens the reader control circuit switch 453 (FIG. 31) for deenergizing the motivating solenoids 495, 500 - 505 in the decoder 494 and for deenergizing the solenoid 417 in the main reader tape feed mechanism 408. Thereupon, the mechanism 408 feeds the tape 412 forwardly one step to shift the just read code out of the main reader 407 and at the same ime to shift the ensuing code into the main reader 407. When the decoder 494 (FIG. 53) is normalized, as described, the operated solenoid 567 is deenergized for permitting its cycling mechanism to operate and to close its switch 614, as described. Closure of the switch 614 causes the carriage moving mechanism to move the carriage **9*a* forwardly 0.050 inch, by the circuit that runs from source (S) and switch 541, wire 615, motivating solenoid 267, wire 616, now closed switch 614, and to ground through wire 617, the same as described for 0.050 inch characters. As soon s the ratchet wheel 228 is moved two teeth and the carriage 9*a* is thereby advanced two units (0.050 inch) as described, the blade 286 engages the effective contacts 290, 291 for completing the circuit from source (S) and switch 541, through wires 564 and 618, restoring solenoid 481, wire 619, contact 291, wire 620, switch 614 and to ground through wire 617. Operation of solenoid 481 recloses the reader control circuit switch 453 for the reading of the succeeding code that is now in the main reader 407** as described.

Figure 53:
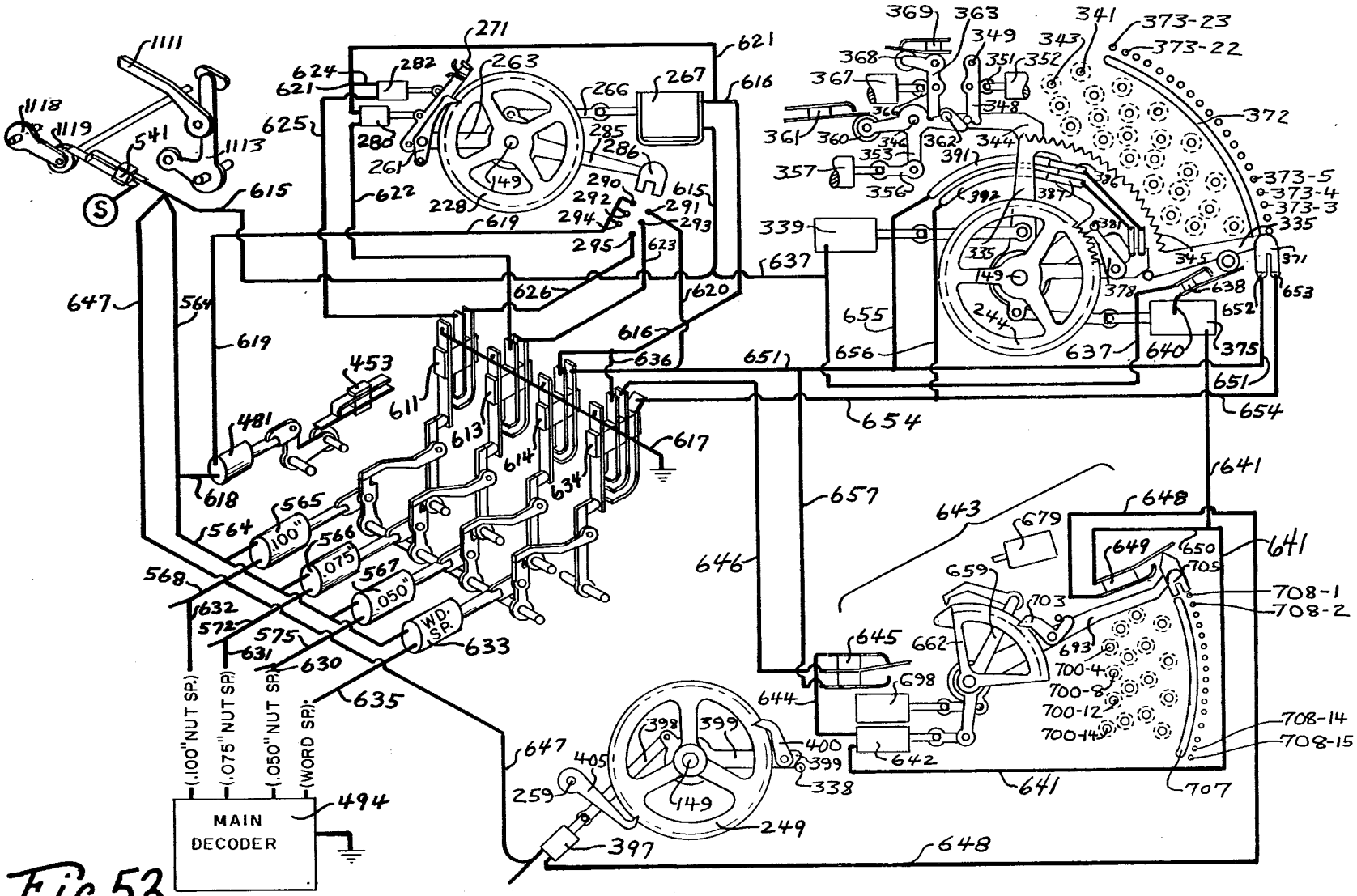
FIG. 53 is a schematic wiring diagram of the circuits that are related to cycling control and carriage movement for automatic code controlled word spaces and nut spaces. Nut spaces are two, three and four unit blank spaces that are not alterable for justifying purposes.

A wire 631 is connected between the wire 572 and the ".075"NUT SP. (1, 4, 5, 7)" (FIG. 50) terminal in the decoder 494 (FIG. 53). A wire 632 is connected between the wire 568 and the ".100 inch NUT SP. (2, 4, 7)" (FIG. 50) terminal in the decoder 494 (FIG. 53). When the main reader 407 (FIG. 31) senses the 0.075 inch Nut Space code 1, 4, 5, 7 and the main decoder 494 (FIG. 53) is operated accordingly, a circuit is completed thereby that travels from source (S) and switch 541, through wire 564, the solenoid 566 for cocking the .075 inch cycling mechanism, wires 572 and 531, and the circuit goes to ground through the operated decoder 494. By the circuit, the 0.075 inch cycling mechanism is employed for cycling the control tape 412 and moving the carriage **9*a* appropriately for the 0.075 inch nut space, in the same manner as described for the 0.075 inch characters. Similarly, when the main reader 407 (FIG. 31) senses the 0.100 inch nut space code (2, 4, 7) and the decoder 494 (FIG. 53) is operated, a circuit is directed from source (S) and switch 541, through wire 564, the solenoid 565 for cocking the 0.100 inch cycling mechanism, wires 568 and 632, and to ground through the operated decoder 494**. Thus, the 0.100 inch cycling mechanism is operated for controlling a 0.100 inch carriage moving cycle of operations, the same as for 0.100 inch characters described previously.

Word spaced operations, which may include additional units of movement for justifying purposes, will now be described. As described in our aforesaid copending applications, a word space is encoded whenever the space bar of the encoding machine is operated. When a word space code 3, 4, is sensed by the main reader 407 (FIG. 31), the main decoder 494 is operated accordingly and the cocking solenoid 417 in the tape feed mechanism 408 is operated by the reader control circuit, the same as described for any other code. As stated above, there is never more than a total of 23 units (equal to the fixed length justifying area) added to any justified line, regardless of the number of word spaces, and as the number of word spaces increase, the quotient amount decreases accordingly.

Operation of the decoder 494, according to the word space code, completes a circuit that runs from source (S) and switch 541 (FIG. 53), through wire 564, a solenoid 633 for cocking a word space cycling mechanism which is just like that described in connection with FIG. 39 except that its switch 634 (FIG. 53) has four blades instead of the three shown in switch 611, the circuit continues through a wire 635 connected between solenoid 633 and the terminal marked "WORD SP. (3, 4,)" (FIG. 50), and it goes to ground through the operated decoder 494 (FIG. 53). Upon operation of the solenoid 633 and the cocking of its word space cycling mechanism, the mechanism opens the reader control circuit switch 453 for deenergizing the solenoid 417 (FIG. 31) and the motivating solenoids 495, 500 - 505 in the decoder 494. Deenergization of the solenoid 417 permits the feed mechanism 408 to feed a succeeding code into the main reader 407, and deenergization of the motivating solenoids 495, 500 - 505 of the decoder 494 permits the decoder 494 to restore for breaking the circuit through the solenoid 633 (FIG. 53). Whereupon, the word space cycling mechanism closes its switch 634 for causing the normal 0.050 inch word space carriage movement by operation of ratchet wheel 228, for at times adding the justifying quotient amount by operation of the ratchet wheel 244 a corresponding number of teeth, and for at times adding one unit (0.025 inch) of a remainder by operation of the ratchet wheel 249.

Closure of switch 634 causes the ratchet wheel 228 and the carriage **9*a* to be advanced the normal word space amount (0.050 inch) by a circuit that runs from source (S) and switch 541, through wire 615, the motivating solenoid 267, wire 616, a wire 636 between wire 616 and switch 634, through now closed switch 634 and it goes to ground through wire 617**.

The circuit for advancing the ratchet wheel 244 and the carriage **9*a* a number of units representing the quotient will now be described. A wire 637 is connected between the wire 615 and a switch 638 that is normally open and that is closed only when the adjustable stop member 335 is shifted counterclockwise to a quotient representing position. The switch 638 is secured on the plate 246 (FIG. 30), and an insulator 639 is secured on the stop member 335, as shown. A wire 640 (FIG. 53) is connected to switch 638 and to the motivating solenoid 375. A wire 641 is connected to the solenoid 375 and to a counting solenoid 642 in a duplex counter 643. The duplex counter 643 is settable according to a justifying remainder code, and the counting solenoid 642 is operated to deduct one from the setting, each time a word space is reproduced, to limit the times a remainder unit is added to word spaces and, at the same time the solenoid 642 is operated to count one in the duplex counter 643 to limit the number of times a justifying quotient amount is added, as will be explained later. As stated above, there is never more than a total of 23 units (equal to the fixed length justifying area) added to any justified line, regardless of the number of word spaces, and as the number of word spaces increase, the quotient amount decreases accordingly. A wire 644 is connected between solenoid 642 and a switch 645 in the counter 643. A wire 646 is connected to the switch 645 and the switch 634. The switch 645 is normally conditioned, as shown here, for rendering the wires 644 and 646 effective, but the switch 645 is shiftable for rendering the circuits that pass through wire 644 and solenoid 642 ineffective when the counter 643** has been operated to count more than sixteen word spaces in a reproduced line, as will be explained fully hereinafter.

Assume now that the adjustable stop member 335 has been set counterclockwise in a quotient representing position and the switch 638 is closed as described, that the counter 643 has not yet counted sixteen spaces and the switch 645 is conditioned as shown here, and that a word space code has been read and the switch 634 is closed. When these conditions exist, the solenoid 375 is operated to rotate the ratchet wheel 244 and thereby adds the quotient amount to the normal word space carriage movement, as described, and the solenoid 375 is operated as follows. The circuit travels from source (S) and switch 541, through wires 615 and 637, the now closed switch 638, wire 640, it operates motivating solenoid 375, it continues through wire 641, the counting solenoid 642, wire 644, switch 645, wire 646, the word space cycling mechanism switch 634 and it goes to ground through wire 617. Thus, the ratchet wheels 228 and 244 are operated simultaneously for moving the carriage **9*a*** a normal word space plus the quotient amount for justifying purposes.

The circuit provided for at times operating the motivating solenoid 397 and thereby rotating the ratchet wheel 249, simultaneously with the ratchet wheel 228 and also at times with the ratchet wheel 244, to add one unit to a number of word spaces that corresponds to the division remainder, will now be described. A wire 647 is connected to the switch 541 and to the motivating solenoid 397. A wire 648 is connected between solenoid 397 and a switch 649, that is normally held open as indicated to render the circuit ineffective but that is permitted to close for rendering the circuit effective when the duplex counter 643 is set according to a remainder as will be explained further hereinafter. A wire 650 is connected to the switch 649 and to the wire 641. Thus, when the switch 649 is closed and a remainder unit is therefore to be added to a word space, and when the word space cycling mechanism switch 634 is closed as described, the remainder unit circuit is complete from source (S) and switch 541, through wire 647, motivating solenoid 397, wire 648, now closed switch 649, wires 650 and 641, the counting solenoid 642, wire 644, switch 645 conditioned as shown which is the condition whenever this circuit is required, wire 646, now closed switch 634, and it goes to ground through wire 617. Thus, the solenoid 397 is operated for each word space, until the switch 649 is opened when duplex 643 counts the number that corresponds to the remainder as will be described later.

From the above, it can be seen that for each justifying word space the ratchet wheel 228 is always rotated two teeth for moving the carriage 9a two units, that ratchet wheel 244 may be rotated a number of teeth from one to twenty three for adding the same number of units as determined by the adjustable stop member 335, and that the ratchet wheel 249 is never rotated more than one tooth (one unit portion of a remainder) for adding one more unit to a number of word spaces that equals the remainder. Thus, it is seen that ratchet wheel 228 is always operated a greater extent than ratchet wheel 249 and that the ratchet wheel 244 may be operated a greater extent than the ratchet wheel 249. Accordingly, a means is provided for closing the reader control circuit switch 453 as soon as the ratchet wheel 228 has rotated its two teeth and the ratchet wheel 244 has rotated the number of teeth determined by the adjustable stop member 335. Thus, in any particular instance where a word space is to have an amount added for justifying purposes, it will be seen that the reader control circuit switch 453 is closed as soon as the ratchet wheel 228 or 244 that rotates the greater amount is fully operated. However, when the adjustable stop member 335 is set in normal zero representing position, there being no movement of the ratchet wheel 244 in such an instance, the reader control circuit switch 453 is reclosed as soon as the ratchet wheel 228 is moved for two units of carriage movement.

The means for closing the reader control circuit switch 453, following word space operations, will now be described.

The arrangement for closing the reader control circuit switch 453, when the adjustable stop member 335 is in zero position and when the ratchet wheel 228 is operated alone or with the remainder ratchet wheel 249, will be explained first. A wire 651 is connected between the wire 620 and a contact 652. The contact 652 (FIG. 30) and a companion contact 653 are secured on the insulator 374 in positions to be engaged by the blade 371 when the member 335 is in the illustrated zero representing position. A wire 654 (FIG. 53) is connected between contact 653 and the switch 634. Under the above conditions, as soon as the ratchet wheel 228 is operated two units and the blade 286 is engaged with the contacts 290 and 291 as described, a circuit is complete from source (S) and switch 541, through wires 564 and 618, the solenoid 481 for restoring the word space cycling mechanism and reclosing the reader control circuit switch 453, wire 619, contacts 290, 291 and blade 286, wire 620, wire 651, contacts 652, 653 and blade 371, wire 654, now closed switch 634, wire 617 and to ground. As soon as the word space cycling mechanism restores, its switch 634 opens, and this deenergizes the solenoid 481 and also permits the operated carriage moving mechanism to restore as previously described.

The arrangement for closing the reader control circuit switch 453, when the adjustable step member 335 (FIG. 30) is set counterclockwise to one of the previously described quotient representing positions and the ratchet wheel 244 is operated simultaneously with the ratchet wheel 228, will now be described. A wire 655, (FIG. 53) is connected to the wire 651 and to the previously described arcuate conductor 391. A wire 656 is connected between the conductor 392 and the wire 654. Under the instant condition and as soon as the carriage 9a is moved the normal word space and the quotient amounts, the restoring solenoid 481 is operated by a circuit that travels from source (S) and switch 541, through wires 564 and 618, the solenoid 481 for restoring the operated word space cycling mechanism and reclosing the reader control circuit switch 453 as described, the wire 619, contacts 290, 291 and blade 286, wires 620, 651 and 655, conductor 391 (FIG. 30), the blade 386, the blade 384, the conductor 383 that engages the blades 384 and 385 when the member 377 is rotated counterclockwise and the drive pawl 378 abuts the adjustable stop 381 as described, through the blade 385, the wire 388, the blade 387, the conductor 392 (FIG. 53), wires 656 and 654, the now closed switch 634 and goes to ground through wire 617. As described previously, operation of the solenoid 481 recloses the reader control circuit switch 453 for reading of the next code and it restores the operated word space cycling mechanism for opening switch 634 and thereby for permitting restoration of the carriage moving mechanism.

As fully described in our aforesaid copending application Ser. No. 213,045, filed Dec. 28, 1971, now U.S. Pat. No. 3,993,179, issued Nov. 23, 1976 and as will be described further herein, the justifying encoding arrangement is designed to adjust the first sixteen or less word spaces, depending on the number of word spaces in the line, in order to make the last character extend exactly to the right margin. Thus, during reproduction of the justified line, the switch 645 is shifted for terminating any further possible operations of the counting solenoid 642 and the motivating solenoid 375, whenever the duplex counter 643 is operated to count sixteen word spaces as will be explained presently. The remainder motivating solenoid 397 is never operated for more than fifteen word spaces as controlled by switch 649 as will be described later. When the switch 645 is shifted and the decoder 494 is operated for a word space, when the switch 634 is cosed and the carriage 9a is shifted the normal two unit word space amount is described, the restoring circuit is effective from source (S) and switch 541, wires 564 and 618, the solenoid 481 for reclosing the reader control circuit switch 453 and restoring the word space cycling mechanism as described, wire 619, contacts 290, 291 and blade 286, wires 620 and 651, a wire 657 between wire 651 and the switch 645, through the now shifted switch 645, wire 646, switch 634, wire 617 and to ground. Thus, for all word spaces over sixteen, the main reader control circuit is rendered effective for reading an ensuing code and the word space cycling mechanism is restored as described, as soon as the carriage 9a is moved two units.

9. DUPLEX COUNTER STRUCTURE

The counting solenoid 642, and the switches 645 and 649 are secured on the vertical plate 35 (FIG. 54) in any known manner. The plate 35 is secured to the general frame members of the machine, as described previously.

Figures 54, 55, 56:
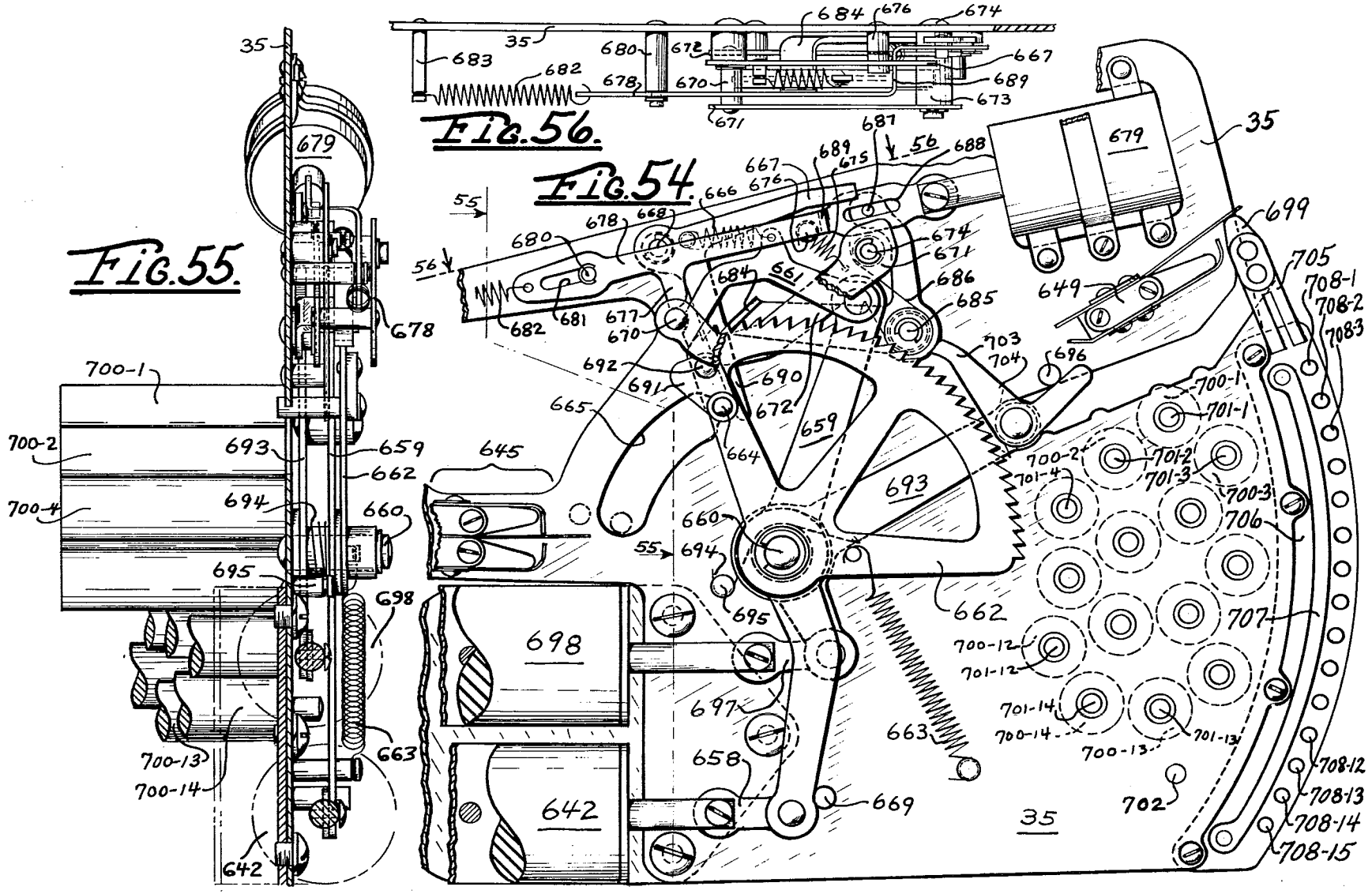
FIG. 54 is a fragmentary full scale right side view of the word space counter which controls justifying in the reproducer and which is also incorporated in reduced scale in FIG. 1.
FIG. 55 is a fragmentary sectional front view of the counter as seen from line 55—55 (FIG. 54).
FIG. 56 is a top view of a pawl-latch mechanism as viewed from line 56—56 (FIG. 54).

A link 658 is pivotally connected to the armature of the counting solenoid 642 and to a depending arm of a member 659 that is pivoted intermediate its ends on a stud 660. Stud 660 is secured on the plate 35. A counting drive pawl 661 is pivoted at one end on the upper end of the member 659, and the other end of the pawl 661 is normally engaged with a ratchet segment 662. Segment 662 is pivoted on stud 660 and it is urged clockwise by a contractile spring 663 that is connected to the segment 662 and to plate 35. A stud 664 is secured on segment 662, and the extended cylindrically shaped head of the stud 664 extends through a slot 665 in the plate 35. The segment 662 is stopped in its illustrated clockwise normal position where the stud 664 engages the upper end of the slot 665. A contractile spring 666 is connected to the pawl 661 and to a clearing detent 667. The detent 667 is pivoted on a stud 668, and stud 668 is secured on plate 35. The spring 666 is connected in such an attitude that it urges the detent 667 clockwise, that it urges pawl 661 counterclockwise against segment 662, and that it urges the pawl 661 and member 659 counterclockwise about stud 660. The member 659 is stopped in its illustrated normal position, when its lower arm engages a stop stud 669 that is secured on plate 35. In this counterclockwise position of member 659, the end of pawl 661 extends under an overrotation preventing stop 670. Stop 670 is formed like a bail, with its ends secured to identical parallel bail arms 671 and 672. These arms 671 and 672 (FIG. 56) are secured on a sleeve 673 that is pivoted on a stud 674. Stud 674 is secured on plate 35. A contractile spring 675 (FIG. 54) is connected to arm 672 and to a stud 676 (FIG. 56) that is secured on the plate 35. The spring 675 (FIG. 54) is provided for rotating the bail-like assembly clockwise and for elevating the stop 670 during clearing operations as will be described. However, the stop 670 is normally held down by a finger 677 that usually blocks the stop in the position shown. Finger 677 is on a link 678 that is connected at its rightward end to the armature of a clearing solenoid 679. Solenoid 679 is secured on the plate 35. The leftward end of ink 678 is supported on a stud 680 that extends through a slot 681 in the link 678, and that is secured on plate 35 (FIG. 56). A contractile spring 682 is connected to link 678 and to a stud 683 that is secured on plate 35. The spring 682 (FIG. 54) normally holds the link 678 leftward against stud 680 as shown, where the finger 677 is in effective blocking position. A ratchet detent 684 is normally engaged with the segment 662 for holding the segment 662 in any counterclockwise operated position. The detent 684 is pivoted on a stud 685 that is secured on plate 35. A torsion spring 686 is anchored in any convenient manner and it is connected to detent 684 for urging the detent 684 counterclockwise against the teeth of segment 662. A stud 687 is secured on an upward extension of the ratchet detent 684, and the stud 687 is assembled through a slot 688 in the link 678. The slot 688 is provided for permitting the stud 687 to shift freely rightward and return as the detent 684 ratchets over the teeth on segment 662 as will be described. The slot 688 is also situated to permit an initial righward movement of the link 678 before the left end of the slot 688 moves the stud 687 in clearing operations as will be explained presently.

The clearing detent 667 normally overlies an offset portion 689 (FIG. 56) of the link 678, but it is normally held up in an ineffective position, clear of the offset 689 as shown in FIG. 54, by engagement of the stud 664 with a depending finger 690 of the detent 667.

As previously described in connection with FIG. 53, the counting colenoid 642 is energized at the same time the solenoid 375, solenoid 397, or both are operated to add a justifying amount to a normal word space, and it is deenergized as soon as the movement for the altered word space is complete. In such an instance when the counting solenoid 642 (FIG. 54) is energized, it pulls link 658 and rotates the member 659 clockwise against the stud 685 while the pawl 661 ratchets over one tooth on the segment 662. When the solenoid 642 is deenergized, the spring 666 returns the drive pawl 661 and member 659, and the pawl 661 rotates the segment 662 one tooth step counterclockwise while the detent 684 ratchets over one tooth on the segment 662. In this manner the segment 662 may be operated successive single tooth steps counterclockwise for counting the occurrence of as many word spaces. During the first of such counterclockwise steps of the segment 662, the stud 664 moves away from the finger 690 and the spring 666 rotates the clearing detent 667 slightly clockwise down on the top edge of the offset 689 so as to be effective during a clearing operation as will be explained.

An insulator 691 is secured on the segment 662 by a rivet 692 and it is also held in position by the stud 664. When the segment 662 is operated for counting fifteen word spaces, the insulator 691 is swung down close to the center blade of the switch 645. Thereafter, at times when a sixteenth word space is counted, the insulator 691 shifts the switch 645 (FIG. 53) for limiting the operations of the justifying motivating solenoid 375, and the counting solenoid 642 to the first sixteen word space operations in a line as previously described.

The clearing solenoid 679 (FIG. 54) is operated, when the machine responds to a carriage return code, as will be described later in connection with carriage return operations. However, upon operation of the clearing solenoid 679, it pulls link 678 rightward. Initial rightward movement of link 678 removes the finger 677 from blocking position over the stop 670, but the bail-like stop 670 is held down in the illustrated position by the bent over portion of detent 684 that overlies the bail arm 672, as shown best in FIG. 56, and the detent spring 686 (FIG. 54) is heavier than the light tensioned spring 675. However, following the initial rightward movement of the link 678, the left end of its slot 688 shifts the stud 687 and the detent 684 clockwise against the tension of spring 686 for disengaging the detent 684 from the segment 662, while the spring 675 rotates the bail-like arrangement including stop 670 and bail arm 672 followingly. As the movement continues, the detent 684 engages the underside of the drive pawl 661 and finally disengages the drive pawl 661 from the segment 662. During the final rightward movement of link 678, the rightward end of the clearing detent 667 drops down to the left of the offset 689 and on top of the stud 676 under tension of spring 666, for holding the link 678 in its operated position until segment 662 is fully returned. As the detent 667 rotates into holding position, its finger 690 swings leftward into the return path of stud 664. When detent 684 has been swung upward and as soon as the drive pawl 661 clears the teeth on segment 662, the spring 663 returns the segment 662 clockwise. At times when the segment 662 has counted sixteen word spaces and the switch 645 has been shifted, the first clockwise return movement of segment 662 withdraws the insulator 691 from the switch 645 and the switch 645 returns to the illustrated normal condition. By the time the segment 662 is returned and the stud 664 is stopped in the upper end of slot 665, the stud 664 will have engaged the finger 690 and thereby rotated the detent 667 counterclockwise to illustrated normal position for releasing the link 678. Whereupon, the spring 682 restores the link 678 leftward, the spring 686 restores the detent 684 counterclockwise, the spring 666 restores the drive pawl 661 into engagement with the segment 662 then in fully restored position, the detent 684 moves away from the pawl 661 and it restores the bail arrangement including stop 670 and bail arm 672 and the detent then engages the segment 662, the left end of slot 688 moves away from the stud 687 while the finger 677 on link 678 moves into blocking position over stop 670, and the link 678 is stopped in normal position as the right end of slot 681 engages the stud 680, all in that order. Thus, the mechanism is cleared and restored to the illustrated normal zero representing position.

The manner in which the duplex counter 643 counts the number of word spaces and limits the number of times a justifying quotient amount is added to the first sixteen spaces in line has just been described. The counter 643 also includes a means (primarily a member 693) that is presettable in position for representing a justifying remainder and that is controlled by the segment 662 for deducting one from the previous setting each time one unit of the remainder is added to a word space. By thus reducing the previous setting to zero, the means also limits the times one unit of a remainder is added to a word space and the number of times is limited to a number that corresponds to the justifying remainder. The presettable means and the means for controlling the switch 649 and thereby controlling the number of times the single units of the remainder are to be added will now be described.

The presettable member 693 is pivoted on the stud 660 to the left of the member 659 (FIG. 55). A torsion spring 694 is anchored on a stud 695 that is secured on plate 35, and the spring 694 is also connected to member 693 (FIG. 54). Spring 694 urges the member 693 counterclockwise to normal position, as shown, against return stop stud 696 that is secured on plate 35. A link 697 is pivotally connected to a depending arm of member 693 and to the armature of a solenoid 698 that is provided for setting the member 693 in a remainder representing position as will be explained presently. The solenoid 698 is secured to plate 35 in any known manner. In the illustrated normal zero remainder representing position (cleared position) of member 693, an insulator 699 that is secured on the remote end of the member 693 holds the switch 649 open as shown for rendering the one unit motivating solenoid 397 (FIG. 53) inoperable as described. When the member 693 (FIG. 54) is in a clockwise remainder representing position, the insulator 699 is moved away from switch 649 and the switch 649 is then closed.

Fourteen selectively operable stop solenoids 700, with respective suffix numbers 1 - 14, are arranged in positions corresponding to the first fourteen operated positions of the member 693. The solenoids 700 are equipped with normally withdrawn stops 701 that are individually designated by respective suffixes, members 1 - 14. The solenoids 700 (FIG. 55) are secured on the leftward face of the plate 35, and their normally ineffective stops 701 (FIG. 54) extend generally no more than flush with the rightward face of the plate 35. The arrangement is such that, upon operation of a solenoid 700, its respective stop 701 is extended into blocking alignment with clockwise movement of member 693 for stopping the member 693 in that remainder representing position. Upon deenergization of a solenoid 700, its stop 701 is withdrawn to ineffective position, in a known manner. A stationary stop stud 702 is secured on plate 35 and it extends into effective blocking position for stopping member 693 inthe Fifteenth (largest number) remainder representing position.

A pawl 703 is pivotally mounted on the member 693, and it is provided for connecting the member 693 with the segment 662 when the member 693 is shifted to a remainder representing position and while the duplex counter 643 counts the number of word spaces that corresponds to the remainder. However, when the member 693 is in the illustrated zero representing (returned) position, the pawl 703 is held in its clockwise ineffective position by the stud 696 as shown, so the segment 662 may be operated independently of the pawl 703 and member 693. A torsion spring 704 is connected to member 693 and to the pawl 703 for urging the pawl 703 counterclockwise into engagement with segment 662 when the member 693 is in a clockwise position.

A blade 705 is secured on and it is insulated from the end of member 693, in any known manner. Blade 705 is flexed against an insulator 706, and it is arranged to engage a conductor strip 707 and successive contacts 708 - 1 to 708 - 15 on the insulator 706 when the member 693 is moved to remainder representing positions 1 to 15, respectively. Insulator 706 is secured on plate 35. As will be described later, a contact 708 - 1 to 708 - 15 is effective only when the member 693 is moved to and stopped in the corresponding remainder representing position, and the continuity through the strip 707, blade 705 and the effective contact 708-1 to 708-15 is used to cycle the instant remainder code through the main reader 407.

When the justifying fifteen unit remainder code is read as will be described, the solenoid 698 is operated for pulling link 697 and rotating the member 693 clockwise against the tension of spring 694 and until the member 693 is stopped in its fifteen unit remainder representing position by the stationary stud 702. As the member 693 moves the first increment clockwise, its insulator 699 permits the switch 649 to close for rendering the motivating solenoid 397 (FIG. 53) operable for adding one unit to each of the first fifteen word spaces as described. At the same time, the member 693 (FIG. 54) and pawl 703 are moved away from return stud 696, and the spring 704 engages the pawl 703 with the teeth of segment 662 and the pawl 703 ratchets over fifteen teeth of the segment 662. As soon as the blade 705 engages the effective contact 708 - 15, further cycling occurs and the solenoid 698 is deenergized as will be described. Whereupon, the pawl 703 holds the member 693 in its fifteenth operated position by engagement of the pawl 703 with the segment 662. As will become apparent later, this fifteen unit representing position of member 693 will not be called for unless the line to be reproduced has fifteen or more word spaces. Thus, during reproduction of the line, when the counting solenoid 642 is operated and the segment 662 is stepped counterclockwise one step for each word space as described, the member 693 is also moved counterclockwise step by step therewith by the spring 694 and engagement of the pawl 703 with the segment 662. Thus, the switch 649 remains closed for fifteen word spaces. However, when the fifteenth word space is counted and the member 693 is shifted the last step counterclockwise, the insulator 699 opens the switch 649 for preventing further operations of solenoid 397 (FIG. 53), and the pawl 703 (FIG. 54) engages the stud 696 and it is rotated clear of the segment 662 as shown. Thereafter, when the line is terminated and the clearing solenoid 679 is operated, and the segment 662 is restored clockwise, as described, without interference from the pawl 703 and the member 693 then in restored condition against stud 696 as shown.

When a code for any other justifying remainder (1 - 14) is read as will be described, the solenoid 698 is operated together with the one of the solenoids 700 - 1 to 700 - 14 that corresponds to the remainder. Under such a condition, the solenoid 698 rotates the member 693 clockwise against the then effectively extended stop 701 - 1 to 701 - 14 for setting the member 693 in the corresponding remainder representing position. When the blade 705 engages the effective contact 708 - 1 to 708 - 14, further cycling of the machine is accomplished and the solenoid 698 is deenergized, as will be explained, and the pawl 703 connects the member 693 with the segment 662 in the same manner as described previously. Thus, under any condition where there is a justifying remainder, the duplex counter 643 is conditioned to permit the switch 649 to remain closed until the solenoid 397 (FIG. 53) has added one unit to a number of word spaces that corresponds to the value of the justifying remainder.

10. JUSTIFICATION CODES

As explained briefly hereinbefore and as described in detail in our copending application Ser. No. 213,045, filed Dec. 28, 1971, now U.S. Pat. No. 3,993,179, issued Nov. 23, 1976 for "Justifying, Text Writing Composing Machine", all encoding, code media handling and code reading is done automatically, preferably in one assembly that is preferably incorporated as a part of the composing machine. As also described, justification of the lines in the instant reproducer is controlled by one or two sets of code punch holes (justification codes) that are located ahead of the code punch holes for characters and functions that make up the text codes for each line to be justified. The first possible set of justification codes is the quotient code, which is for controlling the adjustment of the stop member 335 (FIG. 30 of justification codes is the remainder code, which is for controlling the adjustment of the member 693 (FIG. 54) in the duplex counter 643.

The codes for each possible "QUOTIENT" and for each possible "REMAINDER" are shown in "CHART C" that follows the figure descriptions hereinbefore.

The arrangement for controlling the setting of the adjustable stop member 335 (FIG. 30) according to the quotient codes will be described first. It should be remembered that the locking pawl 344 is disengaged from the member 335 upon return of the carriage 9*a* from a previous line.

When the main reader 407 (FIG. 31) senses a quotient code, the cocking solenoid 417 is operated in preparation for feeding the quotient code out of the main reader 407, the read solenoid 422 is operated for terminating the consecutive tape feeding operations, and the main decoder 494 is operated according to the sensed code, the same as described in topic "5. Main Reader Circuit". When the decoder 494 (FIG. 31) is operated according to a quotient code (CHART C), a ground is provided for a circuit that is designated for that particular quotient. These circuits are indicated, in FIG. 50, by a number that corresponds to the quotient, the initial letters "U.Q." which stand for unit quotient, and numbers in parentheses to show the code for that quotient. For example, near the bottom of FIG. 50, the circuit marked "1 U.Q. (5)" stands for the one unit quotient, the code for which is 5. Likewise, "2 U.Q. (6)" is for the two unit quotient, the code for which is 6. The quotient code circuits will now be described.

A wire 709 (FIG. 57) is connected to the normally closed switch 541 and to the solenoid 339 that is provided for setting the member 335 in an operated position as described. A wire 710 is connected to solenoid 339 and to a normally effective blade 711 in a single pole double throw switch 712. The switch 712 is normally conditoned as shown here, under control of a justifying control key 713 that is normally in a "Justify" position and that will be described later. A blade 714, that is normally engaged with blade 711, is connected by a wire 715 to each of the twenty two stop solenoids 341 - 1 to 341 - 22 (FIG. 30) in any known manner. A wire 716 (FIG. 57) is connected between each of the solenoids 341 - 1 to 341 - 22 and the respective contact 373 - 1 to 373 - 22 (FIG. 30). A wire 717 (FIG. 57) is connected between the wire 715 and the contact 373 - 23, since there is no stop solenoid for the stationary 23rd stop as described. A wire 718 - 1 to 718 - 23 is connected to contacts 373 - 1 to 373 - 23, respectively, and to the terminals "1 U.Q. (5)" to "23 U.Q. (12346)", respectively, in the decoder 494 (FIG. 50).

Thus, operation of the decoder 494 according to a quotient code, completes a circuit that runs from the source (s) and switch 541 (FIG. 57), through wire 709, solenoid 339 for rotating the adjustable stop member 335 counterclockwise as described, wire 710, switch 712, wire 715, one of the differential stop solenoids 341 and its wire 716 or the wire 717 as the case may be, the respective contact 373 - 1 to 373 - 23, and it goes to ground through the respective wire 718 - 1 to 718 - 23 and the operated decoder 494 as described. Thus, the adjustable stop member 335 (FIG. 30) is moved to a quotient representing position by operation of the solenoid 339 and the position is determined by the effective stop 342 - 1 to 342 - 22 or 343 according to a quotient code.

Figure 57:
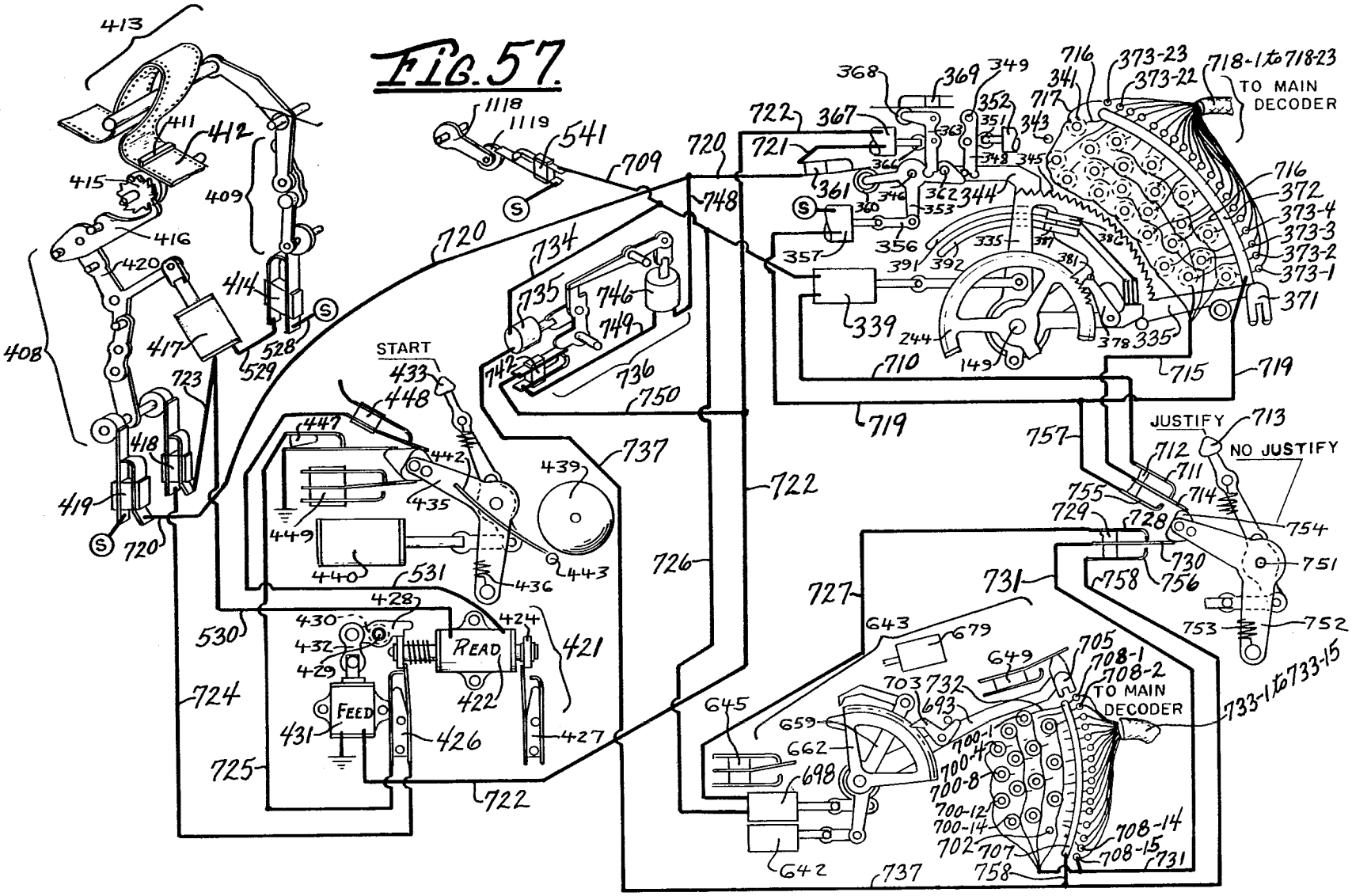
FIG. 57 is a schematic wiring diagram of code controlled circuits for automatically adjusting the justifying mechanism.

As soon as the member 335 is moved into the quotient representing position, the blade 371 is engaged with the effective contact 373 - 1 to 373 - 23 for operating the solenoid 357 and for engaging the locking pawl 344 as will now be described. A source (s) of power is connected to the solenoid 357 (FIG. 57). A wire 719 is connected between solenoid 357 and the conductor strip 372 (FIG. 30). Thus, when the member 335 (FIG. 57) is shifted into quotient representing position, the solenoid 357 is energized for engaging the locking pawl 344 to hold the member 335 in operated position, and the circuit continues through the wire 719, conductor 372, blade 371, the effective contact 373 - 1 to 373 - 23, the related wire 718 - 1 to 718 - 23 and the operated decoder 494 as described.

Upon operation of solenoid 357, the locking pawl 344 (FIG. 30) is latched by pawl 348 into effective position as shown and described. As also described, the spring 354 is now tensed further, while pawl 363 snaps over tud 362 and the insulator 368 permits the reader control circuit switch 369 to open, and the insultor 360 then closes the switch 361. When switch 369 (FIG. 31) opens, the reader control is broken for deenergizing the cocking solenoid 417, the read solenoid 422 and the decoder motivating solenoids 495, 500 - 505 that were energized in response to the reading of the quotient code. Deenergization of the solenoid 417 permits the cocked tape feed mechanism 408 to feed the just read quotient code out of the main reader 407, and, if there is a justification remainder code for the new line, to feed the remainder code into the main reader 407, as described. At times when there is no remainder code for the line, blank tape 412 will be fed into the main reader 407 at this time.

The circuit for remaking the reader control circuit, following the reading of a quotient code, will now be described. It should be remembered that the switches 418 and 419 are closed as soon as the reader control circuit is broken and the tape feed mechanism 408 feeds the tape 412 one step forward. A source (s) of power is connected to switch 419 (FIG. 57). A wire 720, which may include a communication means intermediate its ends as described, is connected between switch 419 and the switch 361. A wire 721 is connected to switch 361 and to the solenoid 367. A wire 722 is connected between solenoid 367 and the solenoid 431 that is grounded as shown. As soon as the quotient code is fed out of the main reader 407 and the switch 419 is closed as described, current flows from source (S) through switch 419, wire 720, the now cosed switch 361, wire 721, the solenoid 367, wire 722, and goes to ground through solenoid 431. Operation of the solenoid 367 (FIG. 30) recloses the reader control circuit switch 369, and, when the pawl 363 releases stud 362, the spring 354 rotates the member 353 back against the stud 347 and permits the switch 361 to open, as described. Operation of the solenoid 431 (FIG. 57) conditions the feed-read switch means 421 for consecutive feeding operations as described. The opening of switch 361 deenergizes the solenoids 367 and 431, and thus the cycles of operations for setting the adjustable stop member 335, according to a quotient code, is complete.

When the quotient code is fed out of the main reader 407 (FIG. 31) and there is no code on the tape 412 immediately following the quotient code, as when there is no justifying remainder code, the blank tape 412 is fed through the main reader 407, under control of the now closed switch 426 (FIG. 57) in the switch means 421 now in feed condition as described. The consecutive step tape feeding circuit runs from source (s) and wire 528, through the now closed switch 414, wire 529, the tape feed cocking solenoid 417, a wire 723 between solenoid 417 and switch 418, the now closed switch 418, a wire 724 (that may include a communication means intermediate its ends, as described) between switch 418 and the switch 426, the now closed switch 426, a wire 725 between switch 426 and the now closed switch 447, and goes to ground as indicated. By alternate operation of the cocking solenoid 417 and the snap-switch opening of switch 418 as described, the blank spaces of the control tape 412 are fed forwardly through the main reader 407 (FIG. 31) until the next code is read. When the next code is read (in this instance, the first text code for the line), the cocking solenoid 417 is energized simultaneously by the reader control circuit that is shown here and that goes through the wire 530, the "read" solenoid 422 and so as described, and by the just described consecutive step tape feed circuit controlled by switches 418 and 426 (FIG. 57). Since the "read" solenoid 422 is now energized simultaneously with the cocking solenoid 417, the reader control circuit takes precedence, and the solenoid 422 opens the switch 426 for terminating the consecutive step blank tape feeding operations.

Return now to the point where a quotient code is fed out of the main reader 407 (FIG. 31) and the consecutive feeding circuit switch 426 is closed, as described, and assume that there is a remainder code following the quotient code on the control tape 412. In this instance, the reading of the remainder code will immediately cause the "read" solenoid 422 to open the switch 426 (FIG. 57) for rendering the consecutive step tape feed circuit ineffective, while the reader control circuit remains effective for operating the cocking solenoid 417, the solenoid 422 (FIG. 31) and the motivating solenoids 495, 500-505 that correspond to the code (in this case, the remainder code) in the decoder 494, as previously described.

When the decoder 494 is operated according to a remainder code, the member 693 (FIG. 54) is set in a position to represent the remainder, as described, under control of the decoder 494 (FIG. 31) and circuitry that will now be described. A wire 726 (FIG. 57) is coneected to the wire 709 and to the solenoid 698 that is provided for shifting the member 693 to a remainder representing position as described. A wire 727 is connected to solenoid 698 and to a normally effective blade 728 in a single-pole double-throw switch 729. The switch 729 is normally conditioned as shown here, under control of the justifying control key 713 that is normally in "Justify" position and that will be described presently. A blade 730 is normally engaged with the blade 728, and it is connected by a wire 731 to each one of the stop solenoids 700-1 to 700-14 and to the contact 708-15 in any known manner. An individual wire 732 is connected to each of the stop solenoids 700-1 to 700-14 and a respective one of the contacts 708-1 to 708-14. Wires 733-1 to 733-15 are individually connected to the respective contacts 708-1 to 708-15, and they are also connected to respective terminals that are marked "1 REMAINDER (7)" (FIG. 50) to "15 REMAINDER (2,4,6,7)" in the decoder 494. Ths suffix numbers refer to the quantity of the remainder and the numbers in parentheses correspond to the code for that remainder. Thus, when the decoder 494 is operated according to a remainder code, the corresponding circuit runs from source(s) and the switch 541 (FIG. 57), through wires 709 and 726, the solenoid 698 for shifting the member 693 to operated position as described, wire 727, blades 728 and 730, wire 731, directly to contact 708 - 15 in the case of a fifteen unit remainder or through the appropriate one of the solenoids 700 - 1 to 700 - 14 and a respective wire 732, the effective contact 708 - 1 to 708 - 15 as the case may be, the wire 733 - 1 to 733 - 15 and the circuit goes to ground through the operated decoder 494 (FIG. 50). When the member 693 (FIG. 54) is stopped in the remainder representing position by the effective stop 701 - 1 to 701 - 14 or by the fifteenth stop 702, the member 693 is coupled with the segment 662 by pawl 703 and the blade 705 is engaged with the effective contact 708 - 1 to 708 - 15, as described, for continuing the tape cycling operations as will now be described.

A wire 734 (FIG. 57) is connected to the wire 709 and to a solenoid 735 in a remainder code tape cycling mechanism 736 to be described presently. A wire 737 is connected between the solenoid 735 and the conductor strip 707. Thus, the solenoid 735 is operated by a circuit that travels from source(s) and switch 541, through wires 709 and 734, solenoid 735, wire 737, conductor strip 707, blade 705, the effective contact 708 - 1 to 708 - 15, the effective wire 733 - 1 to 733 - 15 and to ground through the operated decoder 494 as described.

The remainder code tape cycling mechanism 736 is shown best in FIG. 40, and it will now be described. The solenoid 735 is secured on the support member 461, and a link 738 is pivotally connected to its armature and to a member 739 that is pivoted on rod 456. A torsion spring 740 is anchored on rod 457 and it is connected to member 739 for urging the member 739 clockwise against the rod 457. An insulator 741 is secured on the member 739, in engaging alignment with a normally open switch 742. Switch 742 is secured on the vertical plate 32 (FIG. 37) in any known manner. A pawl 743 is pivoted on the rod 460, it extends over the bail 473 that is common to the first bank of cycling control mechanisms as described, and a torsion spring 744 is connected to the pawl 743 and to the support member 462 for urging the pawl 743 (FIG. 40) counterclockwise to normally rest on the upper end of member 739 as shown. A link 745 is pivotally connected to the pawl 743 and to the armature of a restoring solenoid 746 that is secured on the plate 32 (FIG. 37).

When the member 693 (FIG. 57) is shifted to a remainder representing position and its blade 705 completes the circuit between conductor strip 707 and the effective contact 708 - 1 to 708 - 15, the solenoid 735 is operated as described. Operation of solenoid 735 (FIG. 40) pulls link 738 and rotates the member 739 and its insulator 741 for closing the switch 742. Just prior to the engagement of member 739 with the rod 458, the spring 744 rotates the pawl 743 counterclockwise, while the pawl 743 pushes the bail 473 downward and the end of the pawl 743 shifts into a notch 747 in the member 739 for holding the member 739 in operated position.

When the pawl 743 pushes the bail 473 downward, the bail assembly, including the parts 473, 475, 476, 474 (FIG. 39) and 472, is rotated clockwise for permitting the reader control circuit switch 453 to open as described, the opening of reader control circuit switch 453 (FIG. 31) breaks the reader control circuit for deenergizing the solenoids 417, 422 and the motivating solenoids 495, 500-505 in the decoder 494 as described. Reenergization of the solenoid 417 permits the tape feed mechanism 408 to feed the remainder code out of the main reader 407 and to close the switches 419 and 418 as described. Restoration of the decoder 494, in this instance, breaks the circuit through the solenoid 735 (FIG. 57).

Closure of switch 419 causes the remainder code cycling mechanism 736 to be restored and it causes the feedread switch means 421 to assume the feed condition. To this end, a wire 748 is connected to wire 720 and to the solenoid 746. A wire 749 is connected between solenoid 746 and switch 742, and a wire 750 is connected between switch 742 and the wire 722. In this instance, closure of switch 419 completes the circuit through switch 419, wires 720 and 748, solenoid 746 for restoring the cycling mechanism 736, wire 749, now closed switch 742, wires 750 and 722, and solenoid 431 for returning the feed-read switch means 421 to feed condition. When solenoid 431 is operated, the switch 426 is again closed for completing the consecutive step tape feed circuit as described. Operation of the solenoid 746 pulls the link 745 (FIG. 40) and rotates the pawl 743 clockwise, against tension of spring 744, for disengaging the pawl 743 from notch 747. Whereupon, the spring 740 restores the member 739 and insulator 741 clockwise for permitting the switch 742 to open. The opening of switch 742 (FIG. 57) deenergizes the solenoids 746 and 431.

At the time pawl 743 (FIG. 40) is moved out of notch 747, the spring 479 (FIG. 39) restores the bail 473 and insulator 472 upward for closing the reader control circuit switch 453 (FIG. 31). Thus, the reader control circuit is rendered effective for reading the next code, which in this case will be the first text code for the line and which code follows the blank tape 412 that follows the remainder code as described.

a. Justify — No Justify Key

The justification control key, Justify — No Justify key 713 (FIGS. 8 and 57), is presettable, at the will of the operator, for controlling the reproducer to produce justified copy lines as described above, or to produce unjustified copies even though the control tape 412 that is being used contains the justification codes. In other words, by the use of this key 713, the reproducer may be controlled to produce a justified copy or an unjustified copy from any control tape 412 that contains the justification coddes. When the key 713 is in the "Justify" position, the reproducer will prepare justified copy if the control tape 412 contains justification codes, but, of course, the reproducer will prepare unjustified copy if the control tape 412 does not contain the justification codes. However, when key 713 is in the "No Justify" position, the reproducer will prepare unjustified copy, whether or not the control tape 412 contains justification codes.

The Justify — No Justify key 713 (FIG. 34) is pivoted on a bolt 751 that is secured on the frame plate 20 (FIG. 9). A member 752 (FIG. 34) is also pivoted on bolt 751, along side of the key 713. A contractile spring 753 is connected to the key 713 and to the depending arm of member 752 in any known manner. When the key 713 is in the illustrated "Justify" position, the spring 753 yieldably holds the key 713 against rod 24, and it holds the member 752 clockwise against rod 23. When the key 713 is manually shifted to the "No Justify" position against rod 21, the centerline of spring 753 is shifted to the right of the pivot bolt 751 and the spring 753 snaps the member 752 counterclockwise against the rod 22. In the same manner, return of the key 713 to "Justify" position causes the spring 753 to return the member 752 clockwise against the rod 23 as shown.

As shown here, an insulator 754 is secured on the leftward arm of member 752, and, in the illustrated position of the parts, the insulator 754 shifts the switch 712 in normal condition where the blade 714 is engaged with blade 711. The switches 712 and 729 are secured on the frame plate 20 (FIG. 9) in any known manner. In this normal "Justify" position of the parts, the insulator 754 (FIG. 34) is shifted away from the switch 729, and the blades 730 and 728 are engaged as described. When the key 713 is shifted to "No Justify" position and the insulator 754 is swung counterclockwise, the insulator 754 permits the blade 714 to disengage from blade 711 and to engage with a blade 755 of the switch 712, and the insulator 754 shifts the blade 730 away from blade 728 and into engagement with a blade 756 of the switch 729.

As explained hereinabove, the circuit for operating the solenoid 339 (FIG. 57) to set the stop member 335 in a quotient representing position passes through the solenoid 339, wire 710, blades 711 and 714 of switch 712, etc., when the key 713 is in the "Justify" position and a quotient code is read. As also explained hereinabove, the circuit for operating the solenoid 698 in the duplex counter 643 to set the member 693 in a remainder representing position passes through the solenoid 698, wire 727, blades 728 and 730 of switch 729, and so on, when the key 713 is in the "Justify" position and a remainder code is read.

When the key 713 is in the "No Justify" position, the justification codes that may be read are cycled through the main reader 407, and the members 335 and 693 are left in their respective zero representing positions when a quotient code and a remainder code, respectively, are read. Thereafter, as the line is reproduced, no quotient or remainder amounts will be added to the word spaces, and thus the line is reproduced in unjustified form.

The circuits that are effective when the switches 712 and 729 are shifted from normal condition and the key 713 is in "No Justify" position will now be described. Under this condition, when a quotient code is read and the decoder 494 is operated accordingly as described, the adjustable stop member 335 is locked in its zero representting position (into which position the member 335 is returned during carriage return functions as will be described) by a circuit that runs from source (S) through solenoid 357 for locking the adjustable stop member 335 as described and for opening the reader control circuit switch 369 as described, the circuit continues through wire 719, a wire 757 connected to wire 719 and blade 755, through now engaged blades 755 and 714, wire 715, and so on as described through the decoder 494 now operated according to a quotient code. The opening of the reader control circuit switch 369, deenergizes the solenoid 417 for permitting the tape feed mechanism 408 to feed the quotient code out of the main reader 407 and to close the switch 419. Whereupon, the circuit from source(s), switch 419, wire 720, now closed switch 361, wire 721, solenoid 367 for closing switch 369, and the circuit goes to ground through wire 722 and the "feed" solenoid 431, as described. However, at this point when the switch 369 is closed, the reader control circuit may respond to a remainder code, now in the main reader 407.

Under the "No Justify" condition, when a remainder code is read and the decoder 494 is operated accordingly, a circuit is complete from source (S) and switch 541, through wires 709 and 734, solenoid 735 for operating the remainder code tape cycling mechanism 736 to break the reader control circuit as described, through wire 737 and a wire 758, now engaged blades 756 and 730, wire 731 and so on through the operated decoder 494 as described. When the reader control circuit is broken, the remainder code is shifted out of the main reader 407 and the switch 419 is closed, as described. Whereupon, current travels from source(S) and switch 419, through wires 720 and 748, the solenoid 746 for restoring the reader control circuit and the remainder code cycling mechanism 736, wire 749, now momentarily closed switch 742, wires 750 and 722, and it goes to ground through the solenoid 431 that conditions the arrangement to feed the blank tape 412 that follows the justification codes, as described previously.

Thus, the justification codes are read and bypassed, but the text codes remain effective and the machine is controlled thereby to produce unjustified copies, while the key 713 is in the "No Justify" position.

11. CASE SHIFT, BY CODE

The upper case function code is 4, 6, and the lower case function code is 4, 7, as can be seen by referring to CHART D among the charts that follow the figure descriptions.

Figures 58, 58A:
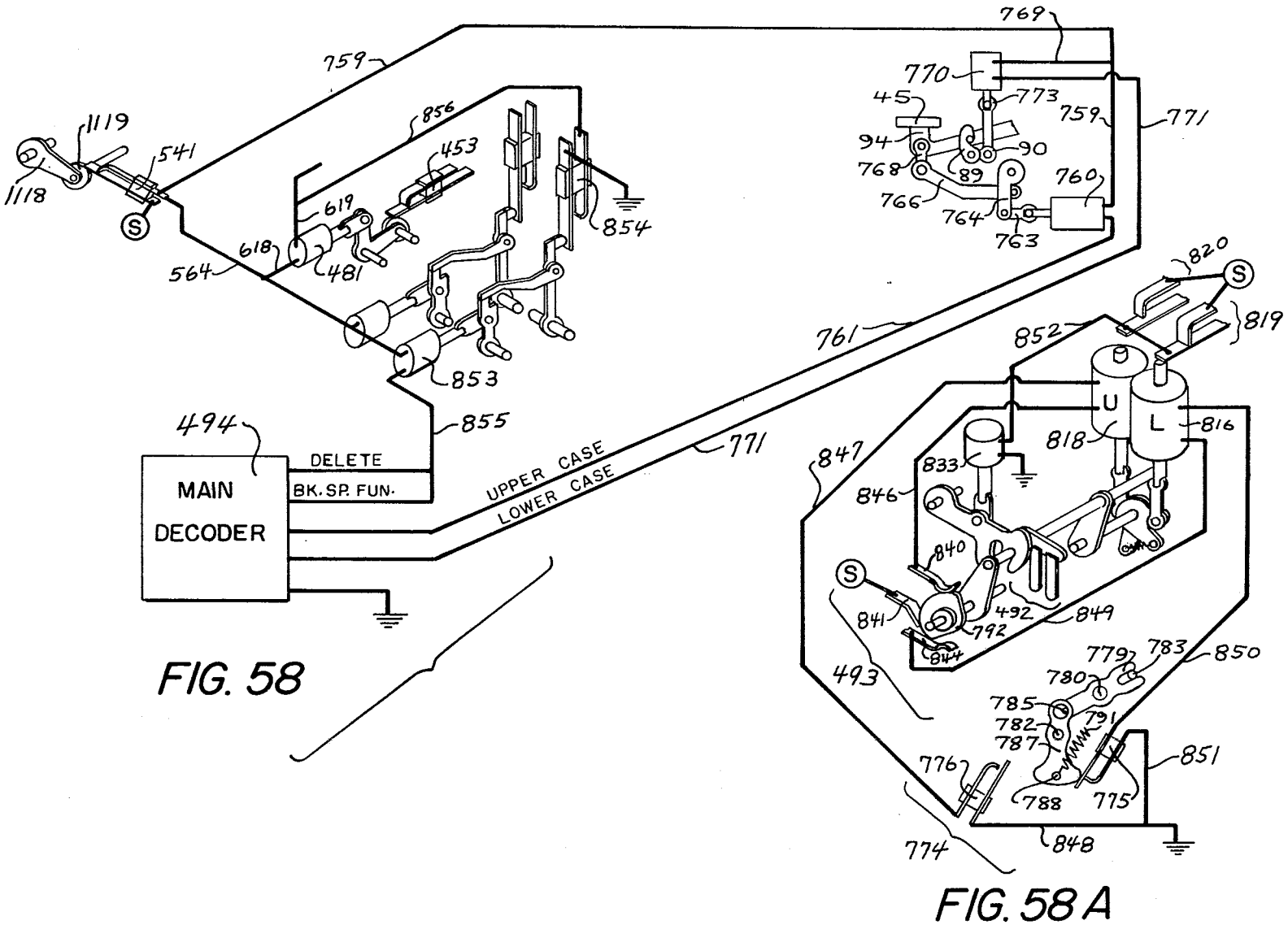
FIG. 58 is a schematic wiring diagram of circuits for code controlled upper-lower case shift operations.
FIG. 58A is a schematic wiring diagram for automatically shifting the upper-lower case switch means.

The arrangement for automatically shifting the machine to upper case condition will now be described. A wire 759 (FIG. 58) is connected to the normally closed switch 541 and to an upper case shift motivating solenoid 760. A wire 761 is connected between solenoid 760 and the upper case terminal that is marked "UP. CASE (4,6)", in FIG. 50, of the main decoder 494 (FIG. 58).

When the main reader 407 (FIG. 31) senses the upper case code 4, 6 and the decoder 494 (FIG. 58) is operated accordingly, current travels from source (S), through switch 541, wire 759, solenoid 760, wire 761 and it goes to ground through the operated decoder 494. Operation of solenoid 760 shifts the machine to upper case condition as will now be described.

The solenoid 760 (FIG. 11) is secured on the inner side of channel member 7, as by screws 762. A link 763 is pivotally connected to the armature of solenoid 760 and a member 764. The upper end of member 764 is pivoted on a stud 765 that is secured on the inner right side of the typewriter frame 8 (FIG. 9). A member 766 (FIG. 11) is also pivoted on stud 765, and a stud 767 is secured on member 766 and the stud 767 extends beyond the edge of member 764. A link 768 is pivotally connected to the remote end of member 766 and to the rockable member 94 of the shift lock key 45. When the shift lock key 45 is manually depressed, its lever 94 (FIG. 14) rocks counterclockwise on bolt 95, the surface 100 (FIG. 15) engages the stud 92, then the key lever 66 (FIG. 14) is rotated counterclockwise for shifting the machine to upper case condition, and finally the machine is latched in upper case condition by the hook member 89, as described hereinbefore. During such a manual operation, the link 768 (FIG. 11) is moved downward, the member 766 is shifted counterclockwise and the stud 767 is shifted idly away from member 764. However, when all the parts are in lower case condition as shown here and the solenoid 760 is energized, the machine is conditioned for upper case as follows.

Operation of solenoid 760 pulls link 763 and rotates member 764 against the stud 767 for rotating the member 766 counterclockwise. Whereupon, the member 766 pulls the link 768, operates the lever 94 and the shift lock key 45 to lock the machine in upper case condition, in the same manner as described for manual operation of the shift lock key 45.

The arrangement for automatically shifting the machine to lower case condition will now be described. A wire 769 (FIG. 58) is connected between the wire 759 and a solenoid 770. A wire 771 is connected to solenoid 770 and to the lower case terminal that is marked "LOWER CASE (4,7)" in the FIG. 50 of the decoder 494.

When the main reader 407 (FIG. 31) senses the lower case code 4, 7 and the decoder 494 is operated accordingly, current travels from source (S) and switch 541 (FIIG. 58) through the wires 759 and 769, solenoid 770, wire 771 and it goes to ground through the operated decoder 494. Operation of solenoid 770 returns the machine to lower case condition as will now be described.

The solenoid 770 is secured on a transverse plate 772 (FIGS. 9 and 11) that is secured at its ends to the typewriter frame 8 in any known manner. A link 773 (FIG. 11) is pivotally connected to the armature of solenoid 770 and to the member 90 (FIG. 14).

Operation of the solenoid 770 (FIG. 11) pulls the link 773 upward for rotating the unit formed of members 90 (FIG. 15), 89 and 88 counterclockwise about the axis of shaft 87, and for thereby releasing the hook member 89 from the pin 92 to thereby permit the machine to return to lower case condition as described previously.

Whenever there is a case shift operation, whether the operation is performed by the previously described manual or automatic means, the upper-lower switch means 493 (FIG. 52) is shifted for in each condition properly controlling the respective upper or lower case character spacing as described hereinbefore.

A snap switch means 774 (FIG. 58A), that is responsive to case shifting operations for controlling the shifting of upper-lower case switch means 493, will now be described. A lower case switch 775 and an upper case switch 776 are secured on a plate 777 (FIG. 59) that is secured on the typewriter frame 8 as by machine screws 778. A member 779 is pivoted on a stud 780 and a member 781 is pivoted on a stud 782, and studs 780 and 782 are secured on plate 777 (FIG. 60) in any known manner. The upper bifurcated end of member 779 (FIG. 59) embraces a stud 783 that is secured on a bracket 784. Bracket 784 is secured on the right side member 72 of the case shifting bail arrangement that was described in connection with FIG. 14. A stud 785 (FIG. 59) is secured on the lower end of member 779 and it extends through a loose fitting hole 786 in the member 781. An insulator 787 is secured on the lower end of member 781, and the insulator carries three studs 788, 789 and 790. A contractile spring 791 is connected to stud 788 and to the end of stud 783, and it provides a snap switch-closing action. In the normal lower case position of the bail 70 and the related parts, the spring 791 urges the member 781 and insulator 787 counterclockwise, where the stud 789 holds the switch 775 closed and where the right side of the hole 786 is stopped against stud 785 as shown. When the bail arrangement, including bail 70, is shifted to upper case position, by operation of solenoid 760 (FIG. 11), a shift key 40 or 41 or the shift lock key 45 as described, the member 784 and stud 783 are shifted clockwise. Whereupon, the stud 783 (FIG. 59) shifts member 779 counterclockwise, and the stud 785 shifts the member 781 clockwise and stud 789 permits switch 775 to open. At about the time the machine reaches upper case condition, the center-line of the spring 791 is shifted sufficiently to the left of the centers of studs 780 and 782 for the spring 791 to snap the stud 790 against the upper case switch 776 for closing the switch 776, and the action is stopped as the left side of hole 786 engages the stud 785. When the bail 70 is again lowered to lower case condition, the arrangement is again snapped back into the illustrated condition where the upper case switch 776 is open and the lower case switch 775 is closed.

Thus, the snap switch means 774 (FIG. 58A) is operated to close the upper case switch 776 when the machine is shifted to upper case, and it is operated to close the lower case switch 775 when the machine is returned to lower case condition.

Figure 59:
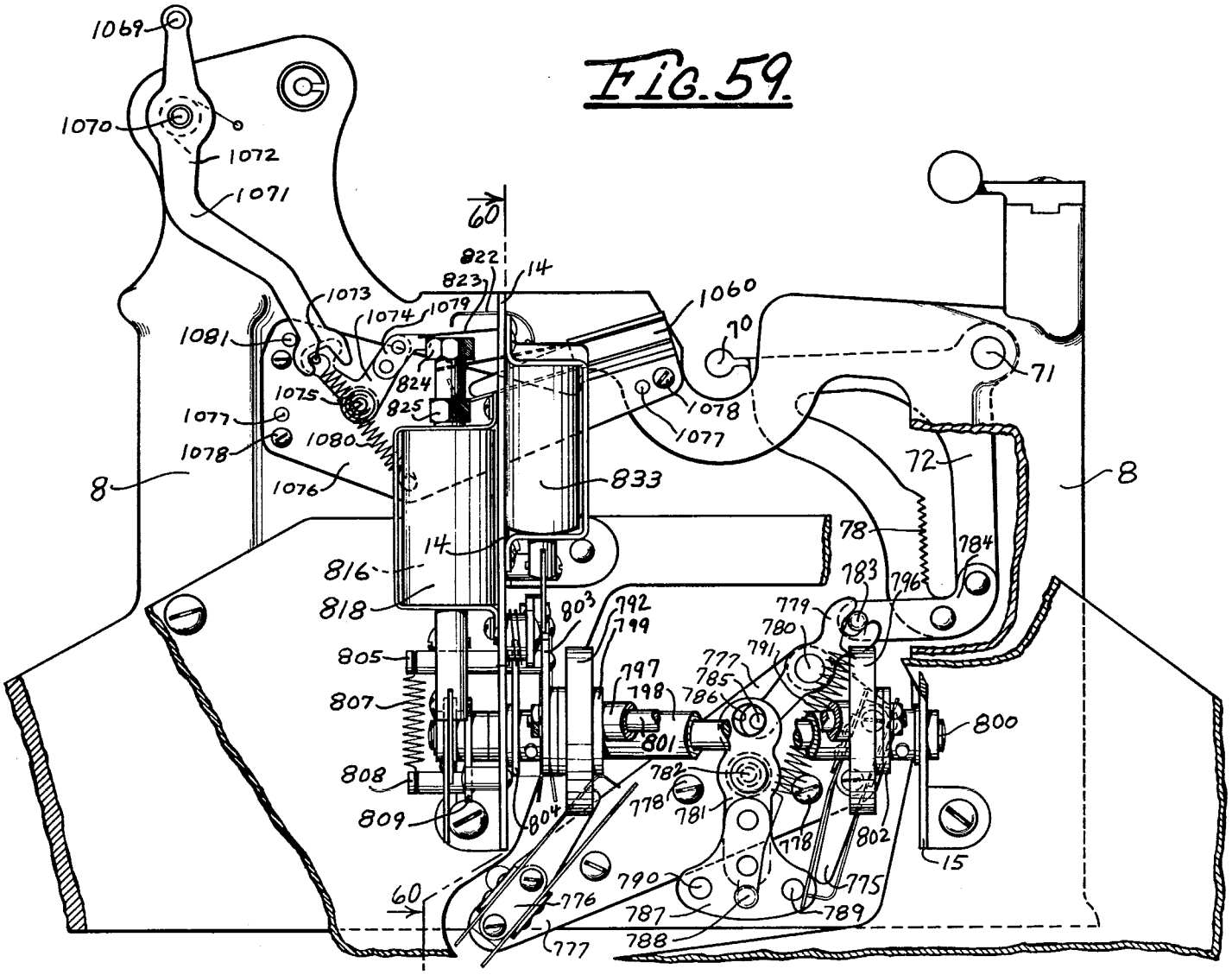
FIG. 59 is a fragmentary right side view showing principally a full carriage return switch, an upper-lower case control with portions cut away for clarity.

The structure of the upper-lower case switch means 493 (FIGS 52 and 58A) will now be described. The upper-lower case switch means 493 is secured on and between the vertical plates 14 and 15 (FIGS. 1 and 59). Five segmental conductors 792 (FIG. 58A), and 793 (FIG. 52), 794, 795 and 796 are unitarily and alternatively shiftable in upper case and in lower case positions. These conductors 792–796 (FIG. 59) are assembled side by side on two tubular insulators 797 and 798, with suitable insulators 799 on each side of each conductor. Thus, the conductors 792–796 are insulated from each other and from other supporting parts. The insulator 798 is assembled on a main shaft 800 that is pivotally mounted on the plates 14 and 15. The insulator 797 is assembled on a bail like rod 801 that is secured at its ends to members 802 and 803. The hub of member 802 is pinned on shaft 800. The hub of member 803 is pinned on shaft 800 and it is also secured to a member 804. A bail like stud 805 is secured on the members 803 and 804, so that the unit formed primarily of the stud 805, member 804 (FIG. 60), member 803, shaft 800, rod 801 and the conductors (792 for example) may be shifted clockwise and counterclockwise, about the axis of shaft 800, in upper case and lower case positions, respectively.

Figure 60:
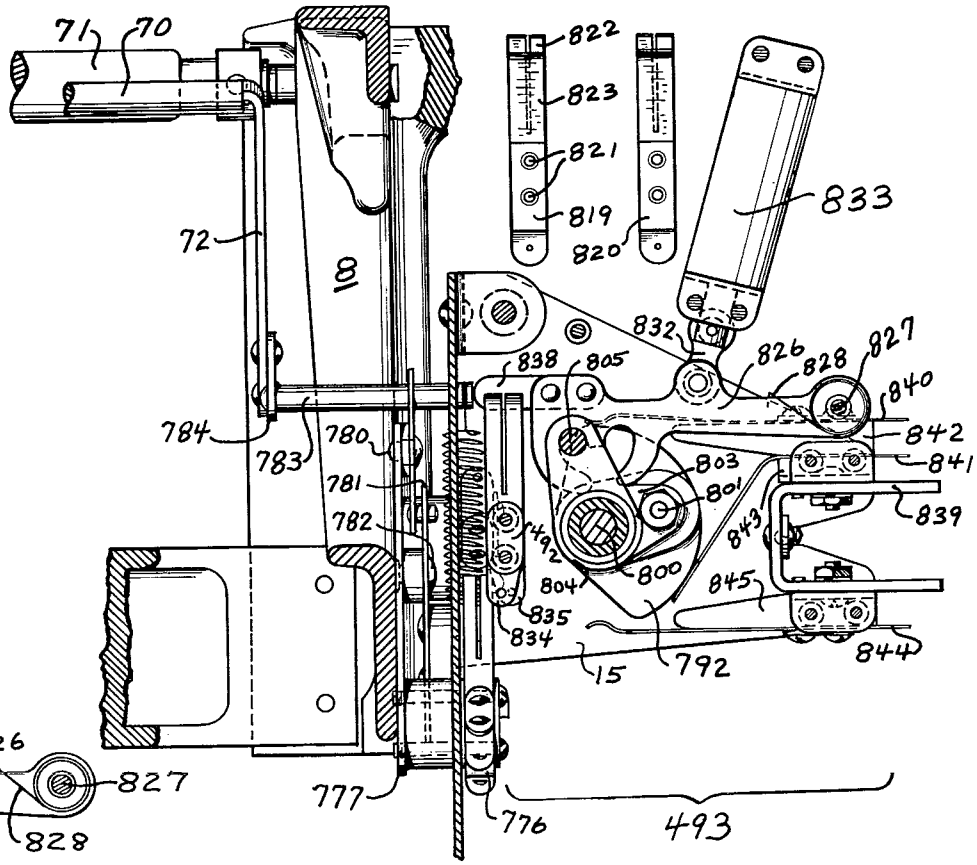
FIG. 60 is a fragmentary front view including a full front view of the upper-lower case switch means and a sectional illustration of the case control as viewed from line 60—60 (FIG. 59).

The stud 805 extends forwardly through a hole 806 (FIG. 61) in the plate 14. A contractile spring 807 is connected to stud 805 and to a stud 808 that is secured on a member 809. Member 809 is pivoted on the main shaft 800, and it is limited in its clockwise and counterclockwise positions by stop stud 810 and 811, respectively. Studs 810 and 811 are secured on plate 14. A pair of identical members 812 and 813 are assembled back to back and they are pivoted on the shaft 800. A contractile spring 814 is connected to the members 812 and 813 for urging the members 812, 813 opposingly against the stud 808. A link 815 is pivotally connected to the member 813 and to the armature of a lower case motivating solenoid 816 that is secured on plate 14. A link 817 is pivotally connected to member 812 and to an upper case motivating solenoid 818 that is secured on plate 14. A pair of normally open switches 819 and 820 are secured to the rearward side of plate 14 as by machine screws 821 (FIG. 60). Each of the switches 819 and 820 comprises blades 822 and 823 (FIG. 59) that normally stand open and that are bent forward (leftward as shown here) over the upper ends of the motivating solenoids 816 and 818, as shown. Bolt shaped insulators 824 and 825 are secured on upward armature extensions of the solenoids 816 and 818 in engaging alignment with the ends of the switches 819 and 820 (FIG. 61), but these insulators 824, 825 normally stand free of the respective blades 823 as shown best in FIG. 59. However, these insulators 824, 825 are provided for closing their respective switch 819, 820, as will be explained presently.

A detent 826 (FIG. 60) is provided primarily for momentarily detaining the mechanism in upper or lower case condition during a case shift to the other condition, and it is operable for initiating shifting of the mechanism, and for opening and reclosing the reader control circuit switch 492 (FIG. 31). As will be described presently, the detent 826 (FIG. 60) assures full operation of the motivating solenoids 816 and 818 (FIG. 61) each time one of these solenoids 816, 818 is operated. The structure of the detent 826 will now be described.

Figure 61:
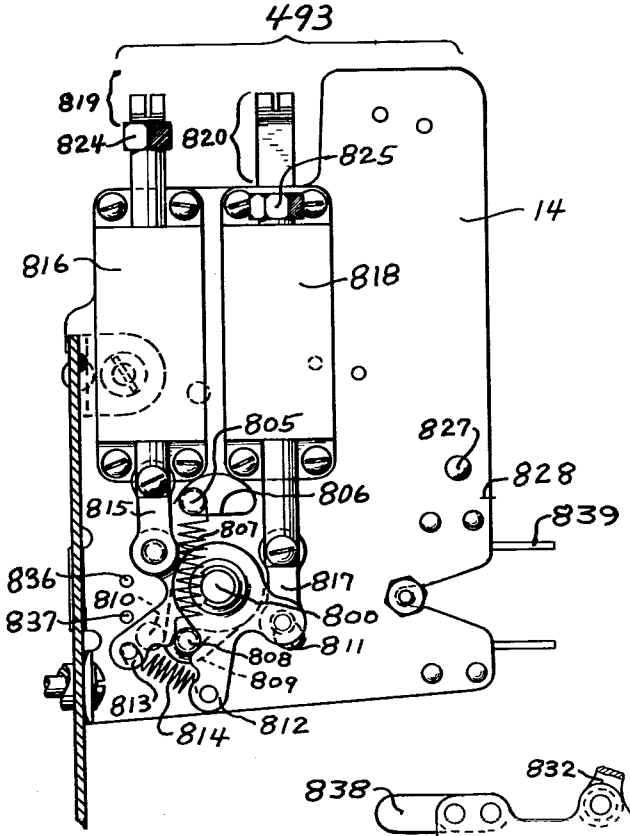
FIG. 61 is a front view of the upper-lower case control as viewed from line 61—61 (FIG. 1).
Figure 62:
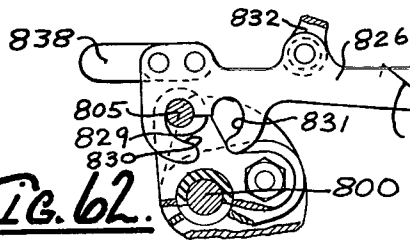
FIG. 62 is a fragmentary view of some of the mechanism shown in FIG. 60.

Detent 826 (FIG. 60) is pivoted on a stud 827 that is secured on the rearward side of plate 14 (FIG. 61). A torsion spring 828 is anchored on plate 14, and it is connected to detent 826 (FIG. 60) for urging the detent 826 counterclockwise against the stud 805 as shown. A projection 829 (FIG. 62) on detent 826 is normally situated between the illustrated lower case position of the stud 805 and the clockwise upper case position of the stud 805 for preventing premature shifting of the mechanism. Opposing cam surfaces 830 and 831 on detent 826 are provided for assuring initiation of a shift of stud 805 and the mechanism to upper case and lower case positions, respectively. A link 832 is pivotally connected to detent 826 (FIG. 60) and to the armature of a solenoid 833 that is secured on the plate 14 (FIG. 59). As will be explained, the solenoid 833 is operated to initiate a shift of the mechanism and to open the reader control circuit switch 492 (FIG. 31).

The reader control switch 492 (FIG. 60) is comprised of two blades 834 and 835, and suitable insulators (not numbered), and it is secured on the rearward side of plate 14 (FIG. 61) by machine screws 836 and 837 in any known manner. A conductor 838 (FIG. 60) is insulated from and it is secured on the detent 826, in any known manner. In the illustrated normal position of the detent 826, the conductor 838 is engaged between the upper ends of the blades 834 and 835 for closing the reader control switch 492.

The switch blades that cooperate with the conductors 792 (FIG. 58A) and 793 - 796 (FIG. 52) are the same for each conductor, so the blades that are associated with conductor 792 (FIG. 60) will now be described by way of example. A channel shaped switch blade support member 839 is secured to plate 15 and to plate 14 (FIG. 61) in any known manner. A lower case blade 840 (FIG. 60), that is a blade that is effectively engaged with the conductor 792 only when the mechanism is in lower case condition as indicated, together with a constantly effective blade 841 and insulators 842 and 843 are assembled as shown, and they are secured on the member 839 in such a manner as to insulate the blades 840, 841 from each other and from the member 839. An upper case blade 844, that is effectively engaged with the conductor 792 only when the conductor 792, shaft 800 etc. are shifted in the clockwise upper case position, is mounted with an insulator 845 on the member 839 as shown. Thus, the conductor 792 couples the blades 840 and 841 when the mechanism is in lower case condition, and it couples the blades 841 and 844 when the mechanism is in upper case condition. In the same manner, the conductors 793, 794, 795 and 796 (FIG. 52) respectively couple the blades 579, 596; 592, 598; 594, 600 and 588, 602 when the mechanism is in lower case condition, and they respectively couple the blades 590, 596; 586, 598; 581, 600, and 583, 602 when the mechanism is in upper case condition.

The conductors 793 - 796 in their lower case and upper case positions, determined by the respective conditions of the upper-lower case switch means 493, control the character spacing of the characters in their respective groups, as described previously. The conductor 792 (FIG. 58A) controls the circuits for operating the motivating solenoids 816 and 818 as will now be described.

A source of power (S) is connected to the constantly effective blade 841. A wire 846 is connected to the lower case blade 840 and to the upper case motivating solenoid 818. A wire 847 is connected to solenoid 818 and to the upper case switch 776. A ground wire 848 is also connected to switch 776. A wire 849 is connected to upper case blade 844 and to the lower case motivating solenoid 816. A wire 850 is connected to solenoid 816 and to the lower case switch 775. A ground wire 851 is also connected to switch 775. A source (S) is connected to both switches 819 and 820, and a wire 852 is connected to both switches 819, 820 and to the solenoid 833 that is grounded as indicated.

When the machine is shifted from lower case to upper case condition, the upper case switch 776 is snapped closed as described. When this occurs, current flows from source (S) and blade 841, through conductor 792, the blade 840 that is effective as long as the upper-lower case switch means 493 is in lower case condition, wire 846, solenoid 818, wire 847, now closed switch 776 and it goes to ground through wire 848. Upon operation of solenoid 818, the solenoid 818 pulls link 817 (FIG. 61) and rotates the member 812 counterclockwise, and, by tension of spring 814, the member 813, stud 808 and member 809 are rotated counterclockwise to where the centerline of spring 807 is to the right of shaft 800 and the member 809 is stopped against the stud 811. Thereafter, the spring 814 is stretched while solenoid 818 operates further to shift its insulator 825 for closing the switch 820. Thus, full operation of solenoid 818 is assured for shifting the centerline of spring 807 to the right of shaft 800, while the stud 805 is held in lower case position by the projection 829 (FIG. 62) on the detent 826. Closure of switch 820 (FIG. 58) completes the circuit through switch 820, wire 852 and solenoid 833. Operation of the solenoid 833 pulls link 832 (FIG. 60) for rotating the detent 826 clockwise against tension of spring 828. Clockwise operation of detent 826 elevates its projection 829 (FIG. 62) out of the path of stud 805. At the same time, the cam surface 830 of the detent 826 coacts with the stud 805 for initiating clockwise shift of the stud 805, and the spring 807 (FIG. 61) snaps the unit that includes stud 805, conductor 792 (FIG. 60), and conductors 793 - 796 (FIG. 52) clockwise from their normal lower case positions.

When the detent 826 (FIG. 60) is shifted clockwise by solenoid 833 as just described, the conductor 838 on the detent 826 is shifted upward and, in cases where the upper case shift is in response to an upper case code on the control tape 412, it opens the reader control circuit switch 492 (FIG. 31) for cycling the control tape 412 and normalizing the decoder 494 as previously described.

When the upper-lower case switch means 493 is shifted to upper case condition, the conductor 792 (FIG. 60) is shifted clockwise to disengage it from the lower case blade 840. When this occurs, the upper case motivating solenoid 818 (FIG. 58A) is deenergized, and the spring 814 (FIG. 61) returns the member 812 slightly clockwise, against the stud 808 then in counterclockwise upper case position, and the link 817 pulls the armature and its insulator 825 downward only sufficiently to open the switch 820. When switch 820 (FIG. 58A) opens, the solenoid 833 is deenergized and the spring 828 (FIG. 60), returns the detent 826 downward, while the spring 807 (FIG. 61) causes the stud 895 to follow the cam surface 831 (FIG. 62) and while the projection 829 is moved into full blocking position for holding the upper-lower case switch means 493 in upper case condition. Thus, the upper-lower case switch means 493 (FIG. 52) is conditioned for controlling carriage movements for all upper case characters that may follow.

When the machine is returned to lower case condition and the switch 775 (FIG. 58A) is again closed as described, the circuit is completed from source (S) and blade 841, conductor 792, now effective blade 844, wire 849, lower case motivating solenoid 816, wire 850, switch 775 and ground wire 851. Operation of solenoid 816 (FIG. 61) pulls link 815 and returns member 813, spring 814, member 812, stud 808 and member 809 clockwise to the illustrated lower case positions, where the stud 836 stops the member 809, stud 808 and the member 812. Thereafter, the solenoid 816 operates the link 815 and member 813 a bit further while the spring 814 stretches to permit the insulator 824 to close the switch 819. When the stud 808 is stopped in its clockwise position as described, the centerline of spring 807 is shifted to the left of shaft 800, but the stud 805 is now detained in its rightward upper case position by detent 826 (FIG. 60). Closure of switch 819 (FIG. 58A) completes the circuit from source (S) and switch 819, through wire 852, solenoid 833 and to ground. Whereupon, the solenoid 833 (FIG. 60) operates the detent 826 to open the reader control circuit switch 492, to remove the projection 829 (FIG. 62) from blocking position and to employ the cam surface 831 for inititating counterclockwise shifting of the stud 805 and for thereby returning the upper-lower case switch means 493 to lower case condition. Whereupon, the conductor 792 (FIG. 60) is returned counterclockwise for disengaging it from blade 844. When blade 844 (FIG. 58A) is disengaged, the solenoid 816 is deenergized and the spring 814 (FIG. 61) returns the member 813 against the stud 808 as shown, and this action permits the switch 819 to open for deenergizing the solenoid 833 (FIG. 58A). Deenergization of solenoid 833 permits the spring 828 (FIG. 60) to restore the detent 826 to the illustrated effective position where its conductor 838 recloses the reader control circuit switch 492 and its projection 829 (FIG. 62) blocks the upper-lower case switch means 493 in lower case position.

From the above, it is seen that upper case code controlled operation of the decoder 494 (FIG. 58) causes the solenoid 760 to shift the machine to upper case condition, and that lower case controlled operation of the decoder 494 causes the solenoid 770 to return the machine to lower case condition. It has also been described that a case shift of the machine causes the snap switch means 774 (FIG. 58A) to control the upper-lower case switch means 493 to assume the corresponding case shift condition and to cycle the control tape 412 for advancing a succeeding code into the main reader 407. It was also described earlier that the conductors 793 - 796 (FIG. 52) of the upper-lower case switch means 493, together with selectively operable character keys 39, control the carriage moving mechanism to move the carriage 9*a* appropriately for each character.

12. DELETE AND BACK SPACE FUNCTION CODES

As explained in our aforesaid copending application Ser. No. 213,045 filed Dec. 28, 1971, now U.S. Pat. No. 3,993,179, issued Nov. 23, 1976 for "JUSTIFYING, TEXT WRITING COMPOSING MACHINE", the delete code 4, 5, 6, 7 may be punched over any other code on the control tape 412 to render that other code ineffective, and the delete codes are generally used for correction purposes. As also explained in the aforesaid copending application, there may be a plurality of successive delete codes to delete as many other successive codes, and a delete code or such successive codes are always followed by a back space function code 5, 7.

The delete and back space function codes cause no function in the reproducer, other than to employ a delete and back space function cycling mechanism for controlling the control tape 412 to be fed through the main reader 407 to bypass these codes.

The wire 564 (FIG. 58) is connected to a solenoid 853 as well as to the solenoids 565 - 567 (FIG. 52) of the character code cycling mechanisms previously described. The cycling mechanism associated with the solenoid 853 (FIG. 58) is like the cycling mechanism shown and described in connection with FIG. 39, except that the three blade switch 611 for example is substituted by a two blade switch 854 (FIG. 58). A wire 855 is connected to solenoid 853 and to the decoder 494. Particularly, the wire 855 is connected to both the delete and back space function terminals that are marked "DELETE (4 5 6 7)" (Bottom of FIG. 50) and "BACK SP. FUN. (5 7)", respectively, in the decoder 494. A wire 856 is connected to wire 619 and to the switch 854 that is grounded as indicated.

When the main reader 407 (FIG. 31) senses a delete or a back space function code and the decoder 494 is operated accordingly as described, the decoder 494 provides a ground for the circuit that travels from source (S) and switch 541 (FIG. 58), through wire 564, solenoid 853, wire 855 and goes to ground through the operated decoder 494. Operation of solenoid 853 causes the reader control circuit switch 453 to be opened, whereupon the tape feed mechanism 408 (FIG. 31) shifts the code out of the main reader 407 and the decoder 494 is normalized as described. When the decoder 494 (FIG. 58) is normalized and the solenoid 853 is thereby deenergized, the cycling mechanism closes the switch 854, and current flows from source (S) and switch 541, through wires 564 and 618, solenoid 481, wires 619 and 856, and it goes to ground through now closed switch 854. The solenoid 481 recloses the reader control circuit switch 453 for reading of the succeeding code, and it restores the operated cycling mechanism for opening the switch 854 to deenergize the solenoid 481, in a previously described manner. In this way, one or more delete codes and the accompanying back space function codes are fed idly through the main reader 407 (FIG. 31), and the reproducer does not perform the deleted operations.

13. UNDERLINE BY CODE

As described in our copending application Ser. No. 213,045 filed Dec. 28, 1971, now U.S. Pat. No. 3,993,179, issued Nov. 23, 1976 for "JUSTIFYING, TEXT WRITING COMPOSING MACHINE", an underline operation includes the imprinting of the underline mark and the encoding of the underline code, but the operation does not include carriage movement. As also explained, the operator pushes the underline key 42 and then a character key 39 in order to underline the respective character and the process is repeated as required for underlining and spelling a word, and carriage movement is performed appropriately only for the character or characters. It should also be understood that an underlined blank space may be provided by the alternate use of the underline and a word space or nut space. This system makes it unnecessary to perform any reverse carriage movement operations for underlining, either in the composer or the reproducer. To accommodate the system, the reproducer of the instant application will merely print the underline mark and shift the control tape 412 forwardly when an underline code (1, 4, 5, 6) is sensed by the main reader 407, as will now be described.

When the main reader 407 (FIG. 31) senses the underline code (1, 4, 5, 6) and the decoder 494 is operated accordingly, the decoder 494 completes the circuit that travels from source (S) and switch 541 (FIG. 63) and through wire 542, resistor 543, normally effective brushes 544 and 546, wire 547, the solenoid 548 for operating the underline key 42, its wire 551, its normally effective brushes 552 and 554, the wire marked "Underline (1, 4, 5, 6)" and the circuit goes to ground through the operated decoder 494, as previously described in detail in connection with FIG. 51. Energization of the solenoid 548 (FIG. 63) operates the key 42 to print the underline mark.

When the underline key 42 is fully operated and imprinting occurs, a conductor 556 carried by the key 42 closes a switch 555 related to the key 42. Whereupon current flows from source (S) and switch 541, through wire 564, the solenoid 853 in the previously described delete and back space cycling mechanism, a wire 857 connected with the wire 855 to the solenoid 853 and to the switch 555 under key 42, and through the now closed switch 555 that is grounded as indicated. As described, operation of solenoid 853 causes the reader control circuit switch 453 to be opened, whereupon the control tape 412 is shifted and the decoder 494 is normalized as described. In this instance, normalization of the decoder 494 deenergizes the solenoid 548 and the underline key 42 is restored in the usual manner. As key 42 begins to return, the switch 555 is opened and solenoid 853 is deenergized, and the switch 854 is closed as described. Whereupon, the solenoid 481 is operated, as described, to restore the operated cycling mechanism and to close the reader control circuit switch 453 for reading the succeeding code. As also described, restoration of the cycling mechanism permits the switch 854 to open for deenergizing solenoid 481. Thus, the underline is imprinted, the code therefor is shifted out of the main reader 407, the machine is restored to a generally normal condition and the main reader control circuit is rendered effective for an ensuing operation.

14. EXTRA LINE SPACING, BY CODES

As described in our aforesaid copending patent application Ser. No. 213,045 filed Dec. 28, 1971 now U.S. Pat. No. 3,993,179 issued Nov. 23, 1976 for "Justifying, Text Writing Composing Machine", extra line spacing codes may be placed on the code medium for directing the reproducer to perform corresponding extra line spacing operations. An extra line spacing operation is performed in the reproducer whenever such a code is sensed, and these operations should not be confused with the normal line spacing operations that are performed automatically when the carriage 9*a* is returned as will be described later.

The reproduced copy paper is shifted one line space forwardly when a line space code (4) is sensed, and it is shifted one line space backwardly when a reverse line space code (4, 5) is sensed. The extra line spacing mechanism is shown particularly in FIGS. 64–67, and it will now be described.

The platen 115 (FIG. 64) is secured on a shaft 116 that is rotatable in the platen carrier 105 as described. A clutch output member 858 is secured on shaft 116 and a clutch input member 859 is rotatable on shaft 116 and on the hub of member 858. A clutch 860 is engageable between the members 858 and 859. A cam member 861 is slidably mounted on the shaft 116 between the clutch 860 and a customary knob 862. Knob 862 is secured on shaft 116 as by a set screw 863. A pair of pins 864 (only one shown) are slidable in suitable holes therefor through knob 862 and they are connected with the cam 861 for sliding the cam 861. A clutch control button 865 is secured on the left ends of the pins 864. In the illustrated leftward position of button 865, the pins 864 and the cam 861 are pulled into their leftward positions where the cam 861 permits the clutch 860 to disconnect the clutch input and output members 859 and 858, and the knob 862, shaft 116, and platen 115 may be rotated manually gradiently in respect to the clutch input member 859. By pressing the button 865 toward knob 862, the pins 864 slide the cam 861 rightward in their normal positions for engaging the clutch 860 and thereby connecting all of the just described mechanism for unitary rotation and position with the shaft 116. A customary normal-line space and detent-ratchet wheel 866 is secured on the input member 859, and a customary yieldable detent 867 (FIG. 65) cooperates with the ratchet wheel 866 for yieldably holding the ratchet wheel 866 and member 859 (FIG. 64) in a line space position of rotation. It should also be understood that the ratchet wheel 866 also normally yieldably holds the knob 862, clutch 860, shaft 116 and the platen 115 unitarily in a line space position, when the clutch 860 is engaged as described. The just described platen positioning means is substantially the same as the corresponding parts in the typewriter chosen as exemplary and employed as a basic component of the machine described herein. However, the clutch input member 859 is modified herein to include a sprocket 868.

As shown, the sprocket 868 (FIG. 65) is a radial pin type and a perforated endless belt 869 (preferably spring steel) is suitable assembled on the sprocket 868 and on a similar sprocket 870. Sprocket 870 is secured to a gear 871 and they are rotatably mounted on the left end of the torque shaft 121 which is carried on the carriage base carrier 104 (FIGS. 2 and 17) as previously described. Thus, this mechanism shown in FIG. 64, together with the belt 869 (FIG. 65), sprocket 870 and gear 871 are shiftable longitudinally with the carriage 9*a*. It can also be seen that the platen 115 and shaft 116 may be shifted up and down for case shifting, as described, without disturbing the rotational positions of the sprockets 868 and 870.

Figure 19:
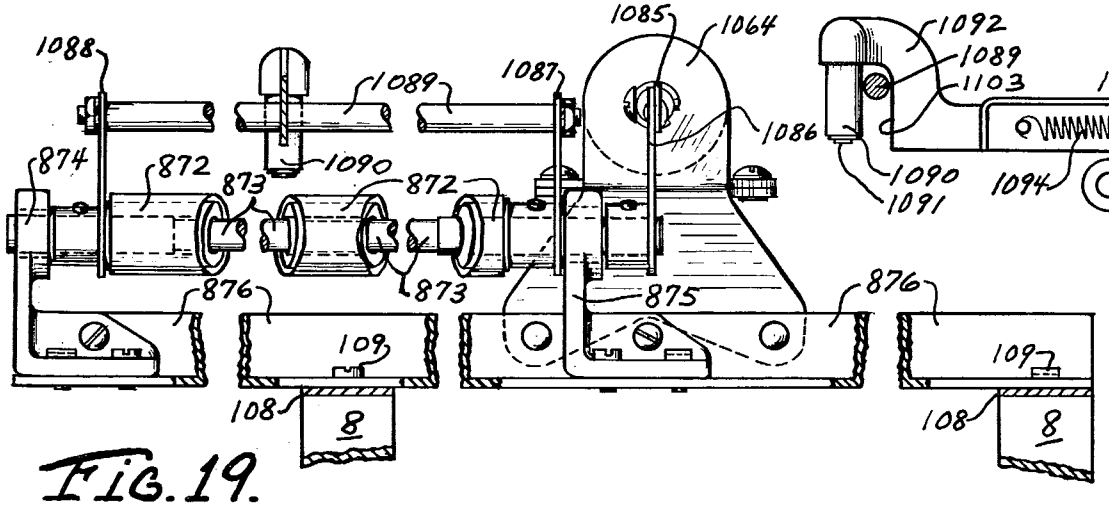
FIG. 19 is a condensed fragmentary front view, taken generally on line 19 — 19 (FIG. 17), showing principally a portion of the normal line space mechanism and the support means therefor.
Figure 20:
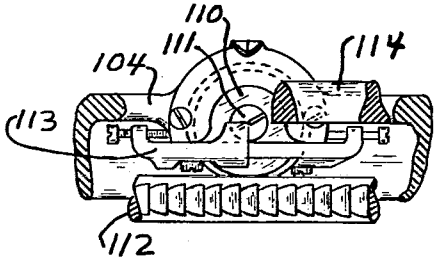
FIG. 20 is a fragmentary front view of the carriage position indicator, the forward support for the carriage, and a carriage mounted adjustable abutment which cooperates with the margin stops.

The gear 871 is constantly meshed with a wire gear 872 which extends longitudinally sufficiently to remain engaged with the gear 871 in all transverse positions of the carriage 9*a* and the gear 871. Wire gear 872 is rotatable on a shaft 873, which extends leftward and rightward therefrom, and the ends of the shaft 873 are rotatably mounted on identical brackets 874 and 875 (FIG. 19). Brackets 874 and 875 are secured on an angle iron 876, and the angle iron 876 is secured on top of the carriage rail supporting portions 108 and the typewriter frame 8 by the cap screws 109 as indicated.

Figure 67:
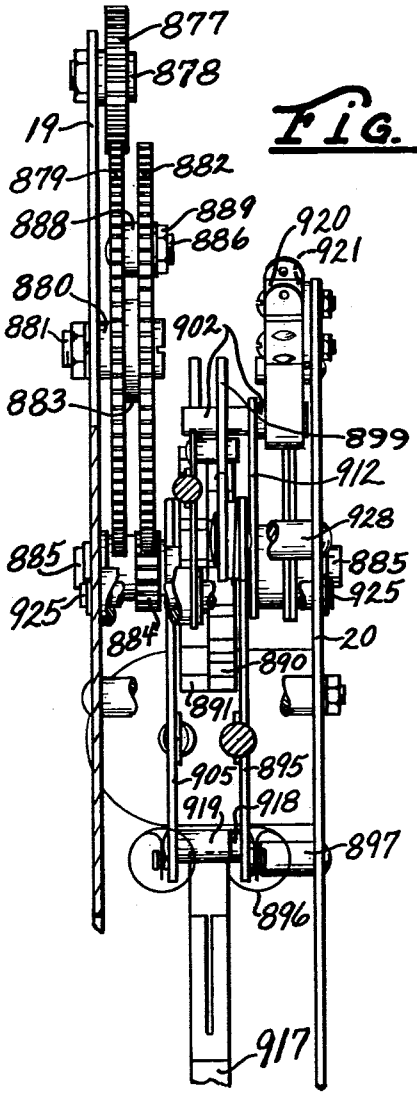
FIG. 67 is a slightly fragmented sectioned rear view of the line space mechanism as seen from line 67 — 67 (FIG. 65).

A spur gear 877 (FIG. 65) is meshed with the wire gear 872 and it is rotatably mounted on a bolt 878 that is secured on plate 19. Gear 877 is meshed with a gear 879 which is secured on a hub 880 (FIG. 67). Hub 880 is pivoted on a bolt 881 and the bolt 881 is secured on plate 19. A gear 882 is pivoted on an extension of the hub 880 and it is spaced from gear 879 by a washer 883 on the hub 880, sufficiently to be clear of the gear 877. Gear 882 is meshed with a gear 884 that is secured on a rotatable shaft 885, and the shaft 885 is rotatably mounted on the plates 19 and 20. An adjustment stud 886 is secured on gear 879 and it extends through an arcuate slot 887 (FIG. 65) in the gear 882. A washer 888 (FIG. 67) is assembled on the stud 886, between the gears 879 and 882, and it is of the same thickness as the washer 883. The adjustment stud and slot arrangement, between the gear 882 that is engaged with gear 884 and the gear 879 that is engaged with gear 877 and is thus entrained with the platen 115, is provided so that the platen 115 may be adjusted to a proper line space as determined by the detent ratchet 866 (FIG. 65) and the gear 884 (FIG. 67) may be adjusted in proper angle of rotation for synchronizing the detent 867 and the line space mechanism. When the parts are thus properly adjusted, a nut 889 is tightened on the stud 886 for clamping the gears 879 and 882 together for unitary rotation.

Two identical ratchet wheels 890 and 891 are assembled on the shaft 885 (FIG. 66), but each is reversed in respect to the other as shown, and the ratchet wheels 890 and 891 are secured for rotation with shaft 885 by a key 892. By rotating the ratchet wheels 890 and 891 counterclockwise one tooth, as by such operation of ratchet wheel 890, the shaft 885 and gear 884 (FIG. 67) are rotated likewise, gears 882 and 879 (FIG. 65) are rotated clockwise, gear 877 is rotated counterclockwise, gear 872 is rotated clockwise, gear 871 and sprocket 870 are rotated counterclockwise, the belt 869 and sprocket 868 are likewise operated counterclockwise, the clutch input member 859 (FIG. 64) and detent ratchet wheel 866 are operated one step of ratchet wheel 866 in a forward direction, and the platen 115 is thereby normally rotated one line space forwardly. In this manner, the platen 115 is forward line spaced one line whenever the ratchet wheel 890 (FIG. 65) is operated one tooth in the same counterclockwise direction. It also holds true that when the ratchet wheels 890 and 891 are rotated one tooth clockwise as by ratchet wheel 891, the platen 115 is likewise rotated one line space reversely. It can also be understood that ratchet wheels 890 and 891 are rotated counterclockwise and clockwise one tooth whenever the operator rotates the platen 115 (FIG. 64) forwardly and reversely, respectively, for each tooth on detent ratchet wheel 866, by turning knob 862 for example.

Figure 66:
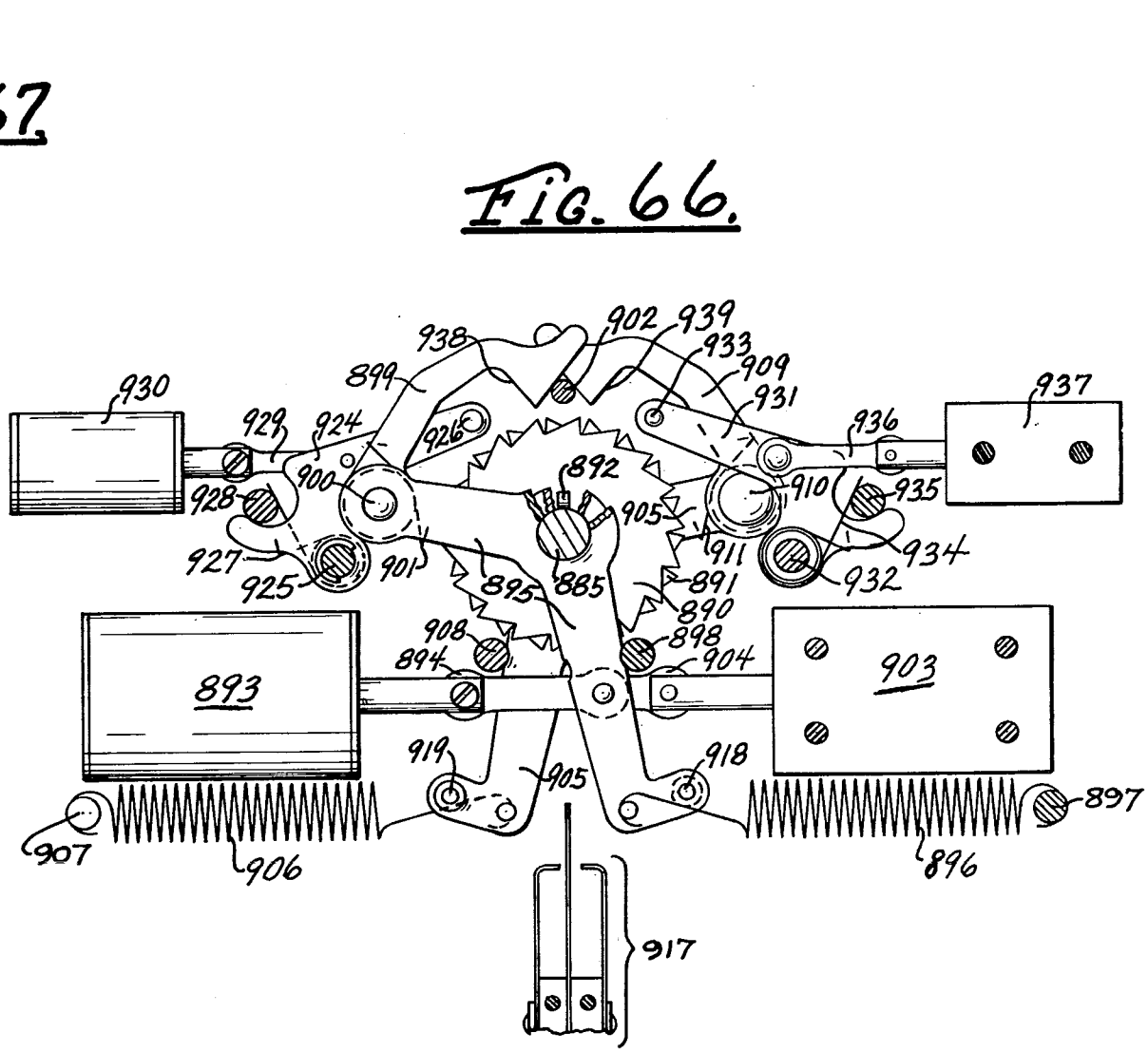
FIG. 66 is a fragmented detailed view of some of the mechanism shown also in FIG. 65.

A forward operation cocking solenoid 893 (FIG. 65) is secured on plate 19, and a link 894 is pivotally connected to the armature of the solenoid 893 and to a bellcrank 895 that is pivoted on shaft 885. A contractile spring 896 is connected to bellcrank 895 and to a stud 897 (FIG. 67) secured on plate 20, and the spring 896 urges the bellcrank 895 counterclockwise in normal position against a rod 898 (FIG. 65) that is secured at its ends to plates 19 and 20. A drive pawl 899 is mounted on bellcrank 895 at pivot 900. Pawl 899 is urged clockwise by a torsion spring 901 connected to the pawl 899 and to bellcrank 895, and the pawl 899 normally rests against a stud 902 as shown in FIG. 66. Stud 902 will be described presently.

A reverse operation cocking solenoid 903 (FIG. 65) is secured on plate 20, and a link 904 is pivotally connected to the armature of the solenoid 903 and to a bellcrank 905 that is pivoted on shaft 885. Bellcrank 905 is like bellcrank 895, but it is assembled in the reverse direction. A spring 906 is connected to the bellcrank 905 and to a stud 907 secured on plate 19, and the spring 906 urges the bellcrank 905 clockwise in normal position against a rod 908 that is secured at its ends to plates 19 and 20. A pawl 909 is pivoted on bellcrank 905 at 910. Pawl 909 is urged counterclockwise by a torsion spring 911 connected to the pawl 909 and to the bellcrank 905, and the pawl 909 normally rests against the stud 902 as shown in FIG. 66.

Stud 902 (FIG. 67) is secured in any known manner to the upper end of a member 912 and the stud 902 extends from both sides of the member 912 as shown. The member 912 is pivoted on shaft 885. The stud 902 and member 912 (FIG. 65) are yieldably held in the illustrated position by a pair of centralizer members 913 and 914 that are pivoted on the shaft 885. A contractile spring 915 is connected to the centralizer members 913 and 914 for urging them clockwise and counterclockwise, respectively, against the stud 902 and at the same time, against an indicator stud 916 that is secured on plate 20.

As will be explained, operation of either one of the bellcranks 895 or 905 shifts a cycling control switch 917. Switch 917 is secured on plate 20, and it is a single-pole double-throw type. A pair of insulated studs 918 and 919 are respectively secured on the bellcranks 895 and 905, and they extend in opposite directions from their respective bellcranks 895, 905 into engaging alignment with the center pole of the switch 917 as shown in FIG. 67. Operation of the switch 917 will be descibed in connection with the cycling control circuit.

As will also be explained presently, the centralizer members 913 and 914 (FIG. 65) are individually rotated away from the indicator stud 916, and, at the end of such rotation, a respective restoring circuit switch 920 or 921 is closed. To this end, an insulator 922 is secured on member 913 in alignment with switch 920, and an insulator 923 is secured on member 914 in alignment with switch 921. The switches 920 and 921 are secured on the plate 20 (FIG. 67).

Upon full forward line space operation, as will be described, a member 924 (FIG. 66) is operated to release the pawl 899 from ratchet wheel 890. Member 924 is pivoted on a rod 925 that is secured at its ends to plates 19 and 20 (FIG. 67). A stud 926 (FIG. 66) is secured on member 924 and it extends under the pawl 899. A torsion spring 927 is connected to member 924 and to a stop rod 928 for urging the member 924 clockwise in normal position against the rod 928 as shown. Rod 928 is secured on plates 19 and 20 (FIG. 67). A link 929 (FIG. 66) is pivotally connected to member 924 and to the armature of a restoring solenoid 930. Solenoid 930 is secured on plate 19 (FIG. 65).

A similar arrangement is provided for restoring the pawl 909, after a reverse line space operation to be described. This arrangement is just like that just described, and it comprises a member 931 (FIG. 66) pivoted on a rod 932, a stud 933 secured on the member 931, a torsion spring 934, rod 935, a link 936 and a solenoid 937. The rods 932 and 935 are secured at their ends to the plates 19 and 20 (FIG. 67), like the rods 925 and 928 described above.

The arrangement is such that, upon operation of the forward cocking solenoid 893 (FIG. 66), the solenoid 893 pulls link 894, rotates bellcrank 895 clockwise and shifts the pawl 899 therewith. Just prior to the end of this motion and prior to the instant bellcrank 895 is stopped against rod 908, a surface 938 on pawl 899 passes to the right of stud 902 and the spring 901 rotates the pawl 899 into engagement with a tooth on ratchet wheel 890, that is one tooth clockwise from the normal position of the pawl 899. Upon deenergizatin of solenoid 893, as will be described, the spring 896 returns the bellcrank 895 and pawl 899 counterclockwise. This counterclockwise movement of pawl 899 pulls the now engaged stud 902 and the ratchet wheel 890 counterclockwise for rotating the previously described gears (FIG. 65), sprocket 868 and the platen 115 counterclockwise one forward line space. As stud 902 and its supporting member 912 are thus shifted counterclockwise, the stud 902 rotates the centralizer member 913 to engage the insulator 922 with the switch 920, and, near the end of the motion, the insulator closes the switch 920.

At the same time the stud 902 (FIG. 66) is shifted counterclockwise about the axis of shaft 885, it permits the spring 911 to rotate the reversing pawl 909 into engagement with the ratchet wheel 891 for preventing over-rotation of the mechanism at the end of the forward line space operation.

Closure of switch 920 (FIG. 65), at the end of the forward line space stroke as described, completes a restoring circuit that energizes the solenoid 930 as will be described. Operation of solenoid 930 (FIG. 66) pulls link 929 and rotates member 924 counterclockwise against rod 928. Such rotation of member 924, by its stud 926, rotates pawl 899 out of engagement with ratchet wheel 890 and above stud 902. As the surface 938 clears the stud 902, the spring 915 (FIG. 65) restores member 913, stud 902 and member 912 back into registration with indicator stud 916 as shown. Return of member 913 and its insulator 922 permits switch 920 to open for deenergizing the solenoid 930 and thus permitting the spring 927 to restore member 924 to the illustrated position. This also permits the spring 901 to restore pawl 899 back against stud 902 (FIG. 66) as shown. The clockwise return of stud 902 also lifts the pawl 909 to the illustrated position out of engagement with the ratchet wheel 891. Thus, the platen 115 is rotated forwardly one line space for each operation of the solenoid 893.

Upon operation of the reverse cocking solenoid 903, it pulls link 904, rotates bellcrank 905 counterclockwise and likewise shifts pawl 909. Prior to the instant bellcrank 905 is stopped against rod 898, a surface 939 on pawl 909 passes to the left of stud 902 and the spring 911 rotates the pawl 909 into engagement with a tooth on ratchet wheel 891 one tooth counterclockwise from the normal position of the pawl 909. Upon deenergization of solenoid 903, the spring 906 returns the bellcrank 905 and pawl 909 clockwise. This movement of pawl 909 pulls the now engaged stud 902 and the ratchet wheel 891 clockwise for rotating the previously described transmission gears (FIG. 65), sprocket 868 and the platen 115 clockwise one reverse line space. As stud 902 and its member 912 are thus shifted clockwise, the stud 902 rotates the centralizer member 914 to engage its insulator 923 with the switch 921, and, near the end of this motion, the insulator 923 closes the switch 921.

At the same time stud 902 (FIG. 66) is shifted clockwise, it permits the spring 901 to rotate the forward drive pawl 899 into engagement with the ratchet wheel 890 for preventing over-rotation of the mechanism at the end of the reverse line space operation.

Closure of switch 921 (FIG. 65) at the end of the reverse line space stroke as described, completes a restoring circuit that energizes the solenoid 937 as will be described. Operation of solenoid 937 (FIG. 66) pulls link 936 and rotates member 931 clockwise against rod 935. Such rotation of member 931, by its stud 933, rotates pawl 909 out of engagement with ratchet wheel 891 and above stud 902. As the surface 939 clears the stud 902, the spring 915 (FIG. 65) restores member 914, stud 902 and member 912 counterclockwise back into registration with indicator stud 916 as shown. Return of member 914 and its insulator 923 permits switch 921 to open for deenergizing solenoid 937 and thus permits the spring 934 to restore member 931 to the illustrated position. This also permits the spring 911 to restore pawl 909 back against stud 902 (FIG. 66) as shown. The counterclockwise return of stud 902 also returns the pawl 899 to the elevated illustrated position out of engagement with the ratchet wheel 890. Thus, the platen 115 is rotated reversely one line space for each operation of the solenoid 903.

The decoder controlled forward and reverse line spacing circuits, together with related cycling and restoring circuits, will now be described.

A wire 940 (FIG. 68) is connected between the normally closed switch 541 and the forward cocking solenoid 893. A wire 941 is connected to the solenoid 893 and to the terminal that is marked "F. LINE SP., (4)" (FIG. 50) which terminal is effective when the decoder 494 is operated for a forward line space, the code for which is 4.

Figure 68:
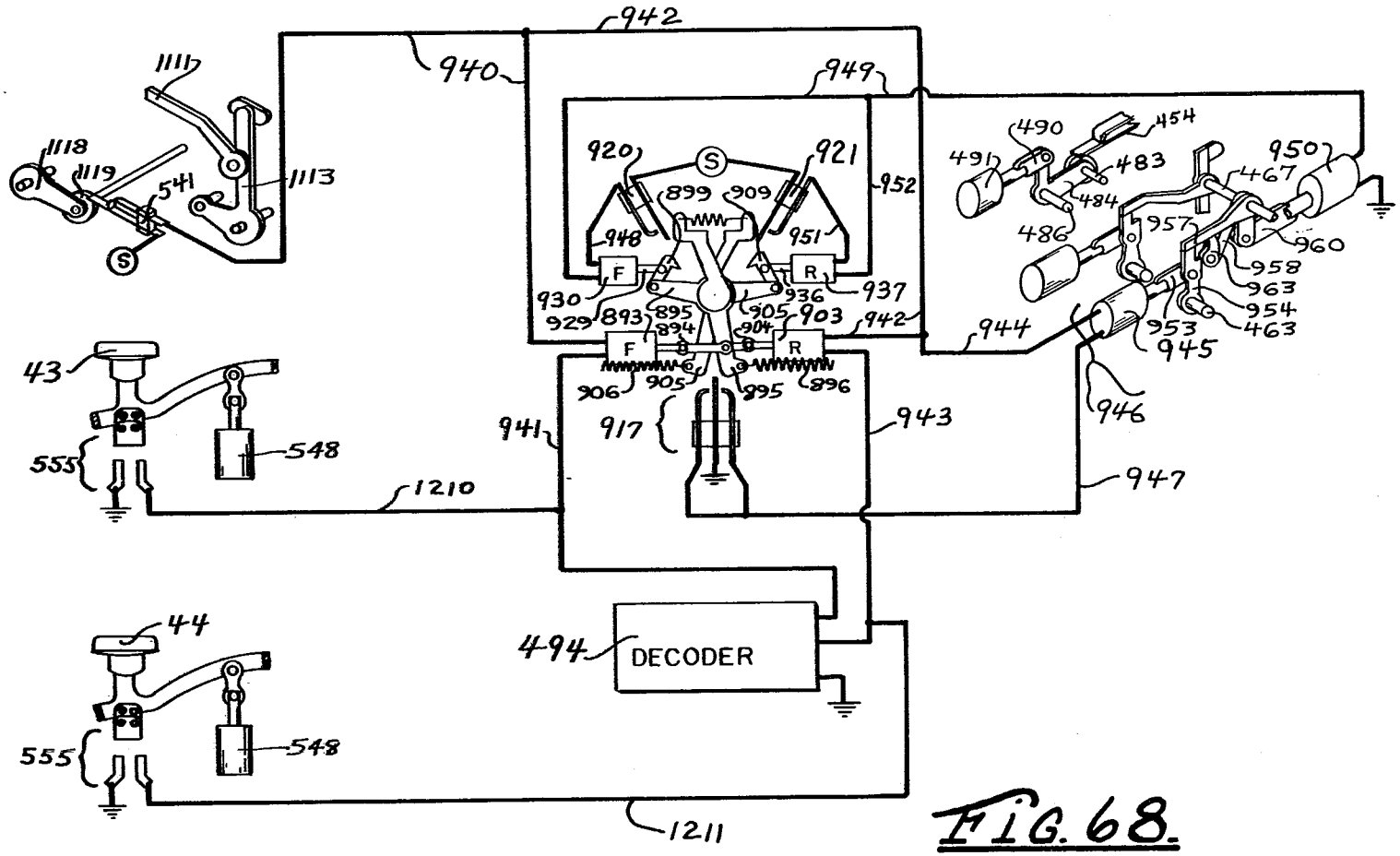
FIG. 68 is a schematic wiring diagram of the circuits for manual and automatic control of the extra line space mechanism.

A wire 942 (FIG. 68) is connected to the wire 940 and to the reverse cocking solenoid 903. A wire 943 is connected between the solenoid 903 and the reverse line space terminal, "R. LINE SP. (4,5)" (FIG. 50), in the decoder 494 (FIG. 68).

A cycling control circuit wire 944 (FIG. 68) is connected to the wire 942 and to a solenoid 945 in a line space cycling mechanism 946 to be described presently. A wire 947 is connected to solenoid 945 and to both throw blades of the switch 917. The center blade of switch 917 is grounded as indicated.

A source of power (S) is connected to both restoring circuit switches 920 and 921. A wire 948 is connected between switch 920 and solenoid 930. A wire 949 is connected to solenoid 930 and to a restoring solenoid 950 in the mechanism 946, and the solenoid 950 is grounded as indicated. A wire 951 interconnects switch 921 and solenoid 937, and a wire 952 interconnects solenoid 937 and the wire 949 as shown.

The line space cycling mechanism 946 will now be described. The solenoids 945 and 950 are secured on the transverse solenoid support members 468 and 469 (FIG. 41), respectively, in the second bank of cycling control mechanisms shown in FIG. 38.

A link 953 (FIG. 41) is pivotally connected to the armature of solenoid 945 and to a member 954 that is pivoted on rod 463. A torsion spring 955 is anchored on rod 464 and it is connected to member 954 for urging the member 954 clockwise against rod 464. A detent 956 is pivoted on rod 467 and a relatively strong torsion spring 957 is connected to the detent 956 for normally urging it down on top of the member 954 as shown. The spring 957 is also connected to a member 958 that is pivoted on rod 467, and it normally urges member 958 clockwise against rod 464. A contractile spring 959 is connected to the support member 471 and to the member 958 for urging the member 958 clockwise as will be described. A link 960 is pivotally connected to member 958 and to the armature of the restoring solenoid 950. A pawl 961 is pivoted on the member 958, and it is adapted to latch under the bail 483 but a finger 962 on the link 953 normally abuts a tab 963 on the pawl 961 for holding the pawl 961 in the illustrated clockwise position. A torsion spring 964 is connected to pawl 961 and to member 958 for urging the pawl 961 counterclockwise, normally against the finger 962.

The arrangement is such that, upon operation of the solenoid 945, the solenoid 945 pulls link 953 and rotates member 954 counterclockwise. When this occurs, the finger 962 is withdrawn from tab 963 and the tab 963 is shifted against bail 483 as the spring 964 rotates pawl 961 counterclockwise. Just prior to engagement of the member 954 with the rod 465, the spring 957 rotates the detent 956 counterclockwise into a notch 965 in the end of member 954 for holding the member 954 in operated position. At the same time detent 956 is shifted into notch 965, the detent 956 pushes the bail 483 down, and thus it rotates the unit formed of bail 483, member 485, shaft 486, member 484 (FIG. 42) and insulator 482 clockwise about the axis of shaft 486 against tension of spring 489, for permitting the reader control circuit switch 454 to open as described.

In a rapid sequence as will be described, the solenoid 945 (FIG. 41) is deenergized and the restoring solenoid 950 is operated. The solenoid 950 then pulls link 960 and shifts the member 958 and pawl 961 counterclockwise against the tensions of springs 957 and 959 for permitting the spring 964 to latch the pawl 961 under the bail 483. The solenoid 950 is then deenergized as will be described. Whereupon, the spring 957 presses member 958 and pawl 961 against the bottom of bail 483, and the spring 959 rotates the member 958, pawl 961, bail 483 and detent 956 clockwise about the axis of rod 467, while the spring 489 (FIG. 42) exerts additional force for raising the bail 483 and insulator 482 to reclose the reader control circuit switch 454 as described. The clockwise rotation of detent 956 (FIG. 41) removes it from the notch 965 in member 954. Whereupon the spring 955 restores member 954 and the finger 962 on link 953 strikes the tab 963 and shifts the pawl 961 out from under bail 483 and thereby frees the bail 483 for a subsequent operation and the reader control circuit switch 454 (FIG. 42) is yieldably held closed by the effect of spring 489 as described. As the pawl 961 (FIG. 41) is disengaged from bail 483, the member 958 is urged against rod 464 by springs 959 and 957, and the detent 956 is pressed down on the end of member 954, as shown, by spring 957.

The sequences of code controlled cycles of extra line space operations will now be described.

An extra forward line space sequence will be described first. When the main reader 407 (FIG. 31) senses the forward line space code 4 and the decoder 494 is operated accordingly as described, the decoder 494 (FIG. 68) provides a ground for the circuit that flows from source and switch 541, through wire 940, forward cocking solenoid 893, wire 941 and goes to ground through the operated decoder 494.

When solenoid 893 is operated and the mechanism is fully cocked for a forward line space operation, the cycling control switch 917 is shifted as described. Whereupon, current flows from source (S) and switch 541, through wires 940, 942 and 944, solenoid 945, wire 947 and to ground through the now shifted switch 917. Upon full operation of the solenoid 945, the line space cycling mechanism 946 operates to open the reader control circuit switch 454 as described.

Opening of switch 454 (FIG. 31) permits the now cocked tape feed mechanism 408 to shift the forward line space code out of the main reader 407 and to thereby permit normalization of the decoder 494. When the decoder 494 (FIG. 68) returns to normal, the solenoid 893 is deenergized and the now cocked line space mechanism forward line spaces the platen 115 as described.

When the forward line space operation is performed, the switch 917 is normalized for deenergizing the solenoid 945 and the restoring circuit switch 920 is closed as described. Closure of switch 920 causes current to flow from source (S) through the now closed switch 920, wire 948, restoring solenoid 930, wire 949, and goes to ground through the restoring solenoid 950. Operation of the solenoid 950 prepares the mechanism 946 to restore, and operation of the solenoid 930 unlatches the forward drive pawl 899 (FIG. 66) and this permits the switch 920 (FIG. 65) to open as described. The opening of switch 920 (FIG. 68) deenergizes the solenoids 930 and 950, and thereby permits the line space mechanism (FIG. 65) to return to normal and permits the line space cycling mechanism 946 (FIG. 68) to restore, respectively. Restoration of the mechanism 946 causes the reader control circuit switch 454 (FIG. 31) to be reclosed, as described, for reading a succeeding code.

An extra reverse line space sequence is performed in a similar manner. When the reverse line space code (4,5) is sensed and the decoder 494 is operated accordingly, the decoder 494 (FIG. 68) completes the circuit that flows from source (S) and switch 541, through wires 940 and 942, reverse cocking solenoid 903, wire 943 and the operated decoder 494. As described, the solenoid 903 cocks the mechanism for a reverse line space operation and shifts the switch 917. Whereupon, the solenoid 945 is operated and the cycling mechanism 946 opens the reader control circuit switch 454.

As described for forward line space operations, the opening of switch 454 causes the control tape 412 to be shifted and the decoder 494 to be normalized. However, in this instance, the decoder 494 deenergizes the solenoid 903, and the line space mechanism performs a reverse line space operation, normalizes the switch 917 for deenergizing solenoid 945 and closes the restoring switch 921. Thus, the circuit is complete from source through now closed switch 921, wire 951, restoring solenoid 937, wires 952 and 949, and solenoid 950. Operation of the solenoid 937 unlatches the reverse pawl 909 and this permits the switch 921 to open for deenergizing the solenoids 937 and 950. Whereupon, the line space mechanism is restored to normal condition, and the cycling mechanism 946 restores and recloses the reader control circuit switch 454 for reading the succeeding code.

15. BOLD FACE AND REGULAR AND PRINT AND NO PRINT CONTROLS

These two features are discussed together since the bold and regular control 545 (FIG. 51) and the print-no print control 553 are similar and, in many respects, a description of one control will serve to describe the other.

The bold and regular control 545 may be shifted by a key 966 (FIG. 8) in regular condition ("Reg.") or "bold" condition for, respectively thereafter, controlling the machine to imprint characters with normal force or to print in a strong "bold" manner. The control 545 may be shifted, from one condition to the other, by manipulation of the key 966, or it may be shifted automatically by motivating solenoids 967 and 968 (FIG. 69) to regular and bold conditions, respectively, as controlled by corresponding codes on the code medium. The control 545 may be locked in either condition by manipulation of a lock 969, and, when the lock 969 is in effective position, the control 545 cannot be shifted by inadvertent manipulation of key 966 or by automatic operation of a motivating solenoid 967 or 968, and in the latter instance the code for such a shift will merely by cycled through the main reader 407, as will be explained. It will be seen that bold and regular printing may be controlled entirely by the control tape 412, or either desired contrary condition of bold and regular printing may be accomplished from the same tape 412.

The print-no print control 553 (FIG. 51) may be shifted by a key 970 (FIG. 8) in print condition or no print condition for, respectively thereafter, controlling the machine to imprint and shift the carriage 9*a* appropriately for each character, or not to print and to merely shift the carriage *9a* appropriately for each character and, in the latter instance, blank space is provided for variables, even though characters and spaces are encoded on the control tape 412. The control 553 (FIG. 51) may be shifted, from one condition to the other, by manipulation of the key 970 (FIG. 8), or it may be shifted automatically by motivating solenoids 971 and 972 (FIG. 51) to print and no print conditions, respectively, in response to corresponding codes on the code medium. Control 553 may be locked in either condition by manipulation of a lock 973 (FIG. 8), and, when the lock 973 is in effective position at a time when the control 553 might otherwise be shifted automatically, the code for such a shift is merely shifted through the main reader 407, as will be explained. It will be seen that print and no print conditions may be controlled automatically by corresponding codes on the control tape 412, or either desired contrary condition may be enforced by the lock 973.

The bold and regular control 545 (FIG. 51) will now be described. As described in topic 6 hereinbefore, a reduced flow of current is provided for the normal imprinting force, and the normal imprinting circuit passes through the resistor 543, normally effective brush 544 in control 545, the constantly effective brush 546 in control 545, wire 547, one of the solenoids 548 for operating a character key 39 and for imprinting a character, and so on. When the control 545 is shifted to bold condition, the brush 544 and resistor 543 are rendered ineffective and a brush 974 and a wire 975 between wire 542 and brush 974 are rendered effective. Thus, when the control 545 is in bold condition, the resistor 543 is avoided and an operated solenoid 548 receives the full flow of the current for imprinting the related character in bold face.

Brushes 544, 546 and 974, and an associated conductor 976 basically constitute a preferred single-pole double-throw switch 977. A description of the switch 977 should serve to describe two more such switches 978 and 979 that are also part of control 545. The switches 978 and 979 are components of a conditioning code arrangement to be described later.

Figures 69, 70, 71, 72, 73:
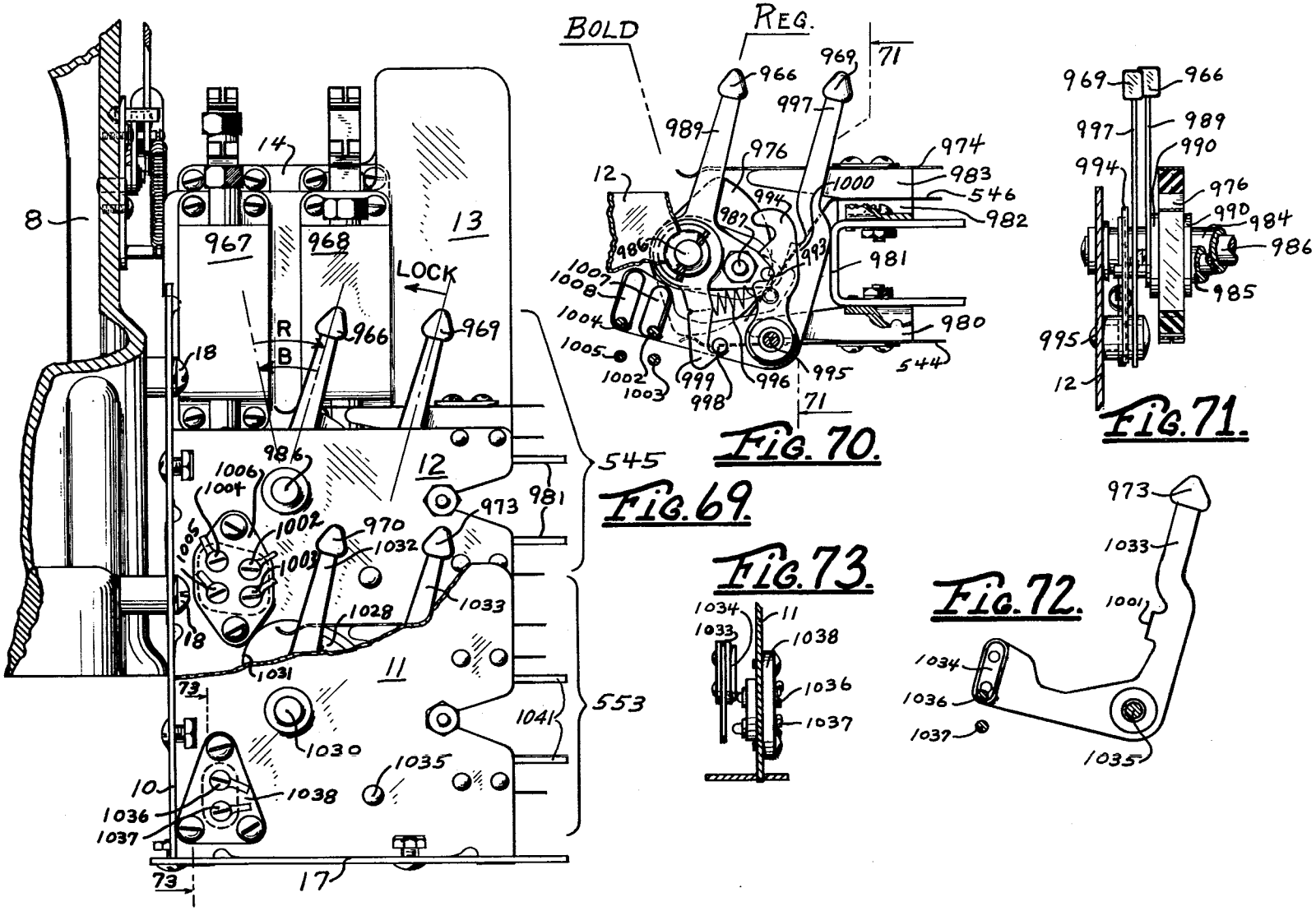
FIG. 69 is a slightly fragmented front view of a bold-regular, print-no print control assembly, and also showing the manner in which the assembly is secured on the righthand side of the basic typewriter frame.
FIG. 70 is a fragmented detailed front view of a key and related control mechanism that is shown obscurely in FIG. 69.
FIG. 71 is a fragmented and sectioned right side view of the mechanism shown in FIG. 70, as seen from line 71 — 71 (FIG. 70).
FIG. 72 is a detailed front view of a key lock that is shown only in part in FIG. 69.
FIG. 73 is a fragmented and sectioned left side view of a switch as viewed from line 73 — 73 (FIG. 69).

Brush 544, together with a suitable insulator 980 (FIG. 70), is secured on the underside of a channel member 981 that is secured on the vertical plates 12 and 13 (FIG. 69). The brushes 546 and 974 (FIG. 70), and suitable insulators 982 and 983, are secured on the top of member 981. Brush 547 is constantly engaged with the conductor 976, and, only when the conductor 976 is in the illustrated clockwise ("Reg.") position, the brush 544 is also engaged with the conductor 976. However, when the conductor 976 is shifted to its counterclockwise ("Bold") position, the conductor 976 is disengaged from the brush 544 and it is engaged with the brush 974.

Figure 46:
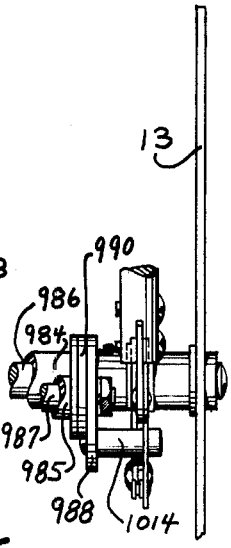
FIG. 46 is a detailed right side fragmentary view of part of the mechanism shown in FIG. 44.

The conductor 976 is mounted on two tubular insulators 984 and 985 (FIG. 71). The insulator 984 is assembled on a shaft 986 that is rotatably mounted at its forward end on the plate 12 and at its rearward end on the plate 13 (FIG. 46). The insulator 985 is assembled on a bail rod 987 that is secured at its rearward end on a member 988, and member 988 is secured on the shaft 986. The forward end of rod 987 is secured on a member 989 (FIG. 70) that also carries the key 966. Member 989 is secured on shaft 986. Identical insulators 990 (FIG. 71) are situated between the conductor 976 and member 989, between the conductors 976, 991 and 992 (FIG. 51) of the switches 977, 978, 979 respectively, between the conductor 976 and the member 988 (FIG. 46), and the insulators 990 are mounted on the insulators 984 and 985. Thus, the conductors 976, 991, 992 are insulated from each other and from the other supporting members.

The unit formed of member 988, the conductors 922 (FIG. 51), 991 and 976, rod 987 (FIG. 70), shaft 986, member 989 and key 966, and the insulators 984, 985, 990, as described, is held in clockwise regular position or in counterclockwise bold position by a stud 993 and a yieldable detent 994. Stud 993 is secured on the member 989 and extends forwardly beyond the edge of detent 994. The working surfaces of detent 994 cooperate with the stud 993 for yieldably holding the key 966 and connected parts in regular or bold position, and for positively preventing the mechanism from rotating beyond these two positions. Detent 994 is pivoted on a stud 995 that is secured on plate 12 (FIG. 71). A contractile spring 996 (FIG. 70) is connected to detent 994 for urging the detent 994 counterclockwise against the stud 993 as shown.

The lock 969 is carried by a lock member 997 that is pivoted on the stud 995. Lock 969 is normally held in the illustrated clockwise position, and it may be held in a counterclockwise effective position, by a stud 998 on member 997 and a yieldable detent 999 that is urged against the stud 998. Detent 999 is pivoted on shaft 986 and the spring 996 is connected between detents 994 and 999 for urging both detents 994 and 999 counterclockwise.

A normally ineffective blocking lug 1000 on the locking member 997 is shaped just like a lug 1001 (FIG. 72) to be described later. However, when the lock 969 (FIG. 8) is manually shifted leftward, the lug 1000 (FIG. 70) is shifted over the stud 993 when the mechanism is in regular position, or it is shifted under the stud 993 when the mechanism is in bold position, for blocking movement of the stud 993 and thereby locking the mechanism in the respective condition. When the lock 969 is shifted counterclockwise, the member 997 is stopped by stud 993 and, when it is returned clockwise, the member 997 is stopped in ineffective position by member 981 as shown. It can be seen that the lock 969 is not shiftable to effective position at times when the key 966 is being shifted, since the end of the lug 1000 is blocked by stud 993 at such times.

To accommodate a conditioning arrangement to be described later, two pair of terminal contacts 1002, 1003 and 1004, 1005 are closed only when the lock 969 is in its effective counterclockwise position. The terminal contacts 1002 – 1005 are of the well known bullet type like those shown in FIG. 73. However, the terminal contacts 1002 – 1005 (FIG. 69) are secured in an insulator block 1006 and the block 1006 is secured on and it extends through a hole therefor in the plate 12. A pair of conductors 1007 and 1008 (FIG. 70) are mounted on a leftwardly extending arm of the lock member 997, and the conductors 1007, 1008 are insulated in a known manner from the arm and from each other. When the lock 969 is shifted counterclockwise, the conductor 1007 is engaged with both contacts 1002 and 1003 for closing the contacts 1002, 1003, and the conductor 1008 closes the contacts 1004 and 1005. When the lock 969 is shifted to the illustrated ineffective position, the conductors 1007 and 1008 are shifted to break contact between the respective pairs of contacts 1002–1005.

The motivating solenoids 967 and 968 (FIG. 44) are secured on plate 13. A link 1009 is pivotally connected to the armature of solenoid 967 and to a member 1010 that is pivoted on the shaft 986. A link 1011 (FIG. 45) is pivotally connected to solenoid 968 and to a member 1012 that is also pivoted on shaft 986. A contractile spring 1013 is connected to the members 1010 and 1012 for urging them in contradirections against a stud 1014. The stud 1014 is secured on the member 988 (FIG. 46).

A pair of normally open switches 1015 and 1016 (FIG. 44), that are just like the switches 819 and 820 (FIGS. 61 and 60), are secured on the back of plate 13 (FIG. 44) in respective alignment with insulators 1017 and 1018 that are secured on the upper ends of the armatures of solenoids 967 and 968, respectively.

The arrangement is such that, when the bold code is read and the solenoid 968 is energized as will be described, the solenoid 968 rotates the member 1012 counterclockwise, and, by the tension of relatively strong spring 1013 and by member 1010, the stud 1014 and the unit including member 988, shaft 986, rod 987, the three conductors (like conductor 976, FIG. 70), member 989 and key 966 is rotated counterclockwise to "BOLD" position, where the studs 993 and the unit is stopped by detent 994. When the unit is stopped in "BOLD" position, the spring 1013 (FIG. 44) yields while the insulator 1018 closes the switch 1016. Closure of switch 1016 continues the cycle, wherein the solenoid 968 is deenergized, as will be described.

Deenergization of solenoid 968 permits the spring 1013 to return the member 1012 slightly clockwise against the stud 1014 while the insulator 1018 is lowered from engagement with the switch 1016 and the switch 1016 returns to its normal open condition.

When the regular code is read and the solenoid 967 is energized as will be described, the solenoid 967 rotates the member 1010 clockwise, and the spring 1013 shifts the member 1012, stud 1014 and the rest of the rotatable unit that includes the key 966 (FIG. 70) clockwise to the illustrated "REG" position. When the unit is stopped in regular position by detent 994 as described, the spring 1013 (FIG. 44) yields to permit the insulator 1017 to close the switch 1015, and to thereby continue the cycle that includes deenergization of solenoid 967 as will be described. Solenoid 967 then permits the spring 1013 to return the member 1010 against stud 1014, and to withdraw the insulator 1017 and to thus permit the switch 1015 to open.

At times when the lock 969 (FIG. 70) is effective and the control is not shiftable as described, reading of a bold or regular code and the resulting operation of the solenoid 968 or 967 (FIG. 44), respectively, merely stretches the spring 1013 and the respective solenoid 968, 967 closes the switch 1016 or 1015, for continuing the cycle and for bypassing the code without shifting the control 545.

Figure 63:
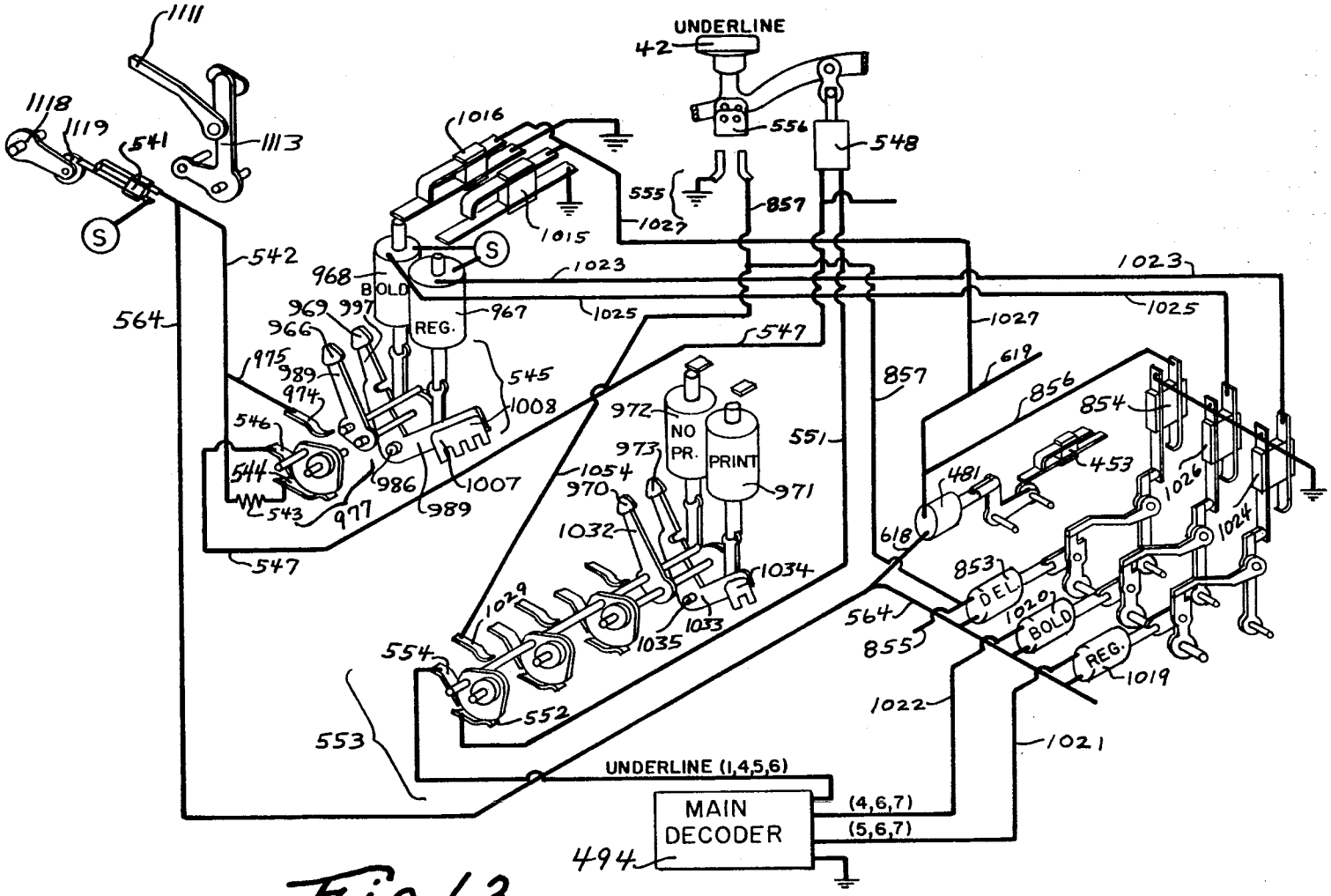
FIG. 63 is a schematic wiring diagram of circuits for automatic underline imprinting and for automatic "bold" and "regular" shift controls.

The circuitry for operating the solenoids 968 and 967 and for thereby shifting the bold and regular control 545 (FIG. 63) will now be described. The wire 545 (FIG. 63) will now be described. The wire 564 is connected to a solenoid 1019 which is part of a "regular" code cycling unit that is just like the unit described in connection with FIG. 39. The wire 564 (FIG. 63) is also connected to another such code cycling unit solenoid 1020. A wire 1021 is connected to the solenoid 1019 and to a terminal marked "REG. FACE (5,6,7)" (FIG. 50) in the main decoder 494 (FIG. 63), A wire 1022 is connected to the solenoid 1020, in the bold code cycling unit, and to a terminal marked "BOLD FACE (4,6,7)" (FIG. 50) in the main decoder 494 (FIG. 63).

A source of power (S) is connected to the solenoids 967 and 968. A wire 1023 is connected to solenoid 967 and to a switch 1024 in the regular ("Reg.") code cycling unit. A wire 1025 is connected to solenoid 968 and to a switch 1026 in the "bold" code cycling unit.

A wire 1027 is connected to the wire 619 and to both of the normally open switches 1015 and 1016, and the switches 1015, 1016 are grounded as indicated.

When the main reader 407 (FIG. 31) senses the regular code or the bold code and the main decoder 494 is operated accordingly, current flows from source (S) and normally closed switch 541 (FIG. 63), through wire 564, the respective solenoid 1019 or 1020, wire 1021 or 1022, and it goes to ground through the operated decoder 494. Upon full operation of the solenoid 1019 or 1020, the respective code cycling unit opens the reader control circuit switch 453, in the same manner as described in connection with FIG. 39. The opening of switch 453 (FIG. 31) breaks the reader control circuit, whereupon the main decoder 494 restores and the now cocked tape feed mechanism 408 shifts the control tape 412 forwardly, as previously described. When the decoder 494 (FIG. 63) is restored following operation according to a "regular" code (5,6,7), the solenoid 1019 is deenergized and its cycling unit closes the switch 1024. Whereupon, current flows from source (S) through solenoid 967 for shifting the control 545 to the regular face controlling condition and for closing the switch 1015 as previously described, the current continues through wire 1023 and goes to ground through now closed switch 1024. Upon full operation of solenoid 967, the switch 1015 is closed as described, and current flows through switch 541, wires 564 and 618, the solenoid 481 (FIG. 39) for reclosing the reader control circuit switch 453 and for restoring the operated cycling unit as described, the current travels through wires 619 and 1027 (FIG. 63), and goes to ground through the now closed switch 1015. When the cycling unit is restored the switch 1024 is opened for deenergizing the solenoid 967 and thereby opening the switch 1015 for deenergizing the solenoid 481. At this point the mechanism is restored, the tape 412 is shifted and the reader control circuit switch 453 is closed for reading the ensuing code.

When the decoder 494 is restored following its operation according to a "bold face" code (4,6,7), the then operated solenoid 1020 is deenergized and its cycling unit closes the switch 1026. Whereupon, current flows from source (S) through solenoid 968 for shifting the control 545 to the bold face controlling condition and for closing the switch 1016 as described, the current continues through wire 1025 and it goes to ground through now closed switch 1026. Upon closure of switch 1016, the solenoid 481 is operated for reclosing the switch 453 and for restoring the operated cycling unit. When the cycling unit is restored, the switch 1026 is opened for deenergizing the solenoid 968 and the switch 1016 is then opened. At this point the mechanism is restored and the reader control circuit switch 453 is closed for reading an ensuing code.

From the preceding, it can be seen that operation of the decoder 494 according to a bold or regular code causes operation of the solenoid 1020 or 1019, respectively, for operating the respective cycling unit to open the switch 453 and to thereby break the reader control circuit. Whereupon, the cocked cycling unit closes its respective switch 1026 or 1024 and thus causes operation of the motivating solenoid 968 or 967 to cause a shift of the control 545 to the appropriate bold or regular condition, respectively, except in instances when the lock 969 (FIG. 70) is in effective position and the shift of control 545 (FIG. 63) is blocked. However, in either instance, full operation of the solenoid 968 or 967 closes its respective switch 1016 or 1015 for causing operation of the solenoid 481 and for thereby restoring the operated cycling unit and for reclosing the reader control circuit switch 453 for reading the ensuing code.

From the foregoing, it can also be recalled that, in normal (Reg.) condition of control 545, the current for imprinting characters in regular face (lighter imprints) is led from source and switch 541, through wire 542, resistor 543 for reducing the flow, switch 977, wire 547 and to the selectively operable solenoid 548. In "Bold" condition of control 545 the full flow and force of the current is led through switch 541, wires 542 and 975, switch 977, wire 547 and the selectively operable solenoids 548 for imprinting the characters in darker Bold Face.

If the concepts of this application are adapted to a machine having the well known continually running power roll arrangement for operating the type arms, the same result can be obtained by having the bold and regular control 545 increase and decrease the speed of the rotating power roll, to achieve bold and regular face imprints, respectively.

As just reiterated above, the current for bold and regular imprinting normally passes through the wire 547 and the particular one of the solenoids 548 for selectively imprinting characters. As described previously herein, the imprinting circuit normally continues from an operated solenoid 548, through a respective wire 551 (FIG. 51), respective brushes 552 and 554 in the print-no print control mechanism 553, and so on through a respective wire and the operated decoder 494. There is a brush 552 and a brush 554, together with a conductor 1028 and a brush 1029 that is effective only when the mechanism is in no print condition, for each character key 309 in the machine, so that the decoder 494 can differentiate among the keys 39. Each switch comprising parts 552, 554, 1028 and 1029 in the mechanism 553, is just like the switches 977, 978 and 979 in the control 545.

However, when the control or mechanism 553 is conditioned for no print, the keys 39 or the key 42 that corresponds to a sensed character code are not operated, but the decoder 494 does not cause the appropriate cycling and consequent carriage movement for each character, as will be explained presently.

The structure and shifting operations of the print-no print control mechanism 553 are basically the same as those described for the control 545. However, a brief description of the mechanism 553 will now be given.

Figure 44:
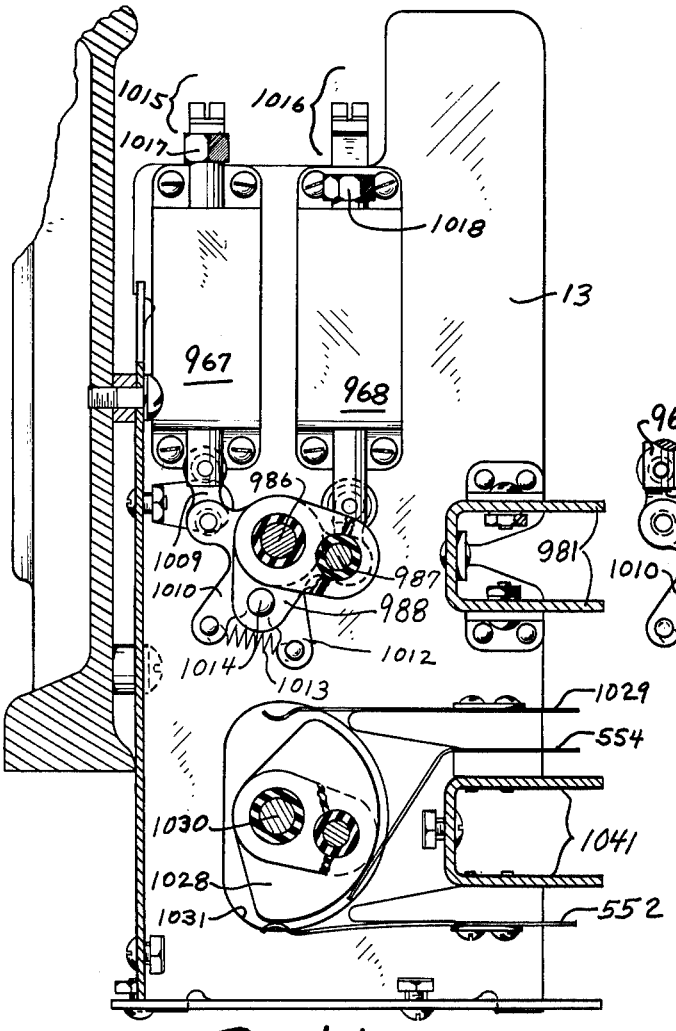
FIG. 44 is a sectional front elevation of a print-no print and bold-regular control assembly, as viewed from line 44 — 44 (FIG. 1).
Figure 45:
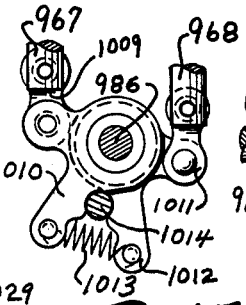
FIG. 45 is a fragmented detailed illustration of part of the mechanism shown in FIG. 44.

The forward end of the mechanism 553 is like that described in connection with FIGS. 70 and 71, except that the rotatable part of the mechanism 553 is mounted for rotation with a longer shaft 1030 (FIG. 69). The forward end of shaft 1030 is pivoted on the plate 11, and it together with its conductors 1028 thereon extend rearward through clearance holes 1031 in plates 12 and 13 (FIG. 44). The rearward end of the print-no print control mechanism 553 is exactly like that previously described in connection with FIGS. 44 – 46, except that the shaft 1030 (FIG. 44) and its motivating solenoids 971 and 972 (FIG. 1) are supported on the vertical frame plate 16.

The print-no print key 970 (FIG. 8) and the lock 973 are mounted on respective levers 1032 and 1033 (FIG. 69) that are the same as those described for the keys 966 and 969 (FIG. 70), except that the locking lever 1033 (FIG. 72) has only one conductor 1034. Lever 1033 is pivoted on a stud 1035 that is secured on plate 11 (FIG. 69). The conductor 1034 (FIG. 72) is provided for operating with bullet type contact terminals 1036 and 1037 for accommodating a conditioning code arrangement that will be described later. However, the contact terminals 1036 and 1037 are secured in an insulator block 1038 (FIGS. 69 and 73) that is secured on and it extends in part through a hole therefore in the plate 11 as shown. The arrangement is such that, when the lock 973 (FIG. 72) is shifted in its counterclockwise effective position, the member 1033 locks the key 970 (FIG. 69) and its mechanism in either the clockwise print position or the counterclockwise no print position, and, at the same time, the conductor 1034 (FIG. 73) closes the contact terminals 1036 and 1037. When the lock 973 (FIG. 72) is returned to its clockwise ineffective position, the key 970 (FIG. 69) is released for manipulation or for automatic shifting of the mechanism 553, and the conductor 1034 (FIG. 72) opens the contact terminals 1036 and 1037.

There are forty switches 1039 (FIG. 51), one for each character key 39 and 42 (FIG. 8), and one such switch 1040 (FIG. 51) for the conditioning code arrangement to be described after. There is one conductor 1028 (FIG. 44) and a set of brushes 552, 554 and 1029 for each of the switches 1039 and 1040 (FIG. 51). The brushes 552, 554 and 1029 are insulated from each other and from a channel member 1041 (FIG. 44) on which the brushes are mounted. The member 1041 (FIG. 1) is secured on the frame plates 11, 12, 13 and 16.

Figure 74:
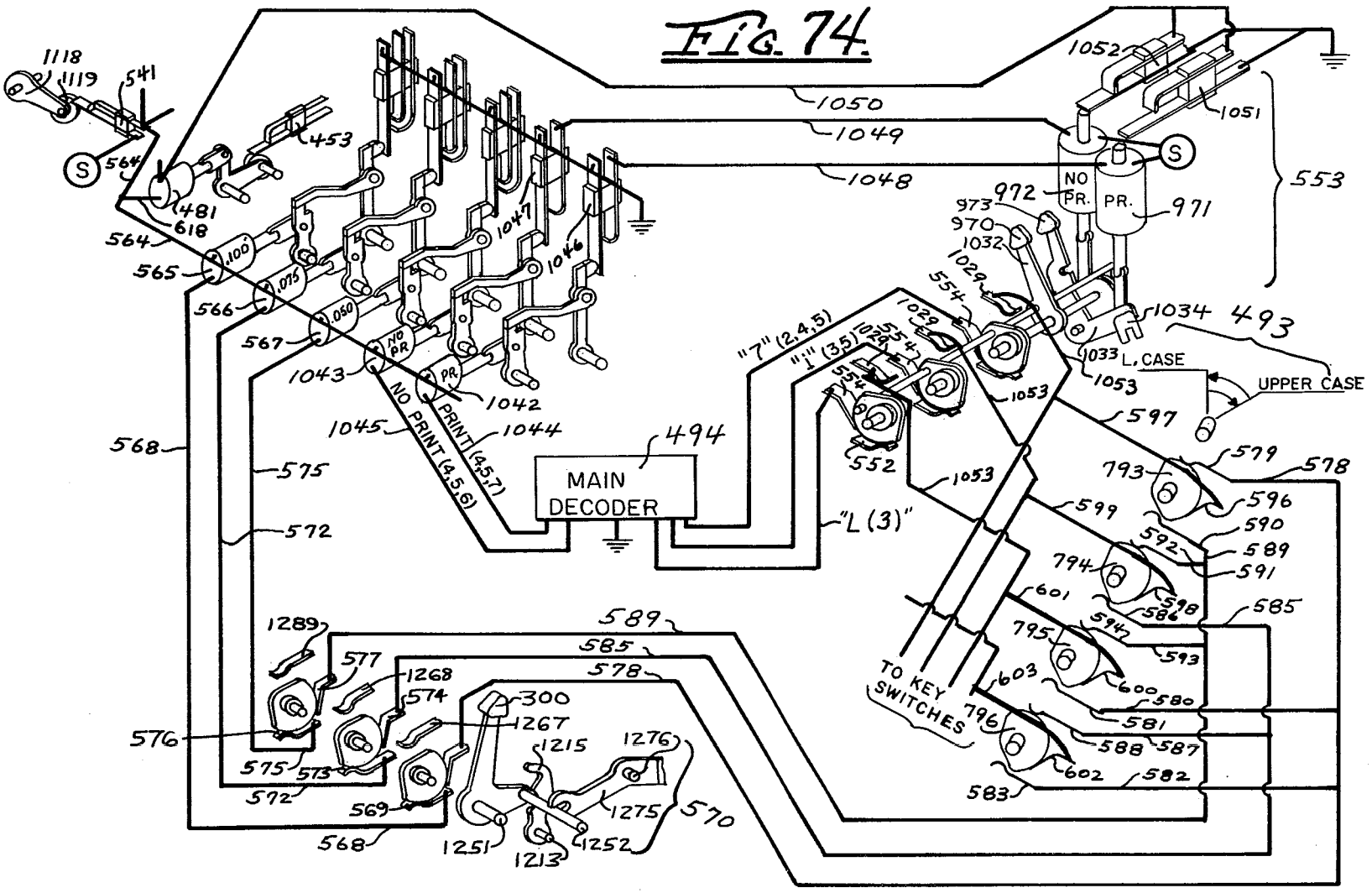
FIG. 74 is a schematic wiring diagram of circuits for automatic print-no print shifting and code cycling controls and for no print character code cycling controls.

The circuits for shifting the print-no print control mechanism 553 according to corresponding codes on the code medium will now be described. The wire 564 (FIG. 74) is connected to a print ("P") cycling mechanism solenoid 1042, and it is also connected to a no print ("No P.") solenoid 1043. A wire 1044 is connected between the solenoid 1042 and a terminal marked "Print (4,5,7)" (FIG. 50) in the decoder 494 (FIG. 74). A wire 1045 is connected to the solenoid 1043 and to a terminal marked "NO PRINT (4,5,6)" (FIG. 50) in the decoder 494 (FIG. 74). The solenoid 1042 and a switch 1046, and solenoid 1043 and a switch 1047 are parts of respective print and no print code cycling units that are like the one described in FIG. 39. A wire 1048 (FIG. 74) is connected between switch 1046 and the solenoid 971, and a wire 1049 is connected between switch 1047 and solenoid 972. A source of power (S) is connected to the solenoids 971 and 972. A wire 1050 is connected to the solenoid 481 and to two normally open switches 1051 and 1052 that are grounded as indicated. The switches 1051 and 1052 (FIG. 1) are secured on the plate 16, and they are like the switches 1015 and 1016 (FIG. 44).

When the main reader 407 (FIG. 31) senses the print code and the decoder 494 is operated accordingly, current flows from source (S) and switch 541 (FIG. 74), through wire 564, solenoid 1042, wire 1044 and it goes to ground through the operated decoder 494. Upon full operation of the solenoid 1042, its cycling unit opens the reader control circuit switch 453, in a previously described manner. Upon the consequent normalization of the decoder 494, the solenoid 1042 is deenergized and its cycling unit closes its switch 1046, and current then flows from source (S) through solenoid 971, wire 1048 and goes to ground through now closed switch 1046. Operation of the solenoid 971 normally rotates the shaft 1030 (FIG. 44) and the conductors 1028 thereon clockwise to the illustrated print condition, where the brushes 552 and 554 are effective. Following the major operation of solenoid 971 (FIG. 74), the mechanism yields while the solenoid 971 closes the switch 1051. Closure of switch 1051 completes the circuit that flows from source (S) and switch 541, through wires 564 and 618, solenoid 481, wire 1050 and it goes to ground through switch 1051. Operation of solenoid 481 restores the operated cycling unit for opening switch 1046 and it recloses the reader control circuit switch 453 for reading the ensuing code.

When the "No Print (4, 5, 6)" code is read, the decoder 494 completes the circuit that flows from source (S) and switch 541, wire 564, solenoid 1043 that operates its cycling unit to open the switch 453, and the circuit goes to ground through the operated decoder 494. When the reader control circuit switch 453 is opened, the decoder 494 is normalized, and the solenoid 1043 is deenergized and its cycling unit closes its switch 1047. Whereupon, current flows from source (S) through solenoid 972, wire 1049 and goes to ground through the switch 1047. Operation of the solenoid 972 normally rotates the shaft 1030 (FIG. 44) and the conductors 1028 counterclockwise, to no print condition, where the brushes 554 and 1029 are effective. Upon full operation of solenoid 972, it closes the switch 1052 and thus completes the circuit that flows from source (S) and switch 541, through wires 564 and 618, solenoid 481, wire 1050 and to ground through switch 1052. Operation of solenoid 481 restores the operated mechanisms and recloses the switch 453 for possible reading of an ensuing code, as described.

It should be remembered that when the lock 973 (FIGS. 69 and 72) is in its effective leftward position and a print or no print code occurs, the control mechanism 553 (FIG. 74) is not shifted, but the mechanism 553 yields while its solenoid 971 or 972 operates to close the switch 1051 or 1052 for cycling the code through the main reader 407 in the same manner as described for normal operations.

At times when the mechanism 553 is conditioned for no print operations and a normal character code (excluding the underline code) is read, the decoder 494 completes a circuit which flows from source (S) and switch 541, one of the solenoids 565, 566, or 567 for operating the appropriate 0.100", 0.075", or 0.050", cycling unit to open the reader control circuit switch 453, through the control 570, and through the upper-lower case control mechanism 493 that determines which one of the character cycling units is to work for the instant normal character code, all as previously described for normal character reproducing operations.

As previously described for normal imprinting operations, the particular circuit goes through one of the wires 597, 599, 601, 603, 584 (FIG. 52) or 595, and the switch 555 under the operated character key 39. However, during no print operations when the brushes 552 (FIG. 51) in the now shifted mechanism 553 are ineffective, the solenoids 548 and the keys 39 are not operated when the decoder 494 is operated for characters.

During no print operations, the brushes 1029 and 554 are effective, as described. The brush 1029 (FIG. 74) for each normal character key 39 is connected by a wire 1053 to the wire 597, 599, 601, 603, 584 (FIG. 52) or 595 that is provided for the particular character key's group, as discussed in connection with "Chart A" hereinabove. Thus, during no print character operations, the decoded normal character circuit continues through the particular wire 1053 (FIG. 74), the related effective brushes 1029 and 554, and it goes to ground through the operated decoder 494 as described. The character code cycling that results from the opening of switch 453 and the appropriate carriage movement that follows deenergization of the operated cycling unit 565, 566, 567 (FIG. 52) are the same as those described previously in connection with decoded normal character operations.

Since the underline character code and key 42 (FIG. 63) never do cause carriage movement as described previously, it is necessary only to avoid imprinting the underline mark and to bypass any occurrence of the underline code during no print operations. As for normal characters, the brush 552 in mechanism 553, the wire 551 and the solenoid 548 for the underline key 42 are not operable during no print operations. However, when the underline code (1,4,5,6) is read during no print operations, current flows from source (S) and switch 541, wire 564, the delete code cycling unit solenoid 853, and wire 857, but under this condition the circuit continues through a wire 1054 and the now effective brushes 1029 and 554, and goes to ground through the wire marked "Underline (1,4,5,6)" and the operated decoder 494. The remaining cycling of the underline code is the same as described previously for normal operations.

From the above, it can be seen that encoded material, that includes a no print code and a print code with a text portion including characters therebetween, may be reproduced, and normally blank space will be provided for the text portion that is encoded between the no print and the print codes. However, it can also be seen that, on another occasion, the operator may shift the lock 973 (FIG. 8) to effective position and run the same control tape 412 through the main reader 407 a succeeding time, and the reproducer will then ignore the no print and the print codes and it will imprint the entire text. It can also be seen that blank space may be had from an encoded text that does not include a no print code, and imprinting in a no print area may be performed, when the key 970 is appropriately shifted manually to "No Print" and to "Print" positions, respectively, during reproducing operations.

16. CARRIAGE RETURN

The carriage return code (1,2,3,7) (1) releases the positive drive clutch 155 (FIG. 24) for return of the paper carriage 9*a*, (2) returns the adjustable stop member 335 (FIG. 30) to the normal zero quotient representing position shown, (3) restores the duplex counter segment 662 (FIG. 54) to the normal zero representing position shown, and (4) line spaces the platen 115 (FIG. 8) and the reproduced copy paper thereon a number of line spaces that is predetermined by the position of a line space control button 1055, all in a manner to be described presently.

The extent of normal line spacing is limited to one, two or three steps (for example) as determined by the preset button 1055, rather than by any code determining arrangement, so that the line spacing may be changed by the operator without affecting or being controlled by the encoded text on the control tape 412. In other words, one, two and three normal line spaced copies may be reproduced from the same encoded tape 412.

Figure 75:
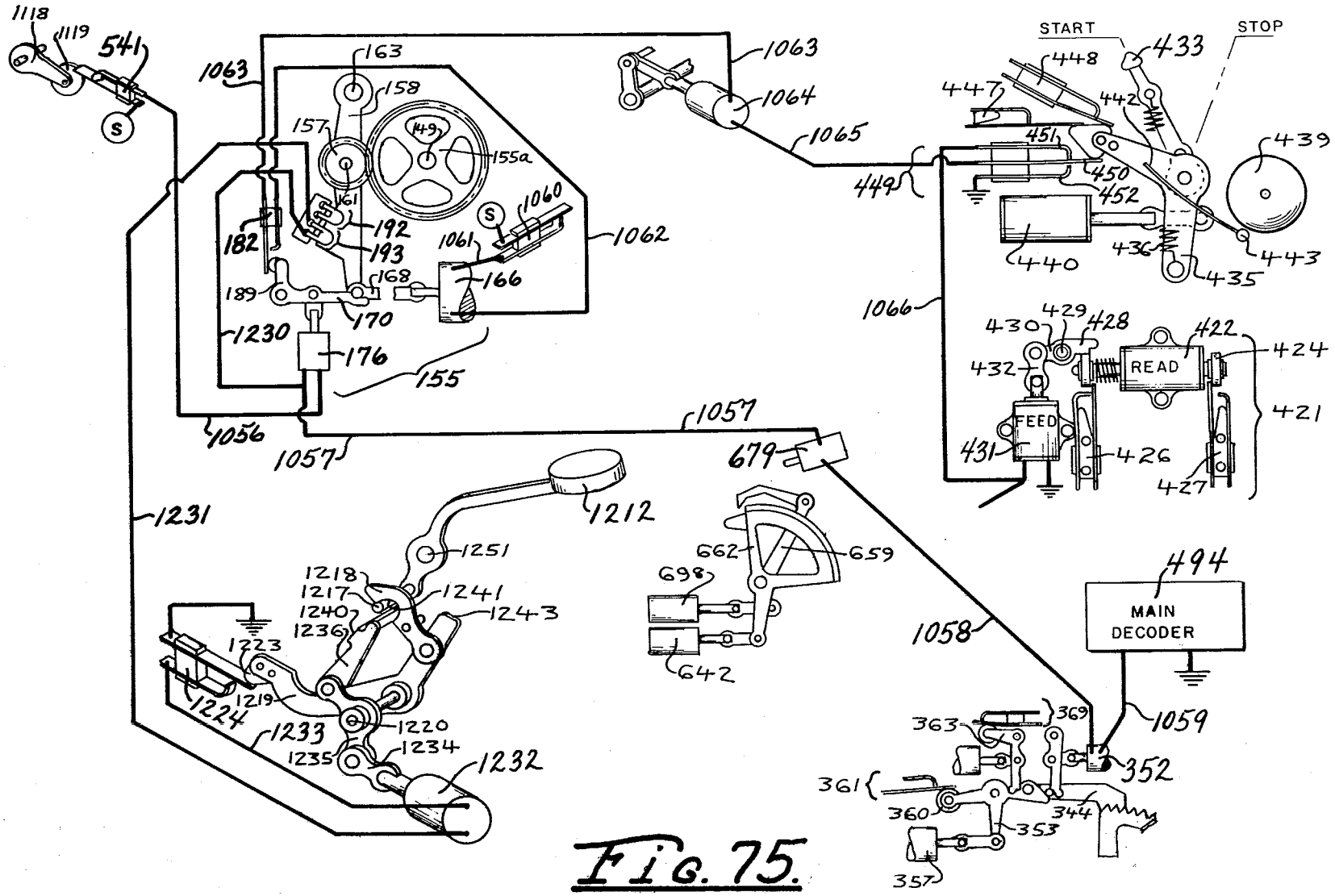
FIG. 75 is a schematic wiring diagram of circuits for automatically controlled and manually controlled carriage return operations.

The circuitry involved, when the decoder 494 (FIG. 75) is operated according to the carriage return code, will now be described. A wire 1056 is connected between the switch 541 and the solenoid 176 (FIG. 24) that is provided for releasing the clutch 155 to permit carriage return as described. A wire 1057 (FIG. 75) is connected to solenoid 176 and to the solenoid 679 (FIG. 54) that clears the duplex counter 643 as described. A wire 1058 (FIG. 75) is connected between solenoid 679 and the solenoid 352 (FIG. 30) for clearing the quotient representing stop member 335 as described. A wire 1059 (FIG. 75) is connected to solenoid 352 and to the terminal marked "CAR. RET. (1, 2, 3, 7)" (top of FIG. 50) in the decoder 494. Thus, when the decoder 494 is operated according to the carriage return code (1, 2, 3, 7) the solenoids 176 (FIG. 75), 679 and 352 are operated simultaneously.

As previously described, operation of the solenoid 176 (FIG. 24) not only causes the carriage 9*a* to be returned, but it also causes the switch 182 to be closed for accomodating a clutch reengaging circuit and it further causes the switch 192 (FIG. 31) to open for breaking the reader control circuit and thus for normalizing the decoder 494. Return of the decoder 494 to normal (FIG. 75) then deenergizes the solenoids 176, 679 and 352.

The clutch reengaging circuit becomes effective as soon as the carriage 9*a* is fully returned. Full return of the carriage 9*a* closes a switch 1060 as will be described presently. A wire 1061 (FIG. 75) is connected between the switch 1060 and the reengaging solenoid 166. A wire 1062 is connected to solenoid 166 and to the switch 182. A wire 1063 is connected between switch 182 and a solenoid 1064 (FIG. 17) that is operable for performing normal line spacing operations as will be described. A wire 1065 (FIG. 75) is connected to solenoid 1064 and to the blade 450 of the switch 449 that is controlled by the reader control key 433 as described. A wire 1066 is connected to the normally effective blade 451 of switch 449 and to the solenoid 431 in the feed-read switch means 421.

When the clutch 155 is disengaged and the carriage 9*a* is returned by the spring means 125a (FIG. 21) as described, the carriage 9*a* is stopped at a left margin position. The left margin position is determined by a presettable left margin means 1067 (FIG. 8) which is identical in principle and function to that described in detail in our aforesaid copending application Ser No. 213045, filed Dec. 28, 1971, now U.S. Pat No. 3,993,179 issued Nov. 23, 1976 for "JUSTIFYING, TEXT WRITING COMPOSING MACHINE" to which reference may be made for a complete understanding of the margin means 1067. The margin means 1067 is manually settable in a usual manner, according to a scale 1068, for stopping the carriage 9*a* in a corresponding returned position. However, as explained in the aforesaid copending application Ser. No. 213,045, filed Dec. 28, 1971 now U.S. Pat. No. 3,993,179 issued Nov. 23, 1976, a portion of the carriage 9*a* engages the margin means 1067 just prior to the returned position for thereafter operating the margin means 1067 to shift a bail rod 1069 (FIG. 59) leftwardly as shown here. As the rod 1069 is shifted leftwardly, the bail rod 1069, its axis shaft 1070 and the right hand bail lever 1071 are rotated counterclockwise against the tension of a torsion spring 1072.

The lower bifurcated end of lever 1071 loosely embraces a stud 1073 that is secured on a bellcrank 1074. Bellcrank 1074 is pivoted on a stud 1075 that is secured on a plate 1076. Plate 1076 is held in place by locating pins 1077 and screws 1078 secured in the frame 8. An insulator 1079 is secured on bellcrank 1074 in alignment with the switch 1060 that is mounted on the plate 1076. A contractile spring 1080 is connected to plate 1076 and to the stud 1073.

Figure 8:
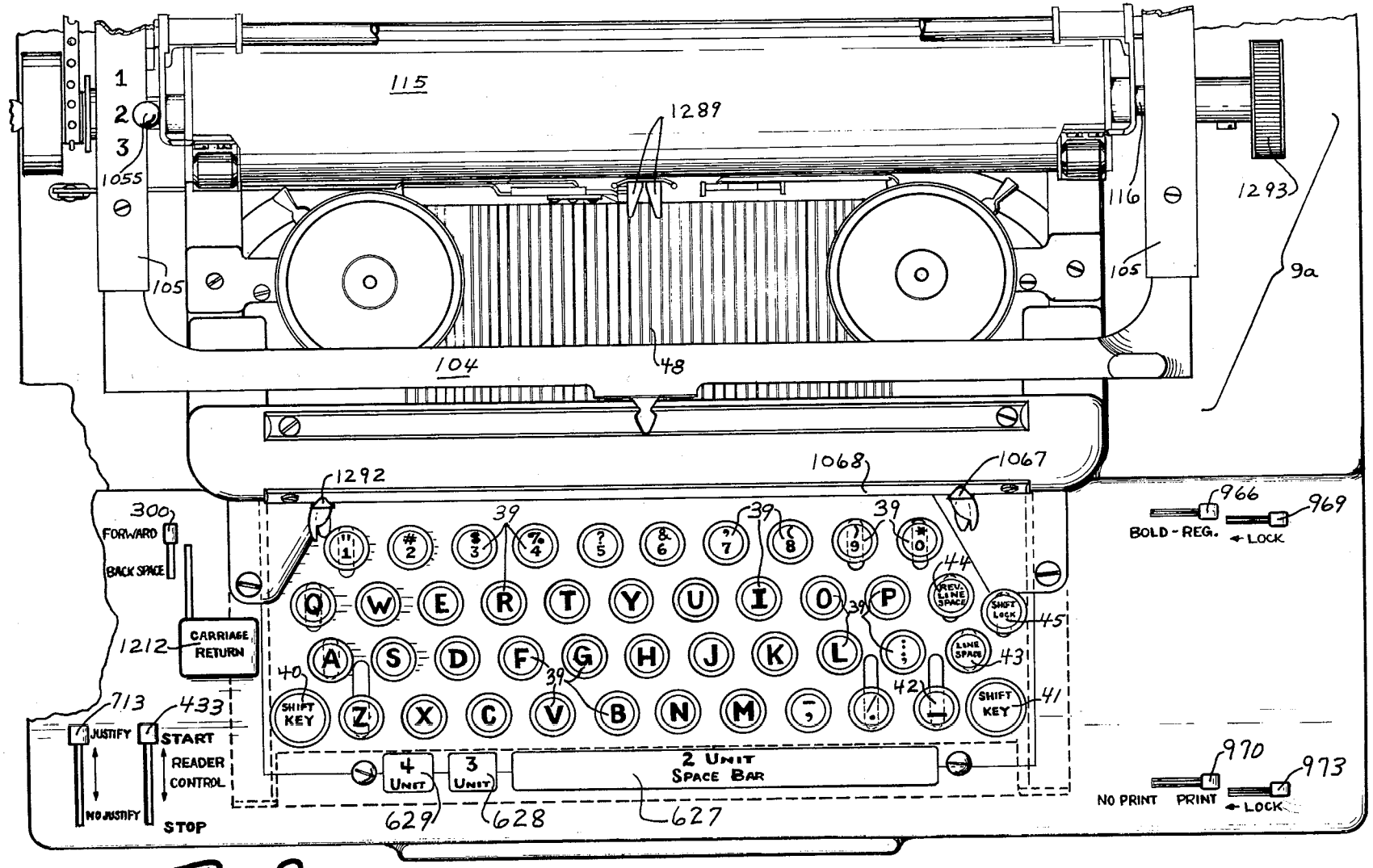
FIG. 8 is a fragmented reduced top view of the machine, showing primarily the keyboard and a portion of the paper carriage.

The arrangement is such that, when the carriage 9*a* is being returned and it approaches the left margin, coaction of the carriage 9*a* and the left margin means 1067 rotates the lever 1071 to shift the stud 1073 and bellcrank 1074 clockwise. As stud 1073 shifts clockwise, the centerline of spring 1080 is shifted to the right of the centerline of stud 1075. Whereupon, the spring 1080 snaps the bellcrank 1074 clockwise, so the insulator 1079 closes the switch 1060 at or about the time the carriage 9*a* is stopped against the left margin means 1067 (FIG. 8). Thus, the switch 1060 (FIG. 59) is closed, when the carriage 9*a* is returned to the left margin.

When a succeeding line is begun and the carriage 9*a* is moved one or more units away from the left margin, the spring 1072 returns the lever 1071 clockwise against a return stud 1081 secured on plate 1076, and, at the same time, the lever 1071 and spring 1080 snap the bellcrank 1074 counterclockwise to permit the switch 1060 to open, all as shown.

From the above, it can be seen that upon full return of the carriage 9*a* , the clutch 155 reengaging circuit is complete from source (S) and then the closed switch 1060 (FIG. 75), through the wire 1061, solenoid 166, wire 1062, now closed switch 182, wire 1063, the solenoid 1064, the wire 1065, the switch 449 in normal condition, the wire 1066, and it goes to ground through the solenoid 431. Operation of the solenoid 166 (FIG. 24) reengages the clutch 155, it recloses the reader control circuit switch 192 ready for reading an ensuing code and it opens the switch 182 (FIG. 75) for breaking the just described reengaging circuit. Operation of the solenoid 1064 causes a normal carriage return line space operation, as will be described. At the moment it is sufficient to know that a normal line space operation occurs automatically when the carriage 9*a* is fully returned. Operation of the solenoid 431 conditions the feed-read switch means 421 (FIG. 57) for consecutive step feeding of the control tape 412, as described. However, if no newly encoded tape 412 is available and the switch 414 is then open as described, the switch means 421 will remain in feed condition, as shown with switch 426 closed, until the switch 414 is again closed, until the blank tape 412 that follows a carriage return code is fed through the main reader 407, and until the read solenoid 442 is operated upon the reading of the next code, as described. Thus, upon full return of the carriage 9*a* , the machine is conditioned for reproducing a possible succeeding line.

17. NORMAL LINE SPACING MECHANISM

As described, the normal line space motivating solenoid 1064 (FIG. 75) is energized when the carriage 9*a* is fully returned, and at such times it is energized until the solenoid 166 has reengaged the drive clutch 155 and the switch 182 is opened.

Figure 18:
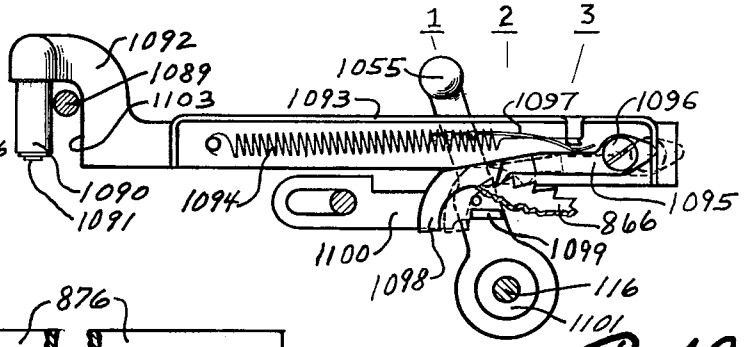
FIG. 18 is a fragmentary view showing part of the normal line space mechanism of FIG. 17, in an operated position.

The solenoid 1064 (FIG. 17) is secured on brackets 1082 and 1083 that are respectively secured on the angle iron 876 and the frame plate 231. A c-shaped clip 1084 is secured in an annular groove on the armature of solenoid 1064 to limit the travel of the armature. A link 1085 is pivotally connected to the armature of solenoid 1064 and to a lever 1086 (FIG. 19) that is secured on the shaft 873. Shaft 873 is rotatably mounted in brackets 874 and 875 as described. A pair of bail levers 1087 and 1088 are secured on shaft 873, and a bail 1089 is secured on the levers 1087 and 1088. A roller 1090 is located to the rear of bail 1089, and it is mounted for rotation on a stud 1091 (FIG. 18) that is secured at its upper end on a slide member 1092. Member 1092 is slidably mounted in a portion 1093 of the platen carrier 105 (FIG. 17) in a known manner. The remaining structure of the normal line spacing mechanism will be described briefly, since it is the same as that found in the typewriter chosen as exemplary and employed as a basic component of the reproducer. A return spring 1094 urges the slide member 1092 rightward as shown here, and it normally holds the member 1092 in the position shown in FIG. 17. A pawl 1095 is pivoted on the member 1092, at 1096, and it is urged counterclockwise by a spring 1097. Normally, an extension 1098 of the pawl 1095 rests on top of a tab 1099, and the pawl 1095 is thus normally held out of engagement with the ratchet wheel 866. The tab 1099 is part of a member 1100 (FIG. 18) that is pivotally connected to the line space control button 1055. Button 1055 is pivoted on a boss 1101 which is part of the platen carrier 105 (FIG. 17) and which supports the center shaft 116 of the platen 115.

The arrangement is such that operation of the solenoid 1064 pulls link 1085; and rotates the lever 1086 (FIG. 19), shaft 873, levers 1087 and 1088, and the bail 1089 (FIG. 17) counterclockwise about the axis of shaft 873. Whereupon, the bail 1089 acts against the roller 1090 and pulls the member 1092 a full stroke leftward. The full stroke is terminated by engagement of the clip 1084 with a surface 1102 on the solenoid 1064. At full stroke position of the bail 1089 (shown in FIG. 18) a surface 1103 on member 1092 prevents the member 1092 from going leftward beyond that position. It may be noted that the roller 1090 and surface 1103 extend downwardly sufficiently to remain in registration with the bail 1089 at times when the platen carrier 105 and therefore the member 1092 are shifted to upper case position.

Figure 17:
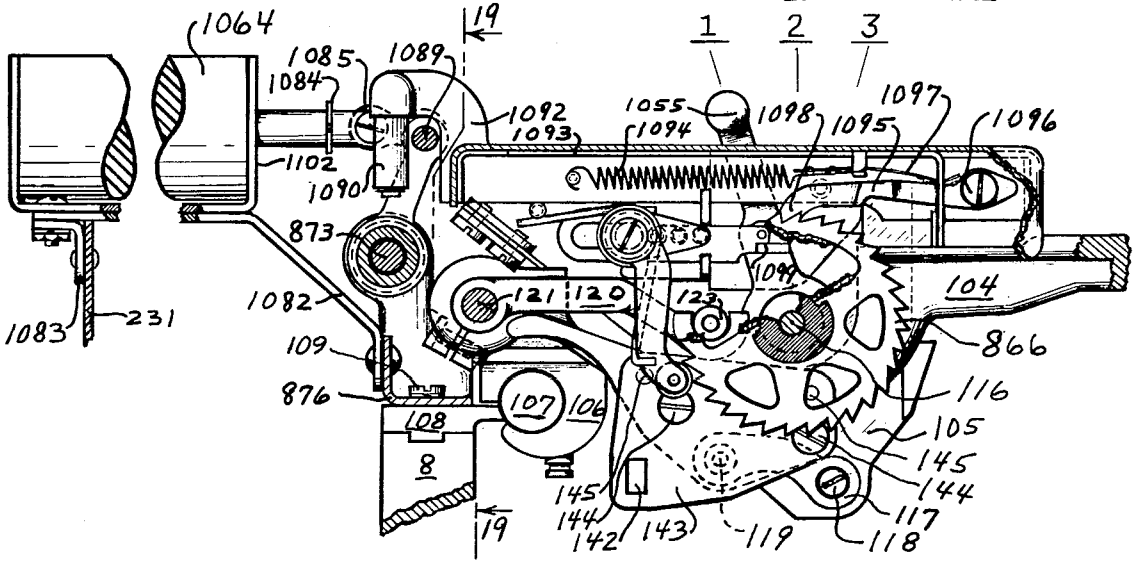
FIG. 17 is a fragmentary left view showing primarily a portion of the left end of the paper carriage and the normal line space mechanism.

When the button 1055 is in the illustrated (1) position at the time the member 1092 is shifted leftward from the position shown in FIG. 17, the extension 1098 of pawl 1095 is initially slid on the top of tab 1099, but, just prior to one third from the end of the full stroke, the extension 1098 drops off of the tab 1099 (FIG. 18) as shown in phantom and the pawl 1095 picks up and shifts the ratchet wheel 866 one tooth counterclockwise for shifting the platen 115 one line space forwardly as described. When the button 1055 is preset in the 2 or 3 position, the tab 1099 is shifted rightwardly one or two steps, respectively, for permitting the extension 1098 to drop sooner during the final stroke and to therefore rotate the ratchet wheel 866 and the plate 115 two or three line spaces respectively.

When the solenoid 1064 is deenergized as explained, the return spring 1094 returns the member 1092 rightward to the position shown in FIG. 17. During this return stroke, the extension 1098 cams back upon tab 1099 and the roller 1090 returns the drive means including bail 1089 clockwise to the illustrated position.

Thus, upon return of the carriage 9a and operation of solenoid 1064, the platen 115 and the copy paper thereon are forward line spaced one, two or three increments, depending on the position of the button 1055.

18. LINE DELETE

In our aforesaid copending application Ser. No. 213,045, filed Dec. 24, 1971 now U.S. Pat. No. 3,993,179, issued Nov. 23, 1976 for "Justifying, Text Writing Composing Machine", it is explained that the code media for a deleted line includes first a line delete code 3, 4, 5, 7, a few blank spaces, then the unaltered text codes for that line and finally a carriage return code 1, 2, 3, 7, arranged in that order. As will now be described, reading of a line delete code prepares the reproducer to feed the control tape 412, to read and bypass the text and function codes that follow, but otherwise to avoid the corresponding text and function operations for the deleted line. Finally, when the carriage return code for the deleted line is read, the reproducer does not perform the normal carriage operations, but thereupon it does return to normal operating condition.

When the main reader 407 (FIG. 31) senses a line delete code 3, 4, 5, 7, the main reader control circuit causes the solenoid 417 to cock the tape feed mechanism 408, it causes the solenoid 422 to shift the feed-read switch means 421 to "read" condition, and it causes the main decoder 494 to be operated according to the sensed code, in the same manner as previously described. Operation of the decoder 494 according to the line delete code initiates lines delete operations as will now be described.

Figure 76:
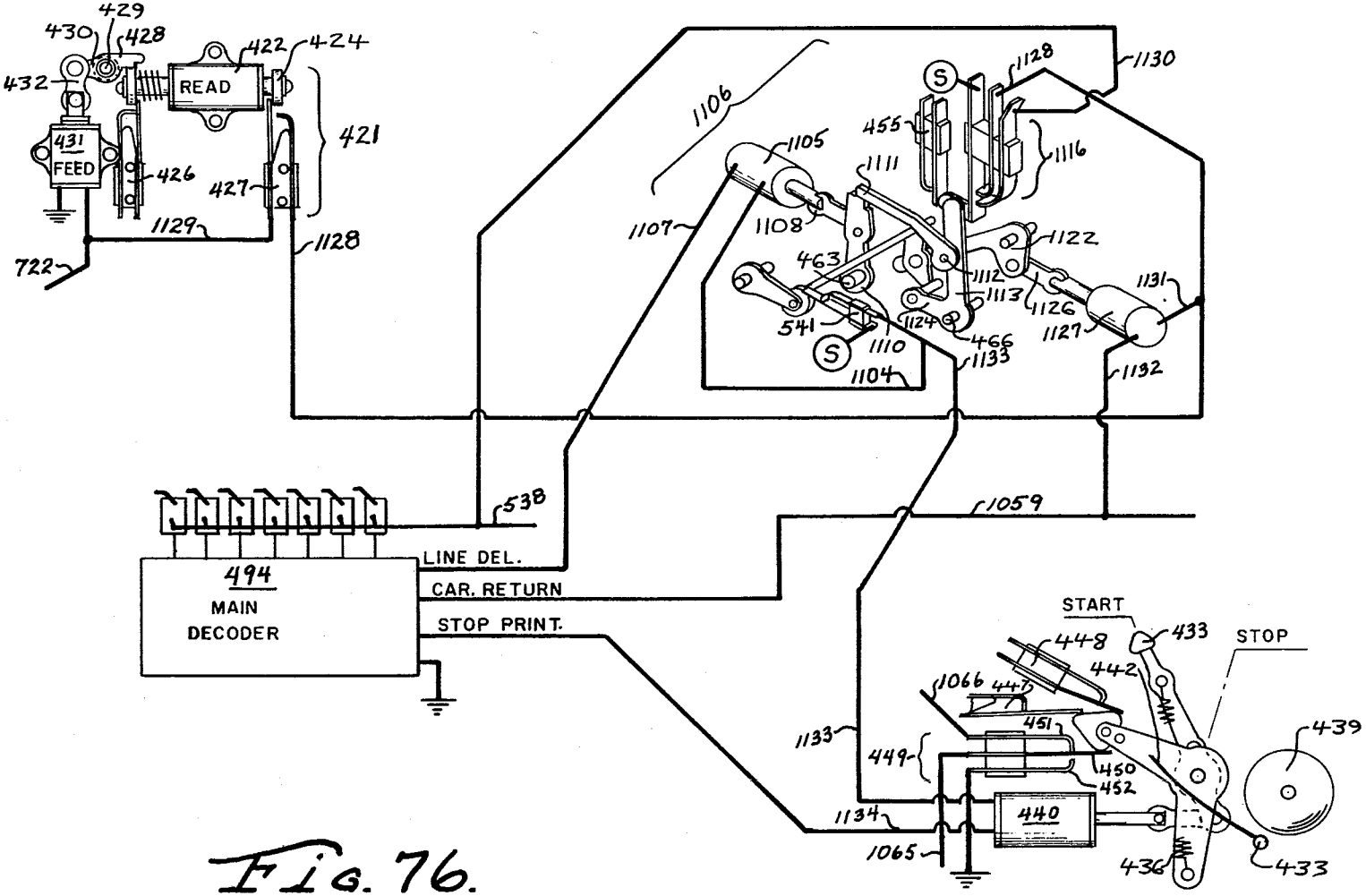
FIG. 76 is a schematic wiring diagram of circuits for automatic code controlled stop printer and line delete operations.

A wire 1104 (FIG. 76) is connected between the normally closed switch 541 and a solenoid 1105 in a line delete cycling mechanism 1106. A wire 1107 is connected to solenoid 1105 and to the terminal marked "LINE DELETE (3,4,5,7)" (FIG. 50) in the decoder 494 (FIG. 76). The switch 541 (FIG. 43) is secured on the plate 31 (FIG. 38) and the solenoid 1105 is secured on the support member 468. A link 1108 is pivotally connected to the armature of solenoid 1105 and to a member 1109 (FIG. 43) that is pivoted on rod 463. Member 1109 is urged clockwise by a relatively strong spring 1110, and it is normally stopped against rod 464. A pawl 1111 normally rests on top of member 1109 as shown, and the pawl 1111 is pivoted at 1112 on a member 1113 that is pivoted on rod 466. A contractile spring 1114 is anchored in any known manner, and it is connected to pawl 1111 for urging the pawl 1111 counterclockwise and for urging the member 1113 counterclockwise against the rod 467. In normal position of the member 1113, an insulator 1115 secured on the upper end of the member 1113 holds the reader control circuit switch 455 closed as shown. Switch 455 is secured on the member 471. A normally open switch 1116 is secured on the memmber 470 in alignment with the insulator 1115. A stud 1117 is secured on a lever 1118 that is pivoted on the shaft 486. An insulator 1119 is secured on stud 1117. A torsion spring 1120 is anchored on rod 465 and it is connected to lever 1118 for urging the lever 1118 counterclockwise to the illustrated normal position where the insulator 1119 holds the switch 541 closed and the stud 1117 is stopped against the bottom of pawl 1111. A restoring pawl 1121 is pivoted on a member 1122 that is pivoted on the rod 467. A torsion spring 1123 is connected to member 1122 and to pawl 1121 for urging the pawl 1121 counterclockwise toward engagement with the stud 1117, but, in normal position of the parts, a finger 1124 on member 1113 holds the pawl 1121 slightly away from the stud 1117 as shown. A relatively strong contractile spring 1125 is anchored on the member 471 and it is connected to member 1122 for urging the member against the rod 464. A link 1126 is pivotally connected to the member 1122 and to the armature of a solenoid 1127 that is secured on support member 469.

When the line delete code is sensed and the decoder 494 (FIG. 76) is operated accordingly as described, current flows from source (S) and normally closed switch 541, through wire 1104, the solenoid 1105, the wire 1107 and it goes to ground through the operated decoder 494. Operation of solenoid 1105 (FIG. 43) pulls link 1108 and rotates member 1109 against rod 465. Just prior to full operation of member 1109, the end of pawl 1111 latches into a notch (like notch 612, FIG. 39) in the upper end of member 1109 (FIG. 43), under tension of spring 1114. As the pawl 1111 latches downward, it pushes the stud 1117 downward and thus shifts the insulator 1119 away from switch 541 to permit the switch 541 to open.

As previously described, all major normal operations, that may be initiated by operation of the main decoder 494, receive their source (S) of power through the switch 541. Therefore, no normal decoder controlled operations will be performed, while the switch 541 is open and while the codes for the deleted line are fed through the main reader 407.

As soon as the switch 541 is opened, the circuit through the solenoid 1105 (FIG. 76) is also broken. Deenergization of solenoid 1105 (FIG. 43) permits the spring 1110 to return member 1009 clockwise against rod 464. Return of member 1109 pushes the latched pawl 1111 and rotates member 1113 clockwise to open switch 455 and to close the switch 1116. At the same time, the finger 1124 of member 1113 releases the restoring pawl 1121 to the influence of its spring 1123 which rotates the pawl 1121 against the stud 1117. The mechanism 1106 remains in this condition while the encoded text for the deleted line is fed through the main reader 407.

When the switch 455 (FIG. 31) is opened, the main reader control circuit is broken. Whereupon, in a previously described manner, the mechanism 408 feeds the line delete code out of the main reader 407, the decoder 494 is returned to normal and the solenoid 422 is deenergized while the latch means 428 holds switch means 421 in "read" condition.

Closure of switch 1116 (FIG. 43) completes circuits for causing consecutive tape feeding, for reading the codes on the control tape 412 to determine the occurrence of the carriage return code at the end of the deleted line, and for restoring the machine from line delete condition to normal condition upon operation of the decoder 494 according to the carriage return code.

The consecutive tape feed initiating circuit that is rendered effective by closure of the line delete mechanism switch 1116 will now be described. A source (S) of power is connected to switch 1116 (FIG. 76) as indicated. A wire 1128 is connected to switch 1116 and to the now closed switch 427. A wire 1129 is connected between the switch 427 and the solenoid 431. Thus, as soon as the switch 1116 is closed, current flows from source (S) and the switch 1116, through wire 1128, the switch 427 closed by the reading of the line delete code and operation of the solenoid 422 as described, wire 1129, and it goes to ground through the solenoid 431. Operation of solenoid 431 releases the latch means 428 and thereby restores the switch means 421 to feed condition, where the switch 427 is opened and the switch 426 is closed as described. When switch 427 opens, the solenoid 431 is deenergized. Closure of switch 426 (FIG. 57) initiates the consecutive step tape feed circuit, that repeatedly operates the solenoid 417 as controlled by the switch 418, to shift the control tape 412 through the main reader 407 (FIG. 31) as described. Thus, the blank tape 412 that follows the line delete code and the text and function codes for the deleted line are fed through the main reader 407.

When the text and function codes for the deleted line enter the main reader 407, the main reader control circuit is not effective, since the switch 455 now remains open while the machine is in the line delete condition as described. However, the decoder 494 is operated according to each of the codes in the deleted line as these codes pass through the main reader 407, since a special line delete reader circuit is made effective by closure of switch 1116 (FIG. 76). It should be understood that the operations of the decoder 494, according to the codes of a deleted line, cause no normal operations since the switch 541 (FIGS. 57, 75 and 76) is open at this time to prevent response to the decoder operations.

The special line delete reader circuit will now be described. A wire 1130 (FIG. 76) is connected to the switch 1116 and to the wire 538 (FIG. 31) that is connected to the motivating solenoids 495, 500–505 of the decoder 494 as described. When the switch 1116 (FIG. 76) is closed as described, the special reader circuit is effective from source (S) and switch 1116, wires 1130 and 538 (FIG. 31), the appropriate solenoids 495, 500–505 in the decoder 494, the related wires 539, and to ground through the sensing spring 410 (FIG. 31) in the main reader 407. Thus, while the mechanism 408 feeds the control tape 412 through the main reader 407, the decoder 494 is operated by each code that passes through the main reader 407, but none of the code controlled operations will be performed until the decoder 494 is operated according to the carriage return code that occurs at the end of the deleted line.

The circuit for restoring the machine from line delete condition to normal condition, when the carriage return code is reached, will now be described. A wire 1131 (FIG. 76) is connected between the wire 1128 and the solenoid 1127. A wire 1132 is connected to solenoid 1127 and to the wire 1059 that is connected to the terminal marked "CAR. RET. (1,2,3,7)" (FIG. 50) in the decoder 494 (FIG. 76) as described. Thus, when the decoder 494 is operated according to the carriage return code, current flows from source (S) through the now closed switch 1116, wires 1128 and 1131, solenoid 1127, wires 1132 and 1059, and it goes to ground through the operated decoder 494. Operation of solenoid 1127 (FIG. 43) pulls link 1126 and rotates member 1122 counterclockwise against tension of spring 1125. At about the end of the stroke, the pawl 1121 latches under the stud 1117. Since the control tape 412 (FIG. 31) is now being fed consecutive steps as described, the carriage return code is fed rapidly out of the main reader 407 and the decoder 494 is normalized in the usual manner. Whereupon, the solenoid 1127 (FIG. 76) is deenergized. Deenergization of the solenoid 1127 (FIG. 43) permits the spring 1125 to return the member 1122 clockwise while the pawl 1121 pushes the stud 1117, insulator 1119 and pawl 1111 upward, with assistance from spring 1120 and against the tension of spring 1114. This upward movement of insulator 1119 recloses the switch 541 (FIGS. 57, 75 and 76) so the machine will respond normally to the next operation of the decoder 494 (FIG. 31). Just prior to engagement of the member 1122 (FIG. 43) with the rod 464, the stud 1117 lifts the pawl 1111 out of the notch in the returned member 1109, and the spring 1114 shifts the pawl 1111 leftward and it rotates the member 1113 counterclockwise against the rod 467 as shown. As member 1113 returns counterclockwise, its finger 1124 unlatches the pawl 1121 from under the stud 1117 while the spring 1120 holds the switch 541 closed as shown. As the member 1113 is returned, its insulator 1115 permits the switch 1116 to open and it then recloses the main reader control circuit switch 455 ready for reading the codes for the succeeding line. At this point the line delete cycling mechanism 1106 is returned to the illustrated condition and the machine is returned to normal, while the switch means 421 (FIG. 57) remains in feed condition for feeding the codes for a succeeding line into the main reader 407. However, if no succeeding line is yet prepared, the switch 414 will be opened and the consecutive step feeding of the tape 412 will be interrupted until the tape 412 for a succeeding line is available, as described.

In a prepared embodiment of the composing machine described in our aforesaid copending application Ser. No. 213,045 filed Dec. 28, 1971 now U.S. Pat. No. 3,993,179 issued Nov. 23, 1976 for "Justifying, Text Writing Composing Machine", the arrangement for encoding the line delete code ahead of the line to be deleted is coupled with a clearing or conditioning encoding means, depending on the presetting of a clear-set key, for encoding a clear code or a conditioning code as the first text code of a succeeding line. When the main reader 407 senses a clear code, the reproducer is controlled to automatically assume a normal condition, and, when the main reader 407 senses a conditioning code, the reproducer is automatically placed in the proper condition for beginning the line that follows, as will be described hereinafter. These are desirable features, since the previous deleted line may include certain machine conditioning functions, such as upper and lower case shifts, bold and regular shifts, and print and no print shift codes, for examples, that are lost in a deleted line. The manner in which the reproducer responds to the clear code and conditioning codes will be described later herein.

19. STOP PRINTER CODE

As previously described, the reader control key 433 (FIG. 32) is normally situated in "start" position, and, in this position, its switching arrangement holds the switches 447 and 448 closed as shown. As also described, the key 433 is manually shiftable to "stop" position for causing the switches 447 and 448 to be opened and thereby for rendering the consecutive step tape feeding circuit (FIG. 57) ineffective and for breaking the main reader circuit (FIG. 31), respectively. The switch 449 (FIG. 32) is also shifted to alter the carriage return circuit for manually controlled operations, when the key 433 is in "stop" position, as will be explained later.

The manner in which the solenoid 440 is operated, to automatically shift the key 433 to "stop" position as explained, will now be described. A wire 1133 (FIG. 76) is connected between the normally closed switch 541 and the solenoid 440. A wire 1134 is connected to solenoid 440 and to the terminal marked "STOP PR. (5,6)" (FIG. 50) in the decoder 494. Thus, when the key 433 (FIG. 31) is in "start" position and the decoder 494 is operated according to a sensed stop printer code 5,6, current flows from source (S) and switch 541 (FIG. 76), through wire 1133, solenoid 440 for shifting key 433 to "stop" position, wire 1134 and it goes to ground through the decoder 494. At about the time solenoid 440 has shifted the key 433 to "stop" position, the member 435 (FIG. 32) is snapped counterclockwise to open switches 447 and 448, and to shift switch 449 as described. When the switch 448 (FIG. 31) is opened, the reader control circuit is thus broken and the tape feed mechanism 408 shifts the stop printer code out of the main reader 407 and it moves the succeeding code into the main reader 407. The breaking of the reader control circuit also permits the decoder 494 to normalize for deenergizing the solenoid 440 (FIG. 76).

When the reader control key 433 is in the "stop" printer position, the reproducer may be operated manually much like an ordinary typewriter, as will be described later. However, when it is desired to resume the code controlled reproducing operations, the operator must manually shift the reader control key 433 back to "start" position. Whereupon, the switches 447 and 448 (FIG. 32) are reclosed, and the switch 449 shifts back to the illustrated position, as described. When the switch 448 (FIG. 31) is reclosed, the reader control circuit is thereby rendered effective, and the main reader 407 will sense the code that is then in the main reader 407.

As described in our aforesaid copending application Ser. No. 213,045 filed Dec. 28, 1971 now U.S. Pat. No. 3,993,179 issued Nov. 23, 1976 for "Justifying, Text Writing Composing Machine", a preferred form of the Composing Machine automatically encodes a conditioning code or a clear code, immediately after a stop printer code. Thus, when the key 433 is returned to "start" position, the first code to be read will be a conditioning code or a clear code, which are provided for coordinating the condition of the reproducer with that of the composer at the time the stop printer code was encoded. Therefore, the reproducer will be conditioned to properly execute the operations that follow the stop printer code. This is a very important feature, since the conditions such as case shift, for example, may be changed manually while the machine was in "stop" printer condition. The conditioning code and clearing code operations will be described presently.

The operator may manually shift the reader control key 433 to "stop" position at times when blank tape 412 is being cycled through the main reader 407. In such an event, the consecutive step tape feed circuit is broken by the opening of switch 447 (FIG. 57) as described. Under this condition, return of the key 433 to the "start" position closes the switch 447 for reinitiating the consecutive tape feeding circuit that runs through the switch 414, solenoid 417, switch 418, and switches 426 and 447 as described.

Thus, it is seen that manual return of the reader control key 433 to "start" position will reinstitute the code reading or the consecutive step tape feeding operations, depending on the "feed - read" condition of the switch means 421.

20. AUTOMATIC CONDITIONING

As described in our aforesaid copending application Ser. No. 213,045, filed Dec 28, 1971 now U.S. Pat. No. 3,993,179 issued Nov. 23, 1976 for "Justifying, Text Writing Composing Machine", the composing machine encodes its immediate condition (upper or lower case, bold or regular, and print or no print) whenever the operator manipulates a conditioning key. As also explained in the aforesaid copending application Ser. No. 213,045, filed Dec. 28, 1971 now U.S. Pat. No. 3,993,179 issued Nov. 23, 1976 the composer may be equipped to automatically encode its condition immediately following a stop printer encoding operation, so the reproducer will be automatically set up to perform properly when it is restarted after being stopped by a stop printer code. As also explained in the aforesaid copending application, Ser. No. 213,045 filed Dec. 28, 1971 now U.S. Pat. No. 3,993,179 issued Nov. 23 1976 the composer may be equipped to automatically encode its condition, as the first code in each line, following the carriage return code of the previous line, so the reproducer will be properly conditioned to proceed, even if the previous line were rendered ineffective by a line delete code or even if the tape 412 is torn in half between lines and the latter part of the tape 412 were then reinserted in the main reader 407. In any event, the reading of a conditioning code by the main reader 407 will normally cause the reproducer to assume the corresponding condition. The only exception to this occurs, in respect to the bold-regular and the print-no print conditions, only when the respective lock 969 (FIG. 70) or 973 (FIG. 69) is in effective position, as described and as will be described further hereinafter.

In our aforesaid copending application, Ser. No. 213,045 filed Dec. 28, 1971 now U.S. Pat. No. 3,993,179 issued Nov. 23, 1976, it is explained that the composer may be in any one of eight combined conditions, when conditioning encoding may occur, and accordingly any one of eight corresponding codes may be recorded on the control tape 412. When a conditioning code is sensed by the main reader 407, the reproducer will operate to assume the corresponding condition, which is the condition that the composer was in at the time the condition was encoded.

The eight possible conditions of the exemplary machines are listed in the "CHART E", hereinabove. The conditioning arrangement disclosed herein may be used in machines having more or less possible conditions, by providing more or less conditioning codes and related control and operating mechanisms similar in principle to those described herein without departing from the spirit of the invention. For examples, machines having imprinting color changing, selective type fonts and other such features may have the instant conditioning features employed in these mechanisms, without departing from the spirit of the invention described herein.

There are eight cycling mechanisms in the illustrated reproducer, one for each of the condition combinations. When a conditioning code affects the reproducer, the corresponding cycling mechanism is utilized to break the reader control circuit, to control the conditioning of the machine and to restore the reader control circuit and the operated cycling mechanism as soon as the machine is in the proper condition, as will be explained presently. The eight cycling mechanisms are identical, so a description of one should serve to described the others. Each cycling mechanism is like the one shown in FIG. 42, and, since, the cycling mechanisms are each very similar to the cycling mechanism described in connection with FIG. 39, only a brief description of the one shown in FIG. 42 will now be given.

Operation of a solenoid 1135 pulls a link 1136 and rotates a member 1137 counterclockwise against rod 465 and against tension of a spring 1138. At about full operation of member 1137, a spring 1139 urges a pawl 1140 into a notch 1141 on the upper end of member 1137. As pawl 1140 drops into the notch 1141, it pushes the bail 483 down for moving the insulator 482 and permitting the reader control switch 454 to open. Whereupon, as will be explained, the solenoid 1135 is deenergized and the spring 1138 returns member 1137 against rod 464. The clockwise return of member 1137 pushes the pawl 1140 rightward, and this rotates a member 1142 clockwise.

An insulator 1143 on member 1142 normally holds a restoring switch 1144 open as shown, and it is situated in alignment with a conditioning switch 1145. Switches 1144 and 1145 are respectively mounted on the members 471 and 470.

When member 1142 is rotated clockwise as described, its insulator 1143 first permits switch 1144 to close and then it closes switch 1145.

If the machine is already in the condition called for by the instant conditioning code, closure of the switch 1144 will immediately restore the operated cycling mechanism and reclose the reader control switch 454, as will be described. However, if the machine is not in the condition called for by the instant conditioning code, closure of the switch 1145 will control the machine to be conditioned appropriately, and, thereupon, the now closed switch 1144 will cause the restoring operations as will be described presently.

The restoring operations include energization of the solenoid 491, as will be described. Operation of solenoid 491 pulls link 490 and rotates member 484 to lift the bail 483 and the insulator 482, as described. Whereupon, the bail 483 lifts pawl 1140 out of notch 1141, and the spring 1139 shifts the pawl 1140 leftward and returns the member 1142 against rod 467 as shown. Return of member 1142 causes its insulator 1143 to permit the switch 1145 to open and then the insulator opens switch 1144. Elevation of the insulator 482 recloses the switch 454 for reading the ensuing code as will be described. The operated cycling mechanism is thus restored to the position shown.

Figure 77:
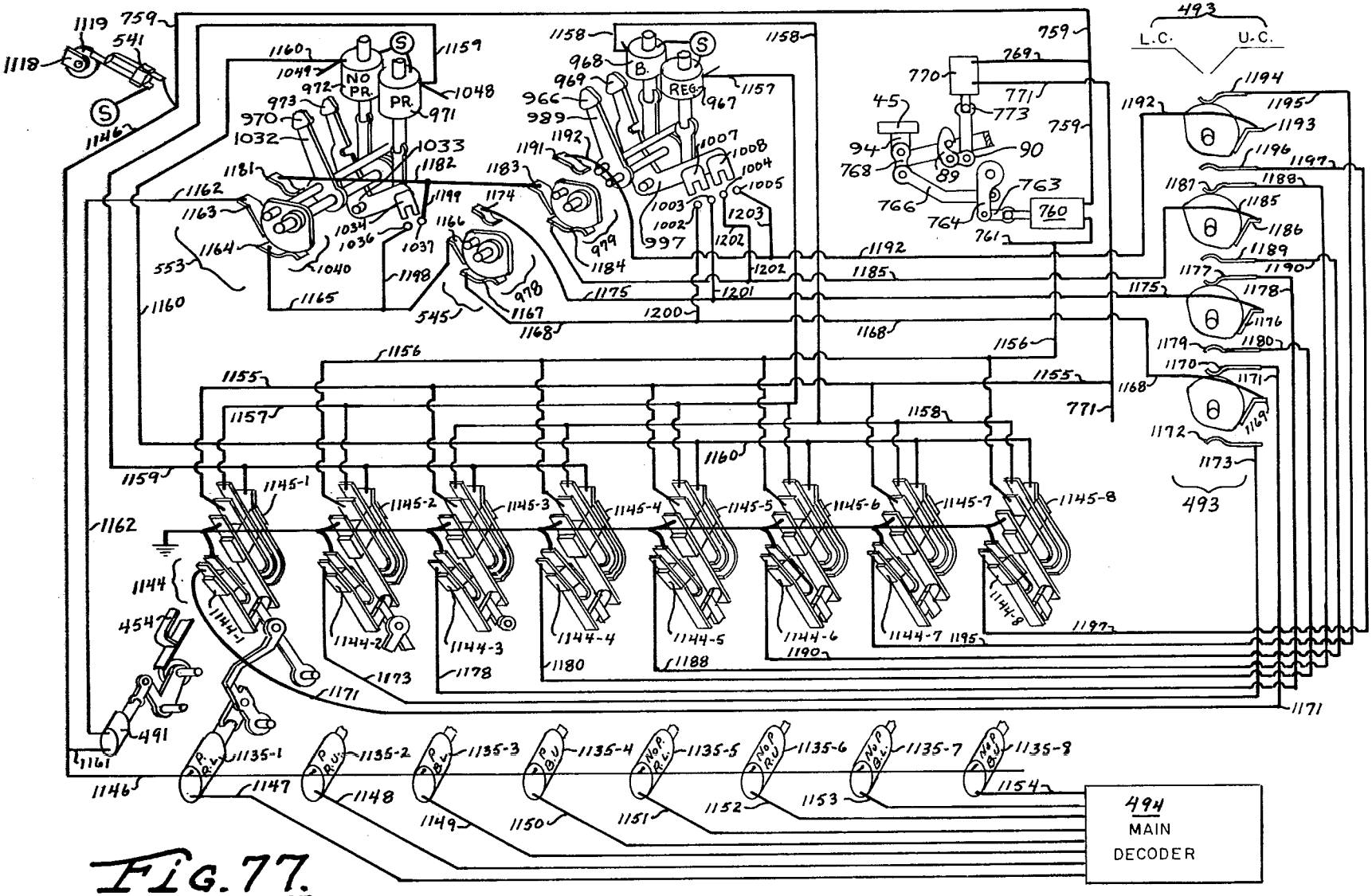
FIG. 77 is a schematic wiring diagram of circuits for automatic code controlled machine conditioning operations.

When the main reader 407 (FIG. 31) senses one of the eight conditioning codes, the decoder 494 is operated accordingly in the previously described manner. Such an operation of the decoder 494 completes a circuit for initiating one of the conditioning sequences of operations. To this end, a wire 1146 (FIG. 77) is connected to the normally closed switch 541 and to each of the solenoids 1135-1 through 1135-8. The initial number 1135 corresponds to the solenoid 1135 (FIG. 42), while the suffix numbers 1 - 8 (FIG. 77) correspond to the conditions (1) – (8) (CHART E) with which the solenoids 1135 are associated. Other condition cycling mechanism parts will be given suffix numbers, when it is necessary to indicate the cycling mechanism to which a part belongs.

A wire 1147 (FIG. 77) is connected to solenoid 1135-1, and to the decoder 94, particularly to the decoder terminal marked "L.R.P.(1,3,4,7)" (FIG. 50). A wire 1148 (FIG. 77) is connected between solenoid 1135 - 2 and the terminal "U.R.P. (1,3,6,7)" (FIG. 50) in the decoder 494. A wire 1149 (FIG. 77) is connected between solenoid 1135-3 and the terminal "L.B.P. (1,3,5,7)" (FIG. 50). In a like manner, wires 1150-1154 (FIG. 77) are connected to solenoids 1135-4 through 1135-8, respectively, and to the terminals "U.B.P.(1,2,4,7)" (FIG. 50), "L.R. No. P.(1,5,6,7)", "U.R.NoP.(1,2,6,7)", "L.B.NoP. (1,4,6,7)", and "U.B-.NoP. (1,2,5,7)", respectively.

From the above, it can be seen that operation of the decoder 494, according to a conditioning code, completes a circuit that flows from source (S) and switch 541 (FIG. 77), through wire 1146, the appropriate one of the solenoids 1135-1 to 1135-8 and the respective wire 1147-1154, and it goes to ground through the operated decoder 494.

Upon operation of the appropriate solenoid 1135-1 to 1135-8, exemplified by solenoid 1135 (FIG. 42), the relates pawl 1140 latches the now cocked member 1137, and, thereupon, the pawl 1140 pushes the bail 483 downward and causes the swith 454 to open as described. Opening of switch 454 (FIG. 31) breaks the reader control circuit for feeding the just read conditioning code out of the main reader 407 and for normalizing the decoder 494, as described. As the decoder 494 returns to normal, the operated solenoid 1135-1 to 1135-8 (FIG. 77) is deenergized and the respective switches 1144 and 1145 are closed, as described.

Assuming that the machine is not already in the appropriate condition, closure of the switch 1145 in the now operated cycling mechanism completes circuitry for putting the machine in the condition that corresponds to the just read code, as will now be described.

The circuitry involved in shifting the machine to lower case or upper case as may be required to prepare the machine according to a conditioning code will be described first. A wire 1155 is connected to the wire 771 and to each of the switches 1145-1, 3, 5 and 7, since the respective cycling mechanisms require the machine to shift to lower case. All of the switches 1145 are grounded as indicated. A wire 1156 is connected to the wire 761 and to each of the switches 1145-2, 4, 6 and 8, since the respective cycling mechanisms call for a shift to upper case. Thus, upon operation of a cycling mechanism associated with a solenoid 1135-1, 3, 5 or 7 and closure of a respective switch 1145, the machine is shifted to lower case by the circuit that flows from source (S) and the switch 541, through the wires 759 and 769, the solenoid 770 for shifting the machine to lower case as described previously, wires 771 and 1155, and it goes to ground through the then closed switch 1145. Upon operation of a cycling mechanism, associated with a solenoid 1135-2, 4, 6 or 8, and closure of a respective switch 1145, the machine is shifted to upper case by the circuit that flows from source (S) and the switch 541, wire 759, the solenoid 760 for shifting the machine to upper case as described, wires 761 and 1156, and it goes to ground through the then closed switch 1145.

When the machine is shifted in lower case or upper case, the upper-lower case switch means 493 is automatically shifted to the appropriate case condition as previously described in connection with FIG. 58A and topic "11. Case Shift, By Code".

The circuitry for shifting the machine to "regular" or "bold" as may be required according to a conditioning code will now be described. A wire 1157 is connected to the solenoid 967 and to the switches 1145-1, 2, 5 and 6, since the respective cycling mechanisms call for a shift to "regular" printing condition. A wire 1158 is connected to the solenoid 968 and to the switches 1145-3, 4, 7 and 8, since the respective cycling mechanisms condition the machine for "bold" imprinting. Upon operation of a cycling mechanism associated with a solenoid 1135-1, 2, 5 or 6, and, upon closure of its switch 1145, the machine is shifted to "regular" condition by the circuit that flows from source (S) and solenoid 967 that shifts the bold-regular control mechanism 545 to regular condition as described, it continues through wire 1157, and goes to ground through the then closed switch 1145-1, 2, 5 or 6. Upon operation of a cycling mechanism associated with a solenoid 1135-3, 4, 7 or 8, and, upon closure of its switch 1145, the machine is shifted to "bold" condition by the circuit which flows from source (S) and solenoid 968 that shifts the mechanism 545 to "bold" condition as described, it continues through wire 1158 and it goes to ground through the then closed switch 1145-3, 4, 7 or 8 as the case may be.

The circuits for shifting the machine to "print" or "no-print" condition according to a conditioning code will now be described. A wire 1159 is connected to the solenoid 971 and to the switches 1145-1, 2, 3 and 4, since the respective mechanisms are provided to condition the machine to print. A wire 1160 is connected to the solenoid 972 and to the switches 1145-5, 6, 7 and 8. Thus, upon operation of a cycling mechanism 1 - 4 and closure of the respective switch 1145, the machine is shifted to "print" condition by the circuit which flows from source (S) through the solenoid 971 that shifts the print-no print control mechanism 553 to "print" condition as described, the wire 1159 and goes to ground through the then closed switch 1145. Upon operation of a cycling mechanism 5 - 8 and closure of the respective switch 1145, the machine is shifted to "no-print" condition by the circuit which flows from source (S) through the solenoid 972 that shifts the control 553 to "no print" as described, through the wire 1160 and it goes to ground through the then closed switch 1145-5, 6, 7 or 8.

From the above, it can be seen that operation of the decoder 494 according to one of the condition codes, shown as items (1) - (8) in CHART E, the machine and particularly the upper-lower case switch means 493 (FIG. 77), the bold-regular control mechanism 545 and the print-no print control mechanism 553 are shifted or, at least, operable to assure that they are in the conditions called for by the code. In the conditioning cycles of operations and as soon as the upper-lower case switch means 493, and mechanisms 545 and 553 are in the called for conditions, a circuit is rendered effective for reclosing the reader control circuit switch 454 and for restoring the operated condition cycling mechanism, as will now be described.

A wire 1161 is connected between wire 1146 and the solenoid 491 that is provided for reclosing the switch 454 and for restoring the operated condition cycling machanism as described. A wire 1162 is connected to solenoid 491 and to a constantly effective blade 1163 of the switch 1040 in the print-no print control mechanism 553. A blade 1164, that is effective only when the mechanism 553 is shifted in "print" condition, is connected by a wire 1165 to a blade 1166 of the switch 978 in mechanism 545. A blade 1167 in switch 978 is effective only when the mechanism 545 is in "regular" condition, and it is connected by a wire 1168 to a constantly effective blade 1169 in the upper-lower case switch means 493. A blade 1170 is effective only when the means 493 is in lower case condition, and it is connected by a wire 1171 to the switch 1144-1 that is closed only when the first conditioning mechanism is operated as described.

A blade 1172, that is effective only when the means 493 is in upper case condition, is connected by a wire 1173 to the switch 1144-2.

A blade 1174, that is effective only when the mechanism 545 is in "bold" condition, is connected by a wire 1175 to a blade 1176. A blade 1177, that is effective with blade 1176 only when the means 493 is in lower case, is connected by a wire 1178 to the switch 1144-3. A blade 1179, that is effective with blade 1176 only when the means 493 is in upper case, is connected by a wire 1180 to the switch 1144-4.

A blade 1181 is effective with blade 1163 only when the mechanism 553 is in "no print" condition, and it is connected by a wire 1182 to a blade 1183. A blade 1184 is effective with the blade 1183 only when mechanism 545 is in "regular" condition, and it is connected by a wire 1185 with a blade 1186. A blade 1187 is effective with blade 1186 only when the means 493 is in lower case, and it is connected by a wire 1188 to the switch 1144-5. A blade 1189 is effective with blade 1186 only when the means 493 is in upper case, and it is connected by a wire 1190 to the switch 1144-6. A blade 1191 is effective with blade 1183 only when the mechanism 545 is in the "bold" condition, and it is connected by a wire 1192 to a blade 1193. A blade 1194 is effective with blade 1193 only when the means 493 is in lower case, and it is connected by a wire 1195 to the switch 1144-7. A blade 1196 is effective with blade 1193 only when the means 493 is in upper case, and it is connected by a wire 1197 to the switch 1144-8. Each of the switches 1144 is grounded in any convenient manner as indicated.

Thus, as soon as the means 493, and the mechanisms 545 and 553 are conditioned according to a particular conditioning code, the restoring circuit is effective from source (S) and normally closed switch 541, through wires 1146 and 1161, the solenoid 491, wire 1162, and through the just described binary type sensing system and the then closed switch 1144-1 to 8. Operation of the solenoid 491 restores the then operated condition cycling mechanism and replaces the switch 454 (FIG. 42) as described, and closure of switch 454 (FIG. 31) renders themain reader control circuit and the main reader 407 effective for reading the ensuing code that is already in the main reader 407 as described.

The conditioning arrangement will normally operate as just described, but in unusual instances, as when the manual over-ride lock 973 (FIGS. 69 and 77) and/or lock 969 is in effective position, the respective mechanism 553 and/or 545 will not be shifted when otherwise required according to a conditioning code and the restoring circuit will bypass the locked mechanism as will now be described.

A wire 1198 (FIG. 77) is connected to the wire 1165 and to the terminal contact 1036, and a wire 1199 is connected to wire 1182 and to the terminal contact 1037. When the lock 973 is in effective position, the mechanism 553 will not be shifted by energization of either one of the motivating solenoids 971 or 972 as described, and, since the conductor 1034 is engaged with the contacts 1036 and 1037, under this condition aas described, the conditioning restoring circuit will be effective through either wire 1165 or 1182, or through both of these wires and the shunt consisting of the wires 1198, 1199 and the engaged conductor 1034. Thus, the mechanism 553 may be locked in "print" or "no print" condition and the restoring circuit will still be effective for operating the restoring solenoid 491, normally as soon as the mechanism 545 and means 493 are conditioned according to a conditioning code.

A similar arrangement is provided for the mechanism 545. A wire 1200 is connected between the wire 1168 and the terminal contact 1002. A wire 1201 is connected to wire 1175 and to the terminal contact 1003. The conductor 1007 engages the contacts 1002 and 1003, only when the lock 969 (FIG. 70) is effective as described. A wire 1202 (FIG. 77) is connected to wire 1185 and to contact 1004, and a wire 1203 is connected to the wire 1192 and to the contact 1005. The conductor 1008 engages the contacts 1004 and 1005 only when the lock 969 (FIG. 70) is effective as described. When the lock 969 is in effective position, the mechanism 545 will not be shifted by energization of either one of the motivating solenoids 967 or 968 as described, and, since the conductors 1007 and 1008 are now engaged with their respective pairs of contacts 1002, 1003 and 1004, 1005, the conditioning restoring circuit will be effective through wires 1168 or 1175, or both and the shunt including wires 1200, 1201 and conductor 1007; or through wires 1185 or 1192, or both and the shunt including wires 1202, 1203 and conductor 1008. Thus, the mechanism 545 may be locked in either "regular" or "bold" printing condition and the restoring circuit will still be effective for operating the restoring solenoid 491, normally as soon as the mechanism 553 and the means 493 are set according to a conditioning code.

Of course, if both locks 973 and 969 are in their effective positions at the same time and at the time when a conditioning code occurs, the restoring solenoid 491 will be operated as soon as the means 493 is set according to the particular conditioning code.

21. AUTOMATIC CLEARING

Clearing consists of putting the machine in the normal lower case, regular and print conditions, in one cycle of operations, and it occurs automatically upon a reading of a clear code.

As described in our copending application Ser. No. 213,045 filed Dec. 28, 1971 now U.S. Pat. No. 3,993,179 issued Nov. 23, 1976 for "Justifying, Text Writing Composing Machine", the composing machine automatically assumes the cleared conditions (cleared condition, as it may be called), upon manual operation of a clear key, and under certain predetermined circumstances it will automatically assume the cleared conditions following its encoding of a "stop printer" code and following a carriage return cycle of operations. In any instance, the composer automatically encodes a "clear" code 3,4,6,7 (CHART D), whenever it is automatically cleared. The "clear" code could just as well be the same as the normal "conditioning" code 1,3,4,7 (item (1) in CHART E), since they both cause the reproducer to assume the same normal conditions (cleared condition). However, the preferred composer and reproducer include both the clearing and conditioning features and distinct respective codes, although it is conceivable that a manufacture may wish to produce such machines with only one or the other of these features.

The "clear" code 3,4,6,7 (CHART D) and the first condition code 1,3,4,7 (CHART E) both cause the reproducer to assume the normal condition, as will now be described. The wire 1147 (FIG. 77), that is connected to the cycling mechanism solenoid 1135 - 1 and to the decoder terminal "L.R.P. (1,3,4,7)" (FIG. 50) as described, is also connected to the terminal marked "CLEAR (3,4,6,7)". Thus, when the decoder 494 is operated according to the "clear" code 3,4,6,7, the circuit is complete from source (S) and switch 541 (FIG. 77), wire 1146, solenoid 1135-1, wire 1147 and the operated decoder 494. Operation of solenoid 1135-1 causes the cycling mechanism to open the reader control circuit switch 454, whereupon the decoder 494 and the solenoid 1135-1 are deenergized and the cycling mechanism closes the switches 1144-1 and 1145-1, as described. If the machine is not already in the cleared normal condition, closure of switch 1145-1 operates the machine to that condition. Whereupon, the restoring circuit is effective through switch 1144-1 for reclosing the reader control circuit switch 454 and for restoring the operated cycling mechanism, all as described in the preceding topic.

22. MANUAL OPERATION OF THE REPRODUCER

As described under topic 4, subtopic "e. Main Reader Control Key", and under topic 19, the key 433 (FIG. 8) is shiftable to "stop" position for terminating all automatic code controlled operations of the reproducer, and, when the key 433 is in "stop" position, the reproducer may be operated manually as will now be described.

Manipulation of a character key 39 normally causes the usual imprinting on the paper carriage 9*a*, and it causes the respective switch 555 (FIGS. 11 and 52) to be closed, the same as described for automatic operations. For manual normal forward operations, closure of a switch 555 (FIG. 52) causes the appropriate carriage movement, according to the condition of the upper-lower case switch means 493, in the same manner as described in topic "7. Cycling Control for Characters".

The space keys 627, 628 and 629 (FIG. 8) are utilized only for manual operations and they will not be described. The keys 627, 628 and 629 are identical to comparable space keys found in our aforesaid copending application Ser. No. 213,045 filed Dec. 28, 1971 now U.S. Pat. No. 3,993,179, issued Nov. 23, 1976 for "Justifying, Text Writing Composing Machine", so their structure will not be described in detail herein. It is sufficient to know that each of the space keys 627–629 (FIG. 11) comprises a conductor 1204 that is shiftable with the respective key 627–629, and, when a key 627–629 is operated, its conductor 1204 is shifted between a pair of blades 1205 and 1206, one of which (for example, blade 1205) is grounded in any convenient manner.

A wire 1207 (FIG. 52) is connected to the wire 589 and to the blade 1206 (FIG. 11) that is associated with the two unit (0.050 inch) space key 627. A wire 1208 (FIG. 52) is connected between the wire 585 and the blade 1206 (FIG. 11) that is associated with the three unit (0.075 inch) space key 628. A wire 1209 (FIG. 52) is connected between the wire 578 and the blade 1206 (FIG. 11) associated with the four unit (0.100 inch) space key 629. When one of the space keys 629, 628 or 627 is depressed, its respective conductor 1204 completes a circuit that flows from source (S) and switch 541 (FIG. 52), through wire 564, and one of the solenoids 565, 566 or 567, provided for operating the respective 0.100, 0.075 and 0.050 inch cycling mechanisms as described. When the four unit space key 629 is the one operated, the circuit continues through the solenoid 565, wire 568, the forward and back space control mechanism 570, normally through wires 578 and 1209, and to ground through the blades 1205, 1206 (FIG. 11) and the conductor 1204 of the operated key 629. When the three unit space key 628 is operated, the circuit through solenoid 566 (FIG. 52) continues via wires 572, 585, 1208 and it goes to ground through the switch under the key 628 (FIG. 11). When the two unit space key 627 is operated, the circuit through solenoid 567 (FIG. 62) continues through wires 575, 589, 1207 and goes to ground through the then closed switch under the key 627 (FIG. 11).

When the solenoid 565, 566 and 567 (FIG. 52) are selectively operated, as just described, and when the operated space key 627–529 is released, the operated solenoid 565–567 is deenergized and the respective cycling mechanism operates to cause the appropriate carriage movement, the same as described previously for code controlled character operations. Also, upon completion of the carriage shift, the restoring solenoid 481 is operated in the same manner, as previously described, for restoring the operated cycling mechanism. Thus, when a space key 627–629 is operated and released, the carriage 9*a* is shifted appropriately.

The line space key 43 (FIG. 8) and the reverse line space key 44 are operable, during manual operation of the reproducer (when the decoder 494, (FIG. 68), is not effective) for causing the corresponding line spacing operations. A wire 1210 is connected between the wire 941 and the switch 555 that is under the line space key 43. A wire 1211 is connected between the wire 943 and the switch under the reverse line space key 44. From the above, it can easily be seen that operation of either the line space key 43 or the reverse line space key 44 will cause the same respective line spacing operations as described for code controlled line spacing operations. However, during manual operations, the incidental operation of the cycling mechanism 946 is of no consequence, since the opening and closing of the switch 454 does nothing to the now ineffective reader control circuit.

As previously described, the carriage case condition may be shifted by manipulation of the shift keys 40 and 41 (FIGS. 8 and 11), and it may be shifted to upper case by the shift lock key 45. As described in topic "11. CASE SHIFT, BY CODE", the upper-lower case switch means 493 (FIG. 58) is automatically shifted, under control of the snap switch means 774, to the appropriate case condition. Thus, the upper-lower case switch means 493 (FIG. 52) is always conditioned to properly control the carriage movement for character keys 39 that have different size characters in upper and lower case, whether the machine is being operated manually or automatically.

a. Manipulative Carriage Return Key

During manual operation, when the reader control key 433 (FIG. 32) is in "stop" position, return of the carriage 9*a* is accomplished by depression of a carriage return key 1212. The key 1212 (FIGS. 8 and 9) is conveniently located immediately to the left of the main keyboard.

The carriage return key 1212 (FIG. 32) is pivoted on a stud 1213 that is secured on the plate 19. A torsion spring 1214 is connected to key 1212 and it is also connected to a detent 1215 that will be described later. At the moment, it is sufficient to know that spring 1214 urges the key 1212 counterclockwise in normal position against a stud 1216 which is secured on plate 19. A stud 1217 is secured on the lower end of key 1212. A pawl 1218 is normally latched onto the stud 1217 as shown, and it is pivoted on a bellcrank 1219. Bellcrank 1219 is pivoted on a stud 1220 that is secured on plate 19. A contractile spring 1221 is connected to pawl 1218 and to a stud 1222. Stud 1222 is secured on plate 19. The stud 1222 is located to stop bellcrank 1219 in the illustrated normal position, and it is so positioned that the tension and angle of spring 1221 urges pawl 1218 counterclockwise and at the same time the spring 1221 urges bellcrank 1219 clockwise against the stud 1222. An insulator 1223 is secured on bellcrank 1219 and it is situated in engaging alignment with a carriage return circuit switch 1224 (FIG. 33) that is secured on plate 19.

When the key 1212 (FIG. 32) is manually depressed, it rotates clockwise about stud 1213, its stud 1217 shifts pawl 1218 leftward and this rotates bellcrank 1219 counterclockwise. However, this action and depression of key 1212 is prevented, unless the reader control key 433 is in the "stop" position and the machine is thus conditioned for manual operations as described. The interlocking means for preventing operation of the carriage return key 1212 when the key 433 is in "start" position will now be described.

A link 1225 is pivotally connected to the key 433 and to a lock member 1226. Member 1226 is pivoted on a stud 1227 that is secured on plate 19. A stud 1228 is secured on member 1226 and it is situated to block counterclockwise movement of bellcrank 1219, when key 433 is in "start" position, as illustrated.

When the reader control key 433 is shifted to "stop" position, it pulls link 1225 and rotates the member 1226 clockwise to elevate stud 1228 beyond a surface 1229 of bellcrank 1219. Thus, the bellcrank 1219 is freed and the carriage return key 1212 is rendered operable as will not be described.

Upon depression of key 1212, it shifts stud 1217, pulls pawl 1218 and rotates bellcrank 1219 counterclockwise. Whereupon, the insulator 1223 closes the switch 1224 for initiating a carriage return operation.

Closure of switch 1224 (FIG. 75) completes a circuit that flows from source (S) and the switch 541, through wire 1056, the solenoid 176 for releasing the clutch 155 as described, a wire 1230 connected between solenoid 176 and the switch 193, through the switch 193 until the clutch 155 is disengaged, a wire 1231 between switch 193 and a solenoid 1232, operates solenoid 1232 for opening switch 1224 as will be described, through a wire 1233 between solenoid 1232 and switch 1224, and it goes to ground through the now closed switch 1224. Thus, upon operation of the key 1212, the solenoids 176 and 1232 are energized.

The solenoid 176 disengages the clutch 155 and thereby permits the carriage 9a to return by its spring 138 as described previously. As the clutch 155 disengages, the switch 193 opens as described, and the solenoids 176 and 1232 are thus deenergized.

Energization and deenergization of the solenoid 1232 causes the switch 1224 to open, when the key 1212 is held depressed longer then necessary as will now be described, and the key 1212 must be returned and redepressed before the switch 1224 can be closed again.

Solenoid 1232 (FIG. 33) is secured on plate 19. A link 1234 (FIG. 32) is pivotally connected to the armature of solenoid 1232 and to a member 1235 that is pivoted on the stud 1220. A pawl release latch 1236 is pivoted on member 1235. A contractile spring 1237 is connected to latch 1236 and to a stud 1238 that is secured on plate 19. Spring 1237 urges the latch 1236 clockwise against the stud 1238, and, at the same time, it urges the member 1235 clockwise against a stud 1239 that is secured on plate 19. A tab 1240 on latch 1236 is normally situated in a semicircular notch 1241 in pawl 1218. When the key 1212 is depressed and the pawl 1218 is shifted generally leftward as described, the rightward end of notch 1241 shifts the tab 1240 and latch 1236 counterclockwise against the relatively light affect of spring 1237. When the insulator 1223 closes the switch 1224, the solenoid 1232 is energized, and the solenoid 1232 is deenergized when the clutch 155 is disengaged as described. Energization of solenoid 1232 pulls link 1234, rotates member 1235 and shifts the latch 1236 downward. Whereupon, the tab 1240 is withdrawn from notch 1241 and the spring 1237 returns the latch 1236 clockwise against stud 1238. This locates the tab 1240 under a straight lower edge 1242 of the pawl 1218. When the solenoid 1232 is deenergized as described, the spring 1237 returns the member 1235 clockwise, it lifts the latch 1236 upward and the tab 1240 disconnects the pawl 1218 from the stud 1217. Thereupon, the spring 1221 returns the pawl 1218 and bellcrank 1219 clockwise, and the insulator 1223 permits the switch 1224 to open. As the pawl 1218 returns rightward, its surface 1242 drops off of the tab 1240 and the pawl 1218 then rests on top of the stud 1217. When the operator releases the key 1212 and the key 1212 is returned by its spring 1214, the stud 1217 is shifted into the notch 1241 and the pawl 1218 again latches onto the stud 1217 as shown. The mechanism is thus restored to the illustrated condition.

From the above, it can be seen that the switch 1224 (FIG. 75) is opened as soon as the clutch 155 is disengaged and the carriage 9a begins to return as described. When the carriage 9a is fully returned against the left margin control 1067, the switch 1060 is then closed as described previously. Whereupon, the clutch 155 reengaging circuit is completed from source (S) and switch 1060, through wire 1061, the solenoid 166 for reengaging the clutch 155, wire 1062, now closed switch 182, wire 1063, solenoid 1064 for providing the normal line space, wire 1065 and to ground through the now shifted switch 449. When the solenoid 166 is fully operated and the clutch 155 is reengaged, the switch 182 is opened and the switch 193 is closed for an ensuing carriage return operation.

When the bellcrank 1219 (FIG. 32) is operated counerclockwise and a manually controlled carriage return operation is in progress as described, the reader control key 433 is blocked against being shifted from "stop" position to the "start" position, and thus automatic code controlled operations can not be initiated at such time. In operated position of bellcrank 1219, a surface 1243 is shifted under the stud 1228 to block the member 1226, link 1225 and the key 433 in "stop" position. When the carriage 9a is returned and bellcrank 1219 is returned against stud 1222, the surface 1243 is shifted from under stud 1228 and the key 433, link 1225 and member 1226 may then be returned to the illustrated "start" position, where stud 1228 blocks surface 1229 and where the bellcrank 1219 and the carriage return key 1212 are locked against manipulation as described.

b. Back Space Key

The back space key 300 (FIG. 8) is locked in "Foward" position whenever the reader control key 433 is in "start" position and the machine is conditioned for code controlled operations. When the key 433 is shifted to "stop" position and the machine is conditioned for manual operation, the back space key 300 may be left in "Forward" position for controlling the machine to move the carriage 9a forwardly during manual forward keyboarding operations as described in connection with FIG. 52, or it may be manually shifted to "Back Space" position (FIG. 8) for controlling the carriage 9a to move reversely during keyboarding operations as will be described presently.

The structural details of the forward and back space control key 300, and the directly connected forwrd and back space control mechanism 570 (FIG. 52) will now be described. The key 300 (FIG. 32), a lock plate 1244, insulators 1245 (FIGS. 35 and 36), four conductors 1246- 1249, a left side member 1250 (FIG. 36) and a supporting shaft 1251 are secured together as a unit, in any well known manner. It should be further understood that the conductors 1246-1249 are insulated from each other and from the other parts of the unit, in any well known manner. The ends of shaft 1251 are pivoted on the vertical frame plates 19 and 20.

Figures 32, 33, 34, 35, 36:
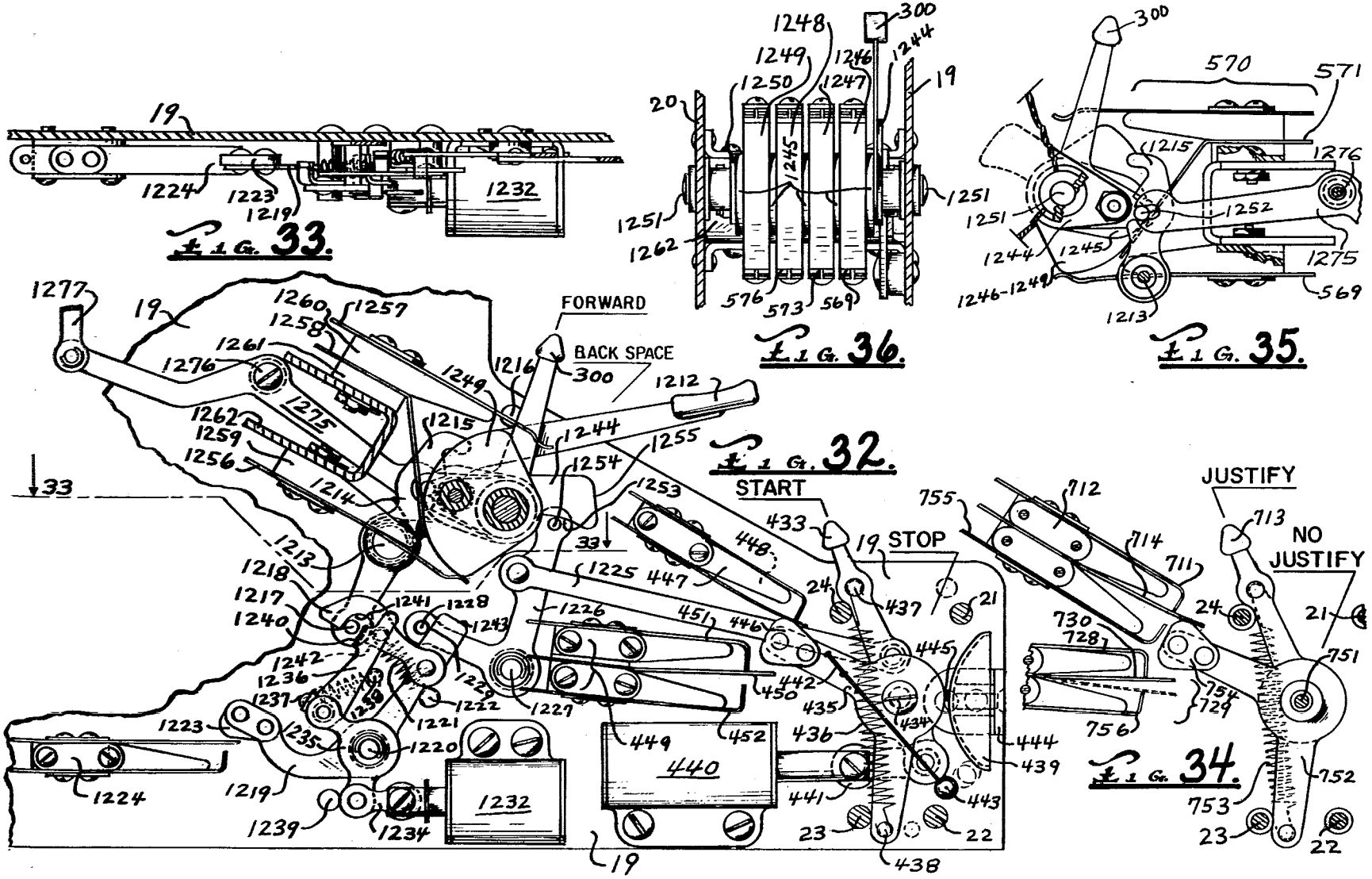
FIG. 32 is a fragmented left sectional view taken on line 32 —32 (FIG. 9), showing principally the reader control, the carriage return and the back space keys and their related control mechanisms.
FIG. 33 is a fragmented top sectional view of a portion of mechanism shown in FIG. 32 as viewed from line 33 — 33 therein.
FIG. 34 is a fragmented left sectional view of the justifying control key as viewed from line 34 — 34 (FIG. 9).
FIG. 35 is a fragmentary right side view of the back space key and its switches that are also shown from the left side in FIG. 32.
FIG. 36 is a fragmentary front view of the back space key and its control switches that are also shown in FIGS. 32 and 35.

The key 300 and the just described unit is yieldably held in either one of its two positions by the detent 1215 (FIG. 35) and a stud 1252 that is secured on a rightward extension of the key 300. Detent 1215 is pivoted on the stud 1213 and it is urged against the stud 1252 by the spring 1214 (FIG. 32).

When the reader control key 433 is in normal "Start" position and lock member 1226 is in the illustrated position as described, a surface 1253 on the lock plate 1244 is blocked by a stud 1254 that is secured on the lock member 1226. Thus, the key 300 is normally locked in its illustrated "Forward" controlling position. However, when the reader control key 433 is shifted to "Stop" position and the machine is conditioned for manual operation, the lock member 1226 is shifted clockwise as described, and the stud 1254 is shifted out from under the surface 1253 and the stud 1254 is thus rendered ineffective at such time. When the key 300 is shifted clockwise to its "Back Space" position, a surface 1255 on plate 1244 is shifted into position for blocking return of the stud 1254 and the key 433 to "Start" position. When the key 300 is returned to "Forward" controlling position, the surface 1255 is elevated and the key 433 and stud 1254 may be manually restored to the illustrated "Start" position of the parts. For the present, it will be assumed that the key 433 is in "Stop" position and the key 300 is manipulatable.

Double-throw switches that cooperate with the conductors 1246–1249 (FIG. 36) will now be described. The switch associated with conductor 1249 (FIG. 32) is exemplary of the others, and it will be described now. A blade 1256 is engaged by conductor 1249, only when the key 300 is in "Forward" operation position. A blade 1257 is engaged by conductor 1249 only when key 300 is in "Back Space" position. A blade 1258 is constantly engaged with conductor 1249. These blades 1256-1258, with suitable insulators 1259, 1260 and 1261, are secured on a support member 1262 in such a manner as to be insulated from each other and from the member 1262. The member 1262 (FIG. 36) is secured at its ends to the plates 19 and 20 in any known manner.

Figure 78:
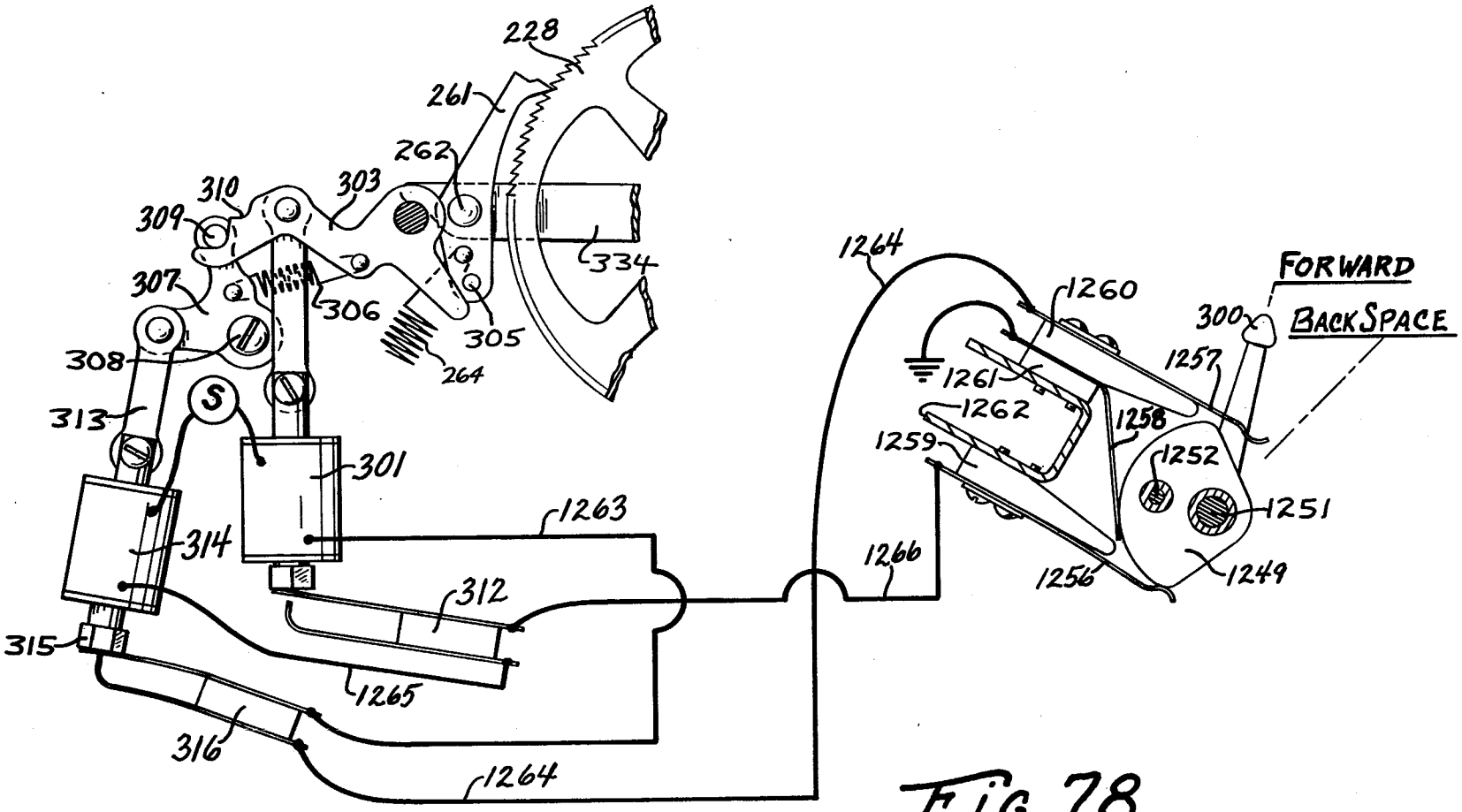
FIG. 78 is a schematic wiring diagram of circuits for manual forward and back space machine conditioning operations.

When the key 300 (FIG. 78) is first shifted to the "Back Space" position, the carriage moving mechanism is conditioned for back spacing operations as will now be described. A source of power (S) is connected to the solenoids 301 and 314. A wire 1263 is connected between solenoid 301 and the normally closed switch 316. A wire 1264 is connected to switch 316 and to the normally ineffective blade 1257. The blade 1258 is grounded as indicated. A wire 1265 is connected between the solenoid 314 and the switch 312, and a wire 1266 is connected between switch 312 and the blade 1256.

When the key 300 is shifted to "Back Space" position, the conductor 1249 first disengages from blade 1256 and it then engages the blade 1257. Thereupon, current from source (S) passes through solenoid 301, wire 1263, switch 316, wire 1264, blade 1257, conductor 1249 and it goes to ground through blade 1258. Operation of the solenoid 301 closes the switch 312 and rotates the member 303 counterclockwise to render the forward operation drive pawl 261 ineffective as previously described in connection with FIG. 29. Upon full operation of solenoid 301, the stud 309 shifts into latching surface 310 (FIG. 78) to hold the drive pawl 261 ineffective as described. The clockwise latching action of member 307 causes the switch 316 to be opened, as described, for breaking the circuit through solenoid 301. The machine is thus prepared for manual back spacing operations.

When the key 300 is returned to "Forward" position, the conductor 1249 first disengages from blade 1257 and it then engages blade 1256. Thereupon, current flows through solenoid 314, wire 1265, now closed switch 312, wire 1266, and it goes to ground through the now effective blades 1256 and 1258. Operation of the solenoid 314 closes switch 316, and it unlatches the member 303 and drive pawl 261 to return to normal forward operation positions, as described previously. Upon return of member 303, the switch 312 is opened, as described, for breaking the circuit through the solenoid 314.

As described previously in connection with FIG. 20, operation of the solenoid 296 alone causes the carriage 9a to be back spaced (reversed) 0.100 inch (four units). As also described, simultaneous operation of the solenoids 296 and 297 causes 0.050 inch (two units) back spacing, and simultaneous operation of solenoids 296 and 298 causes 0.075 inch (three units) back spacing. When the machine is conditioned for back spacing operations as described above, the keyboard character and space keys 39, 627-629 may be manipulated for controlling carriage back spacing that is appropriate for each operated key 39, 627–629 and the upper-lower case conditions, as will now be described. When the key 300 (FIG. 32) is shifted to "Back Space" position, the blade 1256 is rendered ineffective as described, and, in a like manner, the blades 569, 573 and 576 (FIG. 52) are rendered ineffective and, thus, the previously described forward movement circuits are rendered ineffective. At the same time, respectively opposing blades 1267, 1268 and 1269 are rendered effective, for rendering effective the following back spacing control circuits.

Figure 79:
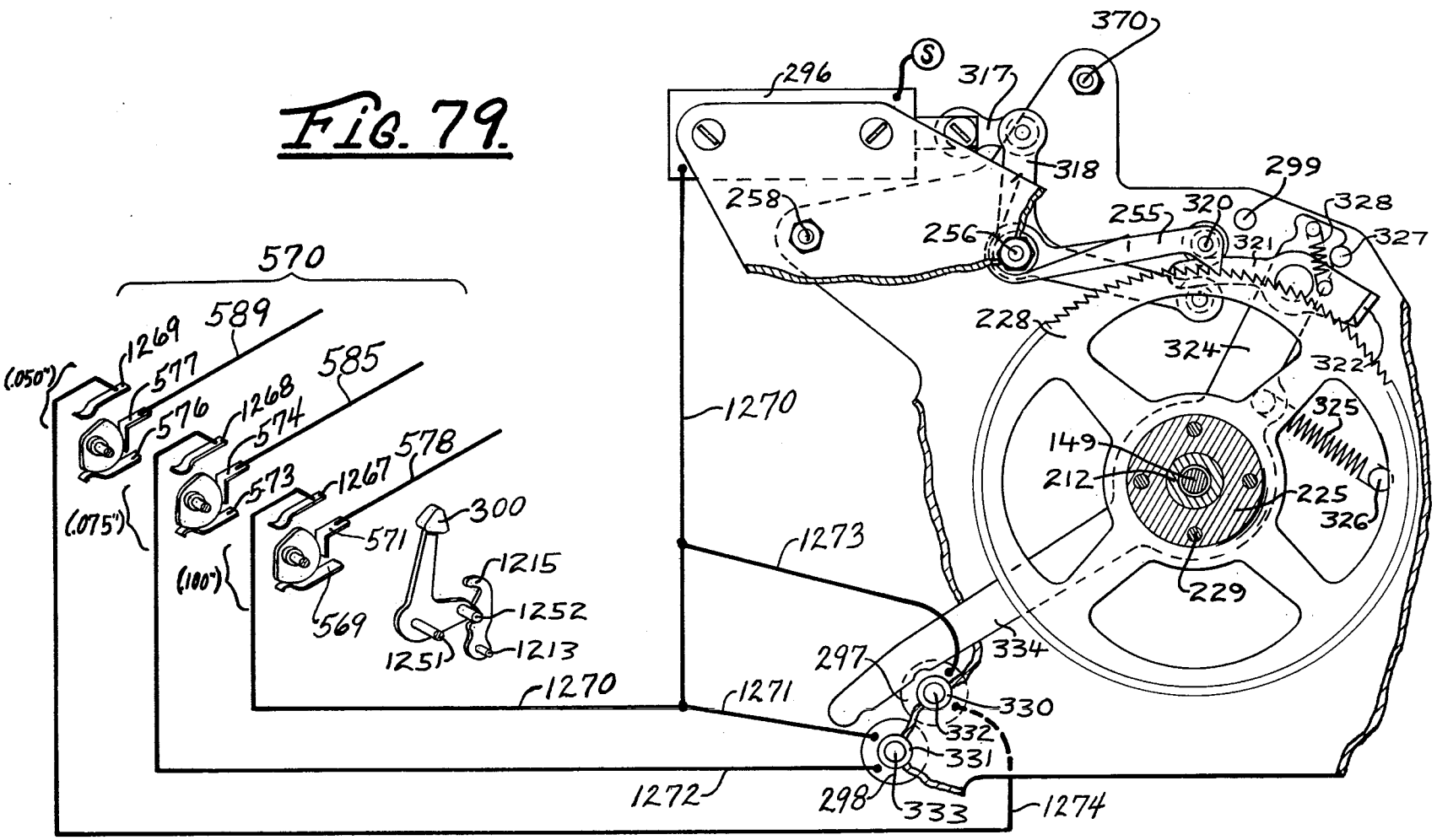
FIG. 79 is a schematic wiring diagram of circuits for manually controlled character and space back-spacing operations.

A power source (S) (FIG. 79) is connected to the back space escapement motivating solenoid 296, in the carriage moving mechanism. A wire 1270 is connected between the solenoid 296 and the blade 1267 in the control 570. A wire 1271 is connected to the wire 1270 and to the stop solenoid 298. A wire 1272 is connected between solenoid 298 and the blade 1268. Similarly, a wire 1273 is connected between wire 1270 and the stop solenoid 297, and a wire 1274 is connected between solenoid 297 and the blade 1269.

Thus, during back spacing when a 0.100 inch character or space key 39, 629 is operated, current flows from source (S) through the motivating solenoid 296, wire 1270, effective blades 1267 and 571, the wire 578 (FIG. 52) and so on through the case control 493 and the operated key 39, 629, or directly to the 39, 629, as previously described. When a 0.075 inch key 39, 628 is operated, the current flows from source (S) through solenoid 296 (FIG. 79), wires 1270 and 1271, the 0.075 inch stop solenoid 298, wire 1272, effective blades 1268 and 574, wire 585 (FIG. 52) and so on to the operated key 39, 628 as described. Upon operation of a 0.050 inch key 39, 627, the current flows from source (S) and the escapement motivating solenoid 296 (FIG. 79), through wires 1270 and 1273, the 0.050 inch stop solenoid 297, wire 1274, effective blades 1269 and 577, wire 589 (FIG. 52) and so on to the operated key 39, 627 as described. In this manner, the carriage moving mechanism is controlled to back space the carriage 9*a* appropriately for the characters and spaces, during manual operations.

Figure 12:
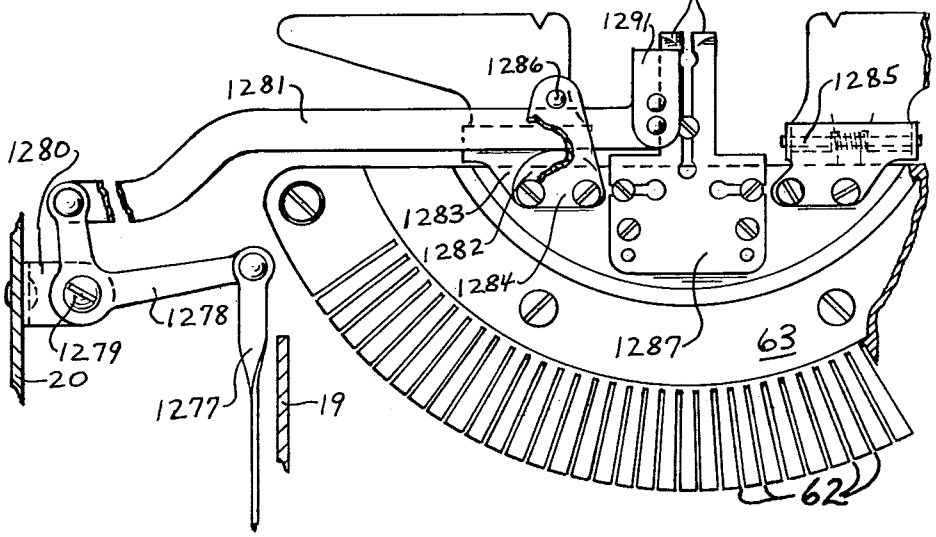
FIG. 12 is a fragmentary front view of the type arm support segment and a back space print preventing means.
Figure 13:
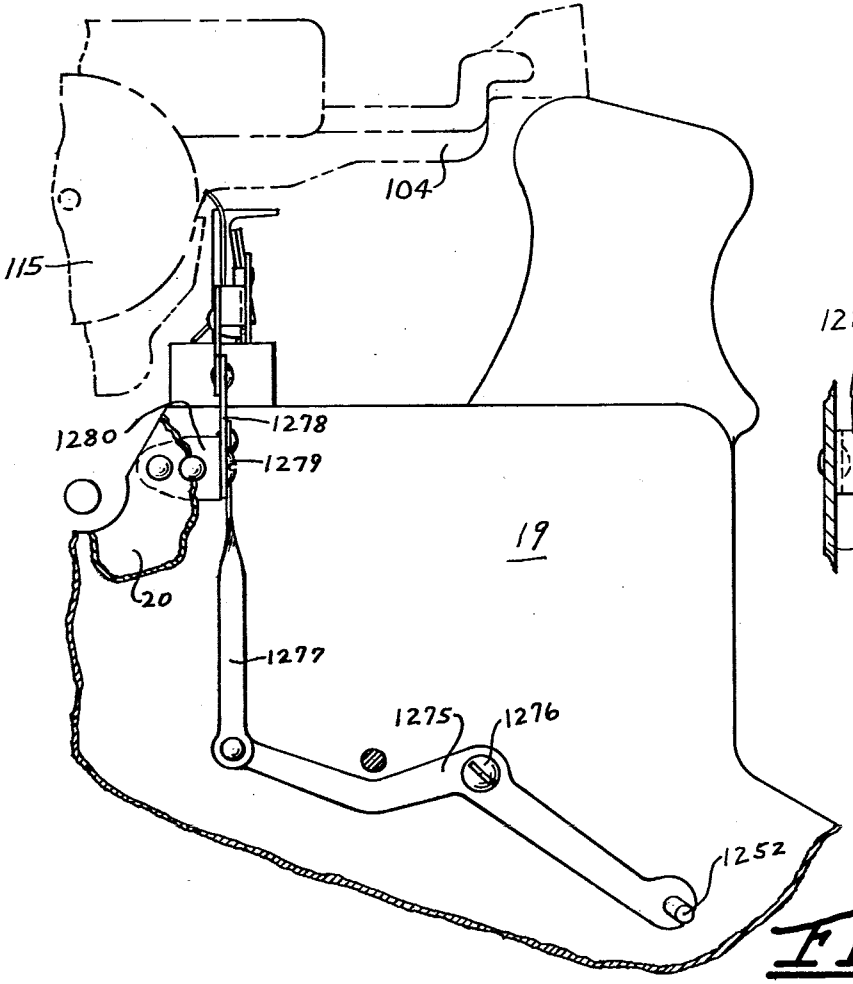
FIG. 13 is a fragmentary left side view of the mechanism shown in FIG. 12 and indicating its location in the machine.

Since the character keys 39 and 42 are manipulatable during manual back spacing operations as described, and since imprinting of the characters at such times is undesirable, a print preventing means is rendered effective by the shift of the key 300 (FIG. 32) to "Back Space" position, as will now be described. The bifurcated end of a member 1275 (FIG. 35) embraces the stud 1252 on the key 300 as shown. The member 1275 is pivoted on a stud 1276 (FIG. 13) that is secured on plate 19. A link 1277 is pivotally connected to the member 1275 and to a bellcrank 1278 (FIG. 12). Bellcrank 1278 is pivoted at 1279 on a bracket 1280 (FIG. 13) that is secured on the plate 20. The left end of a print preventing member 1281 (FIG. 12) is pivotally connected to the bellcrank 1278, and the rightward end of the member 1281 is slidably supported on a semicircular plate 1282 that is slightly thicker than the member 1281. Member 1281 is situated between the forward face of a left hand paper guide hinge portion 1283 and the rearward face of a plate 1284. The left hand hinge portion 1283 is similar to a right hand hinge portion 1285. The plates 1282, 1284 and hinge portion 1283 are assembled as shown, and they are secured on the type arm segment frame 63. A rearwardly extending stud 1286 on plate 1284 holds the member 1281 down in position. The extreme rightward end of member 1281 slidably engages and it is therefore backed up by the forward face of a customary type arm guide 1287 that is secured on the frame 63.

During normal imprinting operations, a projection 1288 (FIG. 11) on each individual type arm 48 is guided between furcations 1289 (FIG. 12) on the guide 1287 for laterally positioning the type face 1290 (FIG. 11) at the point of impact with the ribbon, the paper and the platen 115 (FIG. 8), in a customary manner.

A small sheet of shock absorbing material 1291 (FIG. 12), such as impact resistant fiber on plastic, is secured on the forward face of the member 1281.

When the key 300 (FIG. 32) is shifted to "Back Space" position, the stud 1252 (FIG. 13) shifts the member 1275 counterclockwise. Whereupon, the link 1277 is pulled downward, the bellcrank 1278 (FIG. 12) is rotated clockwise, the member 1281 is shifted rightward and the material 1291 is shifted in front of both furcations 1289, into blocking alignment with the projection 1288 (FIG. 11) of the selectively operable type arms 48. Thereafter, when any character key 39 or 42 is operated in the performance of back spacing operations as described, the respective projection 1288 engages the material 1291 (FIG. 12), before the projection 1288 passes between the furcations 1289, and thus the type arm 48 (FIG. 11) is stopped a few thousands of an inch prior to the incidence of imprinting by its type face 1290. However, in such an instance, the travel of a character key 39 is sufficient to close its switch 555 and to thus cause back spacing of the paper carriage 9*a* as described.

When the key 300 (FIG. 32) is returned to its "Forward" position, the member 1275 (FIG. 13) is returned clockwise, link 1277 is shifted upward, bellcrank 1278 (FIG. 12) is returned counterclockwise, member 1281 is returned leftward and the material 1291 is returned to the illustrated ineffective position.

When the reader control key 433 (FIG. 8) is in "Stop" position and the machine is conditioned for manual operation, the machine may be operated as described, in a manner that is familiar to any typist. Moreover, under this condition, the unjustified copy may be typed in a familiar manner on the paper carriage 9*a* in an area corresponding to the space between the presettable left hand margin control 1067 and a customary presettable right hand margin control 1292. New Paper may be inserted in the paper carriage 9*a* by manual rotation of familiar knobs 1293 and 862 (FIG. 64). The normal line spacing, that occurs automatically upon return of the carriage 9*a* as described, may be preset by manipulation of the familiar button 1055 (FIG. 8). Thus, though considerable novelty is disclosed hereinbefore, the visible parts of the manual controls are designed to be familiar to the usual typist.

What is claimed is:

1. A text writing apparatus for printing text in response to coded input signals, including sensing means, means for applying coded input signals to said sensing means, wherein a first coded input signal corresponds to an underline to be printed, and different second coded input signals correspond to separate text characters to be printed, said apparatus comprising means responsive to said first and second coded input signals for printing said underline and text characters respectively on a medium, means responsive to said second coded signals for moving said medium relative to said printing means in a direction of a line of text to be displayed, said means for moving being unresponsive to said first coded input signals, said means for applying coded signals to said sensing means comprising means responsive to the sensing of said second coded signals and the subsequent completion of movement of said means for moving for sequentially applying further coded input signals to said sensing means, said means for applying coded signals to said sensing means being independent of said means for moving in response to the sensing of said first coded input signals, contact means responsive to operation of said means for moving, said contact means being connected to inhibit operation of said means for applying until completion of the printing operation of a character of text, and means for shunting said contact means in response to the receipt of said first coded input signal.

2. The text writing apparatus according to claim 1, wherein said text characters are proportionally spaced, and said means for moving said medium relative to said printing means causes said movement to occur in increments corresponding to the widths of respective text characters to be printed.

* * * * *

UNITED STATES PATENT OFFICE

CERTIFICATE OF CORRECTION

Patent No. 4,081,070 Dated March 28, 1978

Inventor(s) William S. Gubelmann, deceased, et al

It is certified that error appears in the above-identified patent and that said Letters Patent are hereby corrected as shown below:

Column 3, lines 22-23: "present" should be --preset--.

Column 4, line 3: "conrol" should be --control--.

Column 5, line 8: "out" should be --our--.

Column 7, line 3: "41-42" should be --42-42.

Column 12, line 29: "snd" should be --and--.

Column 18, line 62: "old" should be --hold--.

Column 25, line 38: "215" should be --216--.

Column 26, line 22: "affect" should be --effect--.

line 45: "224" should be --244--.

line 45: "and" (second occurrence) should be --have--.

line 50: "work" should be --word--.

line 61: "operble" should be --operable--.

Column 35, line 59: "department" should be --departing--.

UNITED STATES PATENT OFFICE
CERTIFICATE OF CORRECTION

Patent No. 4,081,070 Dated March 28, 1978

Inventor(s) William S. Gubelmann, deceased, et al

It is certified that error appears in the above-identified patent and that said Letters Patent are hereby corrected as shown below:

Column 47, line 31: Delete the zero.

Column 48, line 48: "assemblied" should be --assembled--.

Column 52, line 20: "normally" should be --normal--.

Column 55, line 37: "wiere" should be --wire--.

Column 58, line 20: "ccontinues" should be --continues--.

Column 59, line 1: "491" should be --481--.

line 4: "618" should be --617--.

line 27: "blase" should be --blade--.

Column 60, line 37: "s" should be --as--.

line 60: "the" (first occurrence) should be --this--.

Column 61, line 6: "spaced" should be --space--.

Column 64, line 37: "cosed" should be --closed--.

Column 65, line 29: "ink" should be --link--.

line 58: "colenoid" should be --solenoid--.

UNITED STATES PATENT OFFICE
CERTIFICATE OF CORRECTION

Patent No. 4,081,070 Dated March 28, 1978

Inventor(s) William S. Gubelmann, deceased, et al

It is certified that error appears in the above-identified patent and that said Letters Patent are hereby corrected as shown below:

Column 69, line 32: After "(Fig.30)" insert --in the carriage moving mechanism. The second possible set--.

Column 70, line 51: "tud" should be --stud--.

line 52: "insulter" should be --insulator--.

Column 71, line 13: "cosed" should be --closed--.

Column 72, line 27: "Ths" should be --The--.

Column 74, line 12: "coddes" should be --codes--.

Column 91, line 49: "547" should be --546--.

Column 92, line 6: "922" should be --992--.

Column 95, line 41: "309" should be --39--.

line 49: Delete "not".

Column 96, line 29: "after" should be --later--.

Column 109, line 12: "swith" should be --switch--.

Column 115, line 26: "not" should be --now--.

UNITED STATES PATENT OFFICE

CERTIFICATE OF CORRECTION

Patent No. 4,081,070 Dated March 28, 1978

Inventor(s) William S. Gubelmann, deceased, et al

It is certified that error appears in the above-identified patent and that said Letters Patent are hereby corrected as shown below:

Column 119, line 44: "on" should be --or--

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*